US007181152B2

(12) United States Patent
Kuma et al.

(10) Patent No.: US 7,181,152 B2
(45) Date of Patent: Feb. 20, 2007

(54) IMAGE FORMING APPARATUS FOR RELIABLY HOLDING ATTACHABLE UNITS

(75) Inventors: Kazuosa Kuma, Kanagawa (JP); Yuusuke Noguchi, Kanagawa (JP); Hiroshi Ishii, Kanagawa (JP); Makoto Kikura, Kanagawa (JP); Yutaka Fukuchi, Kanagawa (JP); Kazuki Suzuki, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/847,868

(22) Filed: May 19, 2004

(65) Prior Publication Data

US 2005/0008393 A1 Jan. 13, 2005

(30) Foreign Application Priority Data

May 20, 2003 (JP) ..... 2003-142623
May 20, 2003 (JP) ..... 2003-142637
Jul. 31, 2003 (JP) ..... 2003-205123

(51) Int. Cl.
*G03G 15/00* (2006.01)

(52) U.S. Cl. ..... 399/110

(58) Field of Classification Search ..... 399/110, 399/107, 90, 111

See application file for complete search history.

(56) References Cited

U.S. PATENT DOCUMENTS 5,040,025 A 8/1991 Fukuchi
5,052,336 A 10/1991 Fukuchi
5,055,881 A 10/1991 Fukuchi
5,124,759 A 6/1992 Fukuchi et al.
5,300,996 A 4/1994 Yokoyama et al.
5,329,340 A 7/1994 Fukuchi et al.
5,689,764 A 11/1997 Fukuchi et al.
RE36,124 E 3/1999 Yokoyama et al.
5,913,095 A 6/1999 Takashima et al.
6,128,451 A 10/2000 Fukuchi
6,151,459 A * 11/2000 Hashimoto et al. ..... 399/27
6,181,899 B1 1/2001 Fukuchi
6,385,418 B1 5/2002 Fukuchi
6,408,142 B1 6/2002 Takeuchi et al.
6,576,177 B2 6/2003 Fukuchi
6,647,223 B2 11/2003 Ishii
6,674,982 B2 1/2004 Saitoh et al.

(Continued)

FOREIGN PATENT DOCUMENTS

EP 0 757 303 A2 2/1997

(Continued)

OTHER PUBLICATIONS

Translation of cited reference JP2002-318480a.*

(Continued)

*Primary Examiner*—Quana Grainger
(74) *Attorney, Agent, or Firm*—Oblon, Spivak, McClelland, Maier & Neustadt, P.C.

(57) ABSTRACT

An image forming apparatus is disclosed that holds its detachably attached constituent units at predetermined positions for operations, and releases the hold when exchanging and inspecting the constituent units. The image forming apparatus includes a main body having an opened portion on one side, one or more devices detachably attached to the main body through the opened portion, and a holding unit that is capable of being opened and closed relative to the opened portion. The holding unit is engaged with the devices and holds the devices at the predetermined positions when the holding unit is closed relative to the opened portion. A fixing unit arranged on the holding unit fixes the holding unit when the holding unit is closed.

42 Claims, 63 Drawing Sheets

U.S. PATENT DOCUMENTS

| | | | | |
|---|---|---|---|---|
| 6,757,515 | B2 | 6/2004 | Ueda | |
| 6,807,392 | B2 * | 10/2004 | Cho | 399/110 |
| 6,973,276 | B2 * | 12/2005 | Mizoguchi | 399/90 |
| 2003/0185586 | A1 * | 10/2003 | Nakahara | 399/110 |
| 2004/0131380 | A1 * | 7/2004 | Kuma et al. | 399/90 |
| 2005/0008393 | A1 | 1/2005 | Kuma et al. | |

FOREIGN PATENT DOCUMENTS

| | | |
|---|---|---|
| EP | 1 416 331 A1 | 5/2004 |
| JP | 2-163761 | 6/1990 |
| JP | 9-190083 | 7/1997 |
| JP | 2002-139976 | 5/2002 |
| JP | 2002-214869 | 7/2002 |
| JP | 2002-229414 | 8/2002 |
| JP | 2002-304039 | 10/2002 |
| JP | 2002-318480 | 10/2002 |

OTHER PUBLICATIONS

U.S. Appl. No. 11/280,353, filed Nov. 17, 2005, Ishii.
U.S. Appl. No. 11/377,568, filed Mar. 17, 2006, Katoh et al.
U.S. Appl. No. 11/247,269, filed Oct. 12, 2005, Uchiyama et al.

* cited by examiner

IMAGE FORMING APPARATUS FOR RELIABLY HOLDING ATTACHABLE UNITS

BACKGROUND OF THE INVENTION

1. Field of the Invention

The present invention relates to an image forming apparatus, such as a color printer, a color copier, a color fax machine, or a combination of them.

2. Description of the Related Art

It is well known that an electrophotographic image forming apparatus forms color images on recording materials such as paper or films (below, they are referred to as "recording sheet") by using toners (developing agents) usually having four colors. In order to form a color image in this way, usually a considerably large number of constituent components have to be used in the color image forming apparatus, and this results in a large size of the image forming apparatus compared with a monochromatic image forming apparatus, and a low printing speed, that is, the color image forming apparatus delivers a small number of the recording sheets in unit time.

Along with wide-spread use of personal computers, image forming apparatuses are more and more frequently used for personal use. For example, the image forming apparatus may be connected to a personal computer and used as a personal printer. In such kind of usage, usually the image forming apparatus is placed near a user of the apparatus for convenience, and it is desirable that height and width of the image forming apparatus be small so as to be handled easily and reduce the space occupied by the apparatus.

Furthermore, because of wide-spread personal use of the image forming apparatuses and requirement of reducing cost of maintenance, more and more users are exchanging consumable articles of and doing maintenance on the image forming apparatuses by themselves.

In order to increase the printing speed of a color image forming apparatus, it is known that a tandem engine configuration is more advantageous than a single-drum configuration. A color image forming apparatus having the single-drum configuration has one photoconductor and a number of developing devices corresponding to different colors arranged near the photoconductor.

In the color image forming apparatus having the single-drum configuration, toner images developed by the respective developing devices are combined on the photoconductor by rotating the photoconductor to pass by the plural developing devices, thereby resulting in a full color image on the photoconductor. Then, the full color image is transferred to a recording material.

On the other hand, a color image forming apparatus of the tandem engine configuration has a number of photoconductors arranged in a series and the same number of developing devices as the photoconductors corresponding to different colors and arranged near the respective photoconductors to form the same number of monochromatic toner images on the respective photoconductors. These toner images of different colors then are then sequentially transferred to a recording material, and a full color image is formed on the recording material.

In order to reduce the size of the color image forming apparatus having the tandem engine configuration, a method as disclosed in Japanese Laid Open Patent Application No. 2002-139976 may be adopted.

In Japanese Laid Open Patent Application No. 2002-139976, it is disclosed that by arranging an image forming unit, including the photoconductors and the developing devices which are integrally connected, and an intermediate transferring unit with a sloping arrangement inside the apparatus, the length of the apparatus can be reduced in the direction along which the intermediate transferring unit and the image forming unit are arranged in comparison with a horizontal arrangement of the intermediate transferring unit and the image forming unit.

In the image forming apparatus disclosed in the above-mentioned patent application, an opening is formed on the main body of the apparatus, and the constituent units of the apparatus are detachably attached to the main body of the apparatus so that these units can be detached from the main body through the opening, thereby facilitating exchange of any unit or maintenance of the apparatus.

When the constituent components are detachably attached to the main body of the apparatus, it is required that these units be accurately positioned at the time of attachment, otherwise image deviation may occur. In the above-mentioned patent application, one end of each of the constituent units is attached to the main body of the apparatus, and the other end is held by a holding member. The holding member is installed inside the apparatus near the constituent units of the apparatus and is able to be opened and closed. When the holding member is closed, it holds the other end of each of the constituent units of the apparatus; when the holding member is opened, it releases the other end of each of the constituent units.

However, in the above-mentioned Japanese Laid Open Patent Application No. 2002-139976, the holding member is fixed to the main body of the apparatus and it cannot be opened or closed freely. Consequently, when taking the image forming unit or the intermediate transfer unit out from the main body of the image forming apparatus, one has to first unfasten screws, which fix the holding member with some-tools, and this work is cumbersome. Because the constituent units of the apparatus are fixed to their positions by the holding member when the holding member is set at the CLOSED position, it is required that the position of the holding member be reliably defined relative to the main body of the apparatus.

Because it is desired that the holding member be able to be opened and closed freely, clearance is provided between the holding member and the constituent units of the apparatus so that the holding member can move freely even when the holding member is holding the constituent units of the apparatus at the CLOSED position. But this clearance makes the constituent units of the apparatus rattle even when the holding member is at the CLOSED position. For this reason, even when the relative position between the photoconductor and the imaging unit is just slightly different from the expected one, shift of image transfer position may occur when transferring images of different colors to form a multi-color image, and this causes low quality images involving color deviation or image transfer position shift.

Further, the holding member is required to have sufficiently high strength to support the imaging unit or the intermediate transfer unit. For example, when a metal plate is used for the holding member, while the strength of the holding member is improved, weight of the holding member also increases, and the image forming apparatus may topple over when the holding member is opened. Therefore, it is required that operation of the holding member be sufficiently safe.

In the above electrophotographic image forming apparatus, usually a high voltage supply is installed inside the main body of the apparatus to supply electric power to components of the above constituent units, such as charging rollers, developing rollers, cleaning rollers and others in the image forming unit, and intermediate transfer rollers, intermediate transfer cleaning rollers, and secondary transfer rollers in the intermediate transfer unit.

To supply electric power from the high voltage supply to the component units, detachable connectors are usually used to connect the high voltage supply and the component units. On the other hand, in an image forming apparatus having constituent components detachably attached to its main body, in order to limit the height of the apparatus, one attempts to reduce the spare room in the main body. However, reducing the room in the main body makes usage of the detachable connectors difficult.

Japanese Laid Open Patent Application No. 9-190083 discloses a different method of supplying the electrical power. As disclosed in Japanese Laid Open Patent Application No. 9-190083, power cords for supplying electric power to the components of the constituent units are laid inside the main body of the image forming apparatus, and when installing the constituent units including the above components into the main body through the opening, high voltage connection terminals arranged inside the main body of the image forming apparatus are brought into contact with connection terminals on the components, thereby enabling the high voltage electric power to be supplied to the various components.

However, since the high voltage connection terminals and the connection terminals on the components of the image forming apparatus are connected in the depths of the main body, it is difficult to confirm whether the connection condition of them is good or not, and particularly, even when the high voltage connection terminals in the depths of the main body have a problem, for example, the terminals are bent somehow, it is difficult to find out about the problem.

Moreover, even if the defects of the connection terminals are confirmed, in order to repair the terminals, one has to remove a cover on the inner side of the main body, and one cannot fix the problem easily.

SUMMARY OF THE INVENTION

Accordingly, it is a general object of the present invention to solve one or more problems of the related art.

A first specific object of the present invention is to provide an image forming apparatus capable of reliably holding its constituent units, which are detachably attached to the image forming apparatus at predetermined positions, and superior in operability and safety when exchanging and inspecting the constituent units and in durability of the image forming apparatus.

A second specific object of the present invention is to provide an image forming apparatus that enables easy and visual confirmation of connection condition of high voltage connection terminals and connection terminals on components of the image forming apparatus, and allows the connection terminals in trouble to be fixed easily, able to obtain stable connection condition at contact points for supplying high voltages to the components.

A third specific object of the present invention is to provide an image forming apparatus having constituent units detachably attached to its main body, that is able to reliably maintain position correspondence between connection terminals of a power supply and members in the constituent units, and is superior in operability when inspecting the image forming apparatus.

According to a first aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion.

According to a second aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit that fixes the holding unit when the holding unit is closed relative to the opened portion, wherein the fixing unit fixes the holding unit at one or more locking positions on the holding unit, said locking positions being arranged in a center portion of an upper edge of the holding unit.

According to a third aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit that fixes the holding unit when the holding unit is closed relative to the opened portion, wherein the fixing unit fixes the holding unit at one or more locking positions on the holding unit, said locking positions being arranged on a perpendicular through the gravity center of the holding unit.

According to a fourth aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit that fixes the holding unit when the holding unit is closed relative to the opened portion, wherein the fixing unit fixes the holding unit at one or more locking positions on the holding unit, said locking positions being symmetrically arranged relative to a perpendicular through the gravity center of the holding unit.

According to a fifth aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion, wherein the devices include an intermediate transfer unit and an image forming unit; and the fixing unit fixes the holding unit at one or more locking positions on the holding unit, said locking positions being arranged in a center portion of an upper edge of the holding unit above the intermediate transfer unit and the image forming unit.

According to a sixth aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion, wherein the devices include an intermediate transfer unit and an image forming unit; and the fixing unit fixes the holding unit at one or more locking positions on the holding unit, said locking positions being symmetrically arranged relative to a center portion of an upper edge of the holding unit above the intermediate transfer unit and the image forming unit.

According to a seventh aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion, wherein the devices include an intermediate transfer unit having a plurality of rollers arranged at intervals and an intermediate transfer belt wound on the rollers; and the fixing unit fixes the holding unit at one or more locking positions on the holding unit, said locking positions being arranged in regions between axles of the rollers.

According to an eighth aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion, wherein the devices include an intermediate transfer unit having a plurality of rollers arranged at intervals, an intermediate transfer belt wound on the rollers, and a plurality of image forming units arranged along the intermediate transfer belt; and the fixing unit fixes the holding unit at one or more locking positions on the holding unit, said locking positions being arranged so that the holding unit is capable of covering axles of the rollers and the image forming units.

According to a ninth aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion, wherein the fixing unit fixes the holding unit at one or more locking positions on the holding unit, said locking positions being at two ends of the holding unit.

According to a 10th aspect of the present invention, there is provided an image forming apparatus comprising a main body having an opened portion on a side thereof; one or more devices detachably attached to the main body through the opened portion; a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion, wherein the fixing unit fixes the holding unit at three or more positions on the holding unit.

According to an 11th aspect of the present invention, there is provided an image forming apparatus comprising: a main body having an opened portion on a side thereof; a high voltage power supply arranged in the main body; an image forming device that is arranged in the main body and includes a component unit, the component unit receiving electric power supplied from the high voltage power supply; and a power feeding panel including a case rotatably attached to the main body and capable of being rotated to a first position to expose the opened portion and to a second position to cover the opened portion, a power feeding unit arranged in the case and capable of feeding electric power from the high voltage power supply to the component units when the case is at the second position, and an insulating plate arranged in the case with the power feeding unit arranged thereon. The power feeding unit includes a first conductive pin capable of sliding along a direction of a center of axle thereof and capable of being brought into contact with a connection terminal of the component unit when the case is at the second position; a first conductive spring connected to the first conductive pin to push the conductive pin to contact the connection terminal of the component unit; a second conductive pin capable of sliding along a direction of an axial center thereof and capable of being brought into contact with a connection terminal of the high voltage power supply when the case is at the second position; a second conductive spring connected to the second conductive pin to push the second conductive pin to contact the connection terminal of the high voltage power supply; and a conductive plate member connected to an end of the first conductive spring and an end of the second conductive spring.

According to a 12th aspect of the present invention, there is provided a power feeding panel of an image forming apparatus comprising: a case rotatably attached to a main body of the image forming apparatus, said case being capable of being rotated to a first position to expose an opened portion on a side of the main body and to a second position to cover the opened portion; a power feeding unit arranged in the case and capable of feeding electric power from a high voltage power supply in the main body to a component unit of the image forming apparatus when the case is at the second position; and an insulating plate arranged in the case with the power feeding unit arranged thereon. The power feeding unit includes a first conductive pin capable of sliding along a direction of a center of axle thereof and capable of being brought into contact with a connection terminal of the component unit when the case is at the second position; a first conductive spring connected to the first conductive pin to push the first conductive pin to contact the connection terminal of the component unit; a second conductive pin capable of sliding along a direction of a center of axle thereof and capable of being brought into contact with a connection terminal of the high voltage power supply when the case is at the second position; a second conductive spring connected to the second conductive pin to push the second conductive pin to contact the connection terminal of the high voltage power supply; and a conductive plate member connected to an end of the first conductive spring and an end of the second conductive spring.

According to a 13th aspect of the present invention, there is provided a power feeding panel of an image forming apparatus comprising: a case rotatably attached to a main body of the image forming apparatus, said case being capable of being rotated to a first position to expose an opened portion on a side of a main body of the image forming apparatus, and to a second position to cover the opened portion; a power feeding unit arranged in the case and capable of feeding electric power from a high voltage power supply in the main body to a component unit of the image forming apparatus when the case is at the second position; and an insulating plate arranged in the case with the power feeding unit arranged thereon. The power feeding unit includes a conductive pin capable of sliding along a direction of a center of axle thereof and capable of being brought into contact with a connection terminal of the component unit when the case is at the second position; a conductive spring connected to the conductive pin to push the conductive pin to contact the connection terminal of the component unit; and a cord coated with an insulating layer, an end of said cord being connected to the conductive spring, and another end of said cord being connected to a connection terminal of the high voltage power supply.

According to a 14th aspect of the present invention, there is provided a power feeding panel of an image forming apparatus comprising: a case rotatably attached to a main body of the image forming apparatus, said case being capable of being rotated to a first position to expose an opened portion on a side of a main body of the image forming apparatus, and to a second position to cover the opened portion; a power feeding unit arranged in the case and capable of feeding electric power from a high voltage power supply in the main body to a component unit of the image forming apparatus when the case is at the second position; and an insulating plate arranged in the case with the power feeding unit arranged thereon. The power feeding unit includes a conductive pin capable of sliding along a direction of an axial center thereof and capable of being brought into contact with a connection terminal of the component unit when the case is at the second position; a conductive spring connected to the conductive pin to push the conductive pin to contact the connection terminal of the component unit; a conductive plate member connected to an end of the conductive spring; a cord coated with an insulating layer, an end of said cord being connected to the conductive plate member, and another end of said cord being connected to a connection terminal of the high voltage power supply.

According to a 15th aspect of the present invention, there is provided a power feeding panel of an image forming apparatus comprising: a case rotatably attached to a main body of the image forming apparatus, said case being capable of being rotated to a first position to expose an opened portion on a side of the main body and to a second position to cover the opened portion; a power feeding unit arranged in the case and capable of feeding electric power from a high voltage power supply in the main body to a component unit of the image forming apparatus when the case is at the second position; and an insulating plate arranged in the case with the power feeding unit arranged thereon. The power feeding unit includes a first conductive pin capable of sliding along a direction of an axial center thereof and capable of being brought into contact with a connection terminal of the component unit when the case is at the second position; a first conductive spring connected to the first conductive pin to push the first conductive pin to contact the connection terminal of the component unit; a first conductive plate member connected to an end of the first conductive spring; a second conductive pin capable of sliding along a direction of an axial center thereof and capable of being brought into contact with a connection terminal of the high voltage power supply when the case is at the second position; a second conductive spring connected to the second conductive pin to push the second conductive pin to contact the connection terminal of the high voltage power supply; a second conductive plate member connected to an end of the second conductive spring; and a cord coated with an insulating layer, an end of said cord being connected to the first conductive plate member, and another end of said cord being connected to the second conductive plate member.

According to a 16th aspect of the present invention, there is provided a power feeding panel of an image forming apparatus, comprising: a case rotatably attached to a main body of the image forming apparatus, said case being capable of being rotated to a first position to expose an opened portion on a side of the main body and to a second position to cover the opened portion; a power feeding unit arranged in the case and capable of feeding electric power from a high voltage power supply in the main body to a component unit of the image forming apparatus when the case is at the second position; and an insulating plate arranged in the case with the power feeding unit arranged thereon. The power feeding unit includes a first conductive pin capable of sliding along a direction of an axial center thereof and capable of being brought into contact with a connection terminal of the component unit when the case is at the second position; a second conductive pin capable of sliding along a direction of an axial center thereof and capable of being brought into contact with a connection terminal of the high voltage power supply when the case is at the second position; and a conductive urging plate connected to a back end of the first conductive pin and to a back end of the second conductive pin to push the first conductive pin to contact the connection terminal of the component unit and the second conductive pin to contact the connection terminal of the high voltage power supply.

According to a 17th aspect of the present invention, there is provided a power feeding panel of an image forming apparatus comprising: a case rotatably attached to a main body of the image forming apparatus, said case being capable of being rotated to a first position to expose an opened portion on a side of the main body and to a second position to cover the opened portion; a power feeding unit arranged in the case and capable of feeding electric power from a high voltage power supply in the main body to a component unit of the image forming apparatus when the case is at the second position; and an insulating plate arranged in the case with the power feeding unit arranged thereon. The power feeding unit includes a conductive pin capable of sliding along a direction of an axial center thereof and capable of being brought into contact with a connection terminal of the component unit when the case is at the second position; a conductive urging plate connected to a back end of the conductive pin to push the conductive pin to contact the connection terminal of the component unit; and a cord coated with an insulating layer, an end of said cord being connected to the conductive plate member, and another end of said cord being connected to a connection terminal of the high voltage power supply.

According to a 18th aspect of the present invention, there is provided a power feeding panel of an image forming apparatus comprising: a case rotatably attached to a main body of the image forming apparatus, said case being capable of being rotated to a first position to expose an opened portion on a side of the main body and to a second position to cover the opened portion; a power feeding unit arranged in the case and capable of feeding electric power from a high voltage power supply in the main body to a component unit of the image forming apparatus when the case is at the second position; and an insulating plate arranged in the case with the power feeding unit arranged thereon. The power feeding unit includes a first conductive pin capable of sliding along a direction of an axial center thereof and capable of being brought into contact with a connection terminal of the component unit when the case is at the second position; a first conductive urging plate connected to a back end of the first conductive pin to push the first conductive pin to contact the connection terminal of the component unit; a second conductive pin capable of sliding along a direction of an axial center thereof and capable of being brought into contact with a connection terminal of the high voltage power supply when the case is at the second position; a second conductive urging plate connected to a back end of the second conductive pin to push the second conductive pin to contact the connection terminal of the high voltage power supply; and a cord coated with an insulating layer, an end of said cord being connected to the first conductive urging plate, and another end of said cord being connected to the second conductive urging plate.

According to a 19th aspect of the present invention, there is provided an image forming apparatus, comprising: a main body having an opened portion on a side thereof; a high voltage power supply arranged in the main body; a component unit capable of being attached to and detached from the main body through the opened portion, said component unit including a component member with a connection terminal formed thereon, said component member receiving electric power from the high voltage power supply through a power feeding terminal in contact with the connection terminal; and a movable unit rotatably attached to the main body and capable of being rotated to a first position to expose the opened portion and to a second position to cover the opened portion, said movable unit holding the component unit when being set at the second position, said power feeding terminal facing said connection terminal when said movable unit is set at the second position.

As an embodiment, the movable unit comprises: a power feeding unit with the power feeding terminal formed thereon; a positioning unit that engages the component member and holds the component member at a predetermined position; an insulating member; and a cover plate. The power feeding unit, the positioning unit, the insulating member, and the cover plate are stacked together.

As an embodiment, the movable unit comprises: a power feeding unit with the power feeding terminal formed thereon; a positioning unit that engages the component member and holds the component member at a predetermined position; an insulating member; and a cover plate. When the movable unit is set at the second position, the positioning unit is closest to the main body with the power feeding unit, the insulating member, and the cover plate following sequentially.

As an embodiment, the movable unit comprises: a power feeding unit with the power feeding terminal formed thereon; a positioning unit that engages the component member and holds the component member at a predetermined position; an insulating member; and a cover plate. When the movable unit is set at the second position, the insulating member is closest to the main body with the power feeding unit, the positioning unit, and the cover plate following sequentially.

These and other objects, features, and advantages of the present invention will become more apparent from the following detailed description of preferred embodiments given with reference to the accompanying drawings.

DESCRIPTION OF THE PREFERRED EMBODIMENTS

Below, preferred embodiments of the present invention are explained with reference to the accompanying drawings.

First Embodiment

In the present embodiment, a color printer having a tandem engine configuration and capable of full-color printing is used as an example. It is apparent that the image forming apparatus of the present embodiment is not limited to the color printer illustrated; it may also be a copier, a facsimile machine or others.

Figure 1:
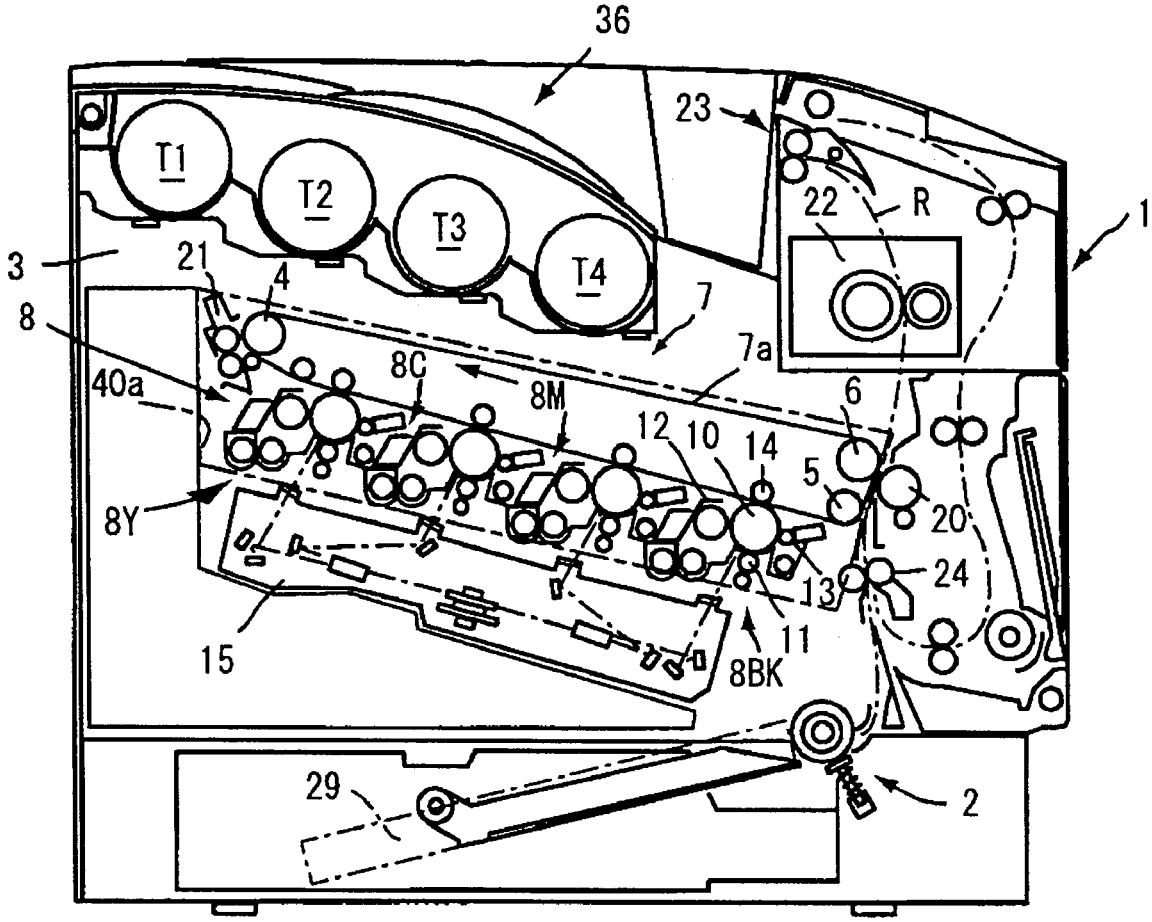
FIG. 1 is a schematic view showing a basic configuration of a color printer according to a first embodiment of the present invention.

FIG. 1 is a front view showing a schematic configuration of a color printer according to the present embodiment.

The color printer in FIG. 1 includes a main body 1, a feeding section 2 in the lower portion of the main body 1 for accommodating paper or other recording sheets 29, and an imaging forming section 3 in the upper portion of the main body 1.

The imaging forming section 3 includes an image generation part 8 having a number of image forming devices, specifically, four image forming units 8Y, 8C, 8M, 8BK, each including a photo conductor 10 on which images are formed, rollers 4, 5, 6, an intermediate transfer unit 7 having an intermediate transfer belt 7*a* which is a flexible belt wound on the rollers 4, 5, 6, an optical writing unit 15 for emitting laser beams onto the photo conductors 10, and a fusing unit 22 for setting toner image on the sheet 29.

The image forming units 8Y, 8C, 8M, 8BK and the intermediate transfer unit 7 are detachably attached to the main body 1. A conveyance path R for conveying the sheet 29 is formed between the feeding section 2 and the fusing unit 22. The roller 6 is arranged to face the conveyance path R.

A secondary transfer roller 20 is arranged onto the intermediate transfer belt 7*a* and at a position opposite to the roller 6 to face the conveyance path R. A belt cleaning device 21 is arranged at a position opposite to the roller 4 for cleaning the surface of the intermediate transfer belt 7*a*.

The image generation part 8 is arranged below the intermediate transfer belt 7*a* between the roller 4 and roller 5 to face the lower part of the portion of the intermediate transfer belt 7*a* between the roller 4 and roller 5.

Each of the image forming units 8Y, 8C, 8M, 8BK has a photo conductor 10 on which images are formed, and the photo conductors 10 are in contact with the intermediate transfer belt 7*a*. Near each photo conductor 10, there are arranged a charging device 11, a developing device 12, and a cleaning device 13.

On the inner side of the intermediate transfer belt 7*a*, transfer rollers 14 for first transfer are arranged at the positions in contact with the corresponding photo conductors 10.

In this embodiment, the image forming units 8Y, 8C, 8M, 8BK are basically the same except that toners (developing agents) held in the developing devices 12 have different colors, specifically, colors of the toners held in the developing devices 12 of the image forming units 8Y, 8C, 8M, 8BK are yellow, cyan, magenta, and black, respectively. In FIG. 1, only the image forming unit BK is explicitly illustrated including reference numbers.

As shown in FIG. 1, toner feeding bottles T1 through T4 are arranged in the upper portion of the main body 1, and the toner feeding bottles T1 through T4 feed toners into the developing devices 12 when the amount of toners in the developing devices 12 decreases.

The optical writing unit 15 emits modulated laser beams to the surfaces of the photo conductors 10 to form yellow, cyan, magenta, and black toner images on the surfaces of the photo conductors 10. In this embodiment, the optical writing unit 15 is arranged below the image generation part 8.

Next, a description is made of the operation of forming color images with the color printer illustrated in FIG. 1.

In the operation of forming images, the photo conductors 10 are driven to rotate clockwise by not-illustrated driving devices, and the surfaces of the photo conductors 10 are charged by the charging devices 11 so as to uniformly possess charges of a specified polarity. The optical writing unit 15 emits laser beams L onto the charged surfaces of the photo conductors 10, and latent images are formed on these surfaces. In this process, the image data controlling light emission onto the individual photo conductors 10 are the monochromatic image data obtained by decomposing the desired full color image into monochromatic images. When the thus formed latent images pass between the photo conductors 10 and the developing devices 12, the latent images are converted into visible toner images by toners in the developing devices 12.

One of the rollers 4, 5, 6 is a driving roller; it is driven by a not-illustrated driving device to rotate counter-clockwise, and thereby the intermediate transfer belt 7*a* is driven to move counter-clockwise as indicated by the arrow in FIG. 1. The other rollers of the rollers 4, 5, 6 are driven rollers. With the intermediate transfer belt 7*a* moving in this way, the corresponding transfer roller 14 transfers a yellow toner image, which is formed by the image forming unit 8Y having the developing device 12 holding the yellow toner, onto the intermediate transfer belt 7*a*. Subsequently, cyan, magenta, and black toner images respectively formed by the image forming units 8C, 8M, and 8BK are transferred by the corresponding transfer rollers 14 and superposed on the transferred yellow toner image. As a result, a full color image is formed on the surface of the intermediate transfer belt 7*a*.

After transfer of the toner images, the cleaning devices 13 remove the residual toners on the surfaces of the corresponding photo conductors 10, and a not-illustrated discharging device discharges the surfaces of the photo conductors 10 to initialize the surface potential for formation of the next image.

On the other hand, a recording sheet 29 fed from the feeding section 2 is conveyed to the conveyance path R. A pair of resist rollers 24 is arranged below the secondary transfer roller 20 and closer to the feeding section 2 than the secondary transfer roller 20. The resist rollers 24 measure the timing of feeding the recording sheet 29, and the recording sheet 29 is fed to the space between the roller 6 and the secondary transfer roller 20.

A transfer voltage, which has a polarity opposite to the polarity of the charge possessed by the toner image formed on the surface of the intermediate transfer belt 7*a*, is applied to the secondary transfer roller 20, and due to this transfer voltage, the toner image on the surface of the intermediate transfer belt 7*a* is transferred onto the sheet 29 at one time.

The recording sheet 29 with the toner image is conveyed to the fusing unit 22, and when recording sheet 29 passes through the fusing unit 22, it is heated and pressure is applied, thereby the toner image is fused and fixed on the recording sheet 29.

The recording sheet 29 with the fused and fixed toner image (below, referred to as "printed recording sheet 29A") at the end of the conveyance path R is further conveyed to a delivery unit 23 arranged near the top of the main body 1, and the delivery unit 23 delivers the printed recording sheet 29A to a storage portion 36 on the top of the main body 1 for storing delivered printed sheets like the printed recording sheet 29A.

In the color printer described above, four image forming units 8Y, 8C, 8M, 8BK are arranged to face the intermediate transfer belt 7*a*, and yellow, cyan, magenta, and black toner images are sequentially transferred and superposed onto the intermediate transfer belt 7*a*. Therefore, with developing devices of four colors and only one object onto which the image is formed, time required for image formation can be greatly shortened compared with an image formation method involving transferring toner images of different colors onto an intermediate transfer belt one by one, and transferring each toner image on the intermediate transfer belt onto a recording sheet and superposing the transferred toner images on the recording sheet to form the full color image.

In addition, because there is a storage portion 36 formed on the top of the main body 1, the printed sheets from the main body 1 do not scatter, and the area required for installing the printer becomes small.

In the above, a description is made of the operation of forming a full color image on the recording sheet 29. However, with one or more set of the four image forming units 8Y, 8C, 8M, 8BK, it is possible to form monochromatic, or bi-chromatic, or tri-chromatic images. For example, when printing a monochromatic image with the printer of the present embodiment, a static latent image can be formed on the photo conducting drum of the image forming unit 8BK; the image forming unit 8BK develops the latent image, and transfers the toner image to the recording sheet 29, and the fusing unit 22 fixes the toner image on the recording sheet 29.

Below, the present embodiment is described in detail.

Figure 2:
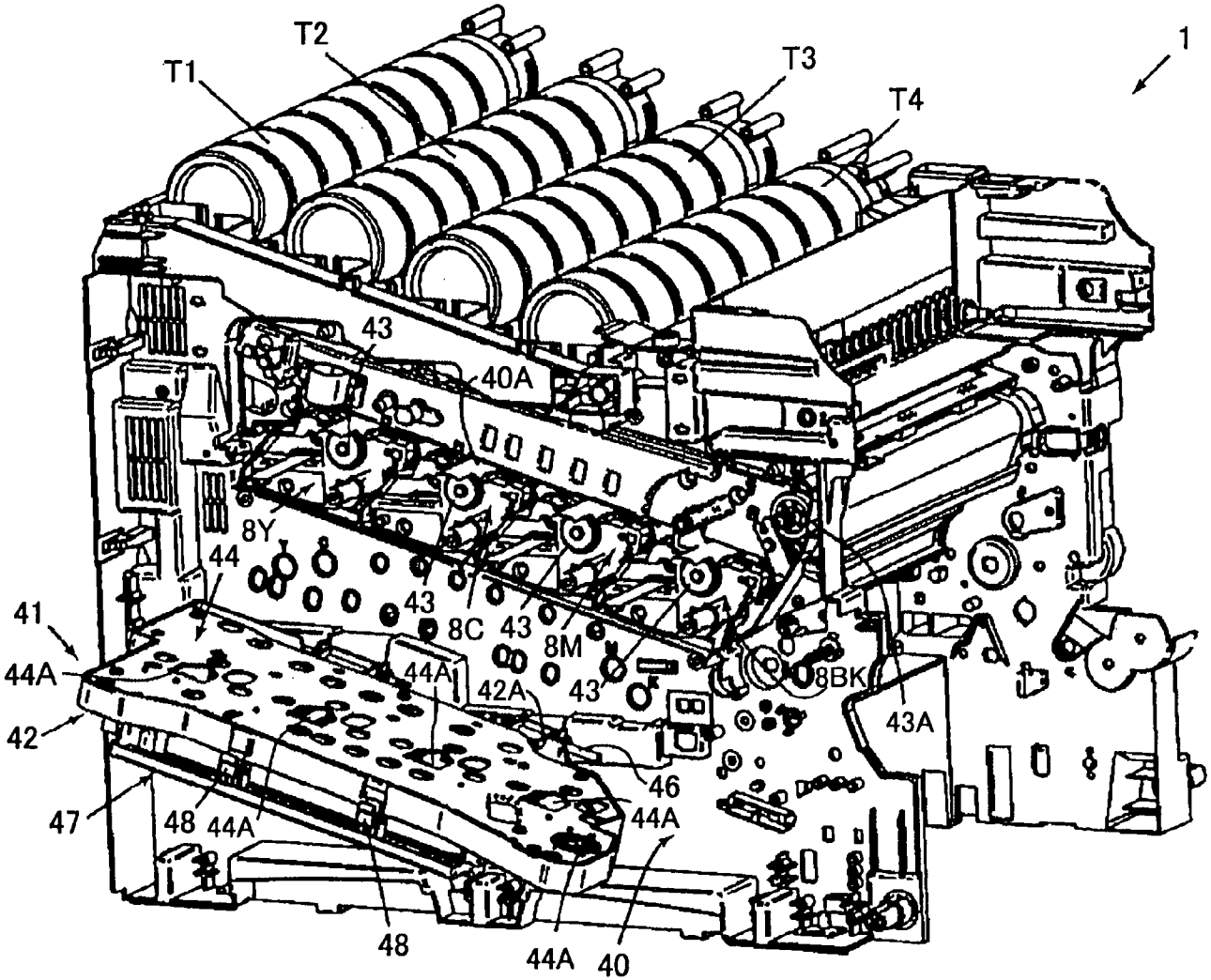
FIG. 2 is a perspective view of the main body 1 showing a structure for holding and positioning the image forming units 8Y, 8C, 8M, 8BK and the intermediate transfer unit 7 according to the first embodiment.

FIG. 2 is a perspective view of the main body 1 showing a structure for holding and positioning the image forming units 8Y, 8C, 8M, 8BK and the intermediate transfer unit 7 according to the present embodiment.

As illustrated in FIG. 2, the main body 1 has a side panel 40, and an opened portion 40A is formed on the side panel 40. The image forming units 8Y, 8C, 8M, 8BK and the intermediate transfer unit 7 can be attached to or detached from the main body 1 through the opened portion 40A.

In the present embodiment, the image forming units 8Y, 8C, 8M, 8BK and the intermediate transfer unit 7 are arranged with a slope relative to the main body 1. For this reason, the opened portion 40A is formed at an angle to match the direction of the arrangement of the image forming units 8Y, 8C, 8M, 8BK. The opened portion 40A is for facilitating exchanging parts in the image forming units 8Y, 8C, 8M, 8BK and the intermediate transfer unit 7.

As illustrated in FIG. 2, a front panel 41 is joined to the main body 1, and it can be attached to or detached from the side panel 40. When the front panel 41 is attached to the portion of the side panel 40 around the opened portion 40A, the front panel 41 covers the opened portion 40A, and at this CLOSED position, the front panel 41 is fitted with the image forming units 8Y, 8C, 8M, 8BK and the intermediate transfer unit 7, and fixes these units in place. That is, the front panel 41 functions as a member for holding and fixing the image forming units 8Y, 8C, 8M, 8BK and the intermediate transfer unit 7. When the front panel 41 is detached from the side panel 40, the opened portion 40A is exposed. This position of the front panel 41 is referred to as an "OPENED" position.

That is, the front panel 41 acts as a cover to close and expose the opened portion 40A, and also maintains the photo conducting drums of the image forming units 8Y, 8C, 8M, 8BK and the roller 6 in the intermediate transfer unit 7 to be slanted at a specific angle so as to define the relative positional relations of these units.

As illustrated in FIG. 2, the front panel 41 includes a cover 42 that is sufficiently large to cover the opened portion 40A, a positioning member or unit 44 that is attached onto the cover 42 and includes a number of insertion portions 44A and 44B for accommodating bearings 43 attached to spindles of the photo conductors 10 and bearings 43A attached to spindles of the rollers in the intermediate transfer unit 7, and a bias setting member 45 (illustrated in FIG. 3) that is arranged between the cover 42 and the positioning member 44 and is able to slide along the surface of the positioning member 44.

Figure 3:
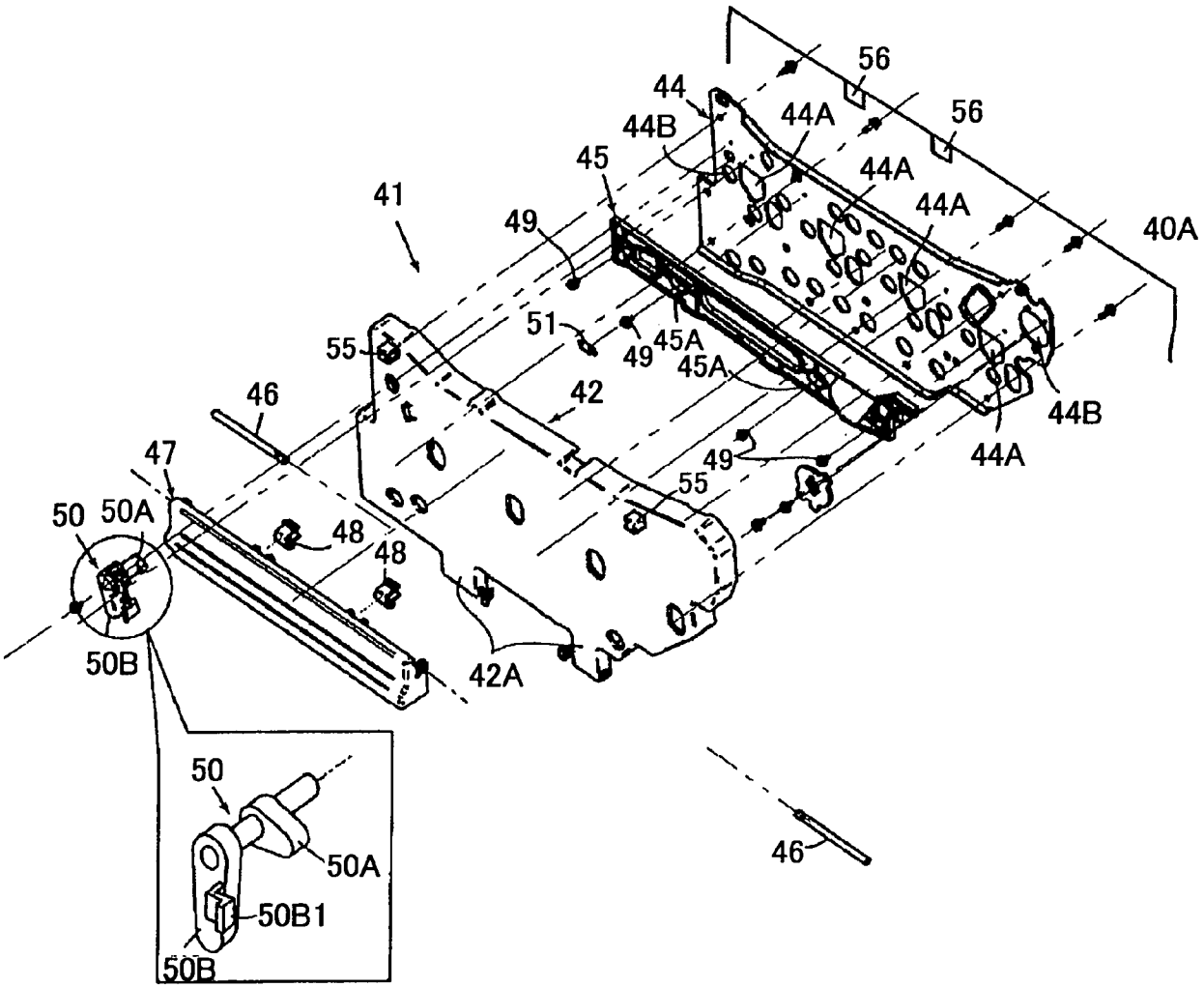
FIG. 3 is an exploded perspective view of the front panel 41.

FIG. 3 is an exploded perspective view of the front panel 41.

As illustrated in FIG. 3, the cover 42 is a molding having a plate-like cross-section. At the lower edge of the cover 42, there are two hinges 42A, and two axles 46 penetrate through the respective hinges 42A, and act as a rotational axis of the front panel 41.

The axles 46 of the hinges 42A are held by bearings 65 (as described below) on a side panel 40, and thereby the front panel 41 is rotatably attached to the side panel 40, and can be lifted up and down to close or expose the opened portion 40A. In this embodiment, because the axles 46 of the hinges 42A are at the lower edge of the front panel 41, the front panel 41 is can be rotated with the lower edge of the front panel 41 as the rotational axis.

Referring FIG. 2 and FIG. 3, a handle 47, as a lock member, is attached to the portion of the cover 42 facing the portion of the side panel 40 above the opened portion 40A when the cover 42 is closed, and the handle 47 is used for opening and closing operations and for holding the front panel 41 when the cover 42 is closed. Springy members 48, each having a laterally-facing U-shaped cross section, are attached to the handle 47 and function as claw members. Two bearings 55 are formed at the upper edge of the cover 42, and the handle 47 is rotatably attached to the cover 42 at the two bearings 55, thereby the handle 47 can be turned up and down (that is, away from or close to the outer surface of the cover 42) with the upper edge of the cover 42 as a supporting center.

Two depressed portions 56 are formed in the portion of the side panel 40 above the opened portion 40A facing the springy members 48 when the cover 42 is closed. The depressed portions 56 act as lock members when the front panel 41 is closed, that is, when the front panel 41 is closed, the springy members 48 are engaged with the lock members 56, thereby, maintaining the front panel 41 at the closed position.

The locked state of the front panel 41 (that is, the engaged state of the springy members 48 and the lock members 55) can be released by turning the handle 47 away from the cover 42. When the handle 47 is turned away from the cover 42, the springy members 48 are bent and narrowed, and thus separate from the lock members 56.

As described above, the front panel 41 is reliably fixed at the CLOSED position by using the handle 47, and the devices installed inside the main body 1 can be accurately held at specified positions.

Referring to FIG. 2 and FIG. 3, the positioning member 44 is integrally joined to the cover 42.

Figure 4A:
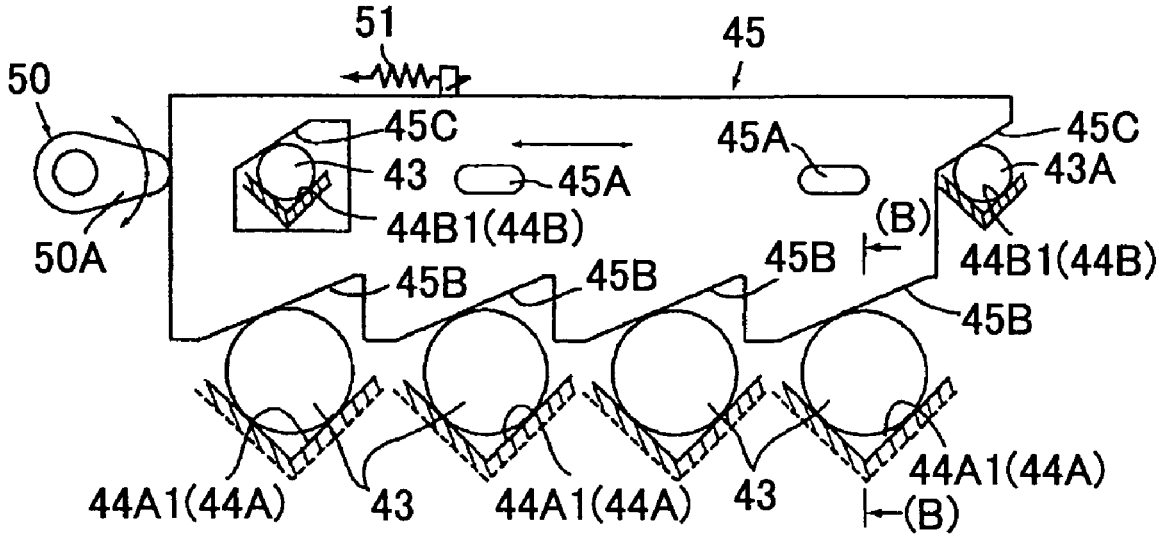
FIG. 4A is an enlarged view of a portion of the front panel 41 showing the positioning operation by the front panel 41.

FIG. 4A is an enlarged view of a portion of the front panel 41 showing the positioning operation by using the front panel 41.

Figure 4B:
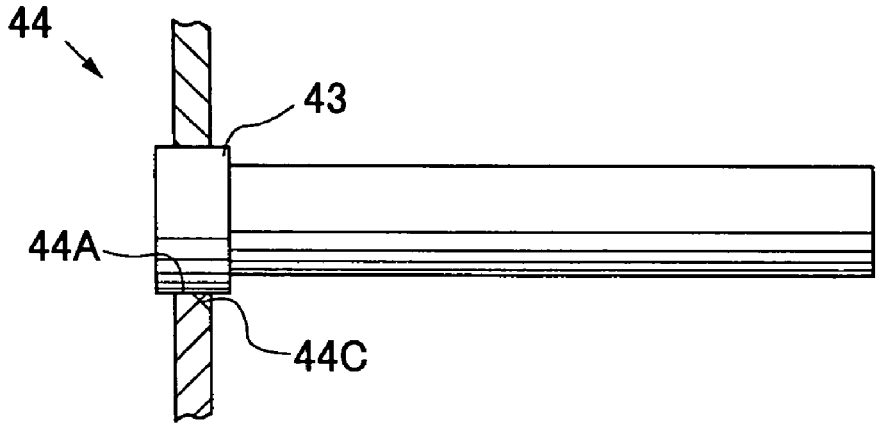
FIG. 4B is a cross-sectional view of the front panel 41 along the line B—B in FIG. 4A.

FIG. 4B is a cross-sectional view of the front panel 41 along the line B—B in FIG. 4A.

As illustrated in FIG. 4A, each of the insertion portions 44A for accommodating the bearings 43 is in a V-shape opening upward, and its V-shaped inclined surface is indicated by 44A1. Similarly, each of the insertion portions 44B for accommodating the bearings 43A is also in a V-shape opening upward, and its V-shaped inclined surface is indicated by 44B1.

In FIG. 4B, only an insertion portion 44A for a bearing 43 is illustrated. In FIG. 4B, the reference 44C indicates an inclined portion for guiding the bearings 43 (or 43A) to be inserted into the insertion portions 44A (or 44B) when the front panel 41 is closed.

Referring to FIG. 3 and FIG. 4A, a screw 49 connected to the positioning member 44 is inserted into an elongated hole 45A, and with the screw 49 as a guide, the bias setting member 45 is able to slide along the surface of the positioning member 44 in the direction of arranging the image forming units 8Y, 8C, 8M, 8BK. Inclined surfaces 45B and 45C are formed in the bias setting member 45 to face the bearings 43 and 43A in the insertion portions 44A and 44B, respectively, of the positioning member 44. The inclined surfaces 45B and 45C are in contact with the bearings 43 and 43A, respectively, and push the bearings 43 and 43A so as to urge the bearings 43 and 43A in a specific direction.

There are various methods of urging the bearings 43 and 43A. Illustrated in FIG. 4A are an eccentric member 50 and a return spring 51.

The eccentric member 50 includes a swayable cam 50A and a rotational handle 50B. The cam 50A is swayably joined to the shaft of the eccentric member 50, and the shaft penetrates through the cover 41 and engages the positioning member 44. The eccentric member 50 is at an end of the bias setting member 45 along the sliding direction of the bias setting member 45. The rotational handle 50B is joined to the same shaft with the eccentric cam 50A, and can be rotated from the outside.

As illustrated in FIG. 3 and FIG. 4, the cam 50A of the eccentric member 50 has an asymmetric profile, and is swayable with the shaft of the eccentric member 50 as a center. By rotating the rotational handle 50B, the swaying end of the cam 50A may be brought into contact with the end of the bias setting member 45 to push the bias setting member 45 to slide along the surface of the positioning member 44. In addition, the swaying end of the cam 50A may also be brought out of contact with the end of the bias setting member 45 by rotating the rotational handle 50B.

The return spring 51 imposes a force on the bias setting member 45 in a direction opposite to that imposed by the eccentric member 50, that is, the return spring 51 pulls the bias setting member 45 while the bias setting member 45 is pushed by the eccentric member 50 when the swaying end of the eccentric member 50 is in contact with the end of the bias setting member 45. As a result, the bias setting member 45 is manipulated to move in the direction of arranging the image forming units 8Y, 8C, 8M, 8BK.

In the present embodiment, the swaying end of the eccentric member 50 is brought into contact with the end of the bias setting member 45 to impose a force on the bias setting member 45 when the rotational handle 50B of the eccentric member 50 is perpendicularly pendant as shown in FIG. 4. Due to the push of the eccentric member 50, the inclined surfaces 45A and 45B of the bias setting member 45 press the bearings 43 and 43A, respectively, against one of the V-shaped inclined surfaces of the insertion portions 44A and 44B of the positioning member 44.

As illustrated in FIG. 3, the rotational handle 50B has an asymmetric shape and is capable of an oscillating motion. A projecting engagement member 50B1 is formed on the rotational handle 50B. When the rotational handle 50B is perpendicularly pendant, the engagement member 50B1 reaches the handle 47, which is for opening or closing the front panel 41, and locks the handle 47.

As described above, the image forming units 8Y, 8C, 8M, 8BK, the intermediate transfer unit 7, or other component units of the image forming apparatus of the present embodiment are held at the desired positions when the rotational handle 50B is perpendicularly pendant. Because the projecting engagement member 50B1 holds the handle 47 at the CLOSED position, it is possible to prevent the handle 47 from being carelessly opened.

According to the above image forming apparatus, when exchanging any of the image forming units 8Y, 8C, 8M, 8BK, and the intermediate transfer unit 7, first the opened portion 40A is opened. Specifically, the handle 47 is held and turned toward the user to release the springy members 48. Due to this, the springy members 48 are narrowed in the vertical direction, and the locked state of the springy members 48 and the lock members 55 is released. Then the handle 47 is held to turn down the cover 42, and thereby, the front panel 41 is moved away and the opened portion 40A is opened.

Because the supporting center with which the front panel 41 is turned down is lower than the opened portion 40A, after the front panel 41 is turned down, the opened portion 40A can be viewed directly downward from the outside, and this makes it easy to confirm positions when exchanging or installing any of the image forming units 8Y, 8C, 8M, 8BK, and the intermediate transfer unit 7. In addition, after the front panel 41 is turned down, that is, after the front panel 41 is opened, there is no way for the front panel 41 to be closed carelessly, preventing one's finger from being jammed by the front panel 41.

When closing the opened portion 40A, in a reversed order to the opening operation as described above, the panel is held and turned up, and the springy members 48 are resiliently engaged with the lock members 56 on the side panel 40. Resultantly, the front panel 41 is at the CLOSED position.

When the front panel 41 is at the CLOSED position, that is, it covers the opened portion 40A, by operating the eccentric member 50, the bias setting member 45 is slid to position the image forming units 8Y, 8C, 8M, 8BK, the intermediate transfer unit 7, or the others. Specifically, the eccentric member 50, which is inserted into the front panel 41 at the CLOSED position, is turned to bring the swaying end of the cam 50A of the eccentric member 50 into contact with one end of the bias setting member 45 along its sliding direction. Thereby, the bias setting member 45 is pushed and slid by the cam 50A of the eccentric member 50 as illustrated in FIG. 4, and thus the inclined surfaces 45A and 45B of the bias setting member 45 press the bearings 43 and 43A, respectively, which are inserted into the insertion portions 44A and 44B of the positioning member 44, against one of the V-shaped inclined surfaces of the insertion portions 44A and 44B. Consequently, both pitches of the photo conductors of the image forming units 8Y, 8C, 8M, 8BK, and the positional relations between these image forming units and the intermediate transfer unit 7, which are facing each other, are defined by the inclined surfaces of the insertion portions 44A and 44B by applying the same force in the same direction.

At the CLOSED position, the springy members 48 engage the side panel 40, and this maintains the CLOSED state of the front panel 41. In addition, at the CLOSED position, the handle 47 is held by the engagement member 50B1 of the rotational handle 50B, thereby preventing the handle 47 from being opened carelessly.

In this way, by the locking devices of the present embodiment, the front panel 41 is reliably held at the CLOSED position, and the component units of the image forming apparatus installed in the main body 1 are held at the desired positions accurately.

Below, the structure for locking the front panel 41 is described according to the present embodiment.

Figure 5:
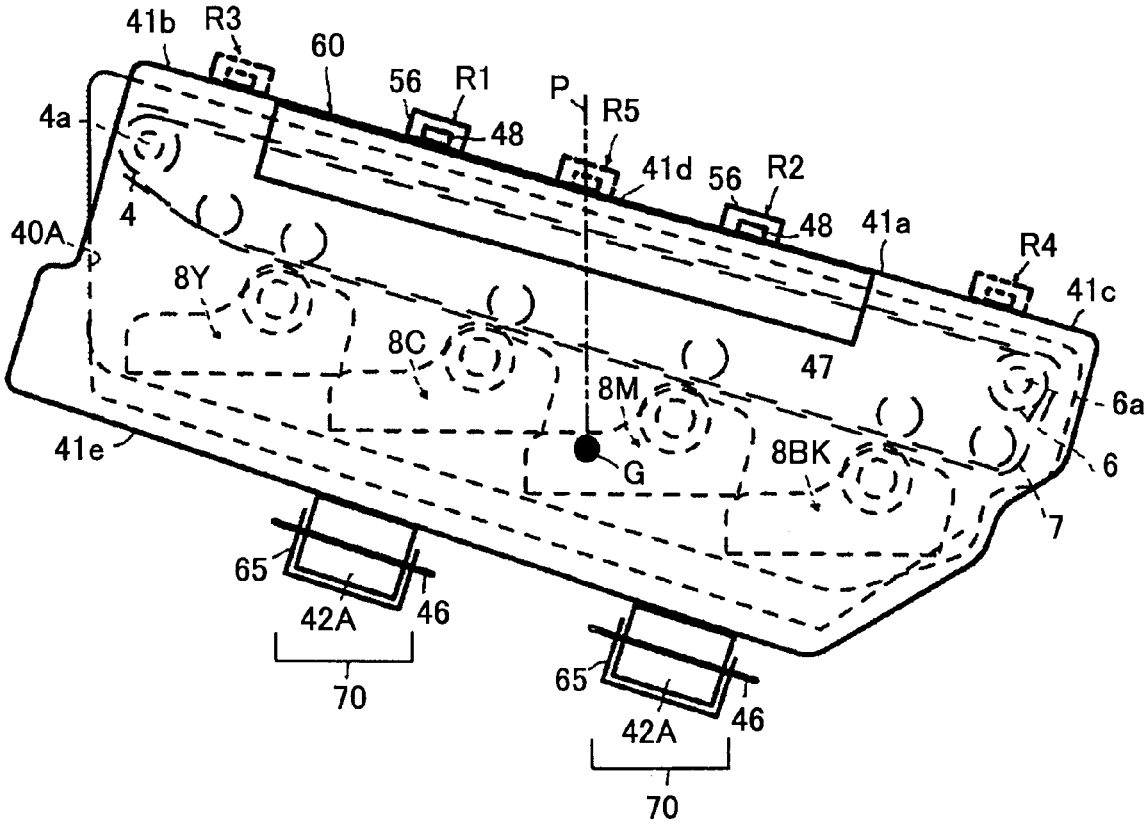
FIG. 5 is an enlarged view of the front panel 41 showing an example of the locking structure of the front panel 41.

FIG. 5 is an enlarged view of the front panel 41 showing an example of the locking structure of the front panel 41.

In FIG. 5, the structure including the springy members 48, the lock members 56, and the handle 47 is referred to as a locking structure 60.

The springy members 48 and the lock members 56 face each other and are engaged with each other when the front panel 41 is at the CLOSED position. The positions where the springy members 48 and the lock members 56 are engaged are referred to as "locking position" and indicated by letters R1 and R2.

In the present embodiment, there are two locking positions R1 and R2, which are symmetric relative to the center of the upper edge 41*a* of the front panel 41, which is above the image forming units 8Y, 8C, 8M, 8BK and the intermediate transfer unit 7. Due to this arrangement, the locking structure 60 does not interfere with operations of attaching the image forming units 8Y, 8C, 8M, 8BK and the intermediate transfer unit 7 to the main body 1, and the front panel 41 can be reliably maintained at the CLOSED position by the locking structure 60.

In addition, the locking positions R1 and R2 are symmetrically arranged with respect to the perpendicular (P) through the gravity center G of the front panel 41; thereby, the balance of the locking positions is maintained, the state of the front panel 41 at the CLOSED position (that is, the locked state) is stable, and the image forming units 8Y, 8C, 8M, 8BK, and the intermediate transfer unit 7 are held at the desired positions accurately.

It should be noted that the locking positions are not limited to the positions R1 and R2. For example, as shown in FIG. 5 by the positions R3, R4, the locking positions may also be arranged near two ends 41*b* and 41*c* of the upper edge 41*a* of the front panel 41. When there is only one locking position, as illustrated in FIG. 5 by the letter R5, the locking position may be at the center 41*d* of the upper edge 41*a* of the front panel 41. This locking position R5 is more preferable because it is on the perpendicular P through the gravity center G of the front panel 41.

The locking positions R1 through R4 are arranged between positions corresponding to axles 4*a* and 6*a* that support rollers 4 and 6, respectively, in the intermediate transfer unit 7. Due to this, when the axles 4*a* and 6*a* of the rollers 4 and 6 are held by the front panel 41 and are fixed at specified positions, the specified positions and the locking positions do not interfere with each other, and the front panel 41 can be reliably fixed at the CLOSED position by the locking structure 60.

In addition, the positions of the locking positions R1 through R5 are selected such that the axles 4*a* and 6*a*, the image forming units 8Y, 8C, 8M, 8BK, and the intermediate transfer unit 7 are surely covered by the front panel 41 when the front panel 41 is at the CLOSED position. Due to this, the front panel 41 can be surely brought to face the axles 4*a* and 6*a*, the image forming units 8Y, 8C, 8M, 8BK, and the intermediate transfer unit 7, and reliably held at the CLOSED position. Consequently, the image forming units 8Y, 8C, 8M, 8BK, and the intermediate transfer unit 7 can be accurately fixed at specified positions.

The arrangement of the locking positions of the locking structure is not limited to the above example. For example, there may be three or more locking positions like R3, R4, and R5. Arrangement of these locking positions can be decided by considering weight of the front panel 41, space available for the arrangement inside the main body 1 and so on. More locking positions lead to a more stable locking state.

Figure 6:
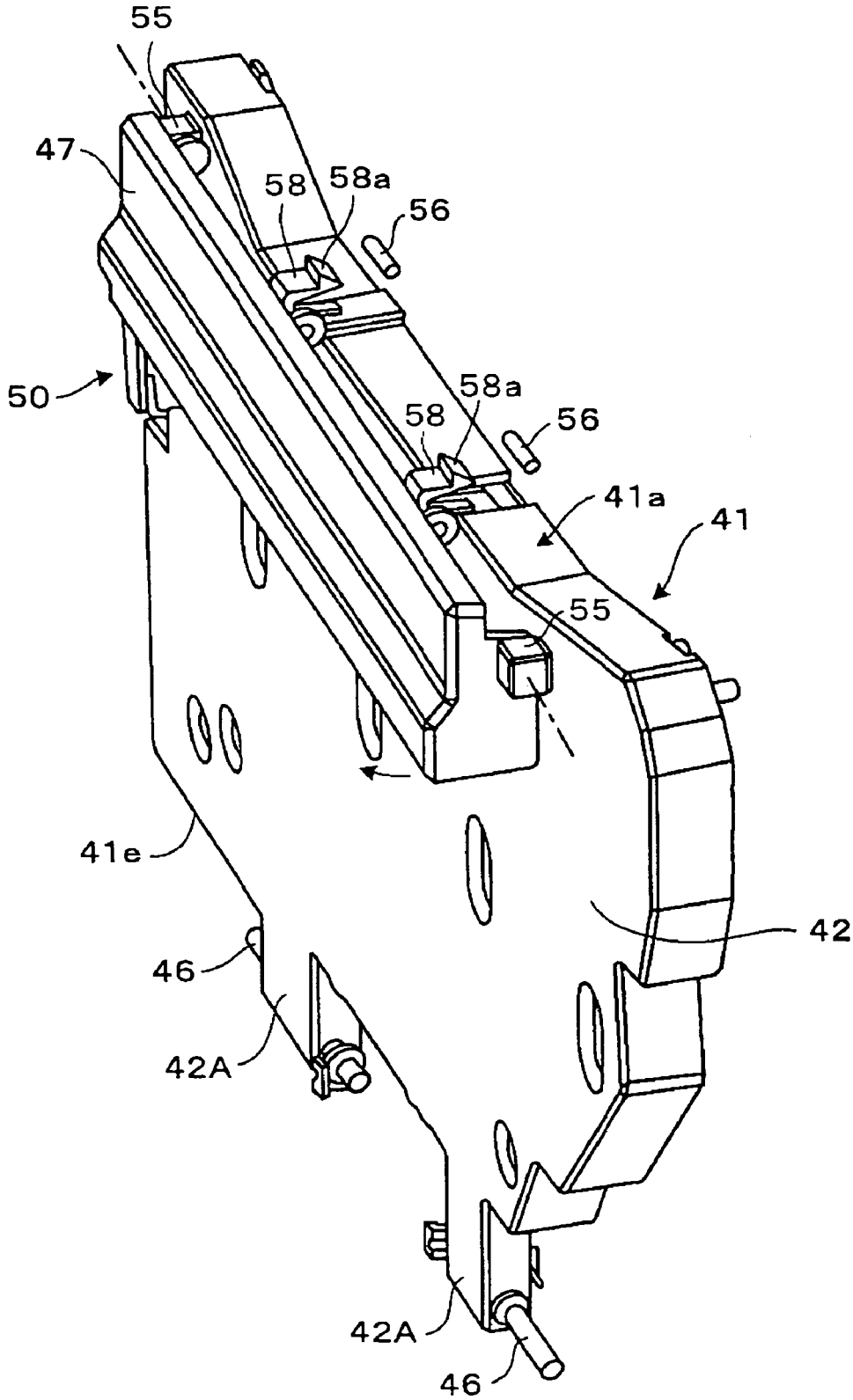
FIG. 6 is an enlarged perspective view showing another example of the locking structure of the front panel 41.

FIG. 6 is an enlarged perspective view of the front panel 41 showing another example of the locking structure.

The locking structure illustrated in FIG. 6 includes claw members 58 and corresponding locking members 56 whose axial line is along the longitudinal direction of the front panel 41. The front ends of the claw members 58 are engaged with the respective locking members 56 when the front panel 41 is at the CLOSED position. As illustrated in FIG. 6, the front end of each of the claw members 58 is L-shaped and projecting toward to the respective locking members 56. The claw members 58 are attached to the handle 47; by rotating the handle 47 away from the cover 42 (that is, to the user's side), the claw members 58 move downward toward the upper edge 41*a* of the front panel 41 to release the engagement of the claw members 58 and the locking members 56. With the above shape, the claw members 58 can be easily engaged with the locking members 56.

Figure 7:
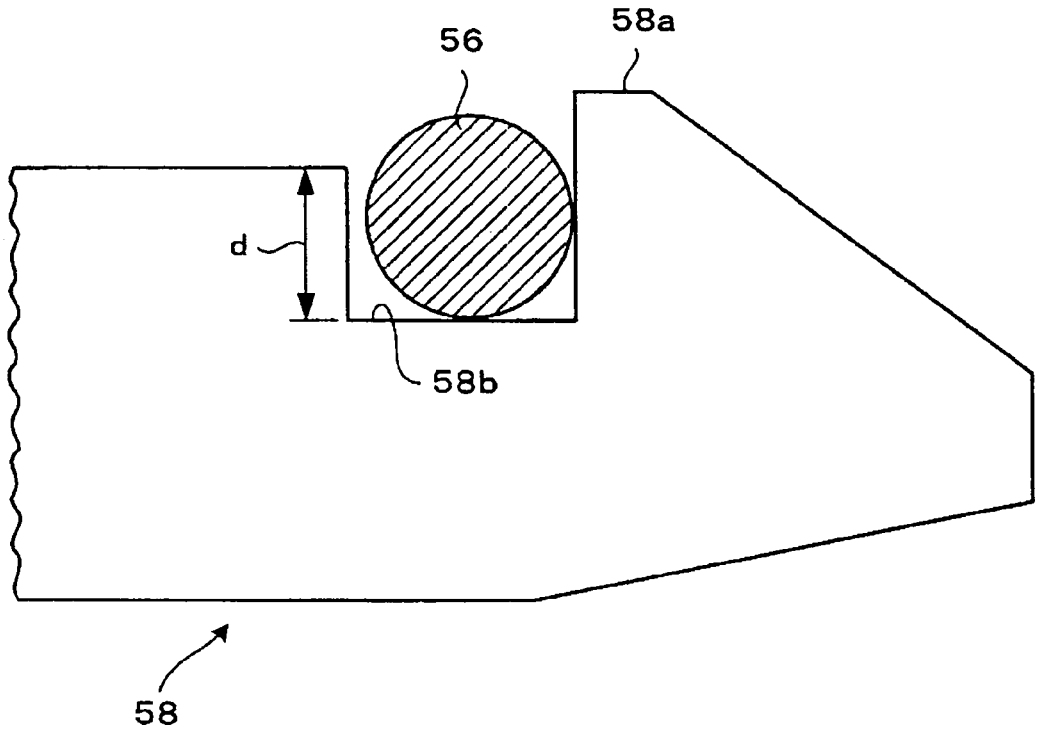
FIG. 7 is an enlarged view showing another example of the claw member 58 and the engagement state between the claw member 58 and the locking member 56.

FIG. 7 is an enlarged view showing another example of the claw member 58 and the engagement state between the claw member 58 and the locking member 56.

As illustrated in FIG. 7, a groove 58*b* is formed in the front portion 58*a* of the claw member 58 to fit the locking member 56. The depth d of the groove 58*b* is sufficiently large so that over half of the locking member 56 is in the groove 58*b*, that is, the depth d of the groove 58*b* is greater than half of the diameter of the locking member 56. With such a locking structure, when the claw member 58 and the locking member 56 are engaged, the claw member 58 can hardly disengage from the locking member 56, and the locking state (or the engagement state) of the front panel 41 can be reliably maintained.

The locking member 56 may be formed in other ways. For example, the axles provided in the main body 1 may be used to form the locking member 56, or the locking member 56 may be a member formed on the main body 1 obtained by reversing the claw member 58 while keeping the axial line of the locking member 56 along the longitudinal direction of the front panel 41.

The springy members 48 and the claw members 58 may be formed from single synthesized resins, metals or ceramics, or by a combination of the synthesized resins and metals. When using single synthesized resins, the springy members 48 or the claw members 58 can be fabricated easily, and it is possible to reduce weights of the springy members 48 or the claw members 58. Furthermore, when the springy members 48 or the claw members 58 are engaged with the locking members 56, because of the elasticity of the synthesized resins, it is possible to improve the engagement condition and reduce the noise in disengagement. When using single metals, it is possible to increase the strength of the springy members 48 and the claw members 58, and improve durability of the springy members 48 and the claw members 58 against disengagement with the locking member 56. When using single ceramics, the springy members 48 and the claw members 58 can be fabricated easily, and it is possible to reduce weights and increase the strength of the springy members 48 and the claw members 58. It is also possible to reduce the noise in disengagement depending on the types of the ceramic.

Figure 8:
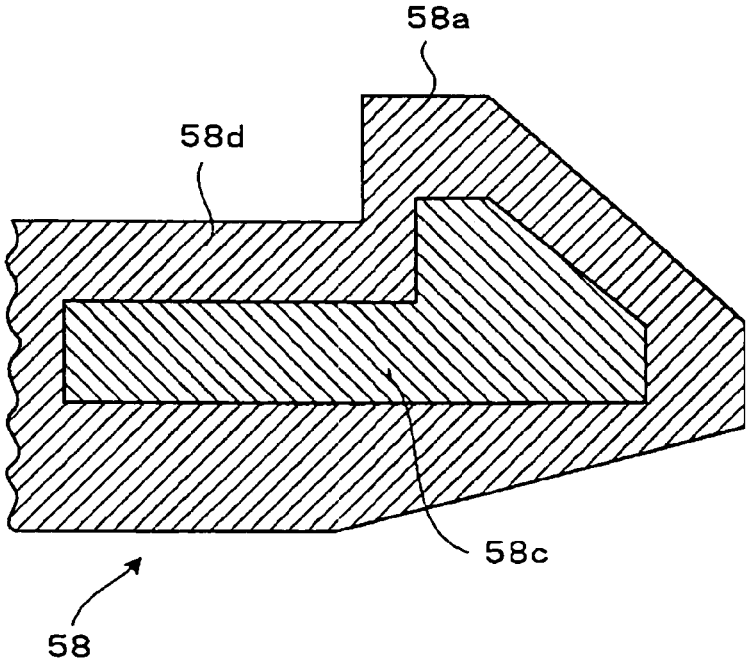
FIG. 8 is a cross-sectional view showing another example of the claw member 58 formed by a combination of different materials.

FIG. 8 is a cross-sectional view showing another example of the claw member 58 formed by a combination of different materials.

As illustrated in FIG. 8, in the claw member 58, the center portion 58*c* is made from a metal, and the center portion 58*c* is covered by a synthesized resin and shaped into a claw by means of insert molding, forming the peripheral portion 58*d* of the claw member 58.

With the configuration in FIG. 8, it is possible to reduce the weight and improve durability of the claw member 58 compared with a claw member formed from a single metal. Especially, because the peripheral portion 58*d* is formed from a resin, it is also possible to reduce noise in disengagement.

Even when the resin is coated on the surface of the center portion 58*c*, it is also possible to effectively reduce noise in disengagement.

Below, the structure for supporting the front panel 41 is described.

Returning to FIG. 5, the structure for supporting the front panel 41 includes two supporting portions 70 separated on the lower edge 41*e* of the front panel 41. In other words, the supporting portions 70 are arranged on the side of the front panel 41 opposite to the locking positions R1 through R5 of the locking structure 60. Each of the supporting portions 70 includes the hinge 42A on the lower edge 41*e* of the front panel 41, the axle 46 of the hinge 42A penetrating through the hinge 42A, and a bearing 65 rotatably holding the two ends of the axle 46.

With such a supporting structure, the front panel 41 can be rotated relative to the lower edge 41*e* to cover the opened portion 40A or expose the opened portion 40A. Because the front panel 41 can be rotated in a wide range, it is easy to exchange the image forming units 8Y, 8C, 8M, 8BK and the intermediate transfer unit 7.

Figure 9:
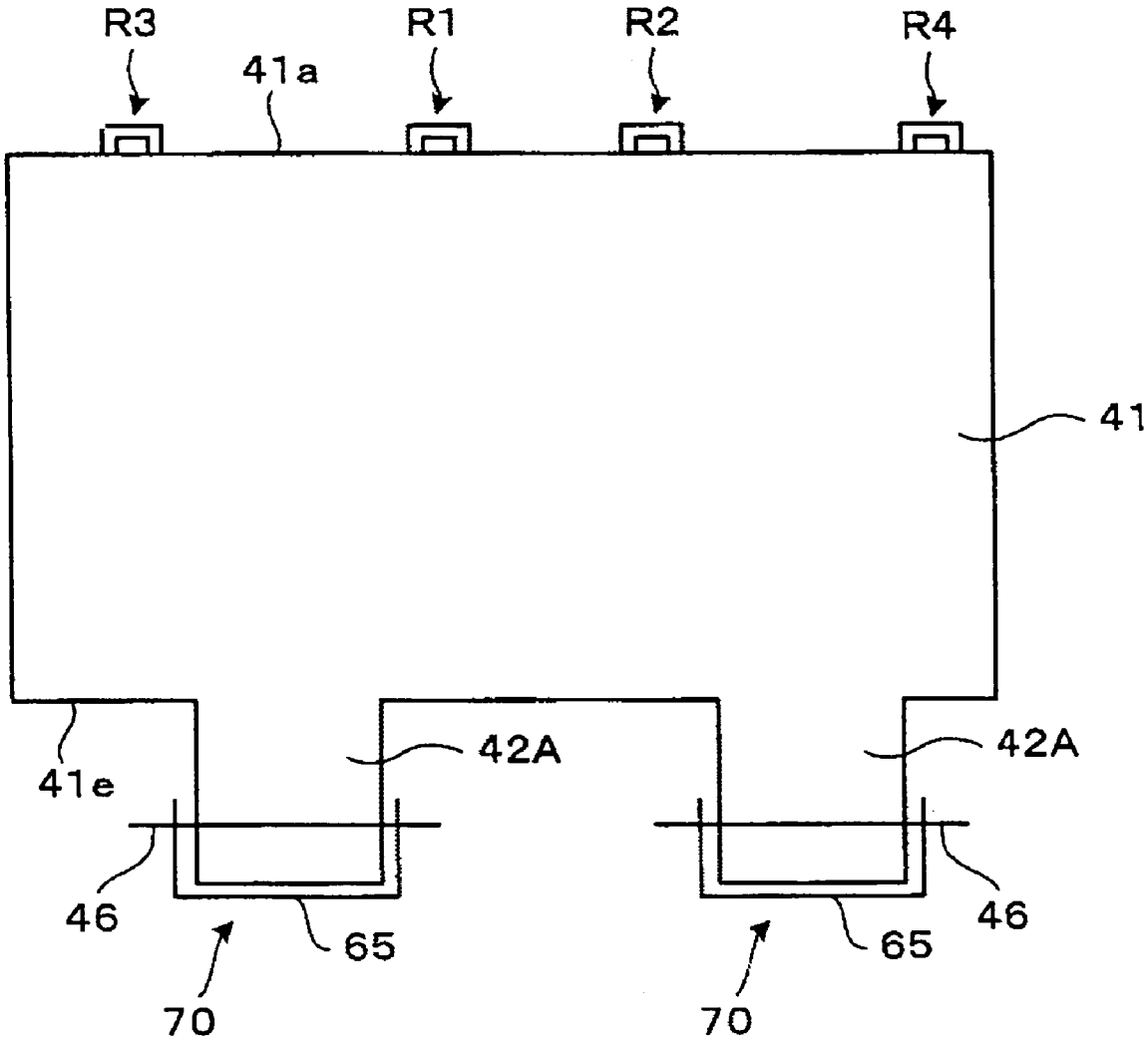
FIG. 9 is a plan view of the front panel 41 showing the positional relations of the supporting portions 70 and the locking positions R1 through R4 of the front panel 41.

FIG. 9 is a plan view of the front panel 41 showing the positional relations of the supporting portions 70 and the locking positions R1 through R4 of the front panel 41.

As illustrated in FIG. 9, the supporting portions 70 may be arranged at positions corresponding to the region on the upper edge 41*a* of the front panel 41 beyond the locking positions R1 and R2; alternatively, at positions corresponding to the region on the upper edge 41*a* between the locking positions R3 and R4. By arranging the supporting portions 70 in connection with the locking positions R1 though R4, it is possible to prevent interference between the locking positions and the supporting portions 70, and to appropriately select the positions of the supporting portions 70 according to the locking positions.

Figure 10:
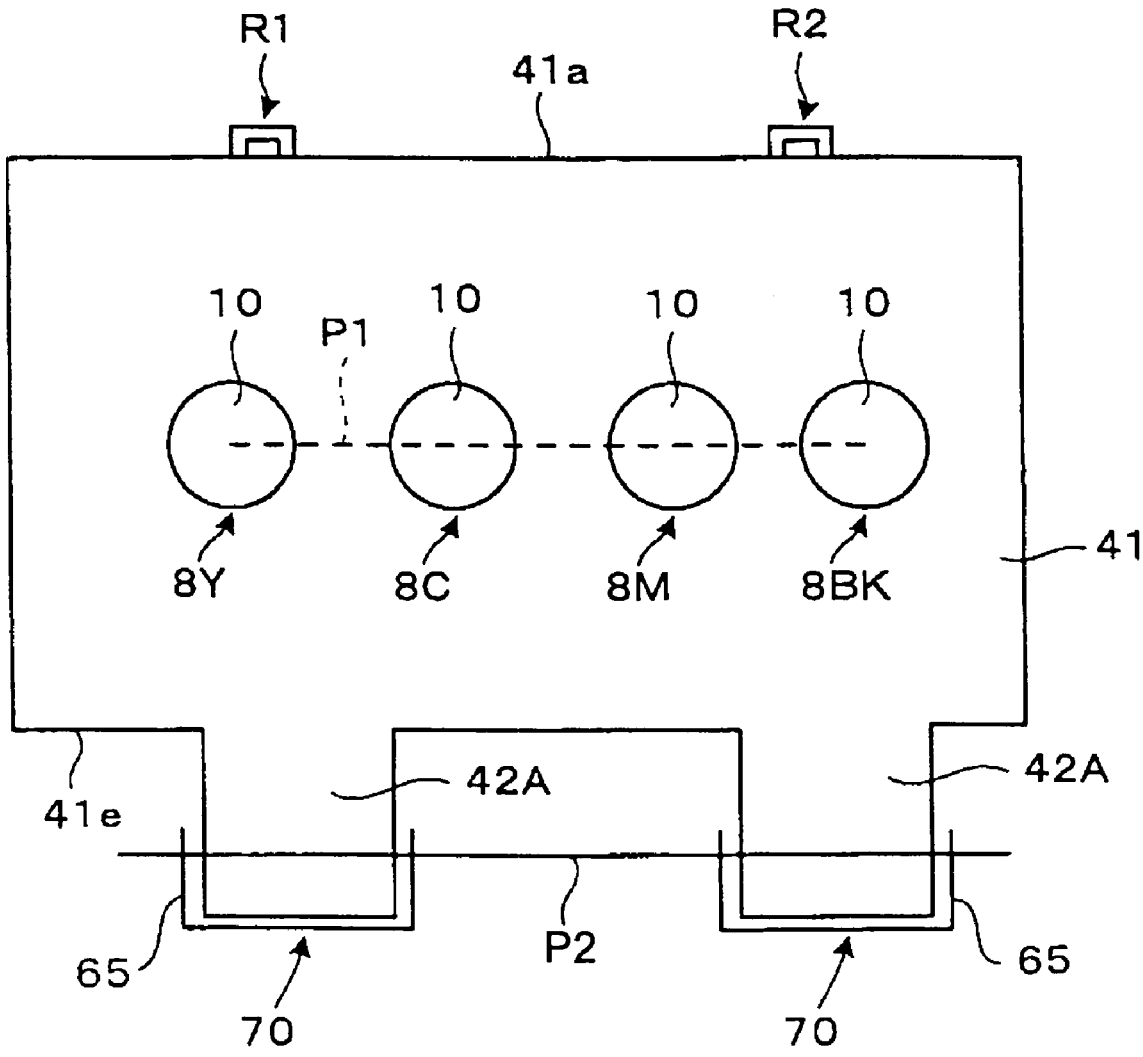
FIG. 10 is a plan view of the front panel 41 showing the positional relations of the supporting portions 70 and the image forming units 8Y, 8C, 8M, 8BK held by the front panel 41.

FIG. 10 is a plan view of the front panel 41 showing the position relation of the supporting portions 70 and the image forming units 8Y, 8C, 8M, 8BK held by the front panel 41.

As illustrated in FIG. 10, the supporting portions 70 are roughly parallel to the direction in which the image forming units 8Y, 8C, 8M, 8BK are arranged, that is, the rotational axis P2 of the front panel 41 is roughly parallel to a central line P1 through the photo conducting drums 10 of the image forming units 8Y, 8C, 8M, 8BK. Note that although the front panel 41 and its rotational axis P2 are horizontally drawn in FIG. 10, actually, the front panel 41 and the image forming units 8Y, 8C, 8M, 8BK are arranged with a slope, and the central line P1 and the rotational axis P2 are also inclined.

By arranging the rotational axis P2 of the front panel 41 to be roughly parallel to the central line P1 of the photo conducting drums 10 of the image forming units 8Y, 8C, 8M, 8BK, when opening or closing the front panel 41, the user can easily and quickly obtain a feel for the position of the image forming units 8Y, 8C, 8M, 8BK, and this makes the operation of exchanging these units smooth.

Although the front panel 41 illustrated in FIG. 9 and FIG. 10 has two supporting portions 70 arranged on the lower edge 41*e*, the front panel 41 may have different number of supporting portions 70. For example, the front panel 41 may have only one supporting portion 70 or three supporting portions 70 on the lower edge 41*e*, as illustrated in FIG. 11 and FIG. 12.

Figure 11:
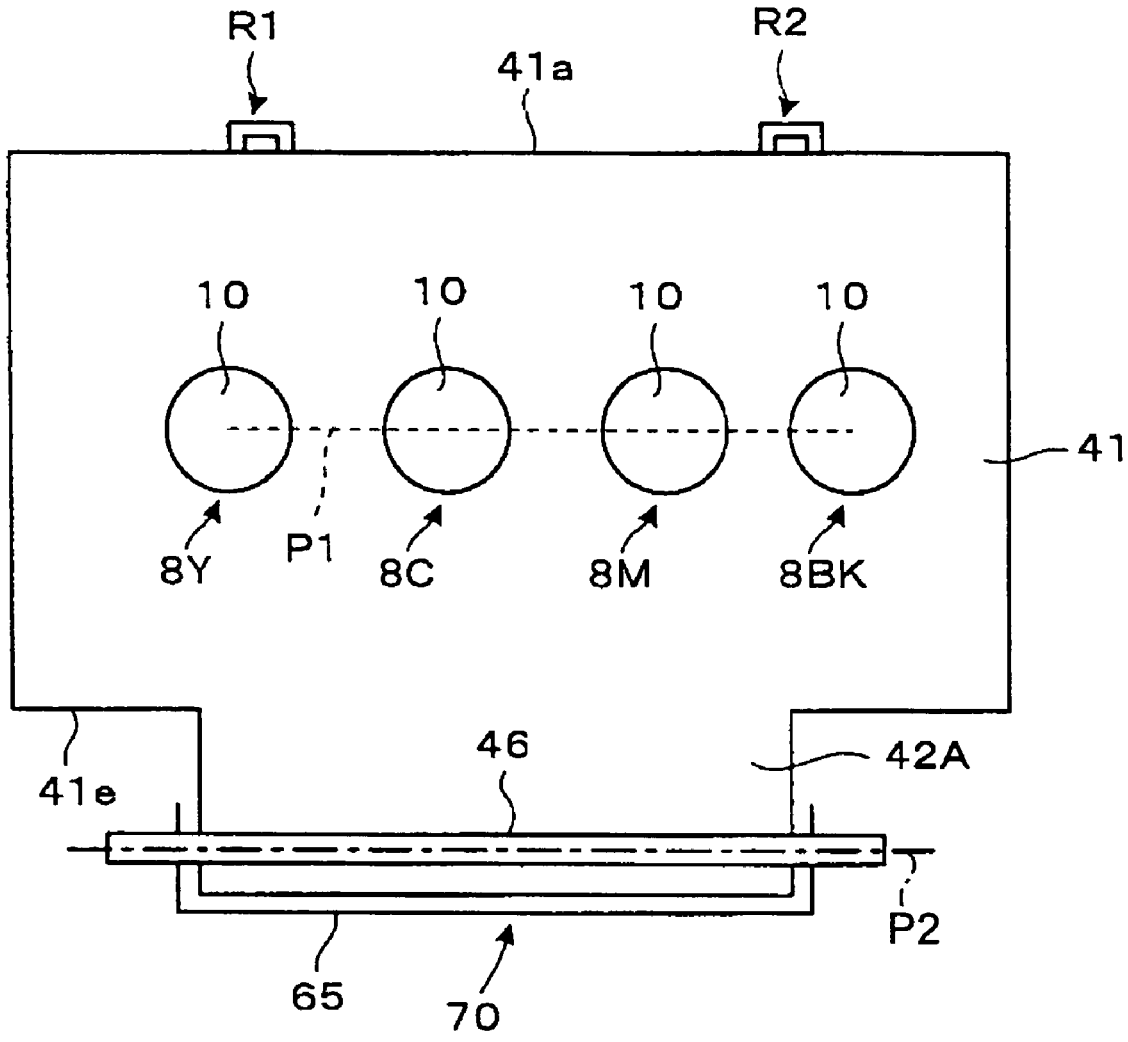
FIG. 11 is a plan view of another example of the front panel 41 including only one supporting portion 70.

FIG. 11 is a plan view of the front panel 41 including only one supporting portion 70.

Figure 12:
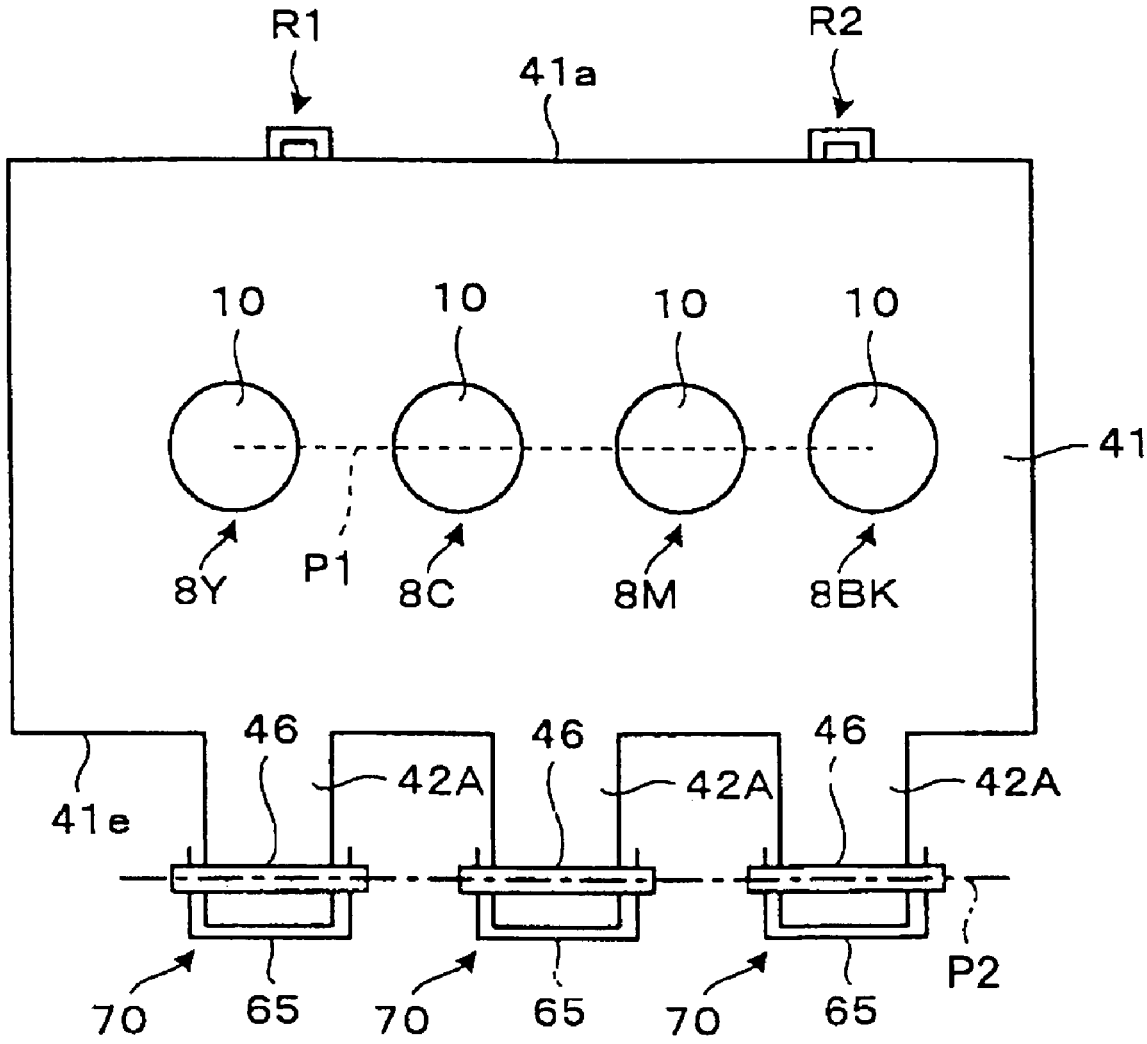
FIG. 12 is a plan view of another example of the front panel 41 including three supporting portions 70.

FIG. 12 is a plan view of the front panel 41 including three supporting portions 70.

The number of the supporting portions 70 can be appropriately selected by considering the weight and size of the front panel 41, and the positional relation with the main body 1. If the front panel 41 is heavy, it is preferable to use only one supporting portion 70 that is long in the width direction of the front panel 41, as shown in FIG. 11, to improve stability of the supporting structure. From the point of view of maintaining balance of the front panel 41 when it is opened and closed, it is preferable to use two supporting portions 70 symmetrically arranged on the lower edge 41*e* of the front panel 41 as shown in FIG. 10, or three supporting portions 70 symmetrically arranged on the center and other two eccentric positions at the lower edge 41*e* of the front panel 41, as shown in FIG. 12.

Figure 13A:
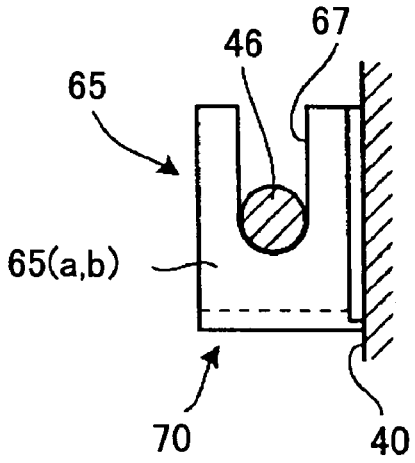
FIG. 13A is an enlarged side view showing the supporting portion 70 including the axle 46 and the bearing 65 for supporting the front panel 41 and engaging the front panel 41 with the side panel 40.

FIG. 13A is an enlarged side view of the supporting portion 70 showing the axle 46 and the bearing 65.

Figure 13B:
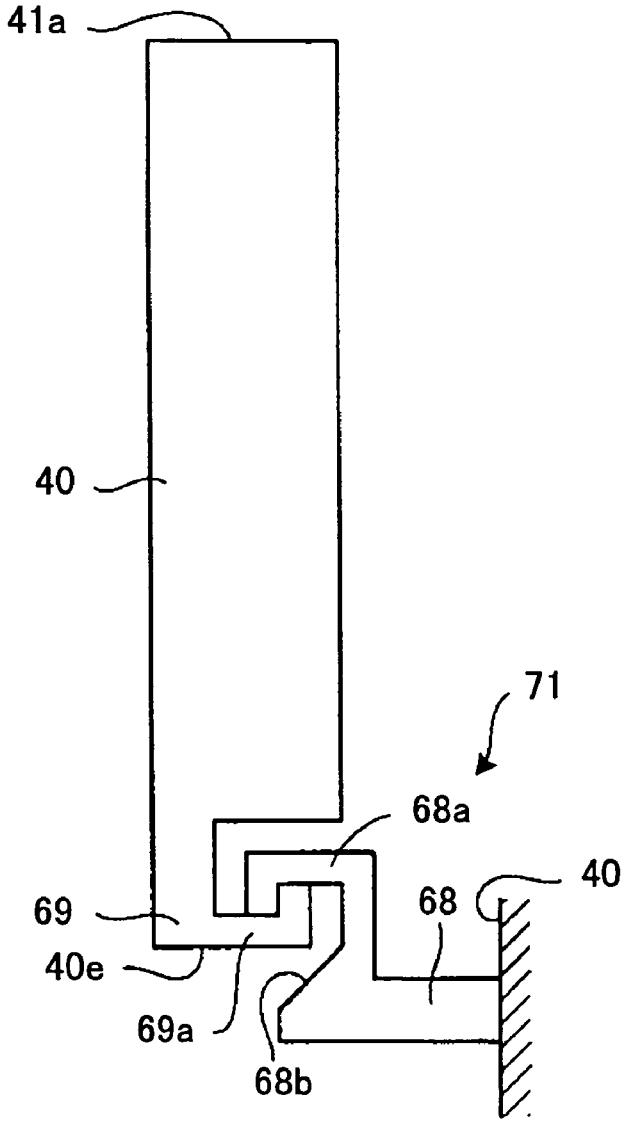
FIG. 13B is an enlarged side view showing a supporting portion 71 of the front panel 41 for supporting the front panel 41 and engaging the front panel 41 with the side panel 40.

FIG. 13B is an enlarged side view showing another example of the supporting structure of the front panel 41 for supporting the front panel 41 and engaging the front panel 41 with the side panel 40.

As illustrated in FIG. 13A, the bearing 65 is fixed on the side panel 40 of the main body 1. The bearing 65 is a hollow frame with its upper side open, and a groove 67 is formed therein by inner side walls 65 and 67 of the bearing 65. The axle 46 of the hinge 42A is placed in the groove 67 while being able to rotate freely. When the front panel 41 is released from the locked state, it can be detached from the main body 1.

The structure for supporting the front panel 41 when it is opened or closed may have other configurations. As illustrated in FIG. 13B, the front panel 41 may be supported and engaged with the side panel 40 by a supporting portion 71. The supporting portion 71 includes a hook portion 69 formed on the lower edge 41*e* of the front panel 41 and a hook portion 68 mounted to the side panel 40.

As illustrated in FIG. 13B, the hook portion 69 is a hollow frame formed in the inner side of the front panel 41, and the side thereof facing the hook portion 68 is opened so that the front end of the hook portion 68 can be inserted in. The front end of the hook portion 68 is downward-opening, and can be engaged with the hook portion 69 from above. Since the front panel 41 tends to move downward due to its own weight, an inclined surface 68*b* is formed in the lower portion of the hook portion 68, being projecting toward the hook portion 69 to restrict the downward movement of the front panel 41.

When the supporting portion 71 is used, the front panel 41 is simply hitched to the main body 1, therefore, assembly operation, like inserting the axle 46 into the hinge 42A, is not necessary, and the installing structure can be made simple.

The supporting portions 70 and 71 may be formed from single synthesized resins, metals or ceramics, or by a combination of the synthesized resins and metals. When the supporting portions 70 and 71 are formed from single synthesized resins, it is easy to mold the supporting portions 70 and 71, and it is possible to reduce the weight of the supporting portions 70 and 71. Furthermore, the elasticity of the resin may reduce the noise in the opening and closing operation. In case of the supporting portion 70, when the axle 46 and the bearing 65 are formed by metals, it is possible to increase the strength and improve durability of the supporting portion 70.

When using single ceramics, the supporting portions 70 and 71 can be molded easily, and it is possible to reduce the weight and increase the strength of the supporting portions 70 and 71.

Figure 14:
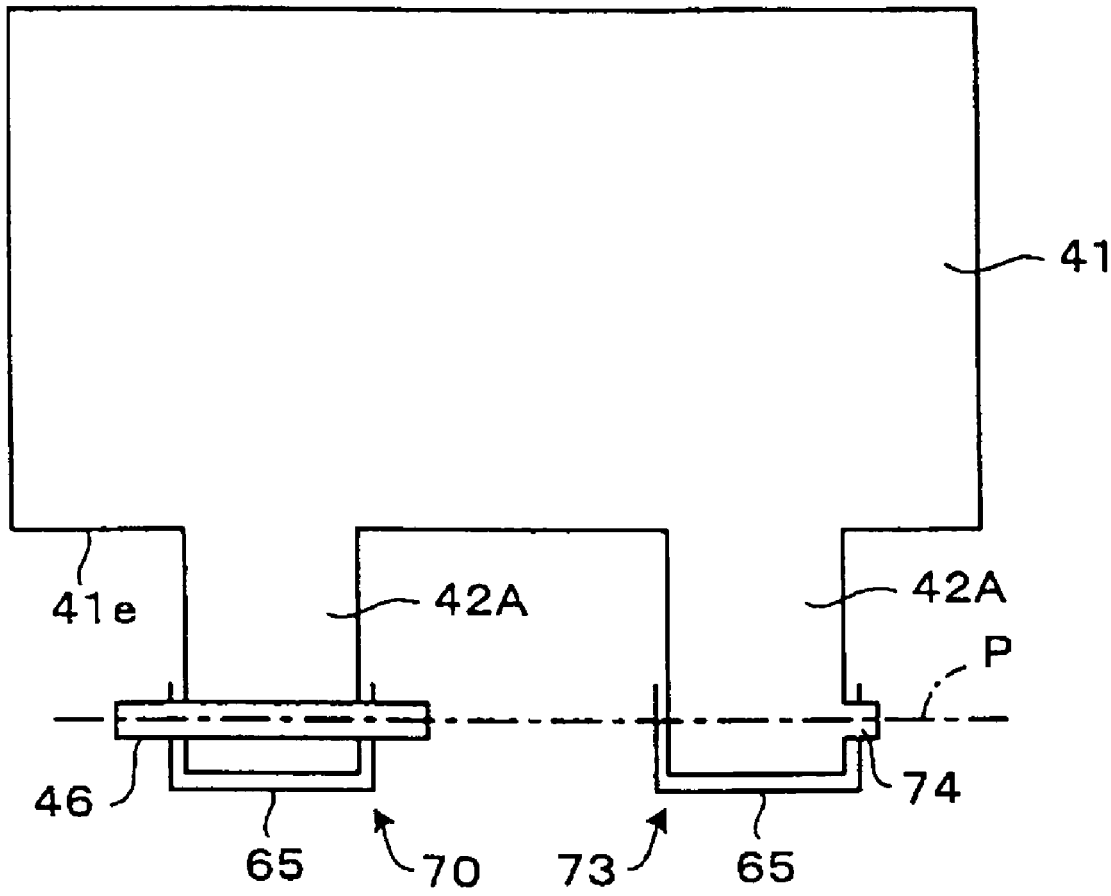
FIG. 14 is a plan view of the front panel 41 formed by a combination of different materials, having a supporting portion 70 and a supporting portion 73.

FIG. 14 is a plan view of the front panel 41 formed by a combination of a metal and a synthesized resin, showing another example of supporting portions 70 and 73 of the front panel 41.

In FIG. 14, supporting portions 70 and 73 are formed on the lower edge 41*e* of the front panel 41. The supporting portion 70 is the same as that described above. The supporting portion 73 includes a hinge 42A, a cylindrical projection 74 that is formed from a synthesized resin and acts as an axle of the hinge 42A, and the bearing 65 that rotatably supports the cylindrical projection 74. The cylindrical projection 74 and the hinge 42A are formed integrally, and the cylindrical projection 74 and the axle 46 of the supporting portion 70 are on the same rotational axis P2. With the configuration in FIG. 14, it is possible to reduce the weight and improve durability of the front panel 41 compared with that formed from a single metal.

In the front panel 41 illustrated in FIG. 14, the supporting portion 73 may also have the same structure with the supporting portion 70. In addition, the front panel 41 illustrated in FIG. 14 may also have only one supporting portion 73 or three supporting portions 73 on its lower edge 41*e* as shown in FIG. 11 and FIG. 12.

In the supporting portion 70, there is provided clearance between the axle 46 and the bearing 65 so that the axle 46 and the bearing 65 are loosely fitted. The clearance between the axle 46 and the bearing 65 roughly equals to 2% of the radius of the axle 46. Due to this clearance, the engagement between the axle 46 and the bearing 65 and between the front panel 41 and the bearings 43 of the photo conductors 10 are not so tight, and this makes operation of the front panel 41 easy.

Figure 15:
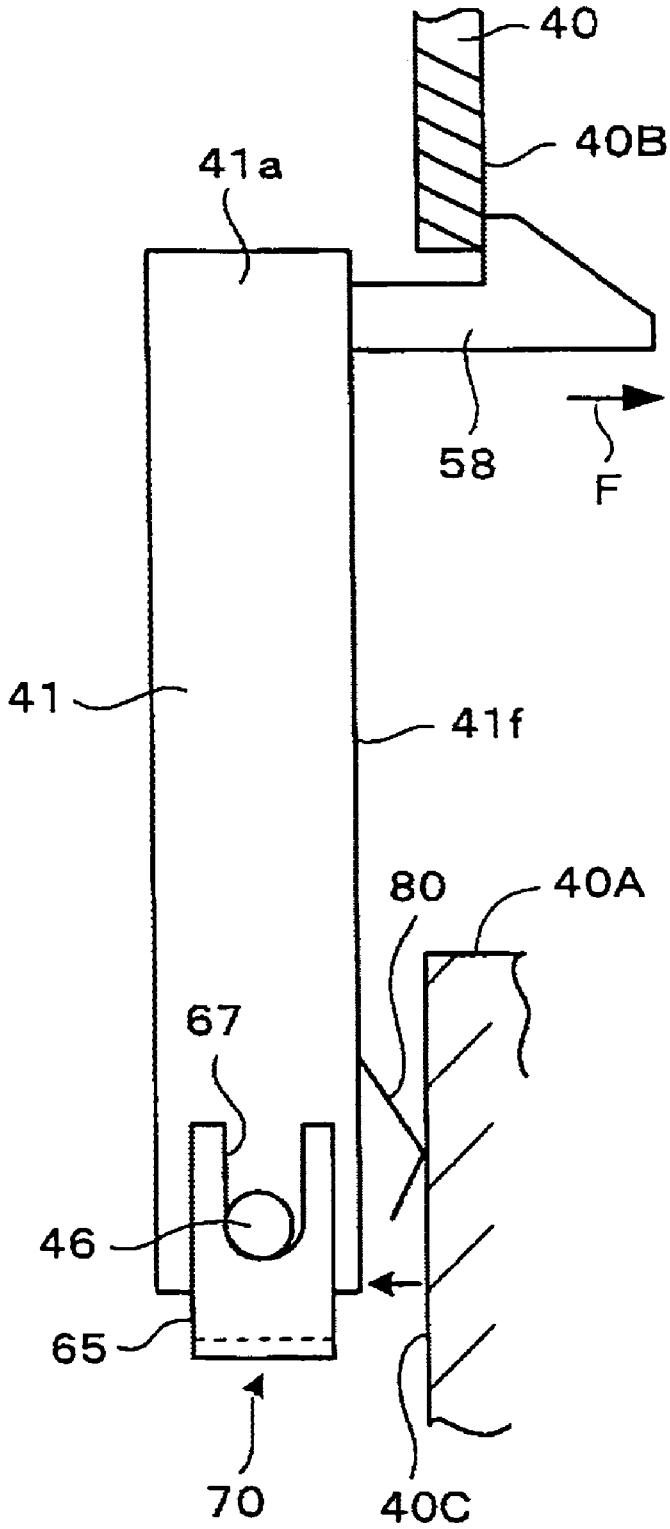
FIG. 15 is an enlarged side view showing an example of an urging member near the supporting portion 70 for improving the engagement condition between the front panel 41,and the side panel 40.

FIG. 15 is an enlarged side view showing an example of an urging member near the supporting portion 70 for improving the engagement condition between the front panel 41 and the side panel 40.

In the example illustrated in FIG. 15, when the front panel 41 is at the CLOSED position, the claw member 58 is hooked by the inner surface 40B of the side panel 40 above the opened portion 40A, instead of being engaged with the locking member 56 described above.

As illustrated in FIG. 15, an urging member 80 is installed to urge the front panel 41 in the direction F, referred to as "locking direction" below. In this example, the urging member 80 is a springy plate, and is located between the outer surface 40*c* of the side panel 40 and the inner surface 41*f* of the front panel 41 near the supporting portion 70.

In addition, the axle 46 of the hinge 42A and the groove 67 are loosely fitted, that is, there is clearance between the axle 46 of the hinge 42A and the groove 67.

By installing the springy plate 80 near the supporting portion 70, the springy plate 80 imposes a force on the front panel 41 in the locking direction F, thereby making the locked state more stable.

Figure 16:
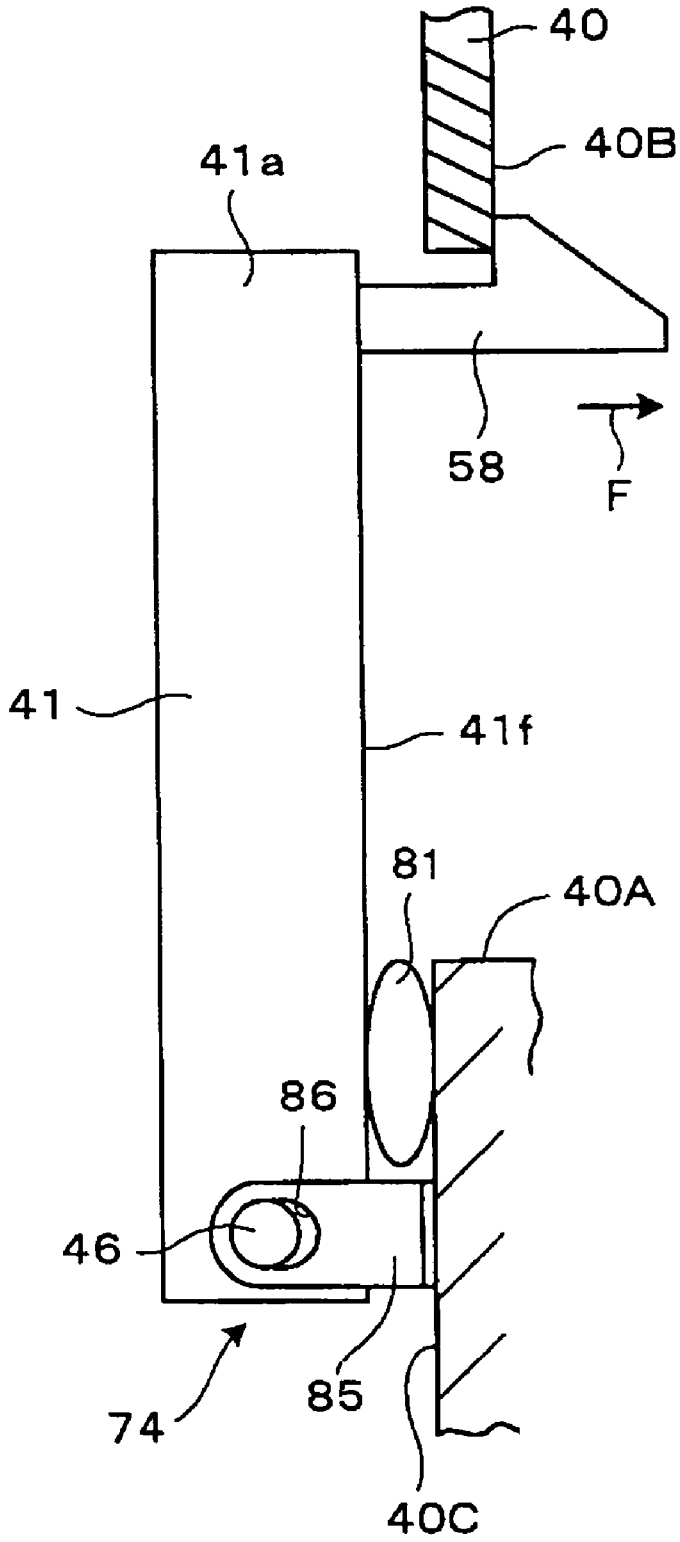
FIG. 16 is an enlarged side view showing another example of the urging member for improving engagement condition between the front panel 41 and the side panel 40.

FIG. 16 is an enlarged side view showing another example of the urging member for improving the engagement condition between the front panel 41 and the side panel 40.

In this example, the claw member 58 is also hooked by the inner surface 40B of the side panel 40 above the opened portion 40A when the front panel 41 is at the CLOSED position.

As illustrated in FIG. 16, an oil bushing 81 is used as the urging member. The oil bushing 81 is located between the outer surface 40*c* of the side panel 40 and the inner surface 41*f* of the front panel 41 near the supporting portion 70. In addition, in FIG. 16, instead of the bearing 65, an insertion-type bearing 85 is used, that is, the axle 46 can be inserted into the bearing 85. The bearing 85 has a hole 86, and the axle 46 is inserted into the hole 86. There is clearance between the hole 86 and the axle 46 to make the hole 86 and the axle 46 loosely fitting.

By installing the oil bushing 81 near the supporting portion 70, the oil bushing 81 imposes a force on the front panel 41 in the locking direction F, and thereby the locked state is more stable.

Figure 17:
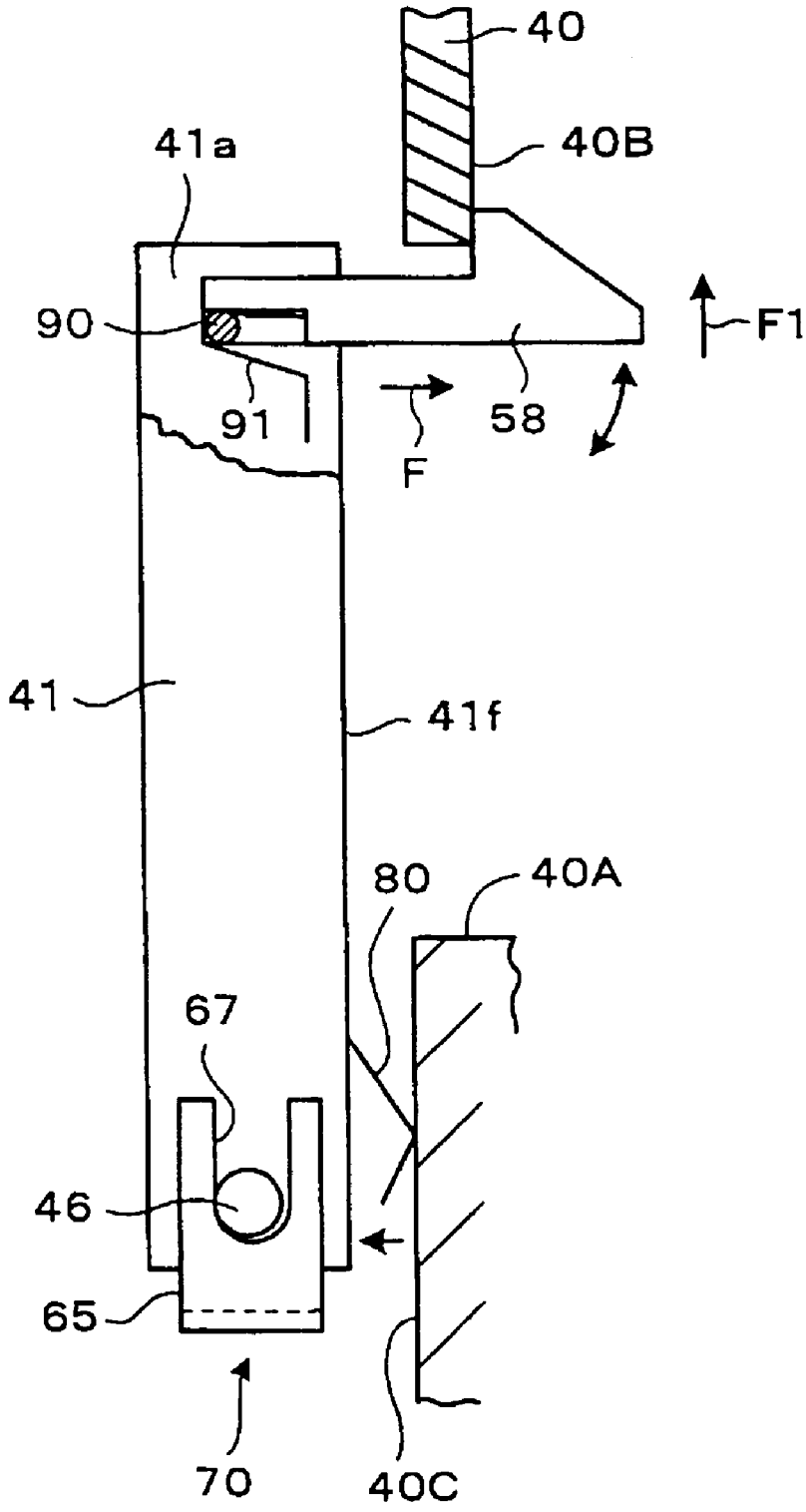
FIG. 17 is an enlarged side view showing an example of an urging member for improving the engagement condition between the claw member 58 and the side panel 40.

FIG. 17 is an enlarged side view showing an example of an urging member for improving the engagement condition between the claw member 58 and the side panel 40.

In the example illustrated in FIG. 17, when the front panel 41 is at the CLOSED position, the claw member 58 is hooked by the inner surface 40B of the side panel 40 above the opened portion 40A.

As illustrated in FIG. 17, an urging member 91 is installed to urge the claw member 58 in the direction F1, referred to as "engagement direction" below. In FIG. 17, the claw member 58 is rotatably supported by the urging member 91 located in the front panel 41 with respect to a rotational axle 90, and the claw member 58 is moveable in the engagement direction F1 or the disengagement direction opposite to the engagement direction F1.

In this example, the urging member 91 is a twisted coil spring wound around the axle 90, and two ends of the twisted coil spring 91 are connected with the claw member 58 and the front panel 41, respectively.

By installing the twisted coil spring 91 to support the claw member 58, a force is imposed on the claw member 58 in the engagement direction F1, and this makes the engagement condition more stable between the claw member 58 and the inner surface 40B of the side panel 40 above the opened portion 40A.

Figure 18:
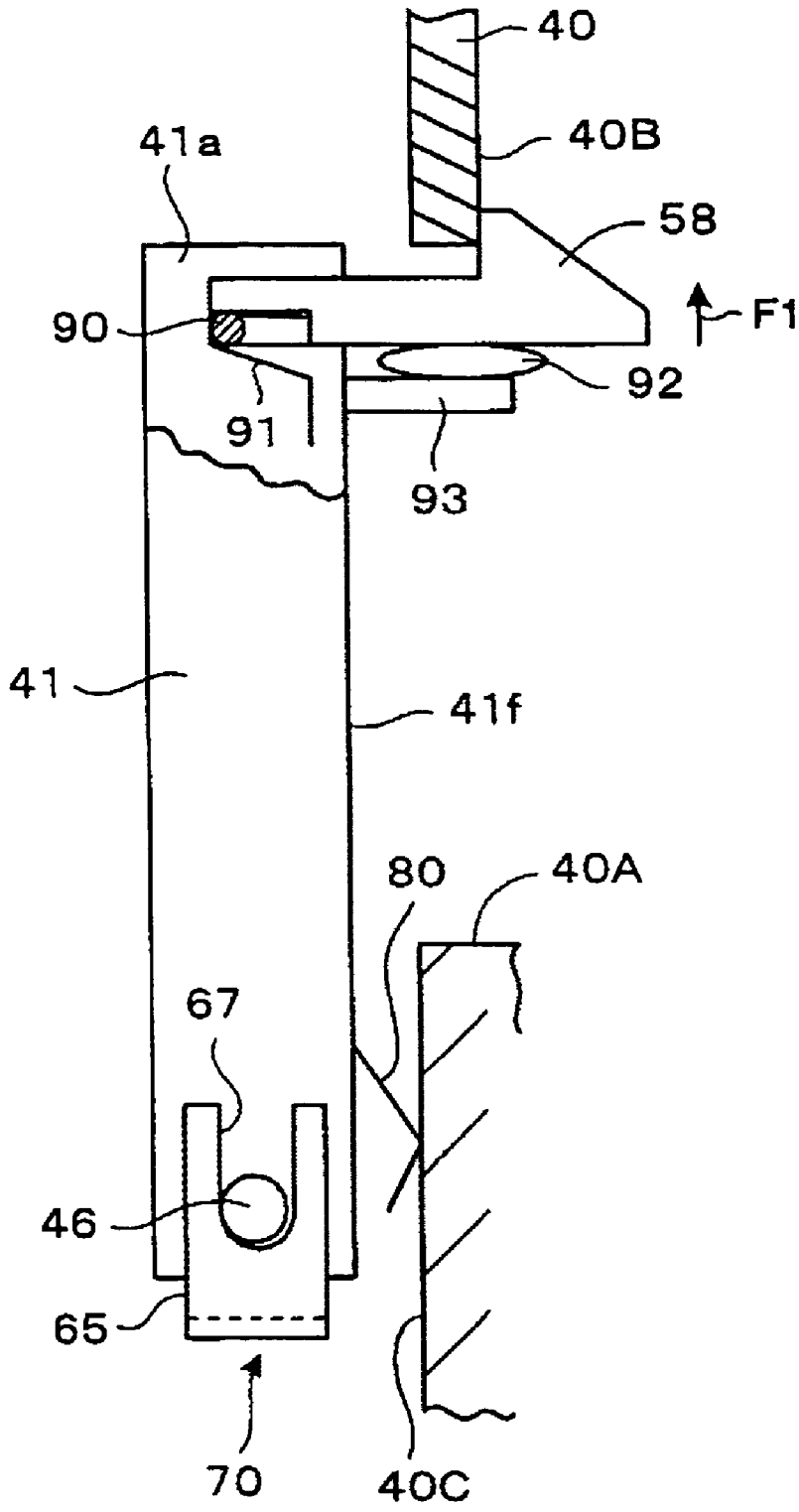
FIG. 18 is an enlarged side view showing another example of the urging member for improving the engagement condition between the claw member 58 and the side panel 40.

FIG. 18 is an enlarged side view showing another example of the urging member for improving the engagement condition between the claw member 58 and the side panel 40.

In the example, in addition to the structure illustrated in FIG. 17, an oil bushing 92 is installed to further urge the claw member 58 in the engagement direction F1. The oil bushing 92 is projecting to the side of the opened portion 43A, and located between the claw member 58 and a bracket 93 lower than the claw member 58.

By further installing the oil bush 92 to support the claw member 58, an additional force is imposed on the claw member 58 in the engagement direction F1, and this makes the engagement condition more stable between the claw member 58 and the inner surface 40B of the side panel 40 above the opened portion 40A.

Further, by installing two different urging members, it is possible to adjust operational feel when the claw member 58 is disengaged with the inner surface 40B of the side panel 40.

Besides the springy plate 80 and the twisted coil spring 91, the elastic urging member may also be a coil spring, or any spring.

Figure 19:
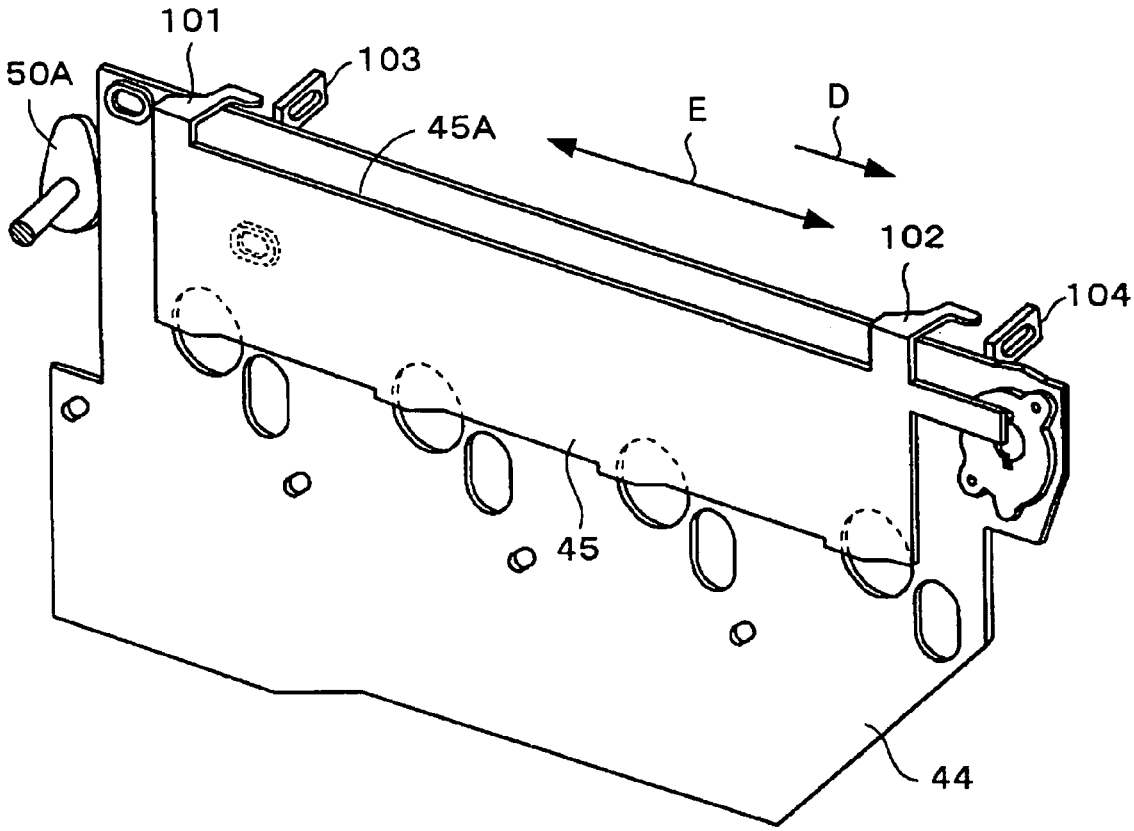
FIG. 19 is a perspective view showing an example of a slidable locking structure of the front panel 41.

FIG. 19 is a perspective view showing an example of a slidable locking structure of the front panel 41.

In FIG. 19, the bias setting member 45 as described above is slidably attached to the front panel 41, and two stoppers 103 and 104 are attached to the main body 1. When the front panel 41 is at the CLOSED position, if the bias setting member 45 is slid, the stoppers 103 and 104 are engaged with the bias setting member 45.

The bias setting member 45, that is one of the components of the front panel 41, is able to freely slide in the direction indicated by the arrow E (referred to as sliding direction, below) relative to the positioning member 44. Two locking claws 101 and 102 are formed on the upper edge 45A of the bias setting member 45, being integral with the bias setting member 45. The stoppers 103 and 104 attached to the main body 1 are arranged at such positions that they can engage the locking claws 101 and 102, respectively, when the front panel 41 is at the CLOSED position. Specifically, when handling the eccentric member 50 to drive the bias setting member 45 to slide in the direction D (referred to as "engagement direction", below), the locking claws 101 and 102 are locked by the stoppers 103 and 104.

With the above configuration, when the front panel 41 is at the CLOSED position, by handling the eccentric member 50 to rotate the eccentric cam 50A, the bias setting member 45 is slid in the engagement direction D1, and the locking claws 101 and 102 engage the stoppers 103 and 104. Thereby, the front panel 41 can be fixed to the CLOSED position reliably, and the image forming units 8Y, 8C, 8M, 8BK, and the intermediate transfer unit 7 can be accurately held at specified positions.

The positions where the locking claws 101 and 102 are locked by the stoppers 103 and 104 may be arranged at the upper edge 41*a* of the front panel 41, on the perpendicular P through the gravity center G of the front panel 41, or alternatively, may be symmetrically arranged with respect to the perpendicular P through the gravity center G of the front panel 41, as illustrated in FIG. 5. Generally, the locking positions of the locking claws 101 and 102 and the stoppers 103 and 104 may be arranged at positions higher than the image forming units 8Y, 8C, 8M, 8BK, and the intermediate transfer unit 7, such portions of the front panel 41, or positions symmetric relative to center 41A of the front panel 41, or positions between the axles 4*a* and 6*a* that support rollers 4 and 6 in the intermediate transfer unit 7, or such positions that the front panel 41 can cover the axles 4*a* and 6*a* and the image forming units 8Y, 8C, 8M, 8BK.

In the above example, the locking claws 101 and 102 are formed on the bias setting member 45, the stoppers 103 and 104 are attached to the main body 1, and the locking claws 101 and 102 and the stoppers 103 and 104 are engaged respectively at two locking positions. However, the present invention is not limited to this example, there may be only one locking position, or three or more locking positions. The specific locations of the locking positions may be decided by considering the weight of the front panel 41 and space for installation inside the main body 1, and a larger number of the locking positions increases the engagement strength of the locking claws 101 and 102 and the stoppers 103 and 104.

Figure 20:
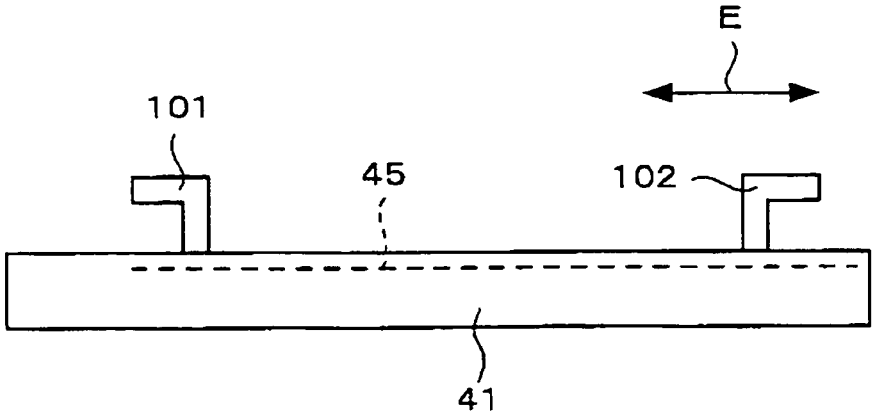
FIG. 20 is a plan view of the bias setting member 45, showing an example of an arrangement of the locking claws 101 and 102.

FIG. 20 is a plan view of the bias setting member 45, showing an example of an arrangement of the locking claws 101 and 102.

As illustrated in FIG. 20, the locking claws 101 and 102 have the same shape and are symmetrically arranged on the upper edge 45A of the bias setting member 45 in the sliding direction E.

Figure 21:
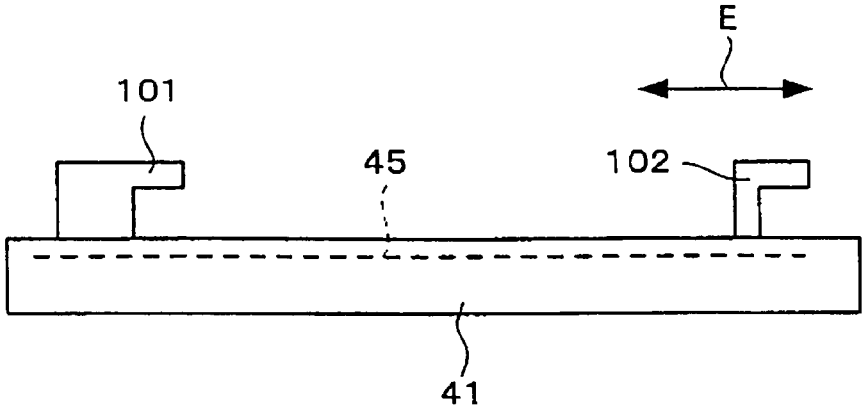
FIG. 21 is a plan view of the bias setting member 45, showing another example of the locking claws 101 and 102.

FIG. 21 is a plan view of the bias setting member 45, showing another example of the locking claws 101 and 102.

As illustrated in FIG. 21, the locking claws 101 and 102 have difference shapes and are asymmetrically arranged on the upper edge 45A of the bias setting member 45 in the sliding direction E.

Figure 22:
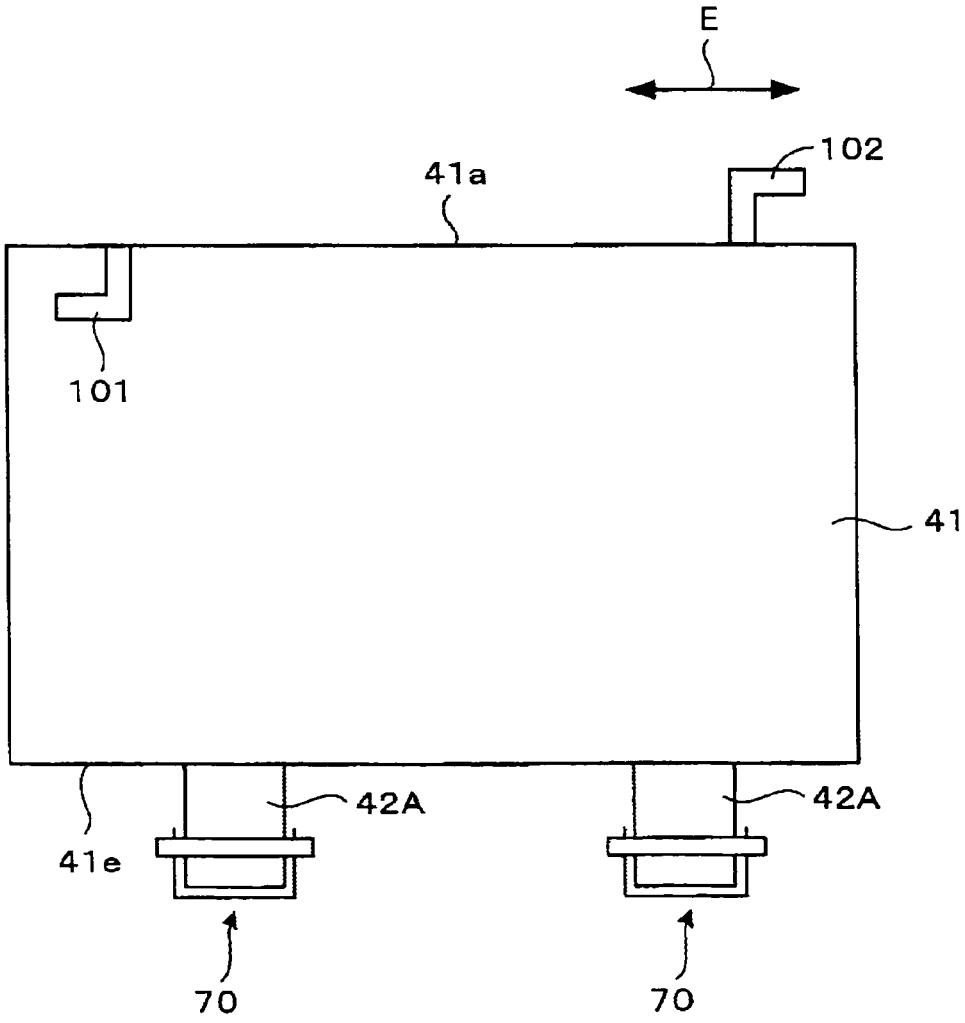
FIG. 22 is a plan view of the bias setting member 45, showing another example of the locking claws 101 and 102.

FIG. 22 is a plan view of the bias setting member 45, showing another example of the locking claws 101 and 102.

As illustrated in FIG. 22, the locking claws 101 and 102 have the same shape and are placed at symmetric positions on the upper edge 45A of the bias setting member 45 in the sliding direction E, but the plane containing the locking claw 101 is perpendicular to the plane containing the locking claw 102.

When the locking claws 101 and 102 are symmetrically arranged, as illustrated in FIG. 20, by arranging the locking claws having the same shape symmetrically, it is possible to reduce the number of parts.

When the locking claws 101 and 102 have different shapes and are asymmetrically arranged, as illustrated in FIG. 21, because the engagement conditions between the locking claw 101 and the stopper 103, and the locking claw 102 and the stopper 104 are different, even when either of the locking claws is damaged, the other locking claw will be still engaged with the corresponding stopper.

The locking claws 102, 103 may be formed from single synthesized resins, metals or ceramics, or by a combination of the synthesized resins and metals. When the locking claws 101 and 102 are formed by single synthesized resins, the locking claws 101 and 102 be fabricated easily, and it is possible to reduce weights thereof. Furthermore, when the locking claws 101 and 102 are engaged with the stoppers 103 and 104, because of the elasticity of the synthesized resins, it is possible to improve the engagement condition and reduce the noise in disengagement. When the locking claws 101 and 102 are formed by single metals, it is possible to increase the strength of the locking claws 101 and 102, and improve durability of the locking claws 101 and 102 against disengagement with the stoppers 103 and 104. When the locking claws 101 and 102 are formed by single ceramics, the locking claws 101 and 102 can be fabricated easily, and it is possible to reduce the weight and increase the strength of the locking claws 101 and 102. It is also possible to reduce the noise in disengagement depending on the types of ceramic.

When the locking claws 101 and 102 are formed by a combination of the synthesized resins and metals, it is possible to reduce the weight of the locking claws 101 and 102 and improve durability compared with locking claws formed from single metals. Especially, when the peripheral portions 58*d* of the locking claws 101 and 102 are formed from a resin, or metal locking members are covered by a resin applied by coating, it is also possible to reduce noise in disengagement.

In this example, because movement of the locking claws 101 and 102 in the sliding direction E can be observed from the side of the opened portion 40A, it makes operations on the front panel 41 more convenient, and urges the user to intentionally lock the front panel 41, thereby, preventing the user from forgetting locking the front panel 41.

Figure 23:
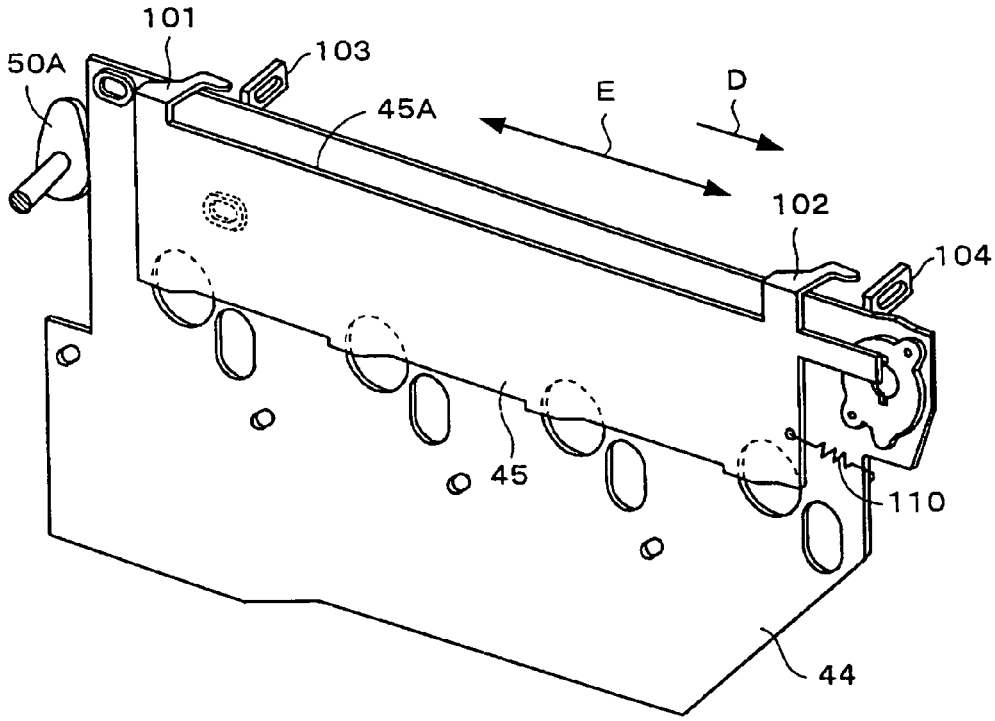
FIG. 23 is a perspective view of another example of the slidable locking structure of the front panel 41, further including an urging member 110 in addition to the configuration in FIG. 19.

FIG. 23 is a perspective view of another example of the slidable locking structure of the front panel 41, further including an urging member 110 in addition to the configuration in FIG. 19.

As illustrated in FIG. 23, the urging member 110 is installed to urge the locking claws 101 and 102 in the engagement direction D, that is, the urging member 110 urges the locking claws 101 and 102 to engage the stoppers 103 and 104.

In this example, the urging member 110 is a spring, and two ends of the spring 110 are fixed on ends of the positioning member 44 and the bias setting member 45, respectively. The spring 110 pulls the bias setting member 45 in the engagement direction D by an elastic deforming force thereof, thereby urging the locking claws 101 and 102 in the engagement direction D to engage the stoppers 103 and 104.

By installing the spring 110, the bias setting member 45 is pulled in the engagement direction D and thereby the locking claws 101 and 102 are urged to engage the stoppers 103 and 104, and as a result, the engagement condition of the locking claws 101 and 102 and the stoppers 103 and 104 becomes more stable, the front panel 41 can be firmly held at the CLOSED position, and the image forming units 8Y, 8C, 8M, 8BK, and the intermediate transfer unit 7 can be accurately fixed at the specified positions.

In addition, as illustrated in FIG. 4, because the return spring 51 is attached to the bias setting member 45 to impose a force in a direction opposite to the engagement direction D, if the force imposed by the spring 110 is stronger than the force imposed by the return spring 51, even when, at the worst, the eccentric cam 50A is damaged, the engagement condition of the locking claws 101 and 102 and the stoppers 103 and 104 can still be maintained. That is, the configuration in this example is preferable from the point of view of safety.

Figure 24:
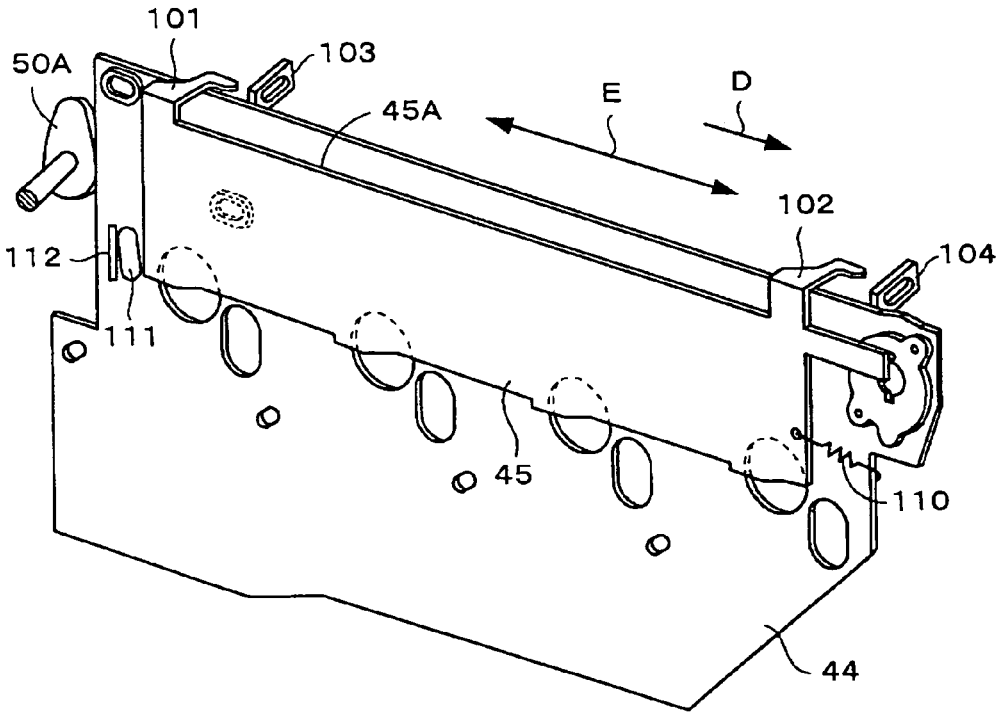
FIG. 24 is a perspective view of another example of the slidable locking structure of the front panel 41, further including an urging member 111 in addition to the configuration in FIG. 23.

FIG. 24 is a perspective view of another example of the slidable locking structure of the front panel 41, further including an urging member 111 in addition to the configuration in FIG. 23.

As illustrated in FIG. 24, on the side of the positioning member 44 opposite to the side where the spring 110 is attached, an oil bushing 111 is attached as the additional urging member. The oil bushing 111 is located between a guiding portion 112 and the end of the bias setting member 45 opposite to the side where the spring 110 is attached, and provides a fluid viscosity force on the bias setting member 45 in the engagement direction E, thereby urging the locking claws 101 and 102 to engage the stoppers 103 and 104.

By installing both the oil bush 111 and the spring 110 that urge the locking claws 101 and 102 in the engagement direction S, the engagement condition of the locking claws 101 and 102 and the stoppers 103 and 104 becomes more stable. Further, by installing two different urging members, it is possible to adjust operational feel when the locking claws 101 and 102 are disengaged from the stoppers 103 and 104.

In the configurations illustrated in FIG. 19 through FIG. 24, the bias setting member 45 is used as the slidable locking member, and the locking claws 101 and 102 are formed on the bias setting member 45. However, the slidable locking member is not limited to the bias setting member 45, and other units can be used as the slidable locking member.

Figure 25:
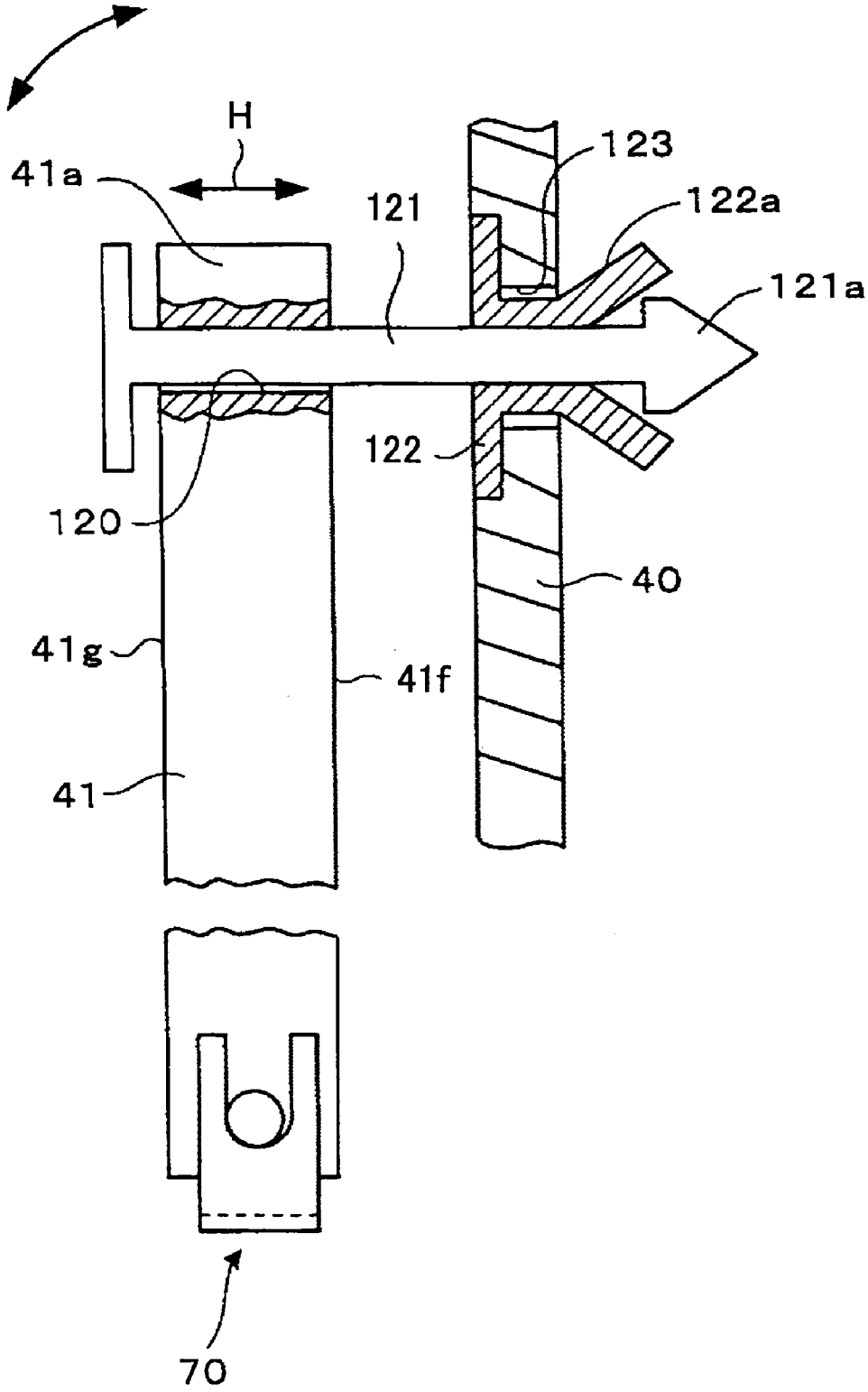
FIG. 25 is a top view of the front panel 41 and the side panel 40, showing another example of the slidable locking structure of the front panel 41, in which the sliding direction of the slidable locking member is the same as the direction in which the front panel 41 is opened or closed.

FIG. 25 is a top view of the front panel 41 and the side panel 40, showing another example of the slidable locking structure of the front panel 41, in which the sliding direction of the slidable locking member is the same as the direction in which the front panel 41 is opened or closed.

As illustrated in FIG. 25, a locking member 121, which is slidable toward the side panel 40 when the front panel 41 is at the CLOSED position, is attached to the front panel 41 on the upper edge 41*a*. The locking member 121 is like a pin; it penetrates the front panel 41 from the outer surface 41g to the inner surface 41*f* of the front panel 41 through a penetration hole 120, and it can be operated from the outer surface 41*g*. A locking bearing portion 122 is formed in the side panel 40, which is a side-wall of the main body 1, and the front end 121*a* of the locking member 121 is inserted into the locking bearing portion 122 and engaged with it. An insertion hole 123 is formed in the side panel 40 to mount the locking bearing portion 122. The locking bearing portion 122 is formed from an elastically deformable material, such as a hard rubber. One end of the locking bearing portion 122 has an enlarged diameter to restrict its movement in the insertion hole 123 in the sliding directions H.

The locking bearing portion 122 further has a restriction portion 122*a*, which preventing the front end 121*a* of the locking member 121 from escaping from the locking bearing portion 122 when the front end 121*a* of the locking member 121 is inserted into the locking bearing portion 122. The restricting portion 122*a* has a conical shape with its diameter being smaller and smaller when approaching the side panel 40.

In this example, the sliding directions H of the slidable locking member 121 are the same as the directions in which the front panel 41 is opened or closed, and the front panel 41 and the locking member 121 can be operated on the same side of the main body 1, that is, the operational directions of the front panel 41 and the locking member 121 are the same, and hence the user does not have any hesitation about the operational direction during operation, making the operation more convenient.

In addition, because the locking member 121 can be operated from the outer surface 41*g*, the locking operation of the front panel 41 is visible to the user, which urges the user to intentionally lock the front panel 41, thereby preventing the user from forgetting to lock the front panel 41. Due to the restriction portion 122*a*, whose diameter becomes smaller as it approaches the side panel 40, even when the front panel 41 is to be moved in the opening direction, the movement of the locking member 121 is restricted and therefore the locking member 121 cannot escape from the locking bearing portion 122. As a result, the front panel 41 is firmly held at the CLOSED position.

Figure 26:
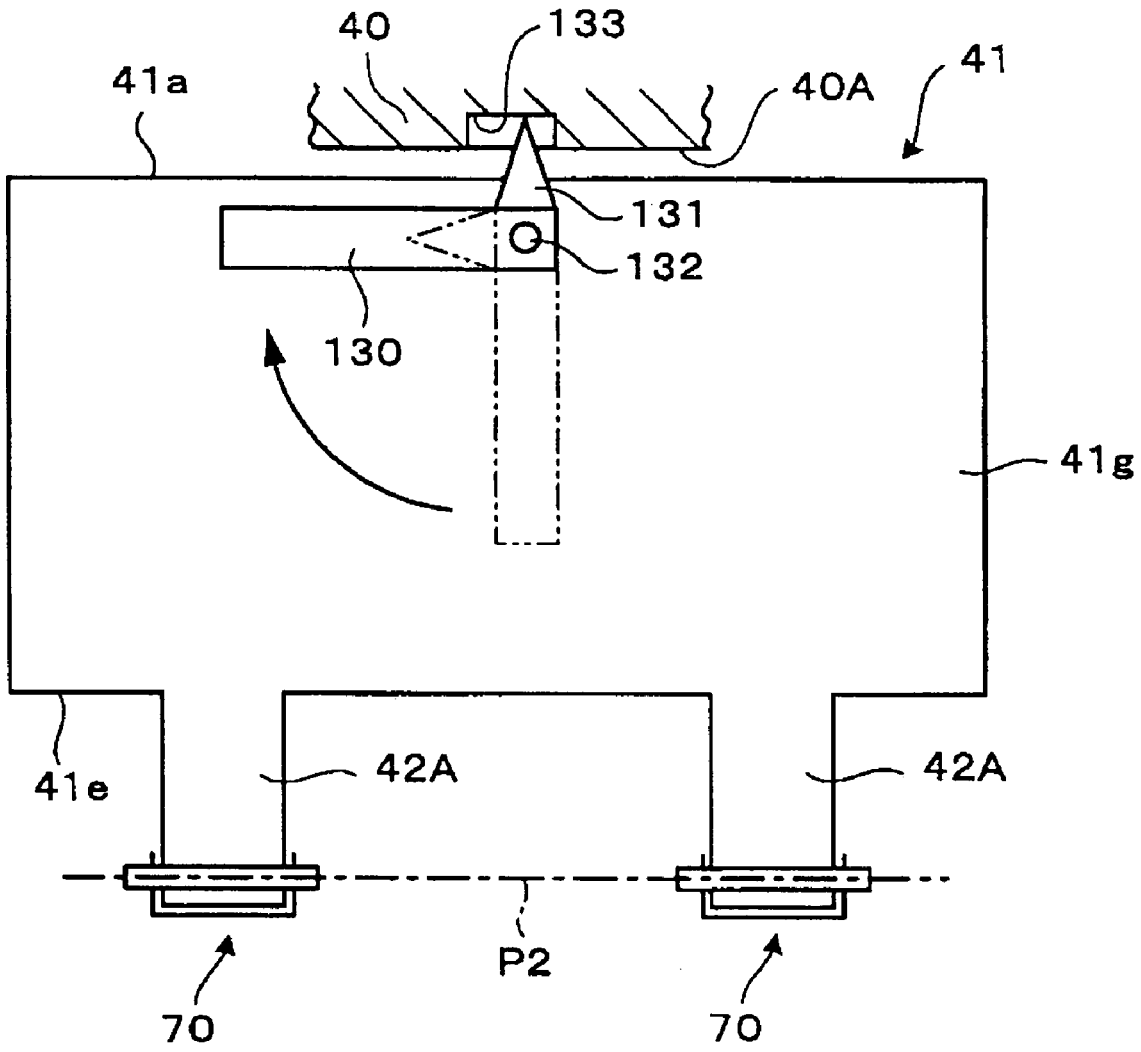
FIG. 26 is a plan view of the front panel 41 showing a locking member 130 that is rotatably attached to the front panel 41 and a locking bearing portion 133 formed in the side panel 40.

FIG. 26 is a plan view of the front panel 41 showing a locking member 130 that is rotatably attached to the front panel 41 and a locking bearing portion 133 formed in the side panel 40, which is a side wall of the main body. When the front panel 41 is at the CLOSED position, the locking member 130 is turned and engaged with the locking bearing portion 133.

The locking member 130 is connected to an axle 132, which is perpendicularly attached to the outer surface 41*g* of the front panel 41. The locking member 130 can be freely rotated relative to the axle 132 in a plane parallel to the outer surface 41*g*. A locking claw 131 is formed at the end of the locking member 130 in such a way that, for example, when the locking member 130 is rotated by 90 degrees, the locking claw 131 is engaged with the locking bearing portion 133. The locking bearing portion 133, for example, is a depressed portion, specifically, a groove. To allow the locking claw 131 to enter the locking bearing portion 133, as illustrated in FIG. 26, the portion of the locking bearing portion 133 on the left side of axle 132, from which the locking claw 131 enters, is longer than the portion on the right side of the axle 132.

Figure 27:
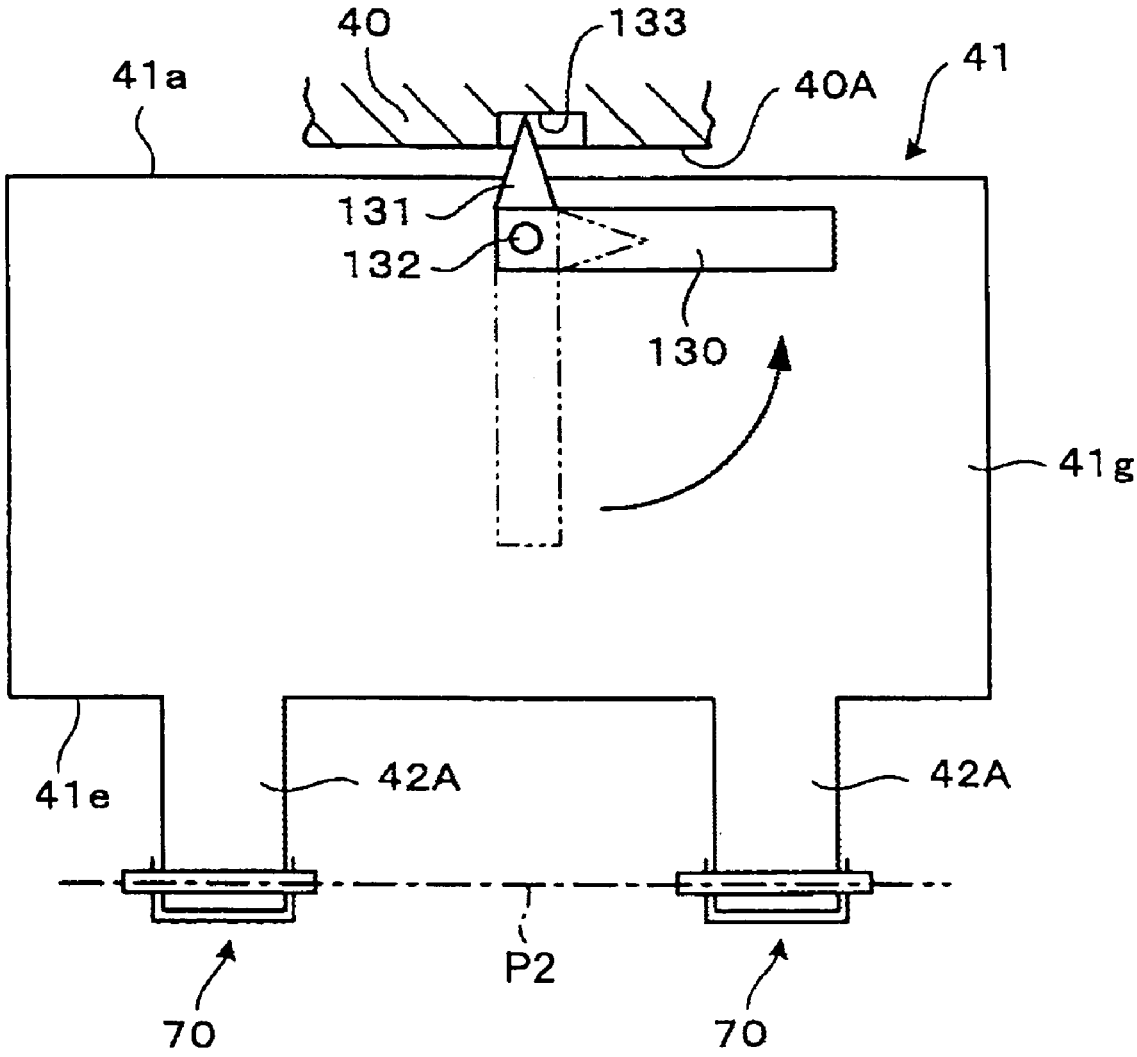
FIG. 27 is a plan view of the front panel 41 showing another example of the locking member 130.

FIG. 27 is a plan view of the front panel 41 showing another example of the locking member 130.

In FIG. 27, the locking member 130 is rotated in a direction opposite to that in FIG. 26. Accordingly, the portion of the locking bearing portion 133 on the right side of axle 132, from which the locking claw 131 enters, is longer than the portion on the left side of the axle 132.

In the configuration shown in FIG. 26, when the front panel 41 is at the CLOSED position, if the locking member 130 is rotated clockwise from a release position indicated by dashed lines to a locking position indicated by solid lines, the locking claw 131 is engaged with the locking bearing portion 133, and thus the front panel 41 is locked at the CLOSED position.

In the configuration shown in FIG. 27, when the front panel 41 is at the CLOSED position, if the locking member 130 is rotated counter-clockwise from a release position indicated by dashed lines to a locking position indicated by solid lines, the locking claw 131 is engaged with the locking bearing portion 133, and thus the front panel 41 is locked at the CLOSED position.

In this way, the front panel 41 is firmly held at the CLOSED position, and the image forming units 8Y, 8C, 8M, 8BK, and the intermediate transfer unit 7 can be accurately fixed at the specified positions. In addition, because the locking member 130 can be rotated in a plane parallel to the outer surface 41*g*, the locking operation of the front panel 41 is visible to the user, and this makes the operation convenient and urges the user to intentionally lock the front panel 41, thereby preventing the user from forgetting locking the front panel 41.

In an image forming apparatus having a locking member 130 rotatably attached to the front panel 41 and a locking bearing portion 133 formed in the side panel 40, wherein the locking member 130 is engaged with the locking bearing portion 133 by turning the locking member 130 by a predetermined angle when the front panel 41 is at the CLOSED position, because the locking member 130 does not engage with the locking bearing portion 133 if the locking member 130 is not rotated by the predetermined angle when the front panel 41 is at the CLOSED position, insufficient engagement can hardly occur between the locking member 130 and the locking bearing portion 133, which may be caused by an insufficient rotation angle of the locking member 130.

The predetermined rotation angle of the locking member 130, by which the locking claw 131 is engaged with the locking bearing portion 133, is not limited to 90 degrees; it can be appropriately selected by considering the positional relation between units mounted on the front panel 41.

Figure 28:
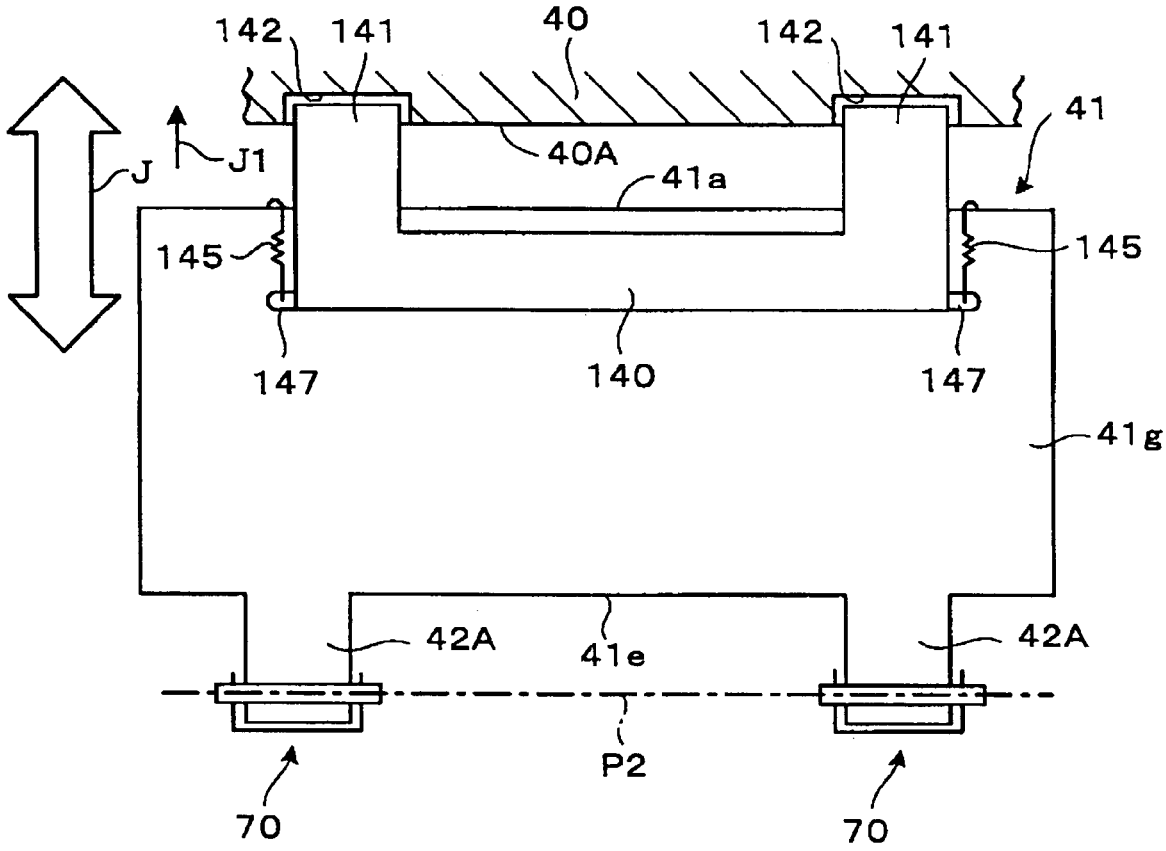
FIG. 28 is a plan view of the front panel 41 showing a locking member 140 movably attached to the front panel 41, wherein with the front panel 41 at the CLOSED position, the locking member 140 is moveable in the vertical direction when viewed from the opened portion 40A.

FIG. 28 is a plan view of the front panel 41 showing a locking member 140 movably attached to the front panel 41, wherein with the front panel 41 at the CLOSED position, the locking member 140 is moveable in the vertical direction when viewed from the opened portion 40A.

The locking member 140 can be moved freely in a plane parallel to the outer surface 41*g* of the front panel 41 in directions indicated by arrows J in FIG. 28. Two locking claws 141 which project upward are formed at respective ends of the upper edge of the locking member 140.

At positions on the side panel 40 corresponding to the locking claws 141, recessed portions 142 acting as locking bearing portions are formed. Two straining springs 145 acting as urging members are attached to the locking member 140 to urge the locking member 140 to move in the engagement direction J1 so that the locking claws 141 are engaged with the locking bearing portions 142. One end of each of the straining springs 145 is connected to a spring hooker 147 at an end of the locking member 140, and another end of each of the straining springs 145 is hooked at the upper edge 41*a* of the front panel 41.

In FIG. 28, when the locking member 140 is pushed down, that is, in the direction opposite to the engagement direction J1, the locking claws 141 and the locking bearing portions 142 are disengaged, and the front panel 41 is released from the locked state.

If the front panel 41 is lifted up from the OPENED position to the CLOSED position and the locking member 140 is pushed once, after the push, the locking member 140 moves in the engagement direction J1, the locking claw 141 are engaged with the locking bearing portion 142, thereby the front panel 41 is held at the CLOSED position. As a result, the image forming units 8Y, 8C, 8M, 8BK, and the intermediate transfer unit 7 can be accurately fixed at the specified positions. In addition, because the locking member 140 is visible to the user from the opened portion 40A, the operation is convenient.

Figure 29:
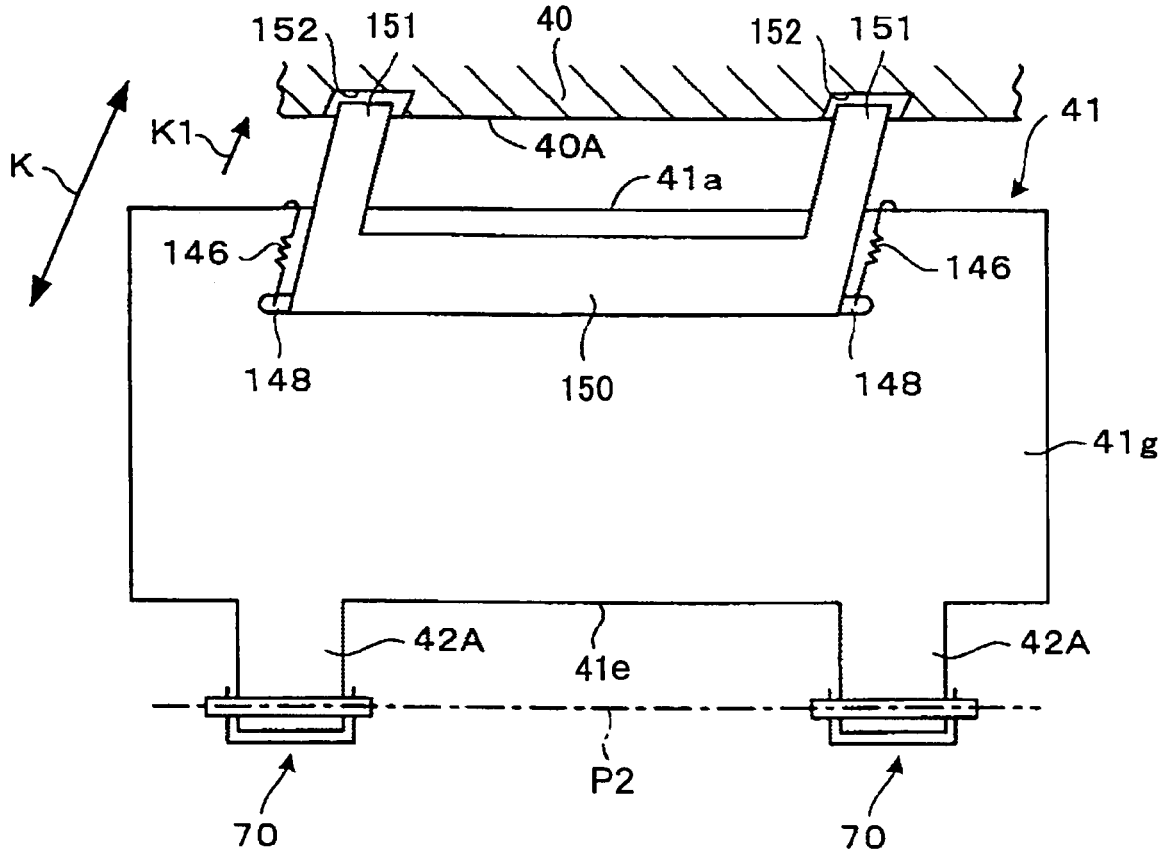
FIG. 29 is a plan view of the front panel 41 showing a locking member 150 movably attached to the front panel 41, wherein with the front panel 41 at the CLOSED position, the locking member 150 is moveable in an inclined direction when viewed from the opened portion 40A.

FIG. 29 is a plan view of the front panel 41 showing a locking member 150 movably attached to the front panel 41, wherein with the front panel 41 at the CLOSED position, the locking member 150 is moveable in an inclined direction when viewed from the opened portion 40A.

The locking member 150 can be moved freely in a plane parallel to the outer surface 41*g* of the front panel 41 in directions indicated by arrows K in FIG. 29. Two locking claws 151 which project upward are formed at respective ends of the upper edge of the locking member 150.

At positions on the side panel 40 corresponding to the locking claws 151, recessed portions 152 acting as locking bearing portions are formed. Two straining springs 146 acting as urging members are attached to the locking member 150 to urge the locking member 150 to move in the engagement direction K1 so that the locking claws 151 engages the locking bearing portions 152. One end of each of the straining springs 146 is connected to a spring hooker 148 at an end of the locking member 150, and another end of each of the straining springs 146 is hooked at the upper edge 41*a* of the front panel 41.

In FIG. 29, when the locking member 150 is pushed in a direction opposite to the engagement direction K1, the locking claws 151 and the locking bearing portions 152 are disengaged, and the front panel 41 is released from the locked state.

If the front panel 41 is lifted up from the OPENED position to the CLOSED position and the locking member 150 is pushed once, after the push, the locking member 150 moves in the engagement direction K1, the locking claws 151 engage the locking bearing portion 152, and thereby the front panel 51 is held at the CLOSED position. As a result, the image forming units BY, 8C, 8M, 8BK, and the intermediate transfer unit 7 can be accurately fixed at the specified positions. In addition, because the locking member 150 is visible to the user from the opened portion 40A, the operation is convenient.

In the locking structures illustrated in FIG. 19 through FIG. 29, each of which includes a locking member slidable relative to the front panel 41, any one of the supporting structures disclosed in FIG. 9 through FIG. 18 may be used to support the front panel 41. The supporting positions in these supporting structures may be arranged at the lower edge 41*e* of the front panel 41, which is symmetric to the engagement positions of the locking members and the locking bearing portions, specifically, at positions corresponding to the region between the engagement positions, or beyond the engagement positions. By arranging the supporting portions in connection with the positions of the engagement positions, it is possible to prevent interference between the supporting portions and the engagement positions, and to appropriately select the positions of the supporting portions according to the engagement positions.

Certainly, the rotational axis P2 of the supporting portions of the front panel 41 may be arranged to be roughly parallel to the central line P1 of the photo conducting drums 10 of the image forming units 8Y, 8C, 8M, 8BK, and thereby, it is easy for the user to quickly obtain a feel for the position of the image forming units 8Y, 8C, 8M, 8BK, when opening or closing the front panel 41, and this makes the operation of exchanging these units smooth.

In addition, by considering the weight and size of the front panel 41, and the positional relation with the main body 1, one or more supporting portions may be provided.

Figure 30:
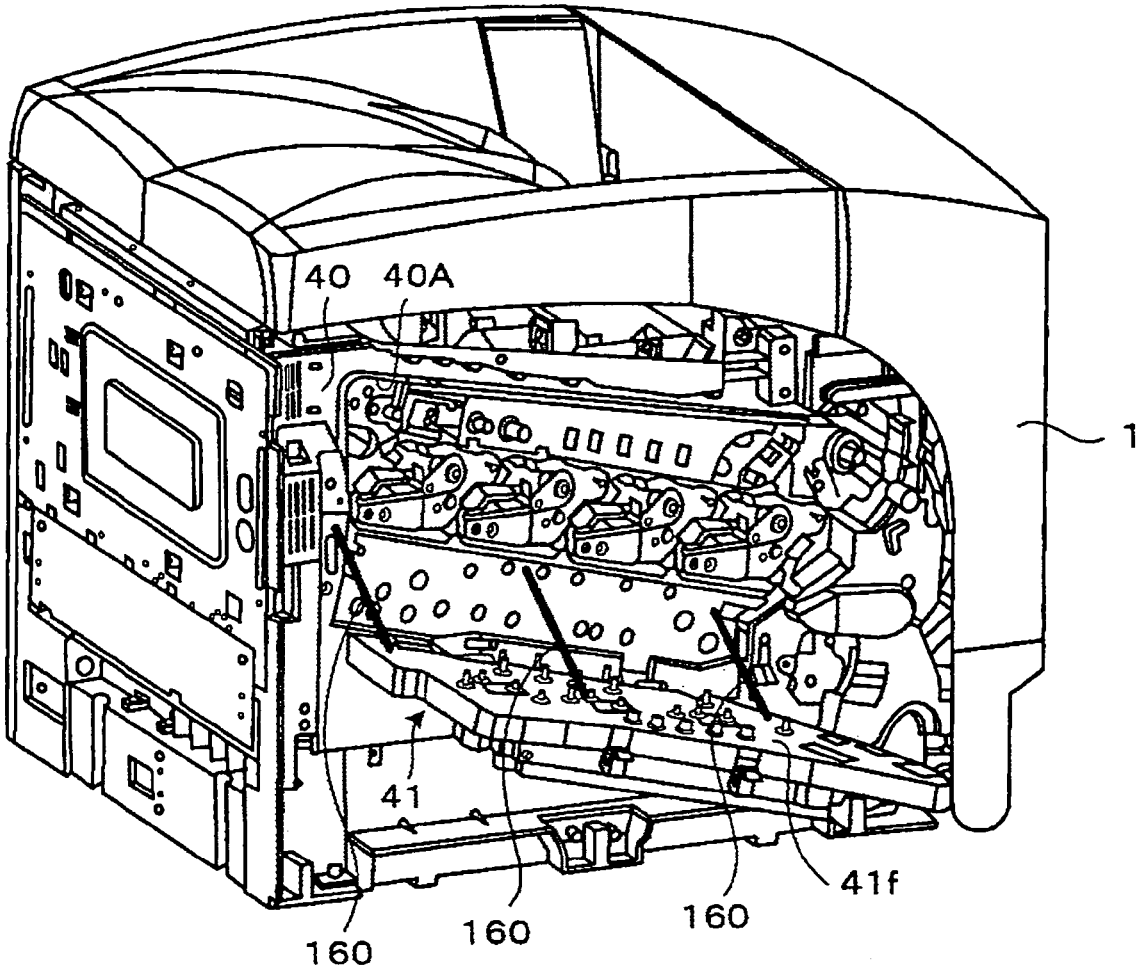
FIG. 30 is a perspective view of an image forming apparatus including belts 160 connected to the front panel 41 and the main body 1.

FIG. 30 is a perspective view of an image forming apparatus including belts 160 connected to the front panel 41 and the main body 1.

In FIG. 30, one end of each of the belts 160 is connected to the lower edge of the inner surface 41*f* of the front panel 41, and the other end of each of the belts 160 is connected to the portion of the side panel 40 below the opened portion 40A. Because of the belts 160, when the front panel 41 is turned down to the OPENED position, the opening angle of turning the front panel down is restricted by the belts 160, and it is possible to avoid collision between the front panel 41 and the main body 1 caused by over-opening of the front panel 41, and to avoid damage to the front panel 41 and the main body 1.

Preferably, the belts 160 are arranged at appropriate positions by considering the weight and size of the front panel 41. For example, the belts 160 may be arranged at edges or the center portion of the front panel 41.

Figure 31:
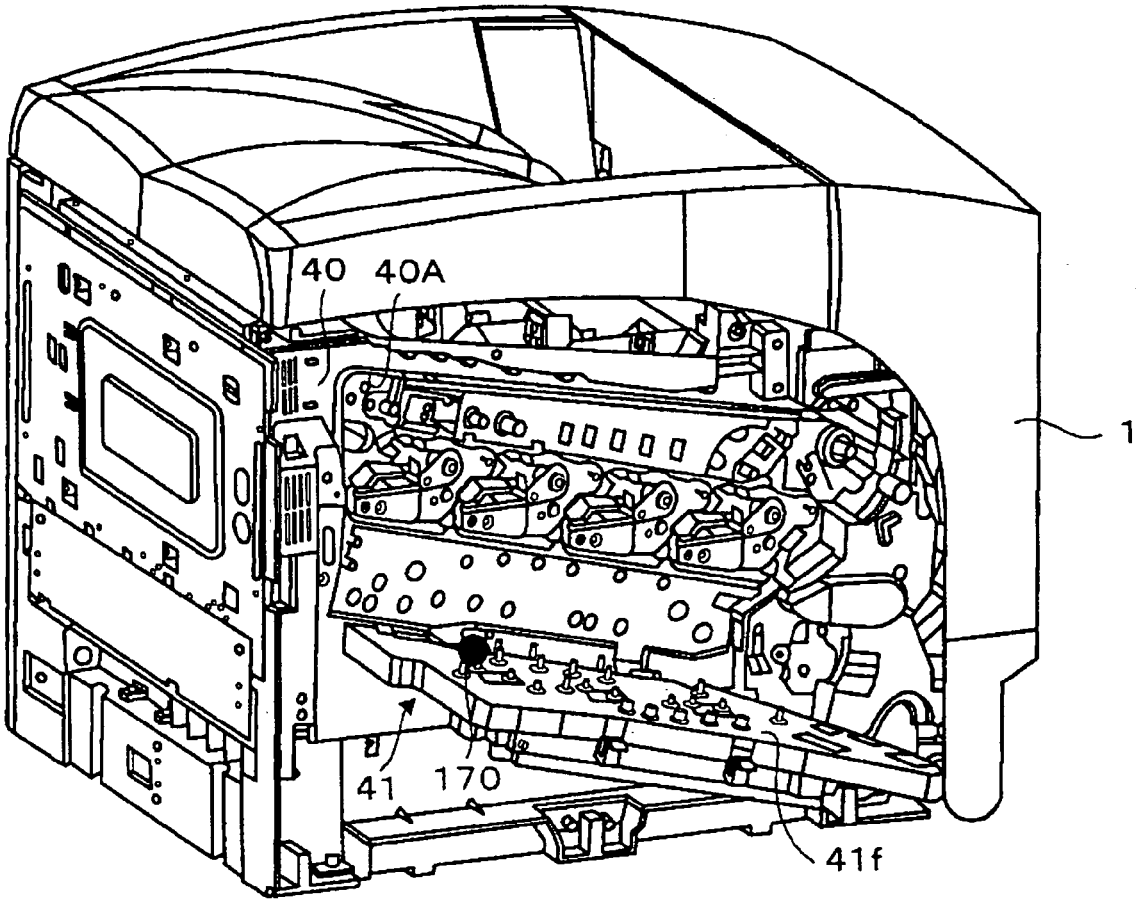
FIG. 31 is a perspective view of an image forming apparatus including a damper 170 located between the front panel 41 and the main body 1 to reduce the speed of the front panel 41 when it is opened.

FIG. 31 is a perspective view of an image forming apparatus including a damper 170 located between the front panel 41 and the main body 1 to reduce the speed of the front panel 41 when it is opened.

In FIG. 31, the damper 170 is placed between the lower edge of the inner surface 41*f* of the front panel 41 and the portion of the side panel 40 below the opened portion 40A. Because of the damper 170, when the front panel 41 is turned down to the OPENED position, the speed of turning the front panel 41 down is lowered by the damper 170, and the front panel 41 moves at a moderate speed. Therefore, when opening the front panel 41, even if the front panel 41 hits the user accidentally, the shock is weak, that is, the operation is safe.

Figure 32:
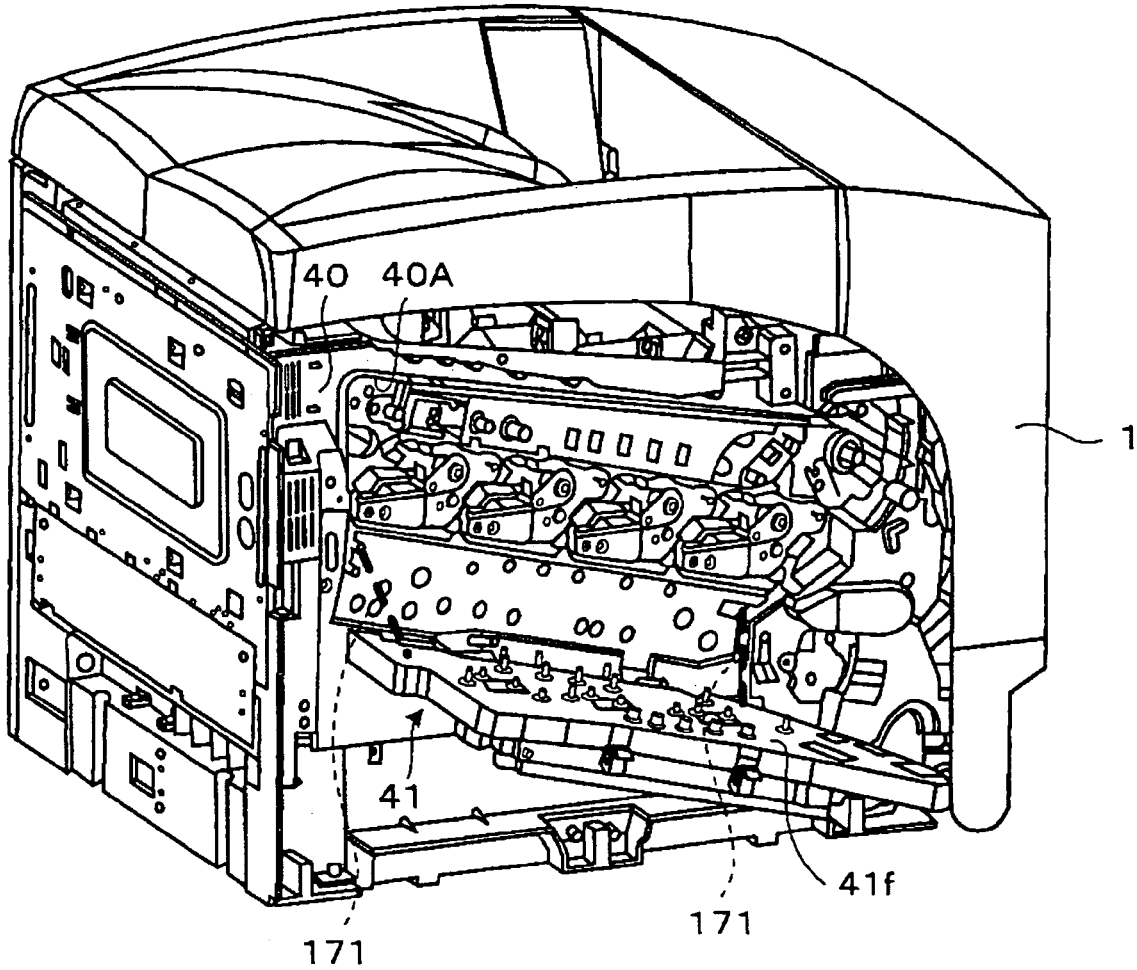
FIG. 32 is a perspective view of an image forming apparatus including springs 171 located between the front panel 41 and the main body 1 to reduce the speed of the front panel 41 when it is opened.

FIG. 32 is a perspective view of an image forming apparatus including springs 171 located between the front panel 41 and the main body 1 to reduce the speed of the front panel 41 when it is opened.

In FIG. 32, one end of each of the springs 171 is connected to the lower edge of the inner surface 41*f* of the front panel 41, and the other end of each of the springs 160 is connected to the portion of the side panel 40 below the opened portion 40A. Because of the springs 171, when the front panel 41 is turned down to the OPENED position, the speed of turning the front panel 41 down is lowered by the springs 171, and the front panel 41 moves at a moderate speed. Therefore, when opening the front panel 41, even if the front panel 41 hits the user accidentally, the shock is weak, that is, the operation is safe.

In addition, by making the elastic force of the springs 171 sufficiently strong, when the front panel 41 is turned down to the OPENED position, the opening angle of turning the front panel down is restricted by the strings 171, and this avoids collision between the front panel 41 and the main body 1 occurring when the front panel 41 is opened too much.

Effect of the present embodiment is summarized below.

By the locking structures, the supporting structures, the urging members, and other components of the present embodiment, the front panel 41 is reliably fixed at the CLOSED position by using-the handle 47, and the devices installed inside the main body 1 can be accurately held at specified positions.

Because the projecting engagement member 50B1 holds the handle 47 at the CLOSED position, it is possible to prevent the handle 47 from being carelessly opened.

Because the supporting center with which the front panel 41 is turned down is lower than the opened portion 40A, after the front panel 41 is turned down, the opened portion 40A can be viewed directly downward from the outside, and this makes it easy to confirm positions when exchanging or installing any of the image forming units 8Y, 8C, 8M, 8BK, and the intermediate transfer unit 7. In addition, after the front panel 41 is turned down, that is, after the front panel 41 is opened, there is no way for the front panel 41 to be closed carelessly, preventing one's finger from being jammed by the front panel 41.

At the CLOSED position, the springy members 48 are engaged to the side panel 40, and this maintains the CLOSED state of the front panel 41. In addition, at the CLOSED position, the handle 47 is held by the engagement member 50B1 of the rotational handle 50B, thereby preventing the handle 47 from being opened carelessly.

Due to the above locking structures of the present embodiment, the front panel 41 is reliably held at the CLOSED position, and the component units of the image forming apparatus installed in the main body 1 are held at the desired positions accurately.

In addition, when the locking positions are symmetrically arranged relative to the center of the upper edge 41*a* of the front panel 41 above the image forming units 8Y, 8C, 8M, 8BK and the intermediate transfer unit 7, the locking structure 60 does not interfere with attachment of the image forming units 8Y, 8C, 8M, 8BK and the intermediate transfer unit 7 to the main body 1, and the front panel 41 can be reliably held at the CLOSED position by the locking structure 60.

When the locking positions are symmetrically arranged with respect to the perpendicular P through the gravity center G of the front panel 41, the balance of the locking positions is maintained, the locking state of the front panel 41 at the CLOSED position is stable, and the image forming units 8Y, 8C, 8M, 8BK, and the intermediate transfer unit 7 are held at the desired positions accurately.

When the locking positions are arranged between positions corresponding to axles 4*a* and 6*a* that support rollers 4 and 6 in the intermediate transfer unit 7, the positions of the axles 4*a* and 6*a* of the rollers 4 and 6 held by the front panel 41 and the locking positions do not interfere with each other, so that the front panel 41 can be reliably fixed at the CLOSED position by the locking structure 60.

When the positions of the locking positions are selected so that the axles 4*a* and 6*a*, the image forming units 8Y, 8C, 8M, 8BK, and the intermediate transfer unit 7 are totally covered by the front panel 41 when the front panel 41 is at the CLOSED position, the front panel 41 can be surely brought to face the axles 4*a* and 6*a*, the image forming units 8Y, 8C, 8M, 8BK, and the intermediate transfer unit 7, and reliably held at the CLOSED position. Consequently, the image forming units 8Y, 8C, 8M, 8BK, and the intermediate transfer unit 7 can be accurately fixed at specified positions.

By the supporting structures of the present embodiment, the front panel 41 can be rotated relative to the lower edge 41*e* through a wide range, thereby it is easy to exchange the image forming units 8Y, 8C, 8M, 8BK and the intermediate transfer unit 7.

By arranging the supporting portions 70 in connection with the locking positions, it is possible to prevent interference between the locking positions. and the supporting portions 70.

By arranging the rotational axis P2 of the front panel 41 to be roughly parallel to the central line P1 of the photo conducting drums 10 of the image forming units 8Y, 8C, 8M, 8BK, when opening or closing the front panel 41, the user can easily and quickly obtain a feel for the position of the image forming units 8Y, 8C, 8M, 8BK, and this makes the operation of exchanging these units smooth.

When using the supporting portion 71, the front panel 41 is simply hitched to the main body 1, and this makes assembly operation unnecessary, and makes the installing structure simple.

By providing the clearance between the axle 46 and the bearing 65, the engagement between the axle 46 and the bearing 65 and between the front panel 41 and the bearings 43 of the photo conductors 10 are not so tight, and this makes operation of the front panel 41 easy.

By installing urging members, the locked state is more stable. When using different kinds of urging members, it is possible to adjust the operational feel.

By making the bias setting member 45 slidable, the locking claws 101 and 102 can be engaged with the stoppers 103 and 104 by sliding the bias setting member 45 in the engagement direction D1; thereby, the front panel 41 can be fixed at the CLOSED position reliably, and the image forming units 8Y, 8C, 8M, 8BK, and the intermediate transfer unit 7 can be accurately held at specified positions.

Because the movement of the locking claws 101 and 102 in the sliding directions E can be observed from the side of the opened portion 40A, it makes operations on the front panel 41 more convenient, and urges the user to intentionally lock the front panel 41, thereby preventing the user from forgetting to lock the front panel 41.

By installing the spring 110, the engagement condition of the locking claws 101 and 102 and the stoppers 103 and 104 becomes more stable, the front panel 41 can be firmly held at the CLOSED position, and the image forming units 8Y, 8C, 8M, 8BK, and the intermediate transfer unit 7 can be accurately fixed at the specified positions.

By arranging the sliding directions H of the slidable locking member 121 the same as the directions of opening or closing the front panel 41, and because the front panel 41 and the locking member 121 can be operated on the same side of the main body 1, the user does not have any hesitation about the operational direction during operation, making the operation more convenient. The locking operation of the front panel 41 is visible to the user, which urges the user to intentionally lock the front panel 41, thereby preventing the user from forgetting to lock the front panel 41. Due to the restriction portion 122*a*, the movement of the locking member 121 is restricted and therefore the locking member 121 cannot escape from the locking bearing portion 122. As a result, the front panel 41 is firmly held at the CLOSED position.

By providing locking member 130 rotatable in a plane parallel to the outer surface 41*g* of the front panel 41, the front panel 41 can be firmly held at the CLOSED position, and the image forming units 8Y, 8C, 8M, 8BK, and the intermediate transfer unit 7 can be accurately fixed at the specified positions. In addition, because the locking operation of the front panel 41 is visible to the user, the operation becomes more convenient and the user is urged to intentionally lock the front panel 41, thereby preventing the user from forgetting to lock the front panel 41.

Because the locking member 130 can be engaged with the locking bearing portion 133 only by rotating the locking member 130 by a predetermined angle when the front panel 41 is at the CLOSED position, in other words, the locking member 130 does not engage with the locking bearing portion 133 if the locking member 130 is not rotated by the predetermined angle, insufficient engagement can hardly occur between the locking member 130 and the locking bearing portion 133.

By providing the belts 160, it is possible to avoid collision between the front panel 41 and the main body 1 caused by over-opening the front panel 41, and to avoid damage to the front panel 41 and the main body 1.

By providing the damper 170 or the springs 171, the speed of turning the front panel 41 down is lowered by the damper 170 when the front panel 41 is turned down to the OPENED position, therefore, the front panel 41 cannot hit the user accidentally, which makes the operation safer.

In addition, in the present embodiment, when the members of the locking structures and supporting structures are formed from single synthesized resins, these members can be fabricated easily, and it is possible to reduce weight of them and improve the engagement condition and reduce the noise in disengagement. When using single metals, it is possible to increase the strength of the members and improve durability against disengagement. When using single ceramics, the members can be fabricated easily, it is possible to reduce the weight and increase the strength of them, and reduce the noise in disengagement. When the members are formed from a combination of a metal and a synthesized resin, it is possible to reduce their weight, improve durability and reduce noise in disengagement.

Second Embodiment

In the present embodiment, it is assumed that the image forming apparatus is a color printer having a tandem engine configuration and capable of full-color printing.

Figure 33:
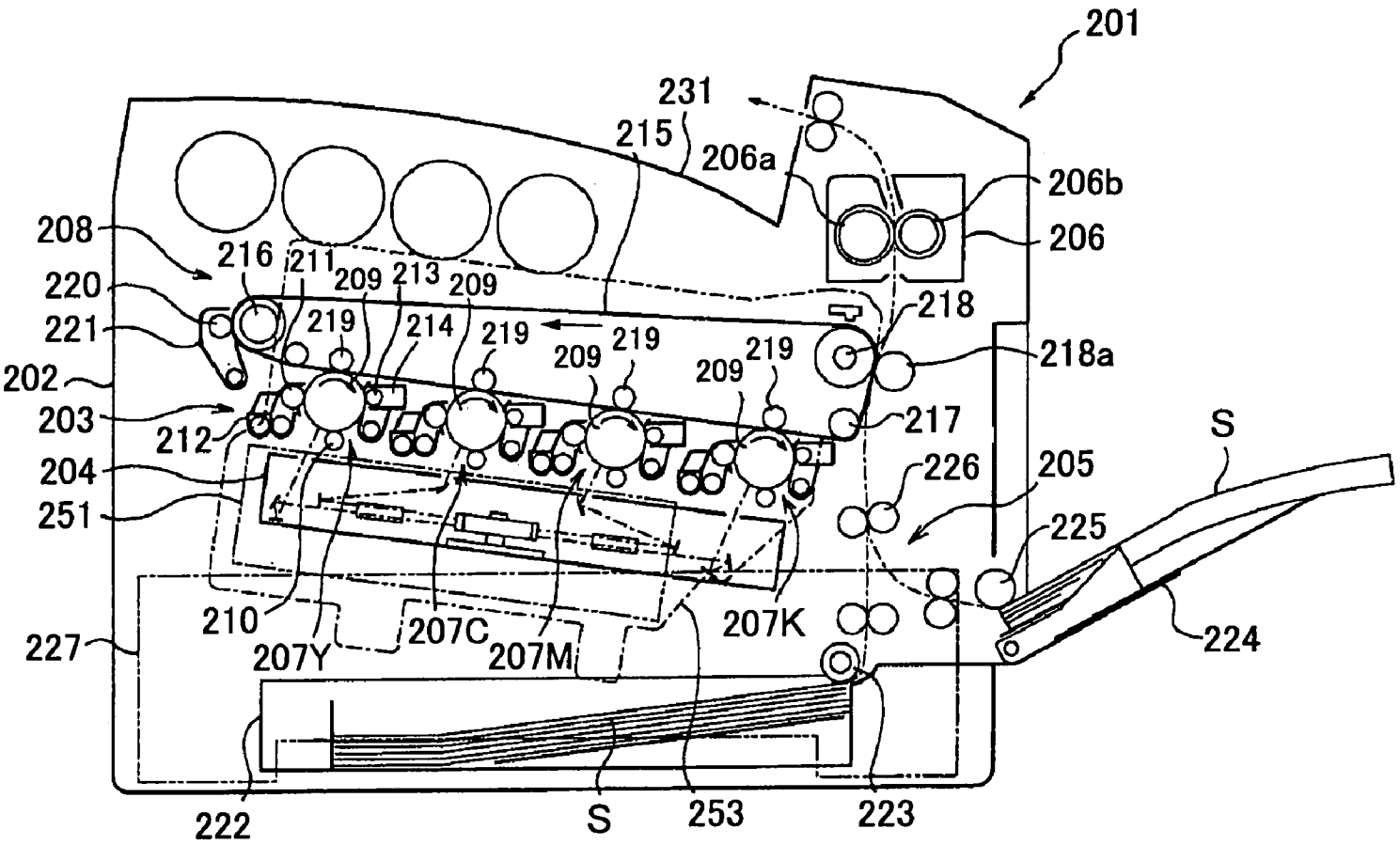
FIG. 33 is a front view showing a schematic inner configuration of a color printer 201 according to a second embodiment.

FIG. 33 is a front view showing a schematic inner configuration of a color printer 201 according to the present embodiment.

The color printer 201 in FIG. 33 includes a main body 202, an imaging forming section 203, an optical writing section 204, a feeding section 205, and a fusing section 206.

The imaging forming section 203 includes four image forming units 207Y, 207C, 207M, 207K, and an intermediate transfer unit 208 and a secondary transfer roller 220 are arranged above the imaging forming section 203. The secondary transfer roller 220 is supplied with electric power. Below, such members are referred to as component members of the image forming apparatus.

The image forming units 207Y, 207C, 207M, 207K have the same structure, but toners (developing agents) held in the developing devices have different colors, specifically, colors of the toners for the image forming units 207Y, 207C, 207M, 207K are yellow, cyan, magenta, and black, respectively.

Each of the four image forming units 207Y, 207C, 207M, 207K includes a photo conductor 209 driven to rotate in the direction indicated by the arrows. Near each photo conductor 209, there are arranged a charging roller 210, a developing roller 211, and a cleaning device 214 including a cleaning roller 213. The four image forming units 207Y, 207C, 207M, 207K are arranged in parallel to each other at equal intervals. Each photo conductor 209 is formed by applying an organic semiconductor layer, which is a photoconductive material, on an aluminum cylinder having a diameter of 30 mm through 100 mm. It is certain that a photo conductive belt can also be used instead of this photo conductive drum 209.

The intermediate transfer unit 208 has an intermediate transfer belt 215, rollers 216, 217 and 218, four first transfer rollers 219, and a belt cleaning device 221 including a cleaning roller 220.

The intermediate transfer belt 215 has a resin film or rubber as a substrate, and the thickness of the substrate is about 50 micron through 600 micron, and has a resistance appropriate for transferring toner images from the photo conductor 209.

The optical writing section 204 is below the image forming units 207Y, 207C, 207M, 207K, emits laser beams modulated according to image data of each color onto the corresponding uniformly charged photo conductors 209 to form yellow, cyan, magenta, and black toner images thereon. Between the charging rollers 210 and the developing device 212, a long and narrow slit are arranged, through which the laser beams from the optical writing section 204 pass through.

Here, a laser scanning light source including a laser and a polygonal mirror can be used for the optical writing section 204; alternatively, a combination of an LED array and a focusing unit can also be used.

The feeding section 205 includes a feeding roller 223 that feeds paper or other recording sheets S from a paper cassette 222 in the main body 202, a feeding roller 225 that feeds the recording sheets S from a manual tray 224 attached to the side of the main body 202, and a resist roller 226.

The fusing section 206 includes a fusing roller 206*a* and a pressing roller 206*b*, and when the recording sheet S having the toner images thereon passes through the fusing section 206, the recording sheet S is heated and a pressure is imposed, and thereby the toner image on the recording sheet S is fused and fixed thereon.

Bottles 227 are arranged in a plate in the peripheral portion of the main body 202 to recycle used toners, which are cleaned by the cleaning devices 214 and 221. The toner-recycling bottles 227 are detachably attached so that they can be exchanged when the bottles 227 are fully filled.

An opened portion 202*a* is formed on the front side of the main body 202, and when viewed from the opened portion 202*a*, a driving unit 228 (FIG. 2) including motors, gears and others is arranged at a deep inner side of the main body 202. The image forming units 207Y, 207C, 207M, 207K and the intermediate transfer unit 208 are detachably attached to the inner side of the main body 202 through the opened portion 202*a*, thereby, connection couplings 229 (FIG. 2) on axles of the rollers 216 and photo conductors 209 are connected with connection couplings 230 on the driving unit 228, enabling the driving unit 228 to drive the photo conductor 209 and the rollers 216.

Next, a description is made of the operation of the color printer 201.

The photo conductors 209 are driven to rotate by the driving unit 228, and the surfaces of the photo conductors 209 are uniformly charged by the charging rollers 220. The optical writing section 204 emits modulated laser beams onto the charged surfaces of the photo conductors 209, and latent images are formed on these surfaces. When the thus formed latent images pass by the developing devices 212, the latent images are converted into visible toner images by toners in the developing devices 212. The first transfer roller 219 transfers the toner images subsequently onto the intermediate transfer belt 215, which is moving in synchronization with the photo conductors 209, and the toner images of different colors are superposed on the intermediate transfer belt 215. As a result, a full color image is formed on the surface of the intermediate transfer belt 215.

After transfer of the toner images, the cleaning devices 213 remove the residual toners on the surfaces of the photo conductors 209, and a not-illustrated discharging device discharges the surfaces of the photo conductors 209 to initialize the surface potential for formation of the next image.

On the other hand, a recording sheet is fed from the paper cassette 222 or from the manual tray 224, the resist rollers 226 adjust the timing of feeding the recording sheet, the recording sheet S is conveyed to the position for image transfer, and the secondary transfer roller 20 transfers the toner image on the surface of the intermediate transfer belt 215 onto the sheet at one time. The recording sheet with the toner image is conveyed to the fusing section unit 226, is heated and pressed there, and then the toner image is fused and fixed on the recording sheet9.

The recording sheet with the fused and fixed toner image is further conveyed to a delivery unit 231 on the top of the main body 202.

Below, the present embodiment is described in detail.

Figure 34:
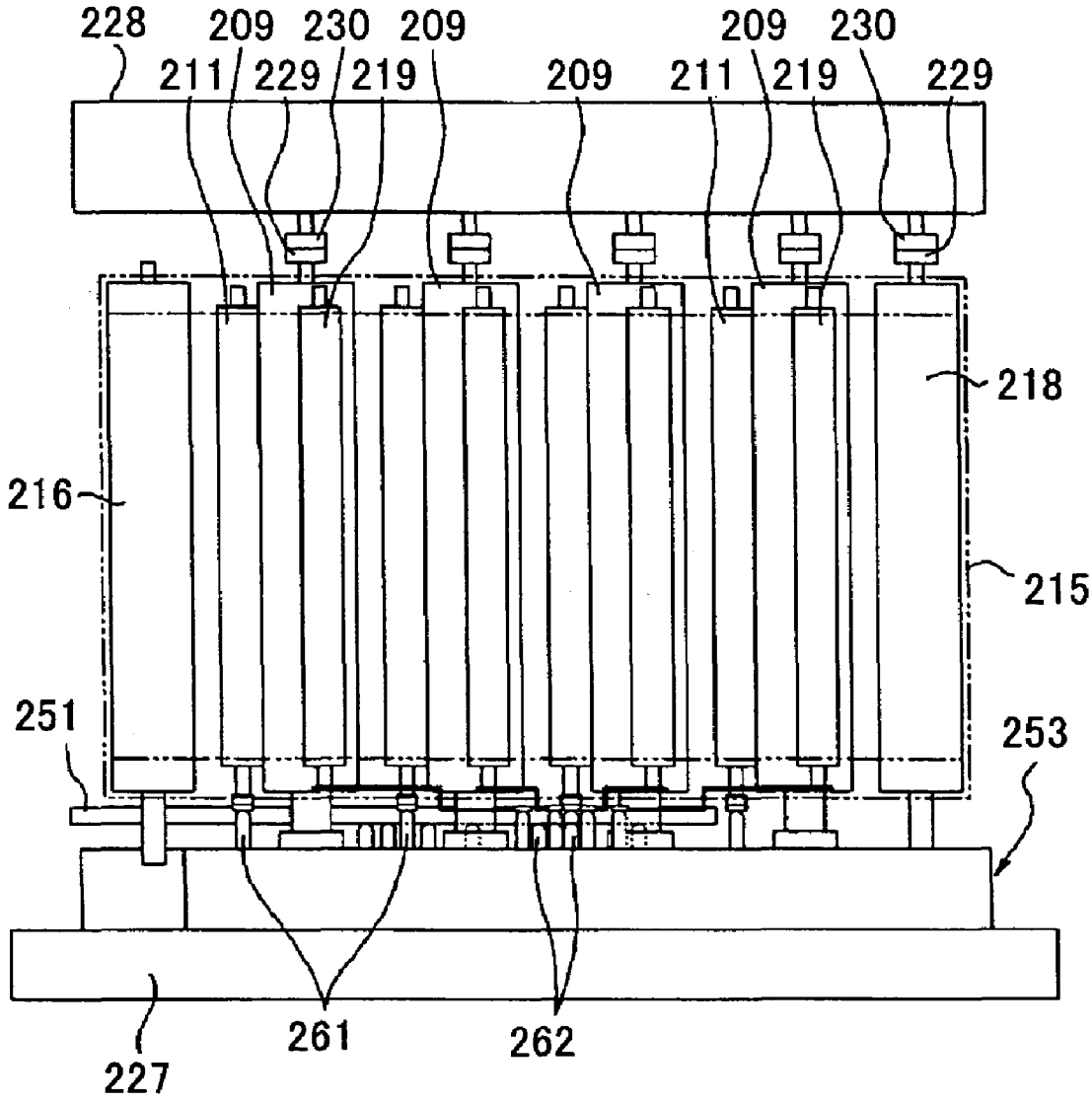
FIG. 34 is a plan view showing the schematic inner configuration of the color printer 201.

FIG. 34 is a plan view showing the schematic inner configuration of the color printer 201.

Figure 35:
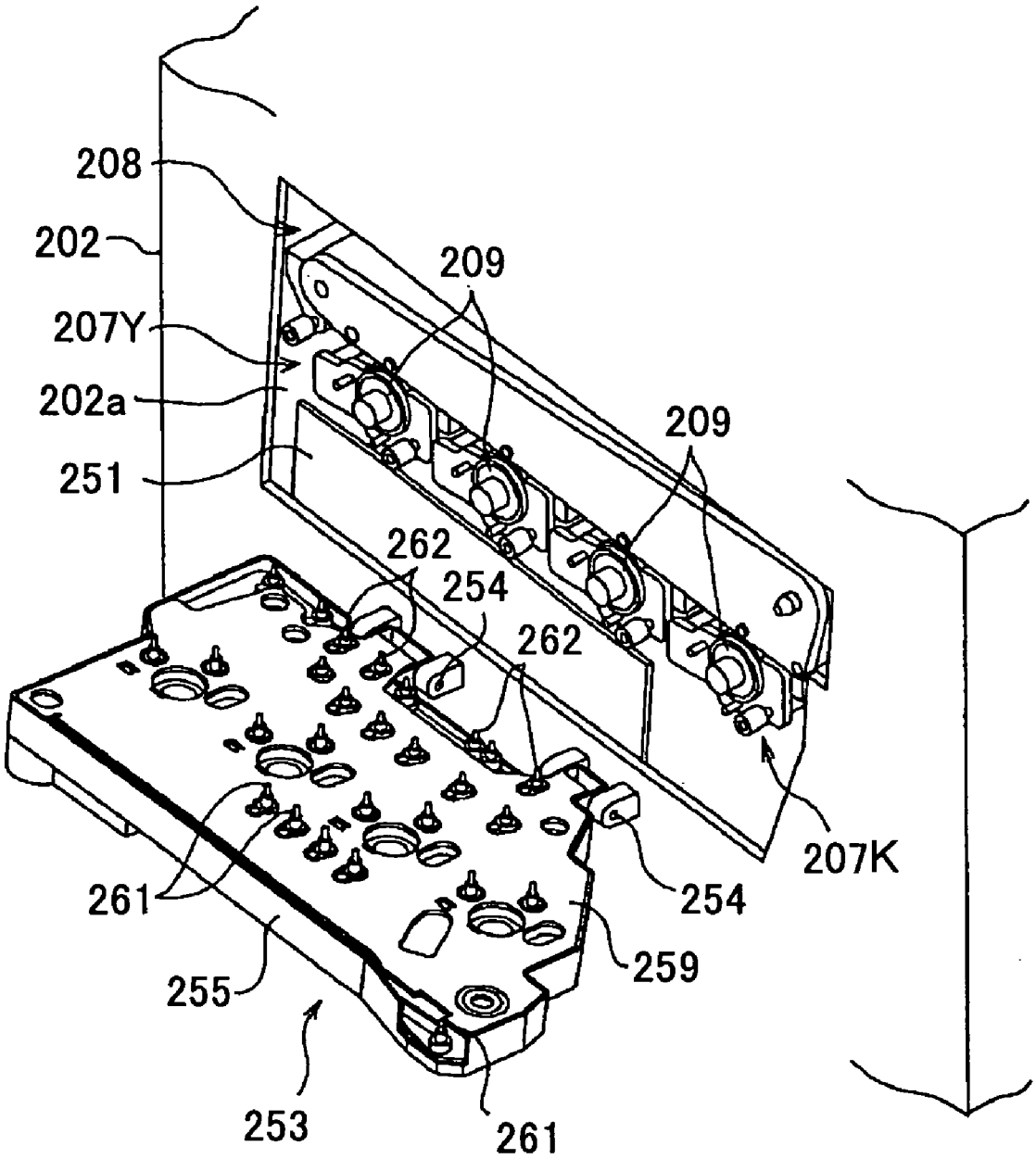
FIG. 35 is a perspective view of a portion of the color printer 201 showing a structure for feeding electric power according to the second embodiment.

FIG. 35 is a perspective view of a portion of the color printer 201 showing a structure for feeding electric power according to the first embodiment.

As described above, the opened portion 202*a* is formed on the front side of the main body 202, and the image forming units 207Y, 207C, 207M, 207K and the intermediate transfer unit 208 are detachably attached to the inner side of the main body 202 through the opened portion 202*a*, and thereby connection couplings 229 on axles of the rollers 216 and photo conductors 209 are connected with connection couplings 230 on the driving unit 228, enabling the driving unit 228 to drive the photo conductors 209 and the rollers 216.

In the main body 202 and near the opened portion 202*a*, a high voltage supply 251 is installed, and the high voltage supply 251 has many connection terminals.

A power feeding panel 253 is attached to the front side of the main body 202 in such a way that the power feeding panel 253 can be rotated from a CLOSED position to an OPENED position or vice versa. Here, when the power feeding panel 253 is at the CLOSED position, it covers the opened portion 202*a*, and when the power feeding panel 253 is at the OPENED position, it exposes the opened portion 202*a*.

Figure 36:
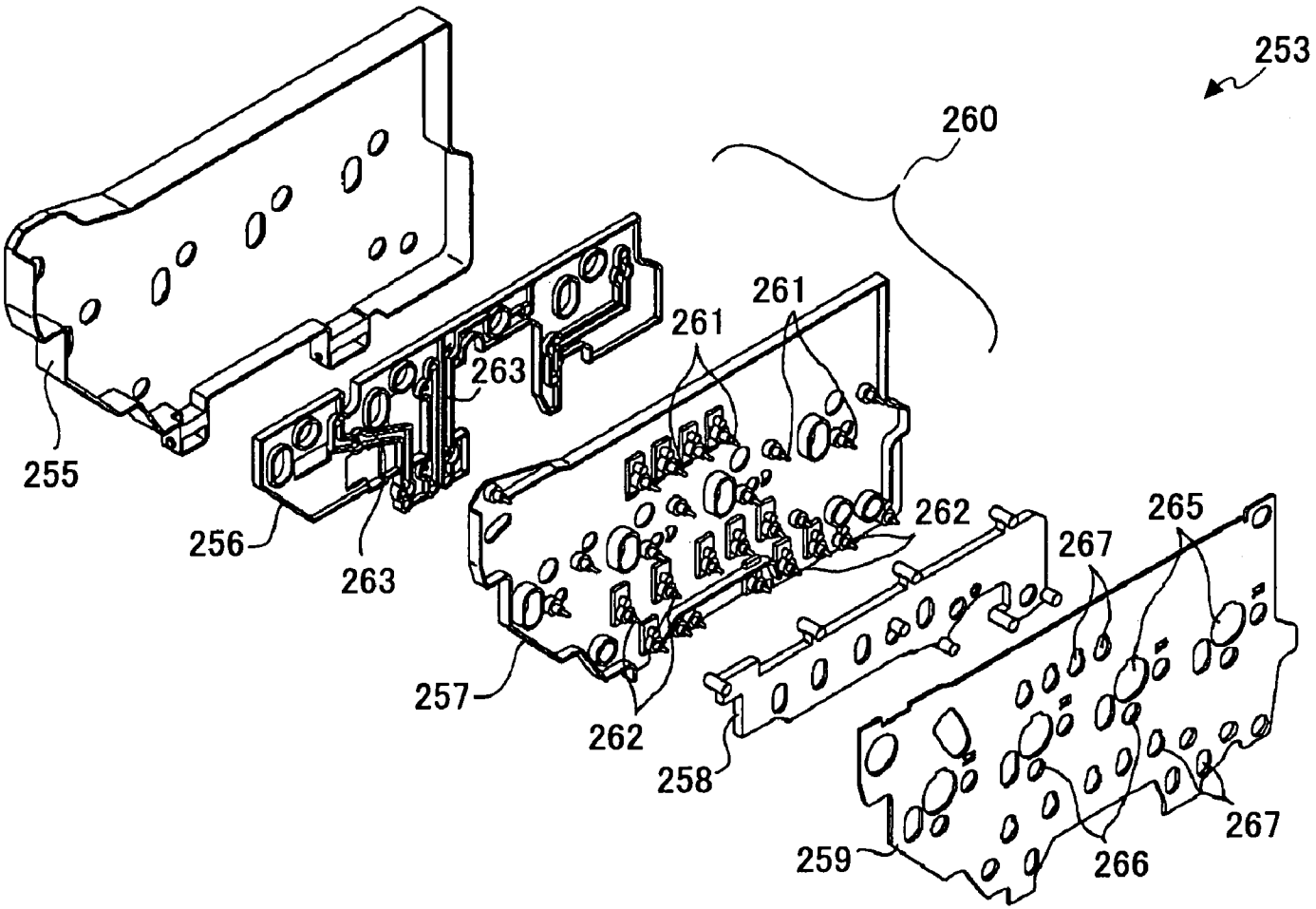
FIG. 36 is an exploded perspective view of the power feeding panel 253.

FIG. 36 is an exploded perspective view of the power feeding panel 253.

Figure 37:
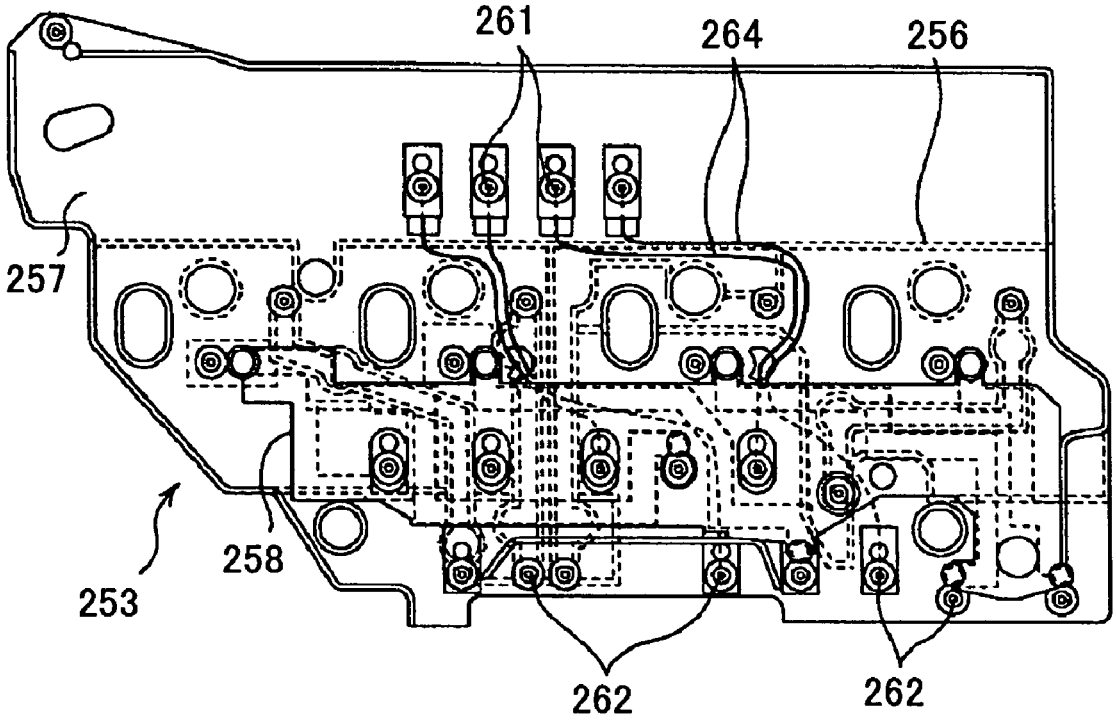
FIG. 37 is a plan view of the power feeding panel 253.

FIG. 37 is a plan view of the power feeding panel 253.

As illustrated in FIG. 36 and FIG. 37, the power feeding panel 253 includes a case 255, three insulating plates 256, 257, 258, and a positioning plate 259. A power feeding structure 260 is formed on the insulating plates 256, 257, and 258, including conductive pins 261 and 262, a conductive plate member 263, and cords 264 (FIG. 37) each having a coated insulating layer.

Figure 38A:
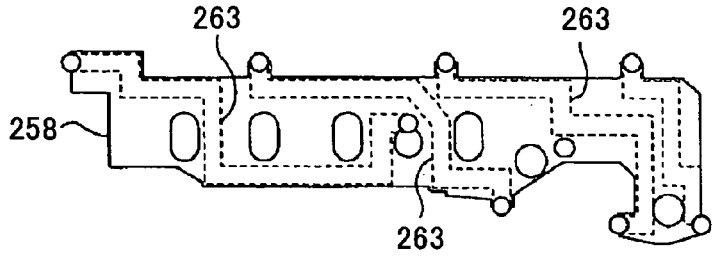
FIGS. 38A through 38C are plan views of the insulating plates 256, 257, and 258, respectively, showing details of the power feeding structure 260 formed thereon.
Figure 38B:
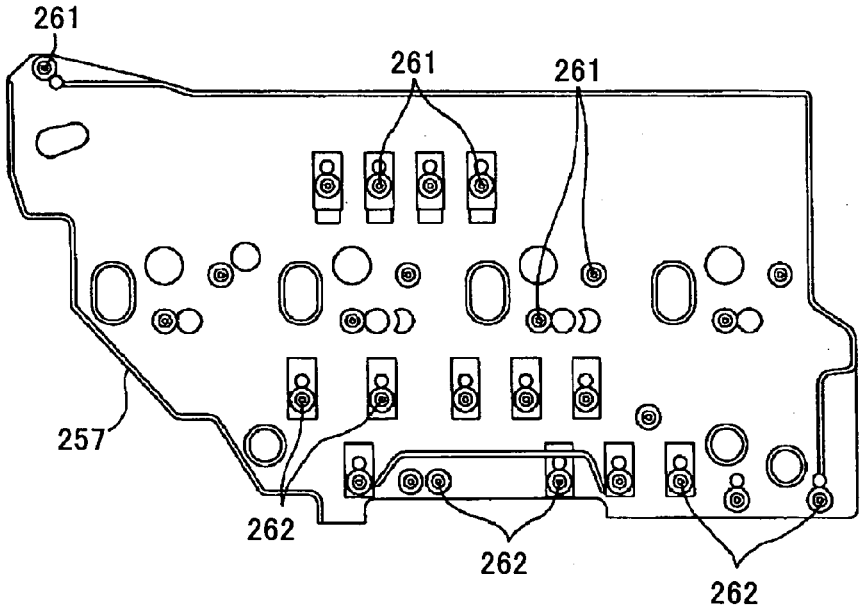
Figure 38C:
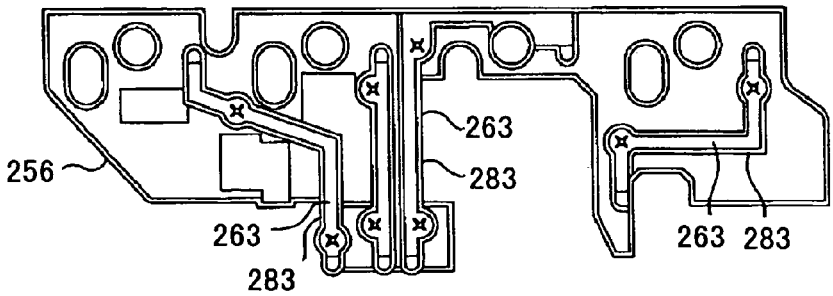

FIGS. 38A through 38C are plan views of the insulating plates 256, 257, and 258, respectively, showing details of the power feeding structure 260 formed thereon.

When the power feeding panel 253 is turned to the CLOSED position, the high voltage supply 251 is connected with the developing roller 211, the charging roller 210 and other component members through the power feeding structure 260, thereby enabling the high voltage supply 251 to supply electric power to the component members.

The conductive pins 261 are in contact with connection terminals of the developing rollers 211, the charging rollers 210, the first transfer rollers 219, the second transfer rollers 208*a*, and other component members. The conductive pins 262 are in contact with the connection terminals 252 of the high voltage power supply 251, The conductive plate member 263 is for connecting the conductive pins 261 and the conductive pins 262 through conductive springs 269, 270 that push the conductive pins 261 and the conductive pins 262, respectively.

The cords 264 are also for connecting the conductive pins 261 and the conductive pins 262 together with the conductive plate member 263 or in replacement of the conductive plate member 263.

The insulating plates 256, 257, 258 are stacked with the power feeding structure 260 in between. The insulating plates 256, 257, 258 are connected by screws or/and by hooks arranged on the insulating plates 256 and 258, and holes formed on the insulating plate 257.

The positioning plate or unit 259 is for supporting and positioning component units (such as the photo conductor 209, the charging rollers 210) accommodated in the main body 202. On the positioning plate 259, holes 265, 266, 267 are formed. When the power feeding panel 253 is turned to the CLOSED position, bearings attached to ends of the photo conductor 209 are inserted into the holes 265, bearings attached to ends of the charging rollers 210 are inserted into the holes 266, and the conductive pins 261 and the conductive pins 262 are inserted into the holes 267.

The positioning plate 259 and the case 55 sandwich the insulating plates 256, 257, 258, and when the power feeding panel 253 is turned to the CLOSED position, the positioning plate 259 is closer to the main body 202 than the insulating plates 256, 257, 258.

The positioning plate 259 and the insulating plates 256, 257, 258 are connected by screws, or/and by hooks formed on one of the insulating plates 256, 257 and 258, and holes formed on the positioning plate 259.

Figure 39:
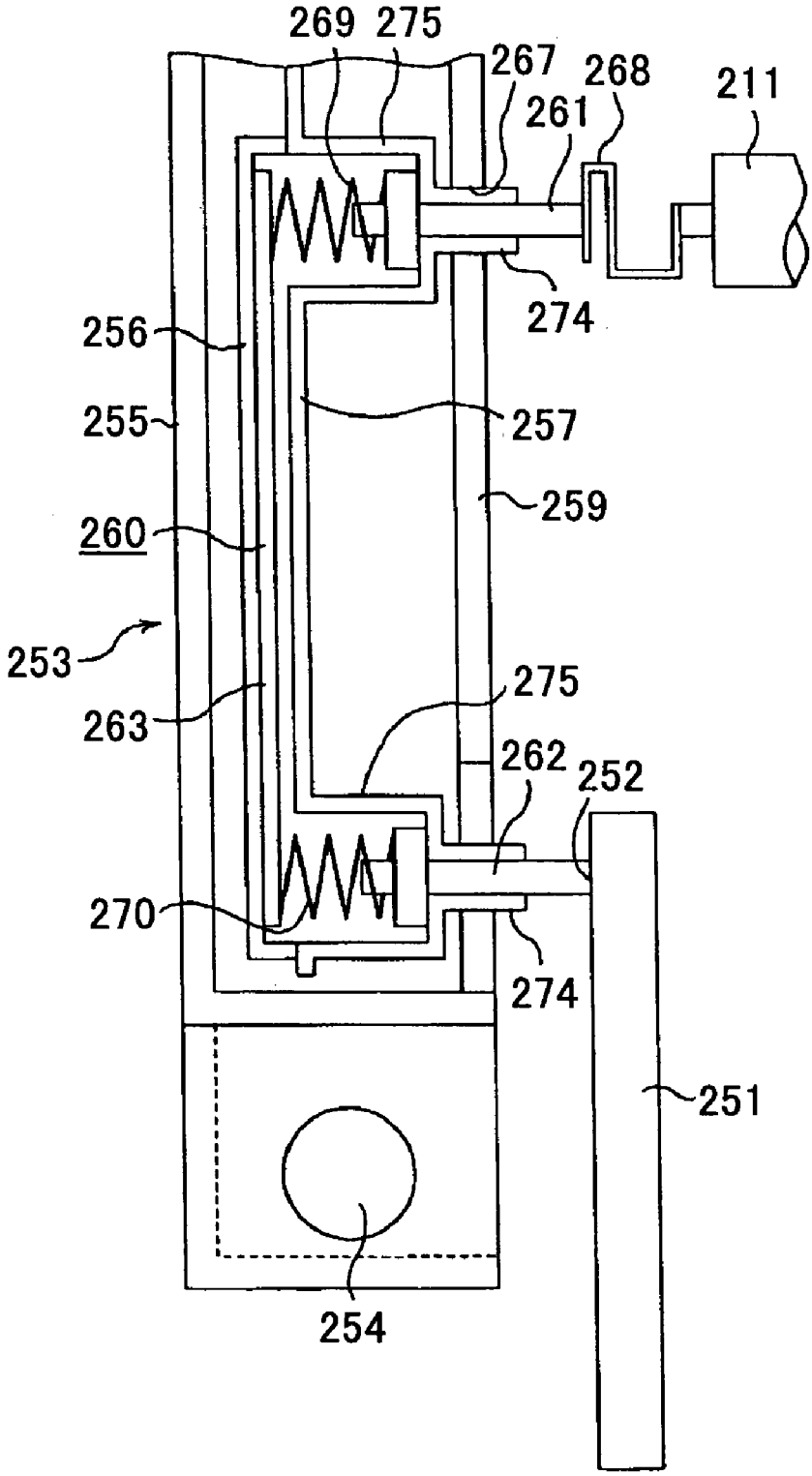
FIG. 39 is a cross-sectional view of a principal portion of the power feeding panel 253 according to the present embodiment, showing detail of the power feeding structure 260.

FIG. 39 is a cross-sectional view of a principal portion of the power feeding panel 253 according to the present embodiment, showing detail of the power feeding structure 260. For the sake of simplicity of illustration, the insulating plate 258 is omitted in FIG. 39, which is closest to the positioning plate 259 among the insulating plates 256, 257, 258.

In the power feeding structure 260, the conductive pin 261 is slidable in the direction along its center of axle, and when the power feeding panel 253 is turned to the CLOSED position, the front end of the conductive pin 261 is in contact with a connection terminal 268 of a component member, such as the developing roller 211, the charging roller 210, which are installed inside the main body 202. The conductive spring 269 is connected to the conductive pins 261, and pushes the conductive pin 261 to contact the connection terminal 268.

The conductive pin 262 is slidable in the direction along its axial center, and when the power feeding panel 253 is turned to the CLOSED position, the front end of the conductive pin 262 is in contact with a connection terminal 252 of the high voltage power supply 251. The conductive spring 270 is connected to the conductive pin 262, and pushes the conductive pin 262 to contact the connection terminal 252.

The two ends of the conductive plate member 263 are connected with the conductive springs 269 and 270, respectively, to connect the conductive pin 261 and the conductive pin 262.

The conductive pin 261 and the conductive pin 262 have the same structure, and the conductive spring 269 and the conductive spring 270 also have the same structure.

Figure 40A:
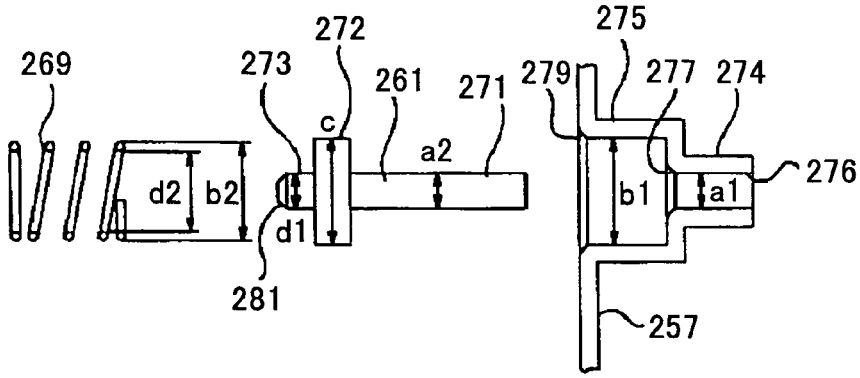
FIGS. 40A and 40B are exploded cross-sectional views showing supporting structures of the conductive pins 261 and 262 for fixing the conductive pin 261 and the conductive pin 262 to the insulating plate 257.
Figure 40B:
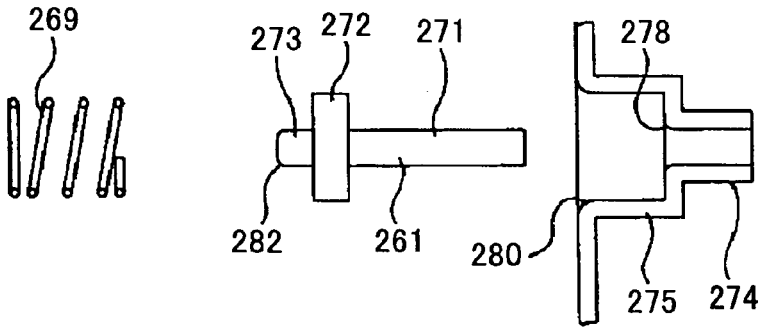

FIGS. 40A and 40B are exploded cross-sectional views showing supporting structures of the conductive pins 261 and 262 for fixing the conductive pin 261 and the conductive pin 262 to the insulating plate 257.

Below, the conductive pin 261 is used as an example. The conductive pin 261 has a pin portion 271, a stopping portion 272, and a connection portion 273. The conductive pin 261 is fabricated by cutting a cylindrical material, or by header operation, or by rolling. The pin portion 271, the stopping portion 272, and the connection portion 273 are also cylindrical shapes.

A guide tube is formed on the insulating plate 257, which includes a pin guide tube 274 for accommodating the conductive pin 261 when it is slid and inserted therein, and a spring guide tube 275 for accommodating the conductive spring 269. The pin guide tube 274 is integrated with the spring guide tube 275, forming a stepwise tube.

Here, the inner diameter of the pin guide tube 274 is represented by a1, and the outer diameter of the pin portion 271 is represented by a2; the inner diameter of the spring guide tube 275 is represented by b1, and the outer diameter of the conductive spring 269 is represented by b2; the outer diameter of the stopping portion 272 is represented by c; the outer diameter of the connection portion 273 is represented by d1, and the inner diameter of the conductive spring 269 is represented by d2.

In this example, the inner diameter of the pin guide tube 274 (a1) is greater than the outer diameter of the pin portion 271 (a2) by 0.01 mm to 0.5 mm, and the inner diameter of the spring guide tube 275 (b1) is greater than the outer diameter of the conductive spring 269 (b2) by 0.01 mm to 0.5 mm. The outer diameter of the stopping portion 272 (c) is greater than the inner diameter of the pin guide tube 274 (a1) and less than the inner diameter of the spring guide tube 275 (b1). The outer diameter of the connection portion 273 (d1) is less than the inner diameter of the conductive spring 269 (d2).

When the above components having such dimensions are assembled to build the power feeding structure 260, the conductive pins 261 and 262 are slidably held by the pin guide tube 274, and the stopping portion 272 is in contact with the step portion between the pin guide tube 274 and the spring guide tube 275, which prevents the conductive pin 261 from falling off from the insulating plate 257. One end of the conductive spring 269 (or 270) is inserted into the spring guide tube 275 with the connection portion 273 of the conductive pin 261 therein, and the other end of the conductive spring 269 is connected to the conductive plate 273.

The inner diameter of the spring guide tube 275 (b1) may be set equal to the outer diameter of the conductive spring 269 (b2); alternatively, the inner diameter of the spring guide tube 275 (b1) may be set smaller than the outer diameter of the conductive spring 269 (b2) by 0.01 mm to 0.5 mm. Because the conductive spring 269 is flexible, in either case, the conductive spring 269 (or 270) can be inserted into the spring guide tube 275.

In addition, the outer diameter of the connection portion 273 (d1) may also set equal to the inner diameter of the conductive spring 269 (d2); alternatively, the outer diameter of the connection portion 273 (d1) may be set smaller than the inner diameter of the conductive spring 269 (d2) by 0.01 mm to 0.5 mm. Because the conductive spring 269 is flexible, in either case, the connection portion 273 can be inserted into the conductive spring 269 (or 270).

The entrance of the pin guide tube 274 may be processed to be a tapered surface 277, as illustrated in FIG. 40A, or a round surface 278, as illustrated in FIG. 40B. These shapes make insertion of the pin portion 271 into the pin guide tube 274 easy, thereby making operation of assembling the power feeding panel 253 easy.

Similarly, the entrance of the spring guide tube 275 may also be processed to be a tapered surface 279, as illustrated in FIG. 40A, or a round surface 280, as illustrated in FIG. 40B. These shapes make insertion of the conductive spring 269 into the spring guide tube 275 easy, thereby making the operation of assembling the power feeding panel 253 easy.

Similarly, the end of the connection portion 273 may also be processed to be a tapered surface 281, as illustrated in FIG. 40A, or a round surface 282, as illustrated in FIG. 40B. These shapes make insertion of the connection portion 273 into the conductive spring 269 easy, thereby making the operation of assembling the power feeding panel 253 easy.

In the power feeding structure 260 as illustrated in FIG. 39, conductive grease may be applied between the outer surface of the pin portion 271 of the conductive pin 260 and the inner surface of the pin guide tube 274, and between the outer surface of the connection portion 273 of the conductive pin 260 and the conductive spring 269 to improve sliding ability of those slidable members and electrical conductivity at the contacting positions.

As illustrated in FIG. 38C, a guide rib 283 having a shape matched with the conductive plate member 263 is attached to the insulating plate 256, and the conductive plate member 263 is fitted in the guide rib 283. Although not illustrated in FIG. 38A, a similar guide rib is also attached to the insulating plate 258 for laying the conductive plate member 263.

Figure 41A:
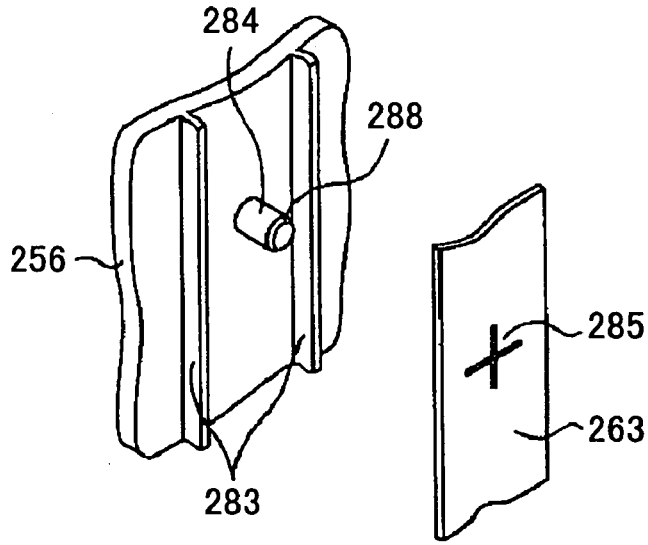
FIGS. 41A through 41C are exploded perspective views showing supporting structures for fixing the conductive plate member 263 onto the insulating plate 256.
Figure 41B:
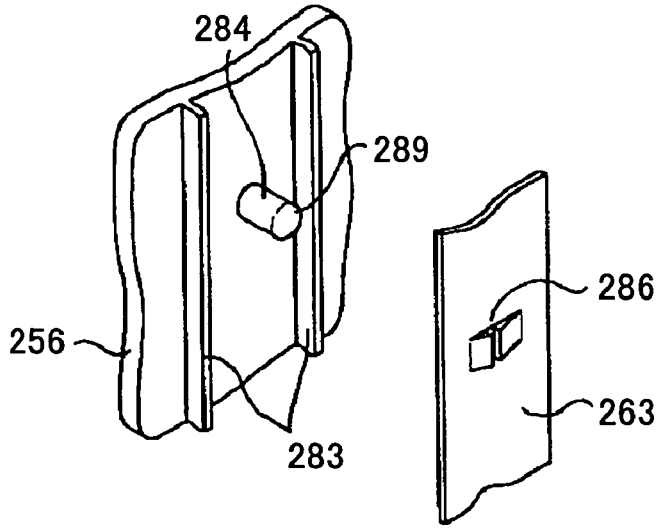
Figure 41C:
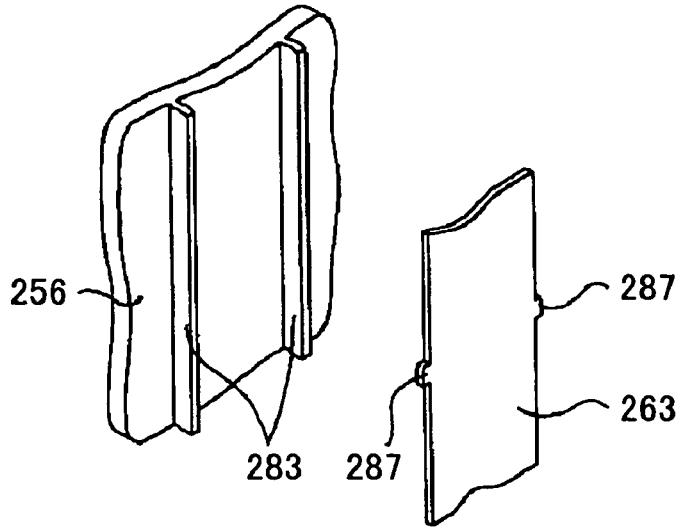

FIGS. 41A through 41C are exploded perspective views showing supporting structures for fixing the conductive plate member 263 onto the insulating plate 256.

The conductive plate member 263 is fixed to the insulating plate 256 by fitting the conductive plate member 263 into the guide rib 283. As illustrated in FIG. 41A, a cross slit 285 is formed at the center of the conductive plate member 263, and a projection 284 is formed on the insulating plate 256. The projection 284 is inserted into the center of the cross slit 285, and the projection 284 is embraced by the cross slit 285, thereby fixing the conductive plate member 263 onto the insulating plate 256. In this way, attachment of the conductive plate member 263 to the insulating plate 256 can be performed by a simple and inexpensive structure.

Instead of the cross slit 285, a slit 286 as illustrated in FIG. 41B may also be used for fixing the conductive plate member 263 to the insulating plate 256. Further, as illustrated in FIG. 41B, two projections 287 may be formed on the two sides of the conductive plate member 263 so that when the conductive plate member 263 is fitted into the guide lib 283, the guide lib 283 can firmly catch the conductive plate member 263.

Although not illustrated, the conductive plate member 263 may also be screwed to the insulating plate 256. Specifically, a hole may be formed on the conductive plate member 263 for the screw to pass through, and a screw hole may be formed on the insulating plate 256 to tighten the screw penetrating the hole on the conductive plate member 263.

When the projection 284 is used for fixing the conductive plate member 263, the end of the projection 284 may also be processed to be a tapered surface 288, as illustrated in FIG. 41A, or a round surface 289, as illustrated in FIG. 41B, to facilitate insertion of the projection 284 into the slit 285 or the slit 286, thereby making the operation of assembling the power feeding panel 253 easy.

The conductive pins 261, 262 and the conductive springs 269, 270 may be formed by combinations of the following materials.

(1) the conductive pins 261, 262 are formed from steel rods, and the conductive springs 269, 270 are formed from piano wire or steel wire.
(2) the conductive pins 261, 262 are formed from copper rods, and the conductive springs 269, 270 are formed from piano wire or steel wire.
(3) nickel layers are formed on the surfaces of either the conductive pins 261, 262, or the conductive springs 269, 270.
(4) nickel layers are formed on the respective surfaces of the conductive pins 261, 262, and the conductive springs 269, 270.
(5) copper layers are formed on the surfaces of either the conductive pins 261, 262, or the conductive springs 269, 270, and nickel layers are further formed on the copper layers.
(6) copper layers are formed on the surfaces of the conductive pins 261, 262, and the conductive springs 269, 270, and nickel layers are further formed on the copper layers.

Figure 42:
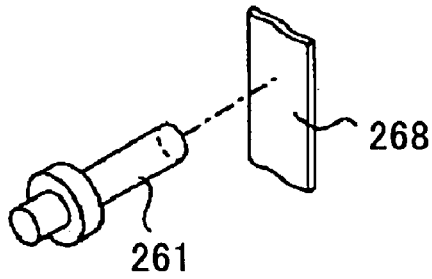
FIG. 42 is a perspective view showing an example of a connection structure of the conductive pin 261 and the connection terminal 268.

FIG. 42 is a perspective view showing an example of a connection structure of the conductive pin 261 and the connection terminal 268.

As illustrated in FIG. 42, the front end of the conductive pin 261 is flat, and the portion of the connection terminal 268 contacting with the conductive pin 261 is also flat. With such a configuration, when the power feeding panel 253 is turned to the CLOSED position, because the flat front end of the conductive pin 261 is in contact with the flat portion of the connection terminal 268, the contacting area between the conductive pin 261 and the connection terminal 268 is increased, the contacting electrical resistance between the conductive pin 261 and the connection terminal 268 is lowered, and consequently, efficiency of power feeding is improved.

Figure 43:
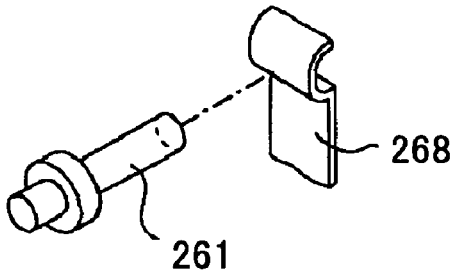
FIG. 43 is a perspective view showing another example of the connection structure of the conductive pin 261 and the connection terminal 268.

FIG. 43 is a perspective view showing another example of the connection structure of the conductive pin 261 and the connection terminal 268.

As illustrated in FIG. 43, the front end of the conductive pin 261 is flat, and the portion of the connection terminal 268 contacting with the conductive pin 261 is a projecting arc. With such a configuration, when the power feeding panel 253 is turned to the CLOSED position, even the position of the conductive pin 261 shifts somehow, the conductive pin 261 can be still in firm contact with the projecting arc portion of the connection terminal 268, enabling stable connection condition between the conductive pin 261 and the connection terminal 268, and stable power supply.

Figure 44:
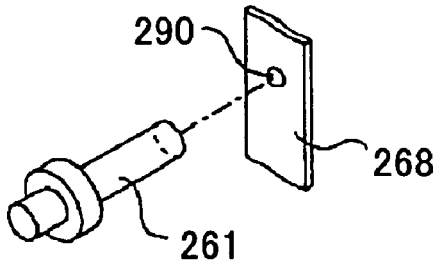
FIG. 44 is a perspective view showing another example of the connection structure of the conductive pin 261 and the connection terminal 268.

FIG. 44 is a perspective view showing another example of the connection structure of the conductive pin 261 and the connection terminal 268.

As illustrated in FIG. 44, the front end of the conductive pin 261 is flat, and the portion of the connection terminal 268 contacting with the conductive pin 261 is a projecting semi-sphere 290. With such a configuration, when the power feeding panel 253 is turned to the CLOSED position, even if the position of the conductive pin 261 shifts somehow, the conductive pin 261 can be still in firm contact with the projecting semi-sphere 290 of the connection terminal 268, enabling stable connection condition between the conductive pin 261 and the connection terminal 268, and stable power supply.

Figure 45:
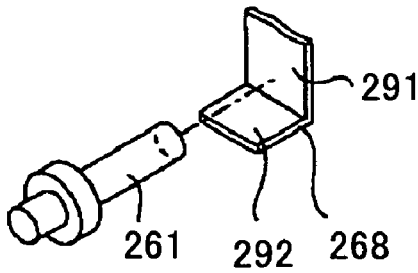
FIG. 45 is a perspective view showing another example of the connection structure of the conductive pin 261 and the connection terminal 268.

FIG. 45 is a perspective view showing another example of the connection structure of the conductive pin 261 and the connection terminal 268.

As illustrated in FIG. 45, the front end of the conductive pin 261 is flat, the connection terminal 268 is L-shaped, including a vertical flat plate 291 and a horizontal flat plate 292, the vertical flat plate 291 is in contact with the front end of the conductive pin 261, and the horizontal plate 292 is in contact with the side surface of the conductive pin 261. With such a configuration, when the power feeding panel 253 is turned to the CLOSED position, because both the front end and the side surface of the conductive pin 261 are in contact with the connection terminal 268, the contacting area between the conductive pin 261 and the connection terminal 268 is greatly increased, the contacting electrical resistance between the conductive pin 261 and the connection terminal 268 is lowered, and consequently, efficiency of power feeding is greatly improved.

Figure 46:
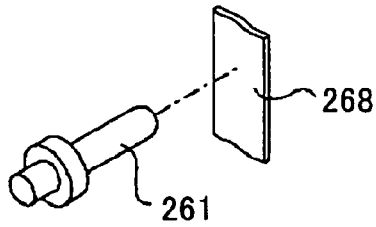
FIG. 46 is a perspective view showing another example of the connection structure of the conductive pin 261 and the connection terminal 268.

FIG. 46 is a perspective view showing another example of the connection structure of the conductive pin 261 and the connection terminal 268.

As illustrated in FIG. 46, the front end of the conductive pin 261 is a semi-sphere, and the portion of the connection terminal 268 making contact with the conductive pin 261 is flat. With such a configuration, when the power feeding panel 253 is turned to the CLOSED position, even the position of the conductive pin 261 shifts somehow on the connection terminal 268, the semi-sphere front end of the conductive pin 261 can be still in firm contact with the connection terminal 268, enabling a stable connection condition between the conductive pin 261 and the connection terminal 268, and a stable power supply.

Figure 47:
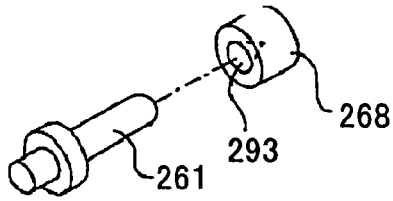
FIG. 47 is a perspective view showing another example of the connection structure of the conductive pin 261 and the connection terminal 268.

FIG. 47 is a perspective view showing another example of the connection structure of the conductive pin 261 and the connection terminal 268.

As illustrated in FIG. 47, the front end of the conductive pin 261 is a semi-sphere, and a conical recess 293 is formed in the portion of the connection terminal 268 contacting the conductive pin 261, and the conic recess 293 has a size able to accommodate the semi-spherical front end of the conductive pin 261. With such a configuration, when the power feeding panel 253 is turned to the CLOSED position, the conductive pin 261 is in firm contact with the connection terminal 268, and this enables a stable connection condition between the conductive pin 261 and the connection terminal 268, and a stable power supply.

In the connection structures illustrated in FIG. 42 through FIG. 47, conductive grease may be applied between the conductive pin 261 and the connection terminal 268 to improve electrical conductivity between the conductive pin 261 and the connection terminal 268.

The conductive pin 261 and the connection terminal 268 may be formed by combinations of the following materials.

(1) the conductive pin 261 is formed from a steel rod, and the conductive terminal 268 is formed from steel.
(2) the conductive pin 261 is formed from a steel rod, and the conductive terminal 268 is formed from copper.
(3) the conductive pin 261 is formed from a copper rod, and the conductive terminal 268 is formed from steel.
(4) the conductive pin 261 is formed from a copper rod, and the conductive terminal 268 is formed from copper.
(5) a nickel layer is formed on the surface of either the conductive pin 261 or the conductive terminal 268.
(6) nickel layers are formed on the respective surfaces of the conductive pin 261 and the conductive terminal 268.
(7) a copper layer is formed on the surface of either the conductive pin 261 or the conductive terminal 268, and a nickel layer is further formed on the copper layer.
(8) copper layers are formed on the respective surfaces of the conductive pin 261 and the conductive terminal 268, and nickel layers are further formed on the copper. layers.

Figure 48:
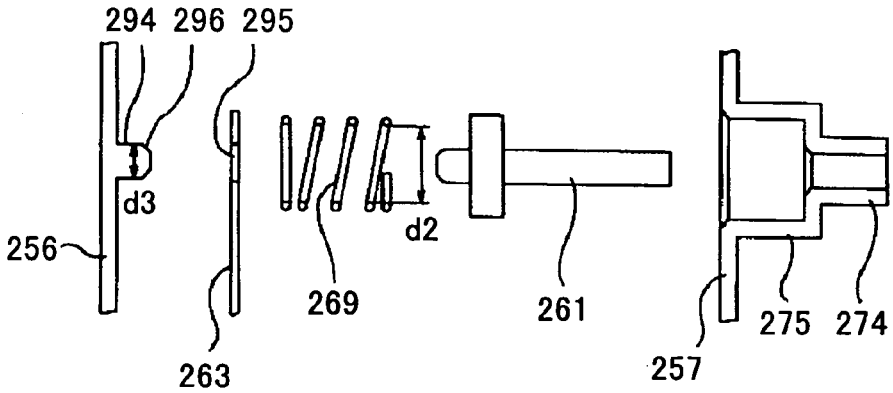
FIG. 48 is an exploded cross-sectional view showing another example of the supporting structure of the conductive pins 261 and 262 for fixing the conductive pin 261 and the conductive pin 262 to the insulating plate 257.

FIG. 48 is an exploded cross-sectional view showing another example of the supporting structure of the conductive pins 261 and 262 for fixing the conductive pin 261 and the conductive pin 262 to the insulating plate 257.

As illustrated in FIG. 48, a projection 294 is formed on the insulating plate 256, and a hole 295 is formed on the conductive plate 263 for the projection 294 to pass through. When the conductive plate 263 is fixed to the insulating plate 256, the projection 294 penetrate through the hole 295, and is inserted into the conductive spring 269 (or the conductive spring 270). In other words, when assembling the power feeding panel 253, the projection 294 acts as a guide of the conductive spring 269 or 270, and this makes the assembly operation easy.

The outer diameter of the projection 294, represented by d3, may be set less than, equal to, or greater than the inner diameter of the conductive spring 269 (d2). Because the conductive spring 269 is flexible, in either case, the projection 294 can be inserted into the conductive spring 269 (or 270).

The end of the projection 294 may also be processed to be a tapered surface 296 or a round surface so as to make insertion of the projection 294 into the conductive spring 269 easy, thereby making the operation of assembling the power feeding panel 253 easy.

Figure 49:
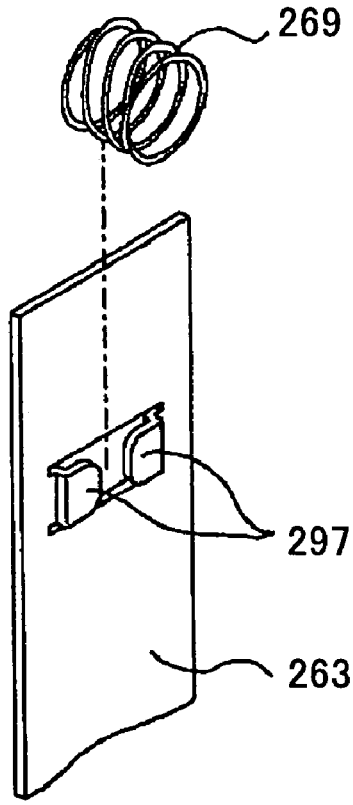
FIG. 49 is a perspective view showing an example of a connection structure of the conductive plate member 263 and the conductive spring 269.

FIG. 49 is a perspective view showing an example of a connection structure of the conductive plate member 263 and the conductive spring 269.

As illustrated in FIG. 49, two L-shaped plates 297 are formed in the conductive plate member 263. The L-shaped plates 297 are formed by pre-cutting an "I" shape in a portion of the conductive plate member 263, and bending the thus obtained two part of the pre-cut portion into an L shape. The two plates 297 catch the wire of the conductive spring 269, and firmly fix the conductive spring 269. This makes the assembly operation easy, enables a stable connection condition between the conductive spring 269 and the conductive plate 263, and a stable power supply.

Figure 50:
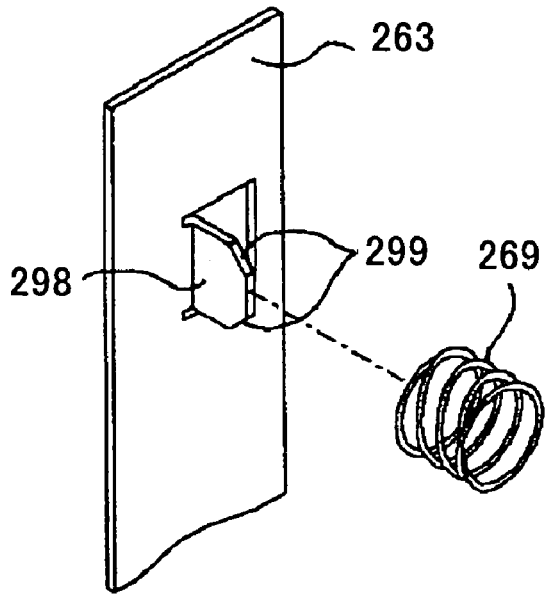
FIG. 50 is a perspective view showing another example of the connection structure of the conductive plate member 263 and the conductive spring 269.

FIG. 50 is a perspective view showing another example of the connection structure of the conductive plate member 263 and the conductive spring 269.

As illustrated in FIG. 50, a plate 298 is formed in the conductive plate member 263. The plate 298 is formed by pre-cutting a square in a portion of the conductive plate member 263, and bending the pre-cut portion up by 90 degrees. The plate 298 is inserted into the conductive spring 269, thereby firmly fixing the conductive spring 269. The end of the plate 298 may be beveled to be a tapered surface 299 or processed to be a round surface.

In the connection structures illustrated in FIG. 49 and FIG. 50, conductive grease may be applied between the conductive plate 263 and the conductive spring 269 to improve electrical conductivity between the conductive plate 263 and the conductive spring 269.

The conductive plate 263 and the conductive springs 269, 270 may be formed by combinations of the following materials.

(1) the conductive plate 263 is formed from steel, and the conductive springs 269, 270 are formed from piano wire or steel wire.
(2) the conductive plate 263 is formed from copper, and the conductive springs 269, 270 are formed from piano wire or steel wire.
(3) a nickel layer is formed on the surfaces of either the conductive plate 263 or the conductive springs 269, 270.
(4) nickel layers are formed on the respective surfaces of the conductive plate 263 and the conductive springs 269, 270.
(5) a copper layer is formed on the surfaces of either the conductive plate 263 or the conductive springs 269, 270, and a nickel layer is further formed on the copper layer.
(6) copper layers are formed on the surfaces of the conductive plate 263 and the conductive springs 269, 270, and nickel layers are further formed on the copper layers.

In the present embodiment, a number of the conductive pins 261, 262 and the conductive springs 269, 270 for pushing the corresponding conductive pins 261, 262 are formed on the power feeding panel 253. Below, an explanation is made of the forces applied by the conductive springs 269, 270.

When there are many conductive pins 261, 262 and conductive springs 269, 270, especially when the forces applied by the conductive springs 269, 270 on the conductive pins 261, 262 are sufficiently large, it is crucial that the forces applied by the conductive springs 269, 270 be uniform in order to maintain good connection condition of the conductive pins 261, 262 when the power feeding panel 253 mounted on the main body 202 is turned to the CLOSED position to bring the conductive pins 261, 262 into contact with the connection terminals 268, 252 in the main body 202. If the forces applied by the conductive springs 269, 270 are not uniform, the insulating plates 256, 257, 258, which accept forces from the conductive springs 269, 270, may be deformed. Particularly, at places where the forces are relatively large, the deformation causes the insulating plates 256, 257, 258 to break away from the main body 202, and leads to unsatisfactory connection condition of the conductive pins 261, 262 around the location of the deformation.

To avoid these problems, in this embodiment, the forces of the conductive springs 269, 270 are set to be small, for example, from 0.5 N to 1.5 N, and the forces of the conductive springs 269, 270 are set to the same value.

Because the forces of the conductive springs 269, 270 are small, the deformation of the insulating plates 256, 257, 258 caused by the large reactive forces from the conductive springs 269, 270 does not occur, and this leads to good connection conditions of all the conductive pins 261, 262 with the connection terminals 268, 252.

Because the forces of the conductive springs 269, 270 are set to the same value, even if the forces of the conductive springs 269, 270 are large, the deformation of the insulating plates 256, 257, 258 caused by the reactive forces from the conductive springs 269, 270 does not occur, and this leads to good connection conditions of all the conductive pins 261, 262 with the connection terminals 268, 252.

On the other hand, even when a number of the conductive springs 269, 270 are provided for pushing a number of the conductive pins 261, 262 in the power feeding panel 253, it is also possible to set the force of one of the conductive springs 269, 270 to be set larger than those of other conductive springs 269, 270. For example, this setting is necessary when one of the conductive pin 261 or 262 should be pushed by a larger force than the other conductive pins 261, 262. In this case, in order to prevent the deformation of the insulating plates 257, 258, or 259 at a position corresponding to the conductive pin that is pushed more strongly than the other conductive pins 261, 262, a deformation-prevention member, for example, a hook, or a spring may be provided to elastically engage the insulating plates 257, 258, and 259 with the case 255 or the positioning plate 259. Due to this, even when one of the conductive pin 261 or 262 accepts a larger force than the other conductive pins 261, 262, it is possible to prevent the deformation of the insulating plates 257, 258, or 259 at the position corresponding to that conductive pin, ensuring good connection conditions of all the conductive pins 261, 262 with the connection terminals 268, 252.

Third Embodiment

Figure 51:
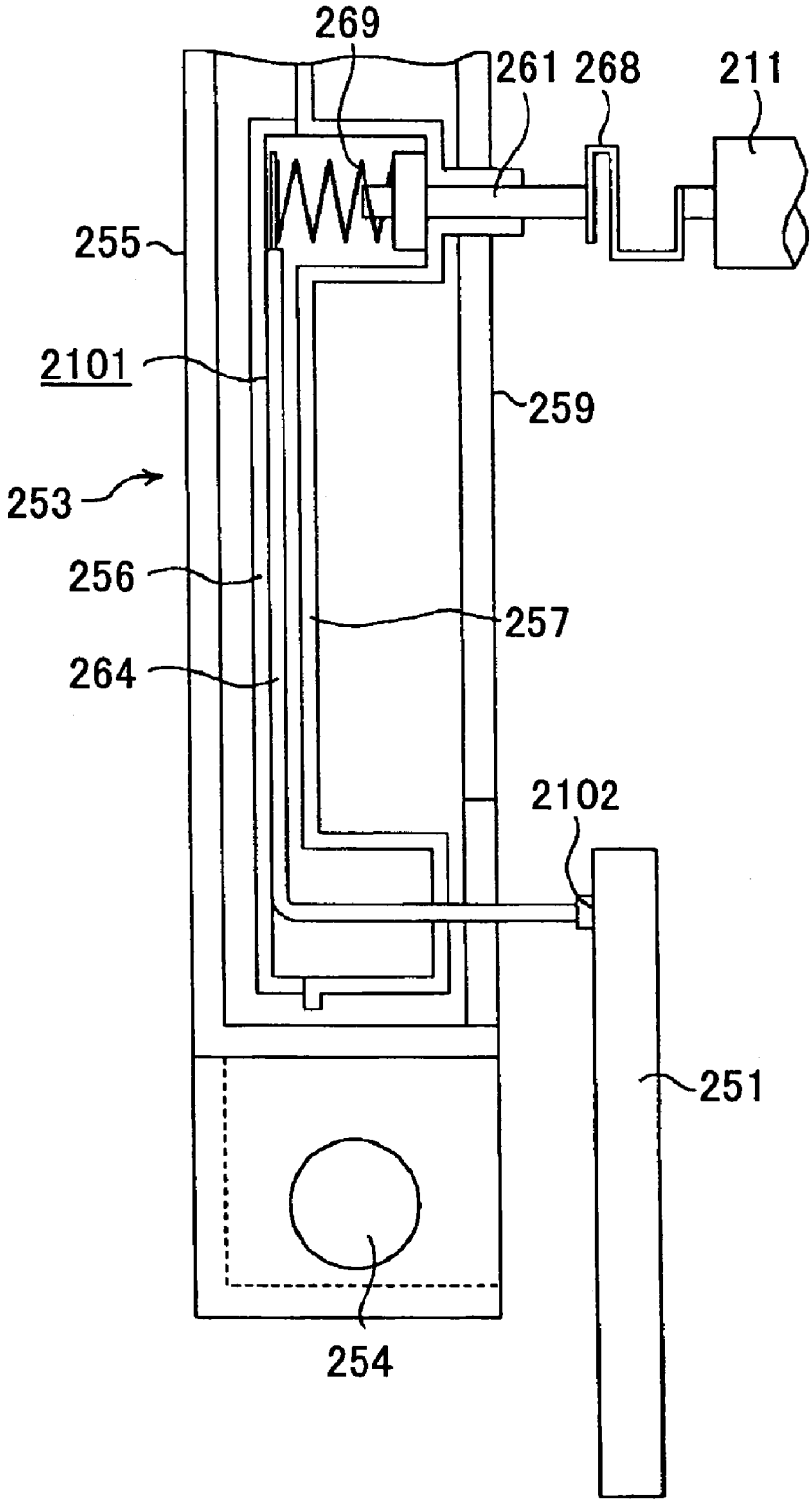
FIG. 51 is a cross-sectional view of a principal portion of the power feeding panel 253 according to a third embodiment.

FIG. 51 is a cross-sectional view of a principal portion of the power feeding panel 253 according to the third embodiment. In the following description, the same reference numbers are used for the same components as those in the previous embodiment, and overlapping explanations are omitted.

In this embodiment, the power feeding panel 253 includes a power feeding structure 2101, which is different from the power feeding structure 260 in the second embodiment.

In the power feeding structure 2101, the conductive pin 261 is slidable in the direction along its axial center, and when the power feeding panel 253 is turned to the CLOSED position, the front end of the conductive pin 261 is in contact with the connection terminal 268 of a component member, such as, the developing roller 211, the charging roller 210, which are installed inside the main body 202.

The conductive spring 269 is connected to the conductive pin 261 to push the conductive pin 261 to contact the connection terminal 268.

The cord 264 is coated with an insulating layer. One end of the cord 264 is connected to the conductive spring 269, and the other end is connected to the connection terminal 2102 of the high voltage power supply 251. The cord 264 and the connection terminal 2102 of the high voltage power supply 251 are connected by a connector.

With the above power feeding structure 2101, when the power feeding panel 253, which is attached to the main body 202, is turned to the CLOSED position to cover the opened portion 202*a* of the main body 202, the front end of the conductive pin 261 is in contact with the connection terminal 268 of the component members, such as the developing roller 211, the charging roller 210. The cord 264 is connected to the connection terminal 2102 of the high voltage power supply 251 by a connector. Therefore, when the power feeding panel 253 is turned to the CLOSED position, the high voltage power supply is able to feed electric power to the component members.

Because the cord 264 is connected to the connection terminal 2102 of the high voltage power supply 251 by a connector, even when the power feeding panel 253 is repeatedly turned to the CLOSED position from the OPENED position, or vice versa, good connection condition between the cord 264 and the connection terminal 2102 of the high voltage power supply 251 can be maintained.

When a number of the power feeding structures 2101 are provided, even if the cords 264 of these power feeding structures 2101 contact each other, because of the insulating coating of these cords 264, electric leakage does not occur at the contacting positions, making lay-out of the cords 264 easy.

Fourth Embodiment

Figure 52:
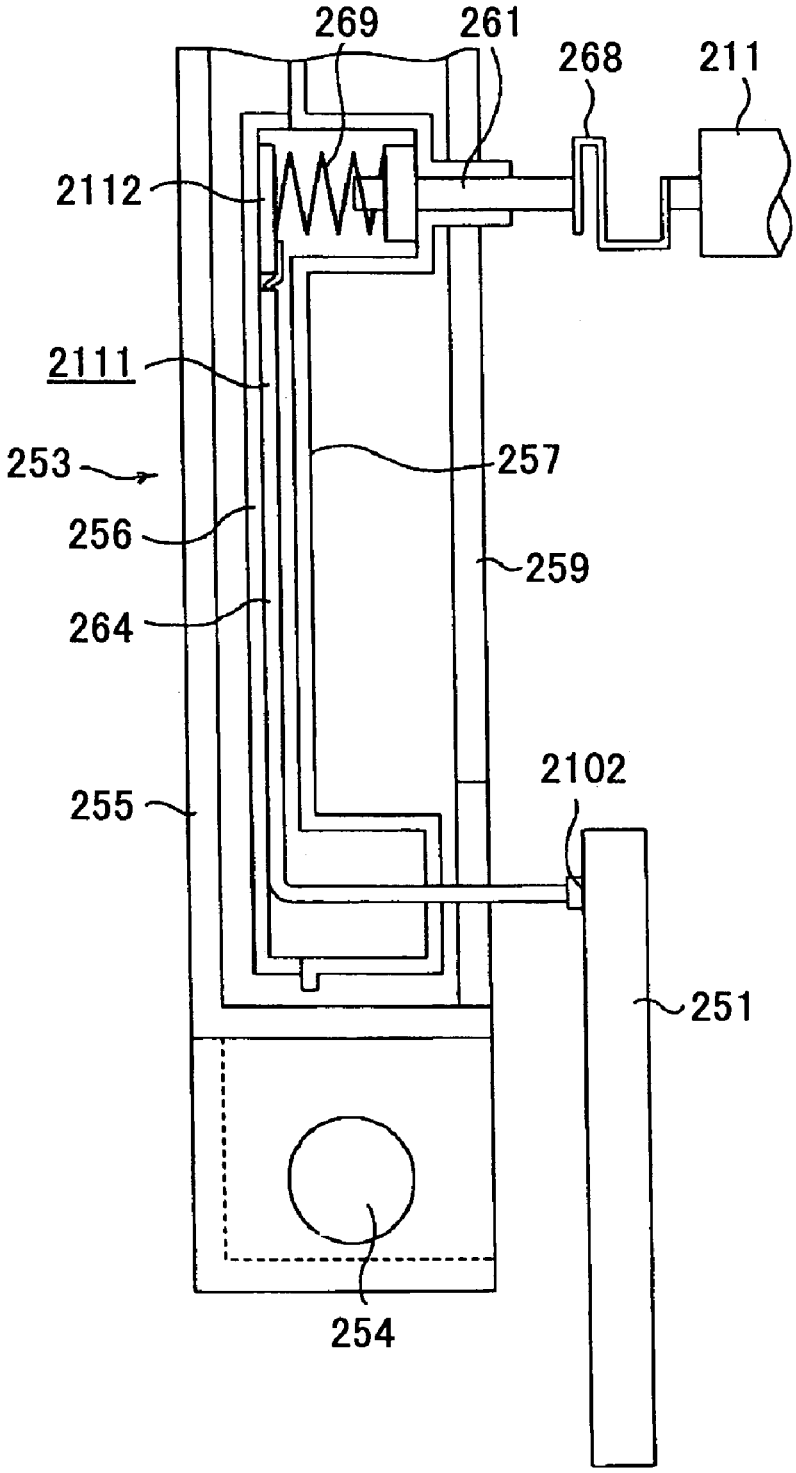
FIG. 52 is a cross-sectional view of a principal portion of the power feeding panel 253 according to a fourth embodiment.

FIG. 52 is a cross-sectional view of a principal portion of the power feeding panel 253 according to the fourth embodiment. In the following description, the same reference numerals are used for the same components as those in the previous embodiments, and overlapping explanations are omitted.

In this embodiment, the power feeding panel 253 includes a power feeding structure 2111, which is different from the power feeding structures 260 and 2101 in the previous embodiments.

In the power feeding structure 2111, the conductive pin 261 is slidable in the direction along its axial center, and when the power feeding panel 253 is turned to the CLOSED position, the front end of the conductive pin 261 is in contact with the connection terminal 268 of a component member, such as the developing roller 211, which is installed inside the main body 202. The conductive spring 269 is connected to the conductive pin 261 to push the conductive pin 261 to contact the connection terminal 268. The conductive plate member 2112 is connected to the end of the conductive spring 269. The cord 264 with an insulating coating layer is connected to the conductive plate member 2112 at one end and connected to the connection terminal 2102 of the high voltage power supply 251 at the other end.

As described above, the conductive plate member 2112 is fitted in the guide rib 283, which is attached to the insulating plate 256, and thereby the conductive plate member 2112 is attached to the insulating plate 256.

In the present embodiment, the power feeding structure 2111 is laid on both the front sides and the back sides of the insulating plates.

Figure 53:
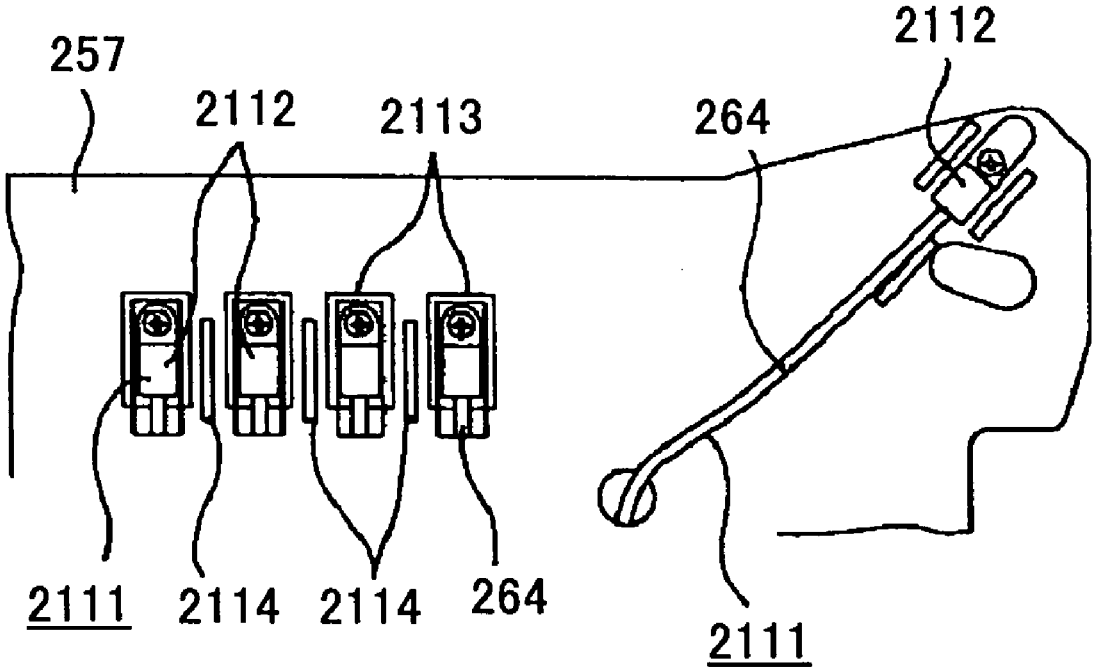
FIG. 53 is a back view of a portion of the insulating plate 257.

FIG. 53 is a back view of a portion of the insulating plate 257.

As illustrated in FIG. 53, one side of the conductive plate member 2112 is connected to one side of the insulating plate 257, and the conductive spring 269 and the conductive pin 269 in contact with the conductive plate member 2112 are attached to the other side of the insulating plate 257. A portion of the insulating plate 257 is cut off so that the conductive spring 269 and the conductive plate member 2112 are connected there.

Guide ribs 2113 each having a shape matched with the conductive plate member 2112 are arranged on one side of the insulating plate 257, and the conductive plate members 2112 are fitted into and screwed to the guide ribs 2113. In addition, ribs 2114 are formed between adjacent guide ribs 2113.

With the power feeding structure 2111, when the power feeding panel 253, which is attached to the main body 202, is turned to the CLOSED position to cover the opened portion 202*a* of the main body 202, the front end of the conductive pin 261 is in contact with the connection terminal 268 of the component member, such as the developing roller 211. The cord 264 is connected to the connection terminal 2102 of the high voltage power supply 251 by a connector. Therefore, once the power feeding panel 253 is turned to the CLOSED position, the high voltage power supply is able to feed electric power to the component members.

As illustrated in FIG. 53, because the power feeding structure 2111 is arranged on both the front side and the back side of the insulating plate 257, the space around the insulating plate 257 can be utilized efficiently. In addition, because the ribs 2114 are formed between adjacent guide ribs 2113 with the conductive plate members 2112 fitted in, the presence of the ribs 2114 increases the surface distance of the insulating plate 257 between two adjacent conductive plate members 2112, and this reduces the magnitude of the surface electric current flowing through the surface of the insulating plate 257 between two adjacent conductive plate members 2112, thereby reducing leakage of the surface electric current.

Fifth Embodiment

Figure 54:
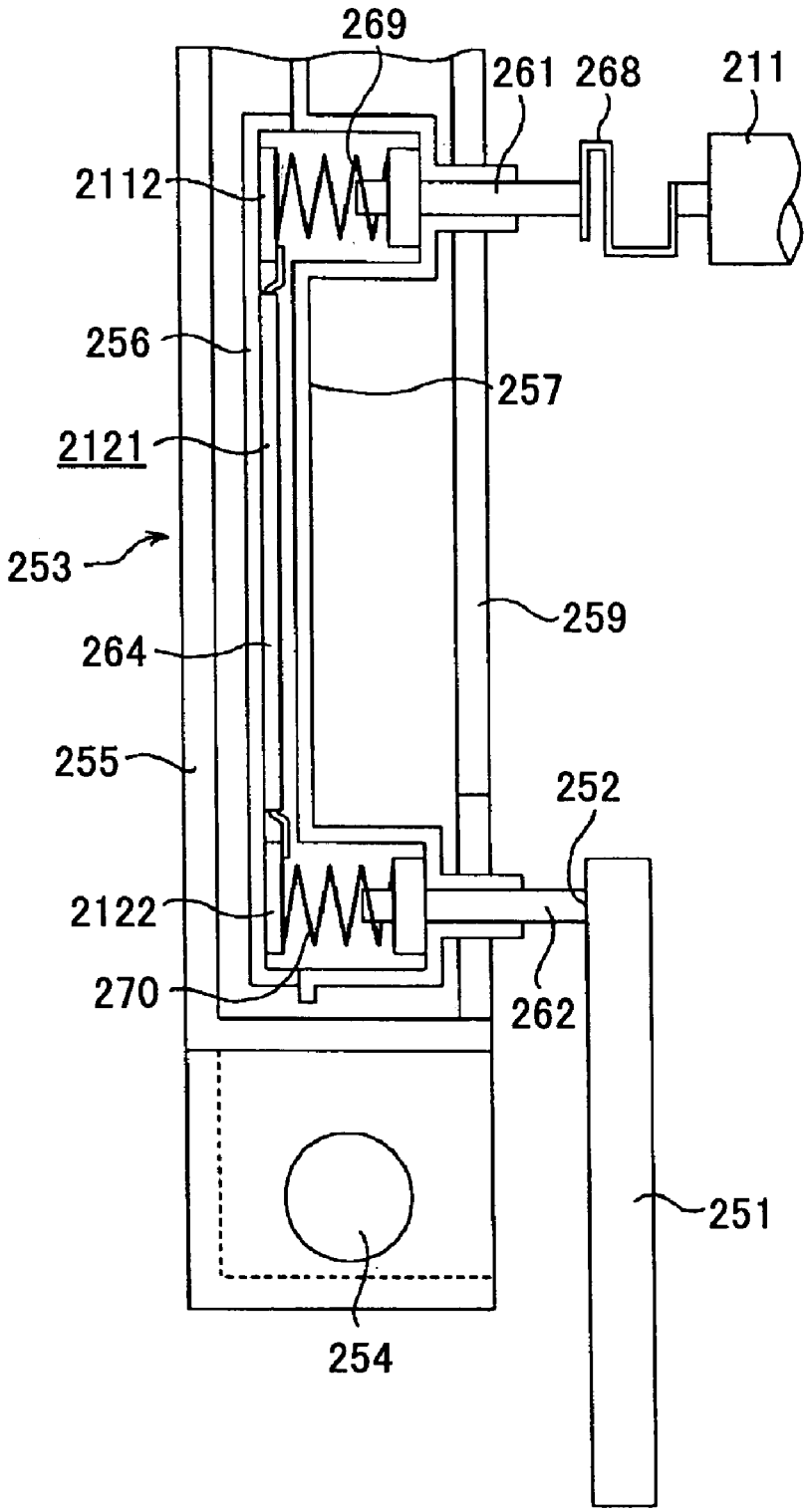
FIG. 54 is a cross-sectional view of a principal portion of the power feeding panel 253 according to a fifth embodiment.

FIG. 54 is a cross-sectional view of a principal portion of the power feeding panel 253 according to the fifth embodiment. In the following description, the same reference numerals are used for the same components as those in the previous embodiments, and overlapping explanations are omitted.

In this embodiment, the power feeding panel 253 includes a power feeding structure 2121, which is different from the power feeding structures in the previous embodiments.

In the power feeding structure 2121, the conductive pin 261 is slidable in the direction along its axial center, and when the power feeding panel 253 is turned to the CLOSED position, the front end of the conductive pin 261 is in contact with the connection terminal 268 of a component member, such as the developing roller 211, which is installed inside the main body 202. The conductive spring 269 is connected to the conductive pin 261 to push the conductive pin 261 to contact the connection terminal 268. The conductive plate member 2112 is connected to the end of the conductive spring 269.

The conductive pin 262 is slidable in the direction along its axial center, and when the power feeding panel 253 is turned to the CLOSED position, the front end of the conductive pin 262 is in contact with the connection terminal 252 of the high voltage power supply 251. The conductive spring 270 is connected to the conductive pins 262 to push the conductive pin 262 to contact the connection terminal 252. A conductive plate member 2122 is connected to the end of the conductive spring 270.

The cord 264 with an insulating coating layer is connected to the conductive plate member 2112 at one end and connected to the conductive plate member 2122 at the other end.

The conductive plate member 2112 and the conductive plate member 2122 are respectively fitted in and screwed to the guide ribs 283, which are arranged on the insulating plate 256, and thereby, the conductive plate members 2112 and 2122 are attached to the insulating plate 256.

With the power feeding structure 2121, when the power feeding panel 253, which is attached to the main body 202, is turned to the CLOSED position to cover the opened portion 202*a* of the main body 202, the front end of the conductive pin 261 is in contact with the connection terminal 268 of the component member, such as the developing roller 211, and the front end of the conductive pin 262 is in contact with the connection terminal 252 of the high voltage power supply 251; therefore, the high voltage power supply is able to feed electric power to the component members.

Sixth Embodiment

Figure 55:
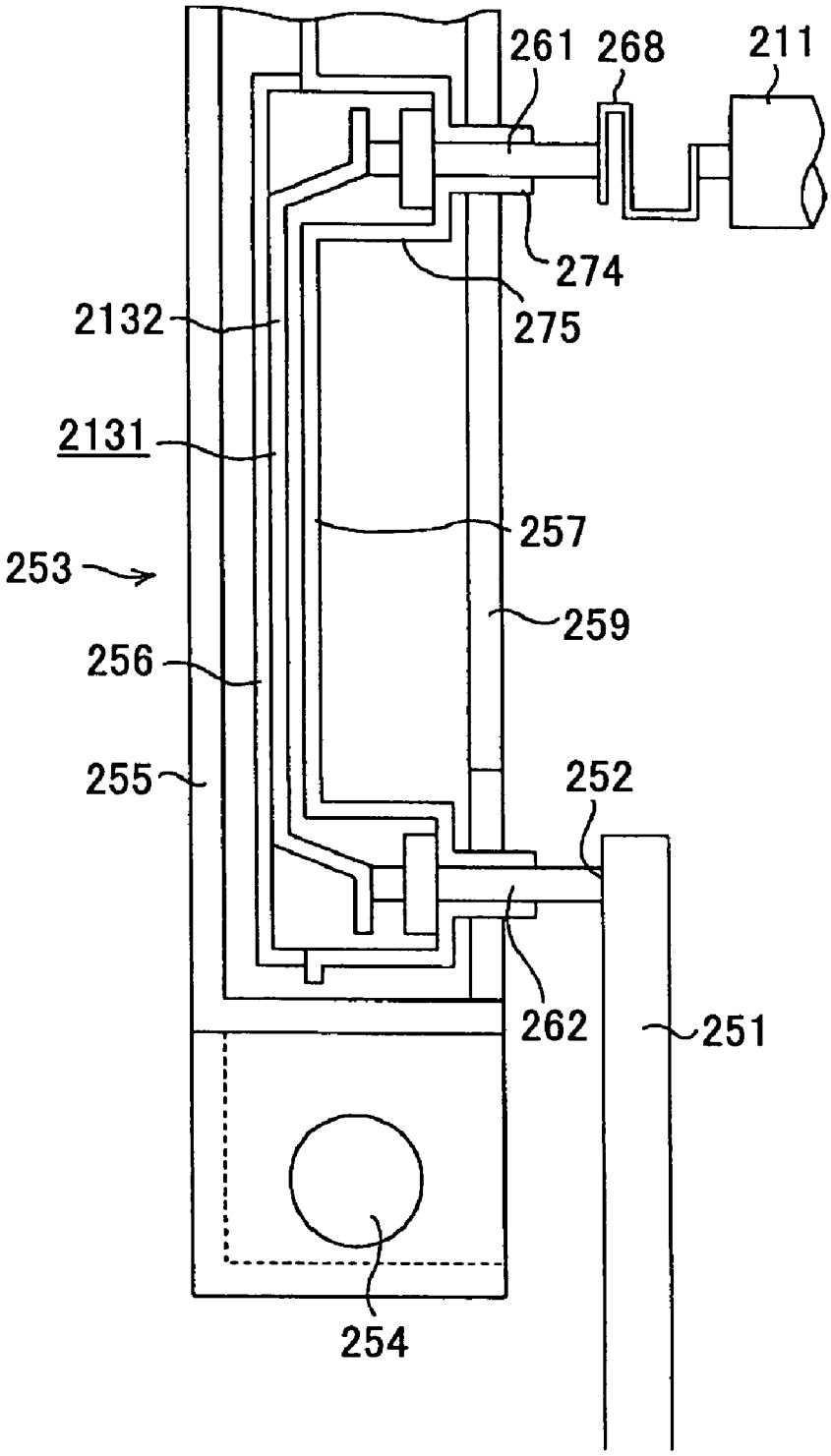
FIG. 55 is a cross-sectional view of a principal portion of the power feeding panel 253 according to a sixth embodiment.

FIG. 55 is a cross-sectional view of a principal portion of the power feeding panel 253 according to the sixth embodiment. In the following description, the same reference numerals are used for the same components as those in the previous embodiments, and overlapping explanations are omitted.

In this embodiment, the power feeding panel 253 includes a power feeding structure 2131, which is different from the power feeding structures in the previous embodiments.

In the power feeding structure 2131, the conductive pin 261 is slidable in the direction along its axial center, and when the power feeding panel 253 is turned to the CLOSED position, the front end of the conductive pin 261 is in contact with the connection terminal 268 of a component member, such as the developing roller 211, which is installed inside the main body 202.

The conductive pin 262 is slidable in the direction along its axial center, and when the power feeding panel 253 is turned to the CLOSED position, the front end of the conductive pin 262 is in contact with the connection terminal 252 of the high voltage power supply 251.

A conductive urging plate 2132 is connected to the back end of the conductive pin 261 and the back end of the conductive pin 262 and pushes the conductive pins 261 and 262 to contact the connection terminals 268 and 252.

The conductive urging plate 2132 is fitted in and screwed to guide ribs arranged on the insulating plate 256, and thereby, the conductive urging plate 2132 is attached to the insulating plate 256.

With the power feeding structure 2121, when the power feeding panel 253, which is attached to the main body 202, is turned to the CLOSED position to cover the opened portion 202*a* of the main body 202, the front end of the conductive pin 261 is in contact with the connection terminal 268 of the component member, such as the developing roller 211, and the front end of the conductive pin 262 is in contact with the connection terminal 252 of the high voltage power supply 251; therefore, the high voltage power supply is able to feed electric power to the component members.

Figure 56:
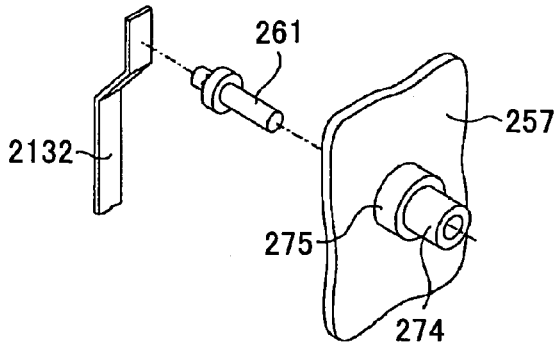
FIG. 56 is an exploded perspective view of the conductive urging plate 2132 and the insulating plate 257, showing an example of a connection method of them.

FIG. 56 is an exploded perspective view of the conductive urging plate 2132 and the insulating plate 257, showing an example of a connection method of them.

As illustrated in FIG. 56, the back end of the conductive pin 261 is flat, and the portion of the conductive urging plate 2132 contacting with the conductive pin 261 is also flat. With such a configuration, when the power feeding panel 253 is turned to the CLOSED position, because the flat end of the conductive pin 261 is in contact with the flat portion of the conductive urging plate 2132, the contacting area between the conductive pin 261 and the conductive urging plate 2132 is increased, the contacting electrical resistance between the conductive pin 261 and the conductive urging plate 2132 is lowered, and consequently, efficiency of power feeding is improved.

Figure 57:
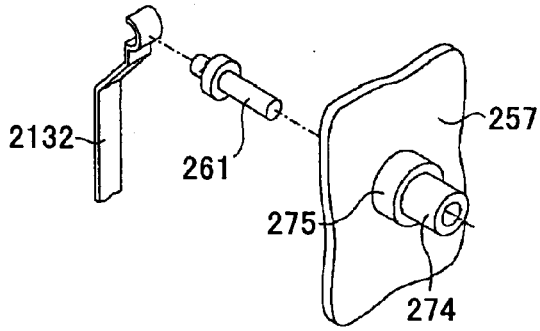
FIG. 57 is an exploded perspective view of the conductive urging plate 2132 and the insulating plate 257, showing another example of the connection method of them.

FIG. 57 is an exploded perspective view of the conductive urging plate 2132 and the insulating plate 257, showing another example of the connection method of them.

As illustrated in FIG. 57, the back end of the conductive pin 261 is flat, and the portion of the conductive urging plate 2132 contacting the conductive pin 261 is a projecting arc. With such a configuration, when the power feeding panel 253 is turned to the CLOSED position, even the position of the conductive pin 261 shifts somehow, the conductive pin 261 can be still in firm contact with the projected arc portion of the conductive urging plate 2132, enabling stable connection condition between the conductive pin 261 and the conductive urging plate 2132, and stable power supply.

Figure 58:
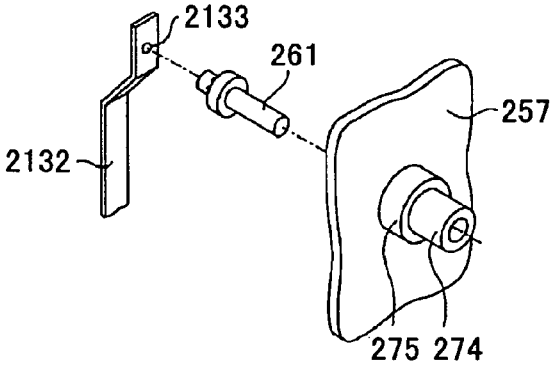
FIG. 58 is an exploded perspective view of the conductive urging plate 2132 and the insulating plate 257, showing another example of the connection method of them.

FIG. 58 is an exploded perspective view of the conductive urging plate 2132 and the insulating plate 257, showing another example of the connection method of them.

As illustrated in FIG. 58, the back end of the conductive pin 261 is flat, and the portion of the conductive urging plate 2132 contacting the conductive pin 261 is a projecting semi-sphere 2133. With such a configuration, when the power feeding panel 253 is turned to the CLOSED position, even the position of the conductive pin 261 shifts somehow, the conductive pin 261 can be still in firm contact with the projecting semi-sphere 2133 of the conductive urging plate 2132, enabling a stable connection condition between the conductive pin 261 and the conductive urging plate 2132, and a stable power supply.

Figure 59:
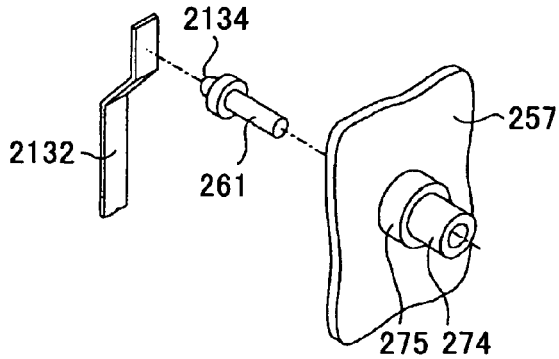
FIG. 59 is an exploded perspective view of the conductive urging plate 2132 and the insulating plate 257, showing another example of the connection method of them.

FIG. 59 is an exploded perspective view of the conductive urging plate 2132 and the insulating plate 257, showing another example of the connection method of them.

As illustrated in FIG. 59, the back end of the conductive pin 261 is a semi-sphere 2134, and the portion of the conductive urging plate 2132 contacting the conductive pin 261 is flat. With such a configuration, when the power feeding panel 253 is turned to the CLOSED position, even the position of the conductive pin 261 shifts somehow on the conductive urging plate 2132, the semi-spherical end of the conductive pin 261 can be still in firm contact with the conductive urging plate 2132, enabling stable connection condition between the conductive pin 261 and the conductive urging plate 2132, and stable power supply.

In the connection structures illustrated in FIG. 56 through FIG. 59, conductive grease may be applied between the conductive pin 261 and the conductive urging plate 2132 to improve electrical conductivity between the conductive pin 261 and the conductive urging plate 2132.

The conductive pin 261 and the conductive urging plate 2132 may be formed by combinations of the following materials.

(1) the conductive pin 261 is formed from a steel rod, and the conductive urging plate 2132 is formed from a steel plate.
(2) the conductive pin 261 is formed from a steel rod, and the conductive urging plate 2132 is formed from a copper plate.
(3) the conductive pin 261 is formed from a copper rod, and the conductive urging plate 2132 is formed from a steel plate.
(4) the conductive pin 261 is formed from a copper rod, and the conductive urging plate 2132 is formed from a copper plate.
(5) a nickel layer is formed on the surface of either the conductive pin 261 or the conductive urging plate 2132.
(6) nickel layers are formed on the respective surfaces of the conductive pin 261 and the conductive urging plate 2132.
(7) a copper layer is formed on the surface of either the conductive pin 261 or the conductive urging plate 2132, and a nickel layer is further formed on the copper layer.
(8) copper layers are formed on the respective surfaces of the conductive pin 261 and the conductive urging plate 2132, and nickel layers are further formed on the copper layers.

Below, an explanation is made of the forces applied by the conductive plate members 2132.

In the present embodiment, a number of the conductive pins 261, 262 and the conductive plate members 2132, which push the corresponding conductive pins 261, 262, are formed on the power feeding panel 253.

When there are many conductive pins 261, 262 and conductive plate members 2132, especially when the forces applied by the conductive plate members 2132 on the conductive pins 261, 262 are sufficiently large, it is crucial that the forces applied by the conductive plate members 2132 be uniform in order to maintain a good connection condition of the conductive pins 261, 262 when the power feeding panel 253 mounted on the main body 202 is turned to the CLOSED position to bring the conductive pins 261, 262 into contact with the connection terminals 268, 252 in the main body 202. If the forces applied by the conductive plate members 2132 are not uniform, the insulating plates 256, 257, 258, which accept forces from the conductive plate members 2132, may be deformed.

In this embodiment, the forces of the conductive plate members 2132 are set to be small, for example, from 0.5 N to 1.5 N, and the forces of the conductive plate members 2132 are set to the same value.

Due to this setting, the deformation of the insulating plates 256, 257, 258 caused by the large reactive forces from the conductive plate members 2132 does not occur. Furthermore, even if the forces of the conductive plate members 2132 are large, the deformation of the insulating plates 256, 257, 258 caused by the reactive forces from the conductive plate members 2132 does not occur. Therefore, good connection conditions are obtainable for all the conductive pins 261, 262 and the connection terminals 268, 252.

On the other hand, when a number of the conductive plate members 2132 are provided to push a number of the conductive pins 261, 262 in the power feeding panel 253, it is also possible to set the force of one of the conductive plate members 2132 larger than those of other conductive plate members 2132. For example, this setting is necessary when one of the conductive pin 261 or 262 should be pushed by a larger force than the other conductive pins 261, 262. In this case, in order to prevent the deformation of the insulating plates 257, 258, or 259 at a position corresponding to the conductive pin that is pushed more strongly than the other conductive pins 261, 262, a deformation-prevention member, for example, a hook, or a spring may be provided to elastically engage the insulating plates 257, 258, and 259 with the case 255 or the positioning plate 259. Due to this, even when one of the conductive pin 261 or 262 accepts a larger force than the other conductive pins 261, 262, it is possible to prevent the deformation of the insulating plates 257, 258, or 259 at the position corresponding to that conductive pin, ensuring good connection conditions of all the conductive pins 261, 262 with conductive plate members 2132.

Seventh Embodiment

Figure 60:
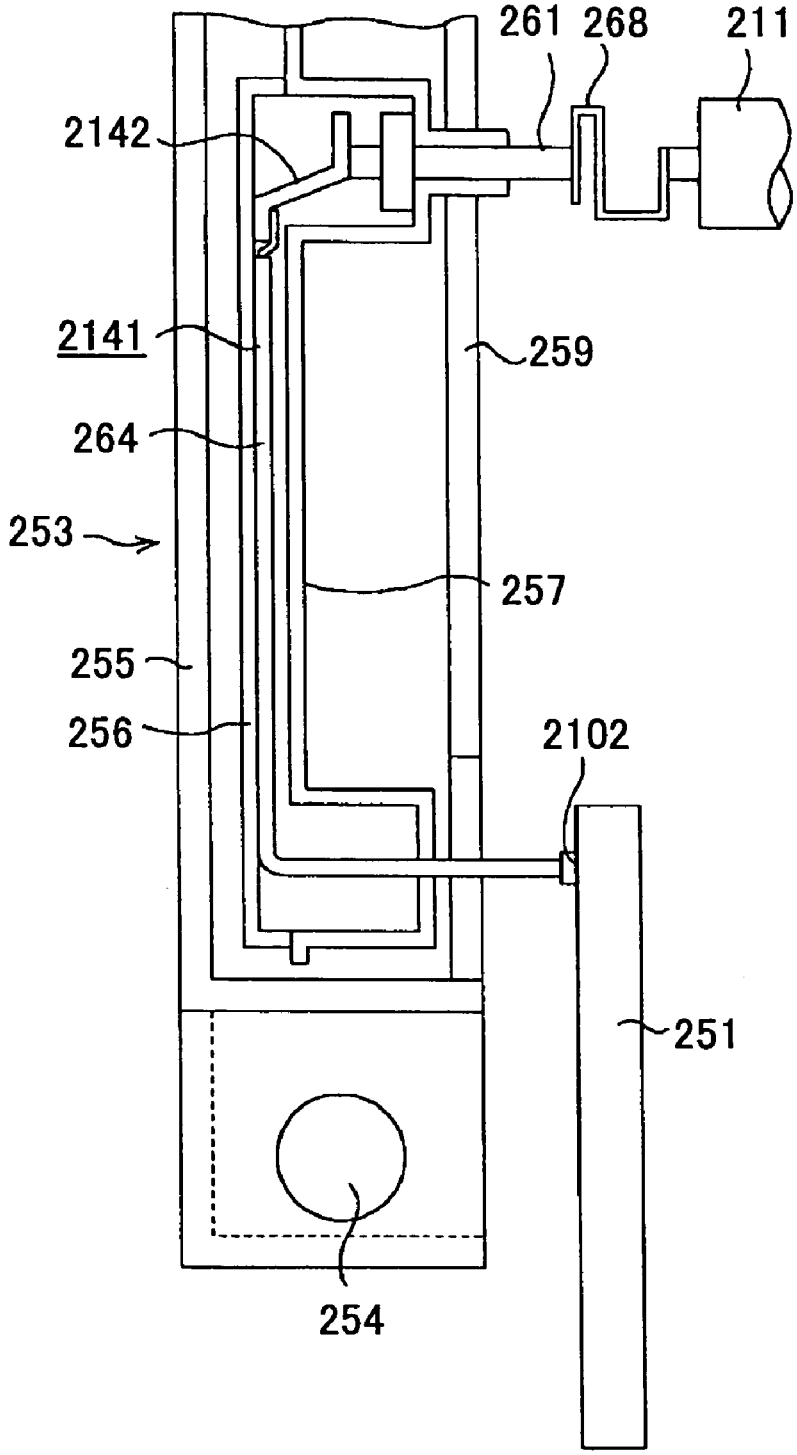
FIG. 60 is a cross-sectional view of a principal portion of the power feeding panel 253 according to a seventh embodiment.

FIG. 60 is a cross-sectional view of a principal portion of the power feeding panel 253 according to the seventh embodiment. In the following description, the same reference numerals are used for the same components as those in the previous embodiments, and overlapping explanations are omitted.

In this embodiment, the power feeding panel 253 includes a power feeding structure 2141., which is different from the power feeding structures in the previous embodiments.

In the power feeding structure 2141, the conductive pin 261 is slidable in the direction along its axial center, and when the power feeding panel 253 is turned to the CLOSED position, the front end of the conductive pin 261 is in contact with the connection terminal 268 of a component member, such as, the developing roller 211, which is installed inside the main body 202.

A conductive urging plate 2142 is connected to the back end of the conductive pin 261 to push the conductive pin 261 to contact the connection terminal 268.

The two ends of the cord 264 with an insulating coating are respectively connected with the conductive urging plate 2142 and the connection terminal 252 of the high voltage power supply 251. For example, the cord 264 and the connection terminal 2102 of the high voltage power supply 251 are connected by a connector.

The conductive urging plate 2142 is fitted in and screwed to guide ribs arranged on the insulating plate 256, and thereby, the conductive urging plate 2142 is attached to the insulating plate 256.

With the power feeding structure 2141, when the power feeding panel 253, which is attached to the main body 202, is turned to the CLOSED position to cover the opened portion 202*a* of the main body 202, the front end of the conductive pin 261 is in contact with the connection terminal 268 of the component member, such as the developing roller 211, and the cord 264 is in connected with the connection terminal 252 of the high voltage power supply 251; therefore, the high voltage power supply is able to feed electric power to the component members.

Eighth Embodiment

Figure 61:
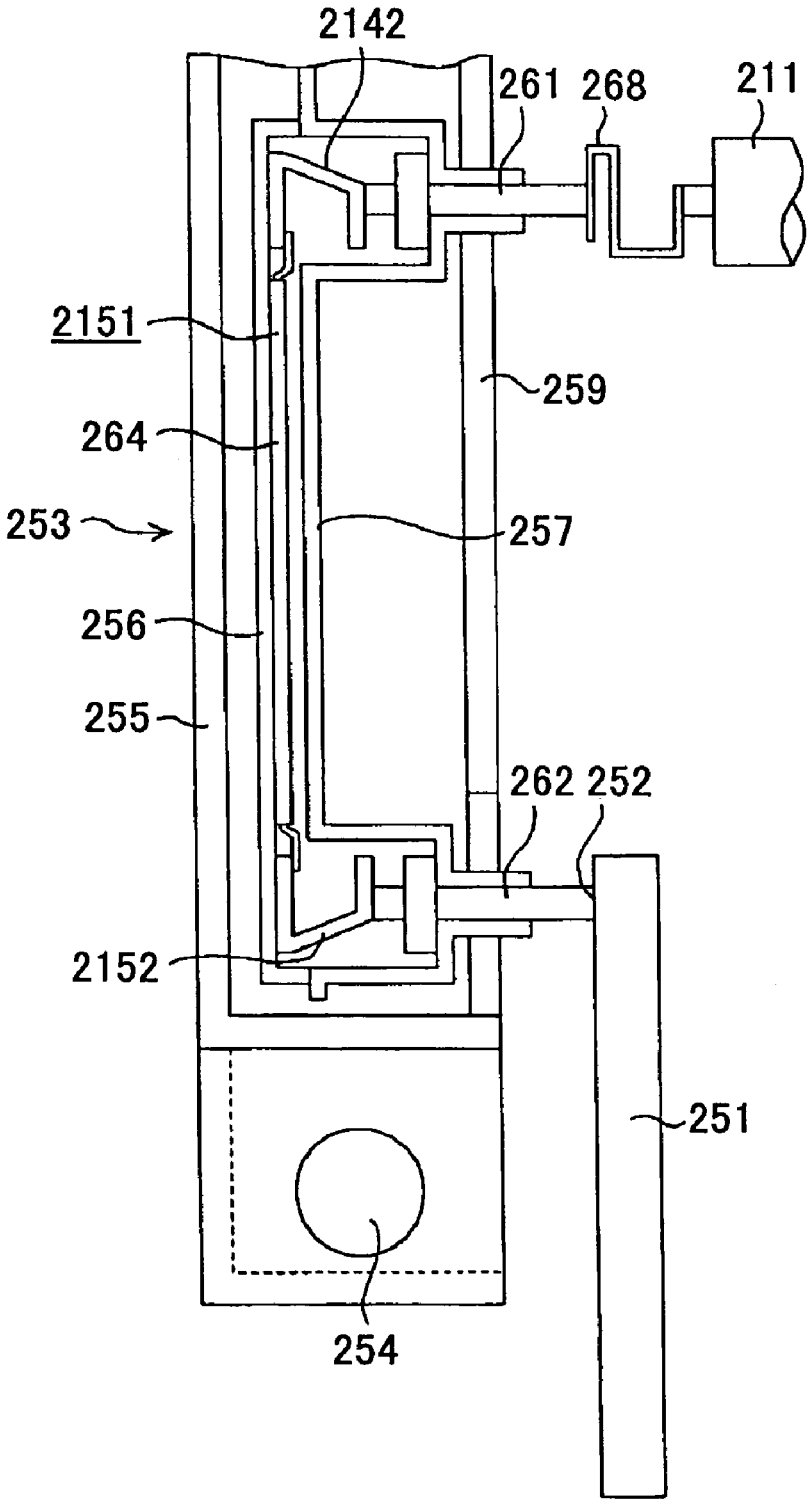
FIG. 61 is a cross-sectional view of a principal portion of the power feeding panel 253 according to an eighth embodiment.

FIG. 61 is a cross-sectional view of a principal portion of the power feeding panel 253 according to the eighth embodiment. In the following description, the same reference numerals are used for the same components as those in the previous embodiments, and overlapping explanations are omitted.

In this embodiment, the power feeding panel 253 includes a power feeding structure 2151, which is different from the power feeding structures in the previous embodiments.

In the power feeding structure 2151, the conductive pin 261 is slidable in the direction along its axial center, and when the power feeding panel 253 is turned to the CLOSED position, the front end of the conductive pin 261 is in contact with the connection terminal 268 of a component member, such as the developing roller 211, which is installed inside the main body 202.

The conductive urging plate 2142 is connected to the back end of the conductive pin 261 to push the conductive pin 261 to contact the connection terminal 268.

The conductive pin 262 is slidable in the direction along its axial center, and when the power feeding panel 253 is turned to the CLOSED position, the front end of the conductive pin 262 is in contact with the connection terminal 252 of the high voltage power supply 251.

A conductive plate member 2152 is connected with the back end of the conductive pin 262 to push the conductive pin 262 to contact the connection terminal 252.

The cord 264 with an insulating coating is connected with the conductive urging plate 2142 and conductive plate member 2152.

The conductive plate members 2142, 2152 are fitted in and screwed to guide ribs on the insulating plate 256, and thereby, the conductive plate members 2142, 2152 are attached to the insulating plate 256.

With the power feeding structure 2151, when the power feeding panel 253, which is attached to the main body 202, is turned to the CLOSED position to cover the opened portion 202*a* of the main body 202, the front end of the conductive pin 261 is in contact with the connection terminal 268 of the component member, such as the developing roller 211, and the front end of the conductive pin 262 is in contact with the connection terminal 252 of the high voltage power supply 251; therefore, the high voltage power supply is able to feed electric power to the component members.

Ninth Embodiment

Figure 62:
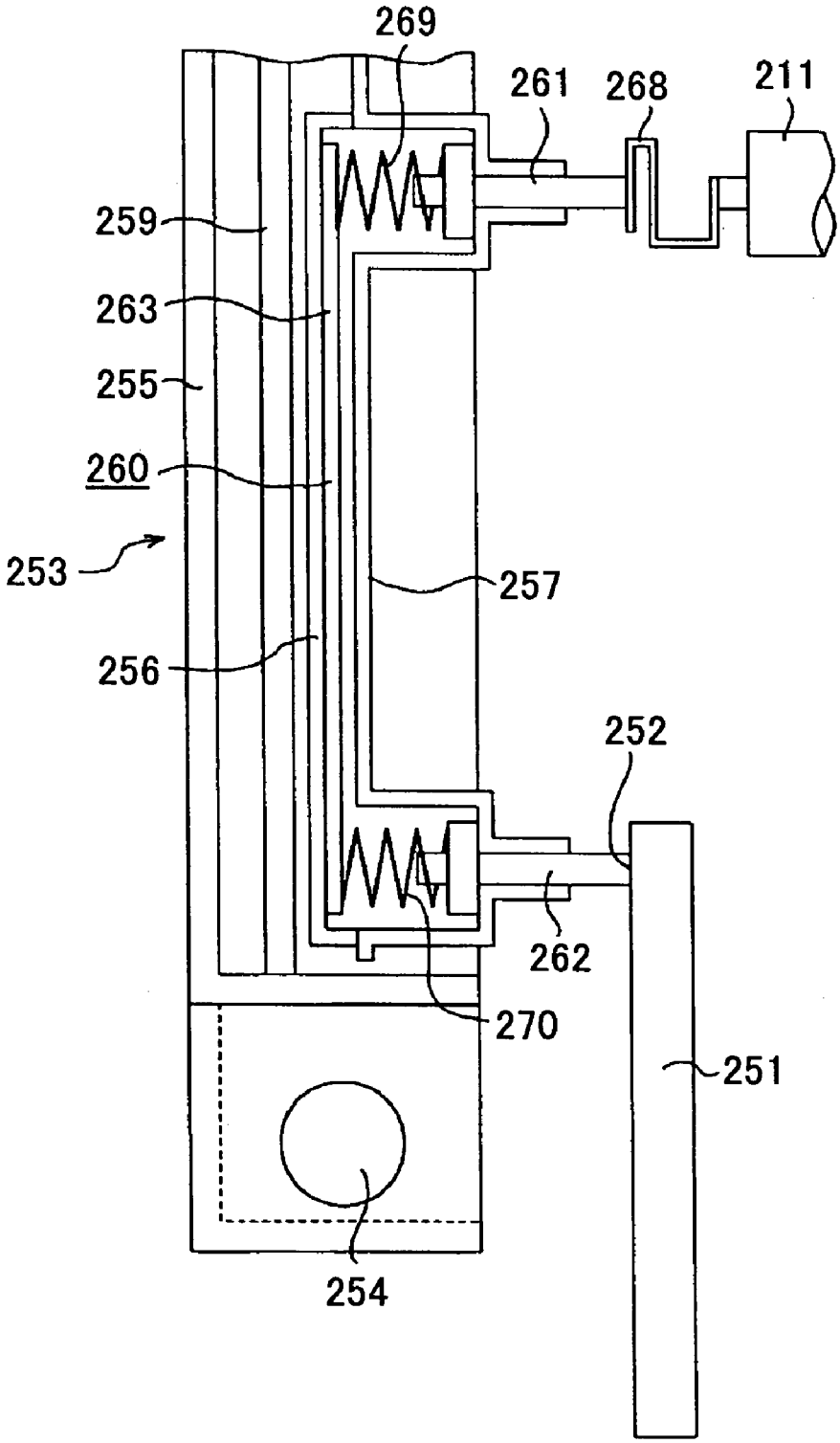
FIG. 62 is a cross-sectional view of a principal portion of the power feeding panel 253 according to a ninth embodiment.

FIG. 62 is a cross-sectional view of a principal portion of the power feeding panel 253 according to the ninth embodiment. In the following description, the same reference numerals are used for the same components as those in the previous embodiments, and overlapping explanations are omitted.

In this embodiment, the arrangement of the positioning plate 259 is different from that in the previous embodiments.

When the power feeding panel 253, including the positioning plate 259, is turned to the CLOSED position to cover the opened portion 202*a* of the main body 202, the positioning plate 259 is at a position further from the main body 202 than the insulating plates 256, 257, and 258. In other words, when the power feeding panel 253 is turned to the CLOSED position, the insulating plates 256, 257, and 258 are close to the opened portion 202*a* of the main body 202, and the positioning plate 259 is outside the insulating plates 256, 257, and 257.

With this configuration, the photo conductors 209, the charging rollers 210 and others, which are held by the positioning plate 259, are far from the positioning plate 259, and the insulating plates 256, 257, and 258 are between the positioning plate 259 and the photo conductors 209, the charging rollers 210 and so on; therefore, even when the positioning plate 259 is formed from a steel plate, it is possible to prevent electric leakage due to discharging through the air between the positioning plate 259 and the photo conductors 209, the charging rollers 210 and so on.

Effects of the second through ninth embodiments are summarized below.

The power feeding panel 253 is rotatably attached to the front side of the main body 202, and includes the case 255, insulating plates 256, 257, 258, the positioning plate 259, and the power feeding structure 260 (and others) arranged on the insulating plates 256, 257, and 258. The power feeding structure 260 includes the conductive pins 261 and 262, the conductive plate member 263, and cords 264 coated with insulating layer.

With the above configuration, when the power feeding panel 253 is turned to the CLOSED position, the high voltage supply 251 is connected with the developing roller 211, the charging roller 210 or other component members through the power feeding structure 260, and thereby the high voltage supply 251 can supply electric power to the component members.

Because the power feeding structure 260 is located in the power feeding panel 253, and power feeding is enabled by just closing the power feeding panel 253, it is not necessary to arrange power cords for supplying electric power to the component members in the main body 202 of the image forming apparatus, making the power cord arrangement inside the main body very simple.

In addition, because of the power feeding panel 253, the high voltage connection terminals and the connection terminals of the component members are near the opened portion 202*a*, it is easy to confirm the connection condition of them, and even when the connection terminals have a problem, it is easy to find the problem and fix it easily and quickly.

Because the conductive springs 269, 270 or conductive urging plates push the conductive pins 261, 262 to contact the connection terminals, stable connection conditions of the conductive pins 261, 262 and the connection terminals 268, 252 can be obtained, and thereby the power supply process is also stable.

Because the cord 264 is fixed to the high voltage connection terminal 252, the operation of fixing the cord 264 to the high voltage connection terminals becomes easy. In addition, even if the power feeding panel 253 is repeatedly opened and closed, good connection condition between the cord 264 and the high voltage connection terminal 251 (and others) can be maintained.

When a number of the power feeding structures are provided, even if the cords of these power feeding structures contact each other, because of the insulating coating of these cords 264, electric leakage does not occur at the contacting positions, making lay-out of the cords 264 easy.

By using the conductive urging plates, the number of parts of the power feeding structure is reduced; therefore the power feeding structure become simple. Further, because the number of the contacting points is reduced, electrical resistances at the contacting points are reduced.

Because the power feeding structure is arranged on the insulating plates, which is a multi-layer structure, the insulating condition of the power feeding structure is good, preventing electrical leakage from the power feeding structure. With a larger number of the insulating plates, the number of components of the power feeding structure can also be increased.

Because the power feeding structure can be arranged on both the front side and the back side of the insulating plates, the space around the insulating plates can be utilized efficiently.

Because ribs are formed between adjacent guide ribs, the surface distance of the insulating plates between two adjacent conductive plate members is increased, and this reduces the magnitude of the surface electric current flowing through the insulating plates between two adjacent conductive plate members 2112, thereby reducing leakage of the surface electric current.

When using screws to connect the insulating plates, it is possible to prevent disengagement of the insulating plates due to vibration or shock when being dropped. When connecting the insulating plates by hooks and holes, the structure become simple and inexpensive.

When the positioning plate is placed closer to the main body 202 than the insulating plates when the power feeding panel 253 is at the CLOSED position, the component members can be firmly held by the positioning plate without position shifts.

When the positioning plate is placed further from the main body 202 than the insulating plates when the power feeding panel 253 is at the CLOSED position, even if the positioning plate is formed from a steel plate, it is possible to prevent electric leakage due to air discharging between the positioning plate and the component members.

When using screws to connect the insulating plates and the positioning plate, it is possible to prevent disengagement of the insulating plates and the positioning plate due to vibration or shock when being dropped. When connecting the insulating plates and the positioning plate by hooks and holes, the structure become simple and inexpensive.

By providing clearance between members in the power feeding structure when one member is inserted into another member and applying conductive grease therebetween, it is possible to improve sliding ability of the slidable members and electrical conductivity at the contacting positions.

By making contacting portions of the members in the power feeding structure tapered surfaces, or round surfaces, it is easy to perform insertion of the members, thereby facilitating operation of assembling the power feeding panel 253. With a round surface, it is possible to prevent the members to be inserted from being damaged by the contacting portions.

Because the conductive pins 261 and 262 are slidably inserted into the pin guide tube 274, the conductive pins 261 and 262 can be firmly held. The stopping portion 272 is in contact with the step portion between the pin guide tube 274 and the spring guide tube 275; thereby it is possible to prevent the conductive pin 261 from falling off from the insulating plate 257.

Because the conductive spring 269 (or 270) is inserted into the spring guide tube 275, the conductive spring 269 can be reliably held.

When the front end of the conductive pin 261 is flat and the corresponding portion of the connection terminal 268 is also flat, the contacting area between the conductive pin 261 and the connection terminal 268 is increased, the contacting electrical resistance between them is lowered, and consequently, efficiency of power feeding is improved.

When the front end of the conductive pin 261 is flat, and the corresponding portion of the connection terminal 268 is a projecting arc or a projecting semi-sphere, even if the position of the conductive pin 261 shifts somehow, the conductive pin 261 can be still in firm contact with the projected arc portion of the connection terminal 268, enabling a stable connection condition between the conductive pin 261 and the connection terminal 268, and a stable power supply.

When the front end of the conductive pin 261 is flat, and the connection terminal 268 is L-shaped, because both the front end and the side surface of the conductive pin 261 are in contact with the connection terminal 268, the contacting area between the conductive pin 261 and the connection terminal 268 is greatly increased, the contacting electrical resistance between the conductive pin 261 and the connection terminal 268 is lowered, and consequently, efficiency of power feeding is greatly improved.

Similarly, when the front end of the conductive pin 261 is a semi-sphere, and the corresponding portion of the connection terminal 268 is flat, even if the position of the conductive pin 261 shifts somehow on the connection terminal 268, the semi-sphere front end of the conductive pin 261 can be still in firm contact with the connection terminal 268, enabling a stable connection condition between the conductive pin 261 and the connection terminal 268, and a stable power supply.

When the front end of the conductive pin 261 is a semi-sphere, and a conical recess 293 is formed in the corresponding portion of the connection terminal 268, the conductive pin 261 is in firm contact with the connection terminal 268, and this enables a stable connection condition between the conductive pin 261 and the connection terminal 268, and a stable power supply.

When using a cross slit 285, or an I-shaped slit 286 on the conductive plate member 263 and a projection 284 on the insulating plate 256, attachment of the conductive plate member 263 to the insulating plate 256 can be performed by a simple and inexpensive structure. When using two projections 287 on the two sides of the conductive plate member 263, the guide rib 283 can firmly catch the conductive plate member 263.

Because the conductive pins or other members of the power feeding structure are formed from steel or copper, the conductivity of them is good.

Because nickel layers are formed on one of two contacting members, it is possible to prevent erosion. Further, when nickel layers are formed on both of the two contacting members, it is possible to prevent erosion and prevent the two members from being damaged by each other.

Further, when both nickel layers and copper layers are formed, both conductivity and erosion resistance are improved. Further, when both nickel layers and copper layers are formed on both of the two contacting members, conductivity and erosion resistance are further improved.

When the projection 294 is formed on the insulating plate 256 and a hole 295 is formed on the conductive plate 263, when the conductive plate 263 is fixed to the insulating plate 256, the projection 294 penetrate through the hole 295, and is inserted into the conductive spring 269 (or the conductive spring 270). Therefore, when assembling the power feeding panel 253, the projection 294 acts as a guide of the conductive spring 269 or 270, and this makes the assembly operation easy.

By using the bent plates 297 or 298, the wire of the conductive spring 269 can be firmly held, and this makes the assembly operation easy, which enables stable connection condition between the conductive spring 269 and the conductive plate 263, and stable power supply.

Because the forces of many conductive springs 269, 270 are set to be small, for example, from 0.5 N to 1.5 N, the deformation of the insulating plates 256, 257, 258 caused by the large reactive forces from the conductive springs 269, 270 does not occur. Because the forces of the conductive springs 269, 270 are set to the same value, even if the forces of the conductive springs 269, 270 are large, the deformation of the insulating plates 256, 257, 258 caused by the reactive forces from the conductive springs 269, 270 does not occur. This leads to good connection conditions of all the conductive pins 261, 262 with the connection terminals 268, 252.

Even when setting the force of one conductive spring larger than other conductive springs 269, 270, by providing a deformation-prevention member to elastically engage the insulating plates 257, 258, and 259 with the case 255 or the-positioning plate 259, it is possible to prevent the deformation of the insulating plates 257, 258, or 259 at a position acted on by that conductive pin, and this ensures good connection conditions of all the conductive pins 261, 262 with the connection terminals 268, 252.

When the back end of the conductive pin 261 is flat, and the corresponding portion of the conductive urging plate 2132 is also flat, the contacting area between the conductive pin 261 and the conductive urging plate 2132 is increased, the contacting electrical resistance between the conductive pin 261 and the conductive urging plate 2132 is lowered, and consequently, efficiency of power feeding is improved.

When the back end of the conductive pin 261 is flat, and the corresponding portion of the conductive urging plate 2132 is a projecting arc or a projecting semi-sphere, even the position of the conductive pin 261 shifts somehow, the conductive pin 261 can be still in firm contact with the projected arc portion of the conductive urging plate 2132, enabling stable connection condition between the conductive pin 261 and the conductive urging plate 2132, and stable power supply.

When the back end of the conductive pin 261 is a semi-sphere, and the corresponding portion of the conductive urging plate 2132 is flat, even if the position of the conductive pin 261 shifts somehow on the conductive urging plate 2132, the semi-spherical end of the conductive pin 261 can be still in firm contact with the conductive urging plate 2132, enabling a stable connection condition between the conductive pin 261 and the conductive urging plate 2132, and a stable power supply.

10th Embodiment

In the present embodiment, a color printer having a tandem engine configuration and capable of full-color printing is used as an example.

The basic configuration of the color printer of the present embodiment is the same as that illustrated in FIG. 1. Below, the same reference numbers are used for the same elements as those in the first embodiment, and overlapping explanation is omitted.

In the color printer shown in FIG. 1, the image forming units 8Y, 8C, 8M, 8BK and the intermediate transfer unit 7 are detachably attached to the main body 1. A high voltage power supply 3110 supplies electric power to the image forming units 8Y, 8C, 8M, 8BK, the intermediate transfer belt 7*a*, the rollers 4, 5, 6, the secondary transfer roller 20, the belt cleaning device 21, and so on. Below, such members are referred to as component members of the color printer.

Figure 63:
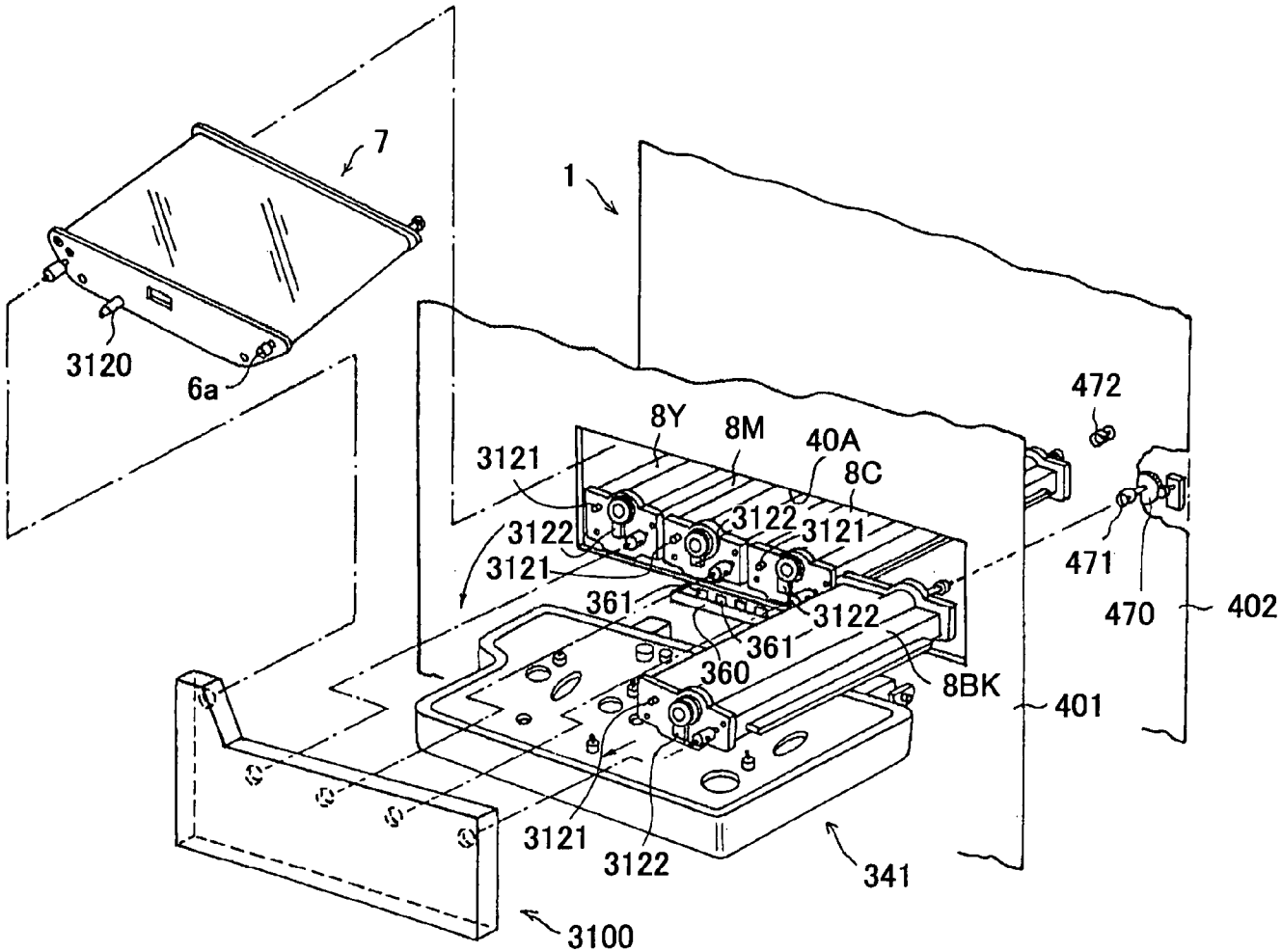
FIG. 63 is an exploded perspective view of the main body 1 according to a 10th embodiment of the present invention, showing a structure near the opened portion 40A for holding and positioning the image forming units 8Y, 8C, 8M, 8BK and the intermediate transfer unit 7.

FIG. 63 is an exploded perspective view of the main body 1 showing a structure near the opened portion 40A for holding and positioning the image forming units 8Y, 8C, 8M, 8BK and the intermediate transfer unit 7.

As illustrated in FIG. 63, the main body 1 has side panels 401 and 402, and the opened portion 40A is formed on the side panel 401. The image forming units 8Y, 8C, 8M, 8BK and the intermediate transfer unit 7 can be attached to or detached from the main body 1 through the opened portion 40A.

In the present embodiment, the image forming units 8Y, 8C, 8M, 8BK and the intermediate transfer unit 7 are arranged on a slope relative to the main body 1. For this reason, the opened portion 40A is formed at an angle to match the direction of the arrangement of the image forming units 8Y, 8C, 8M, 8BK. In FIG. 63, for simplicity, the opened portion 40A and the image forming units 8Y, 8C, 8M, 8BK are horizontally illustrated. The opened portion 40A is formed for facilitating exchange of parts in the image forming units 8Y, 8C, 8M, 8BK and the intermediate transfer unit 7.

On the side panel 402 opposite to the side panel 401, a driving unit 470 for driving the photo conductors 10 of the image forming units 8Y, 8C, 8M, 8BK and the driving roller 6 of the intermediate transfer unit 7, couplings 471 connected to axles of the photo conductors 10, and a coupling 472 connected to the axle 6*a* of the roller 6 of the intermediate transfer unit 7 are arranged at positions corresponding to the image forming units 8Y, 8C, 8M, 8BK and the intermediate transfer unit 7.

A tank 3100 is arranged to recycle used toners output from the image forming units 8Y, 8C, 8M, 8BK and the intermediate transfer unit 7. The tank 3100 is detachably attached to the main body 1 so that it can be exchanged when it is fully filled.

As illustrated in FIG. 2, a front panel 341 is rotatably attached to the side panel 401 of the main body 1. When the front panel 341 is rotated to the CLOSED position to cover the opened portion 40A, the front panel 341 fits with the image forming units 8Y, 8C, 8M, 8BK and the intermediate transfer unit 7, and holds these units. When the front panel 341 is rotated to the OPENED position, the opened portion 40A is exposed.

That is, the front panel 341 acts as a cover to cover and expose the opened portion 40A, and also maintains the photo conductors 10 of the image forming units 8Y, 8C, 8M, 8BK and the roller 6 in the intermediate transfer unit 7 to be urged in a specific direction to define the relative positional relations of these units.

As illustrated in FIG. 63, terminals 3120 are arranged on the intermediate transfer unit 7, terminals 3121 are arranged on the developing roller, and terminals 3122 are arranged on the photo conductors 10 of the image forming units 8Y, 8C, 8M, 8BK. These terminals 3120, 3121, and 3122 are for supplying electric power from the high voltage power supply 110 to the component members. Of course, terminals are also arranged on other units of the color printer, and illustration of these terminals is omitted for simplicity.

The structure of the front panel 341 is similar with that illustrated in FIG. 3. Specifically, the front panel 341 includes a cover 42, a positioning member 44, a bias setting member 45, insulating members 380, and power feeding members 390, 391, 391. The insulating members 380 and power feeding members 390, 391, 391 are described below with reference to FIG. 65.

A high voltage terminal unit 360 is provided below the opened portion 40A, which includes a number of high voltage terminals 361 for connection with the high voltage power supply 3110 (FIG. 1).

Figure 64:
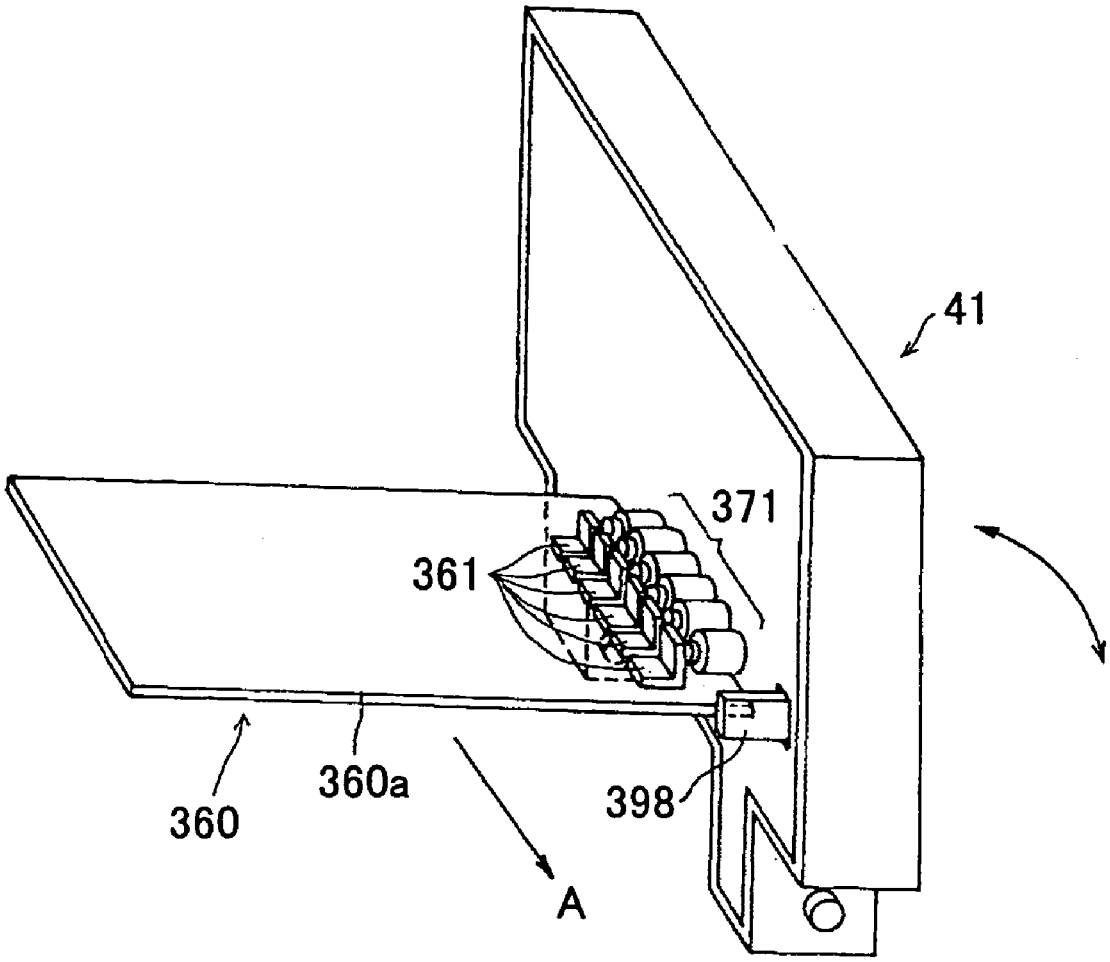
FIG. 64 is a perspective view of the high voltage terminal unit 360 and the position relation with terminals 371 on the front panel 341.

FIG. 64 is a perspective view of the high voltage terminal unit 360 and the positional relations with terminals 371 on the front panel 341.

As illustrated in FIG. 64, terminals 371 are attached to the front panel 341. Each of the terminals 361 is in an L-shape. When the front panel 341 is turned to the CLOSED position, as that shown in FIG. 64, the high voltage terminals 361 are brought into contact with the terminals 371.

The high voltage terminal unit 360 is detachably attached to the main body 1. In this embodiment, the high voltage terminal unit 360 can be attached to or detached from the main body 1 in the direction A from the inside of the main body 1.

A projecting stopper 398 is formed on the front panel 341. When the front panel 341 is turned to the CLOSED position, the stopper 398 latches the plate 360*a* of the high voltage terminal unit 360 to restrain movement of the high voltage terminal unit 360 in the direction A. On the other hand, when the front panel 341 is turned to the OPENED position, the stopper 398 does not contact the high voltage terminal unit 360. That is, when the front panel 341 is turned to the OPENED position, the high voltage terminal unit 360 is detachable, and when the front panel 341 is turned to the CLOSED position, the high voltage terminal unit 360 is held at the specified position, thereby, the position correspondence between terminals 361 and terminals 371 are reliably maintained.

Figure 65:
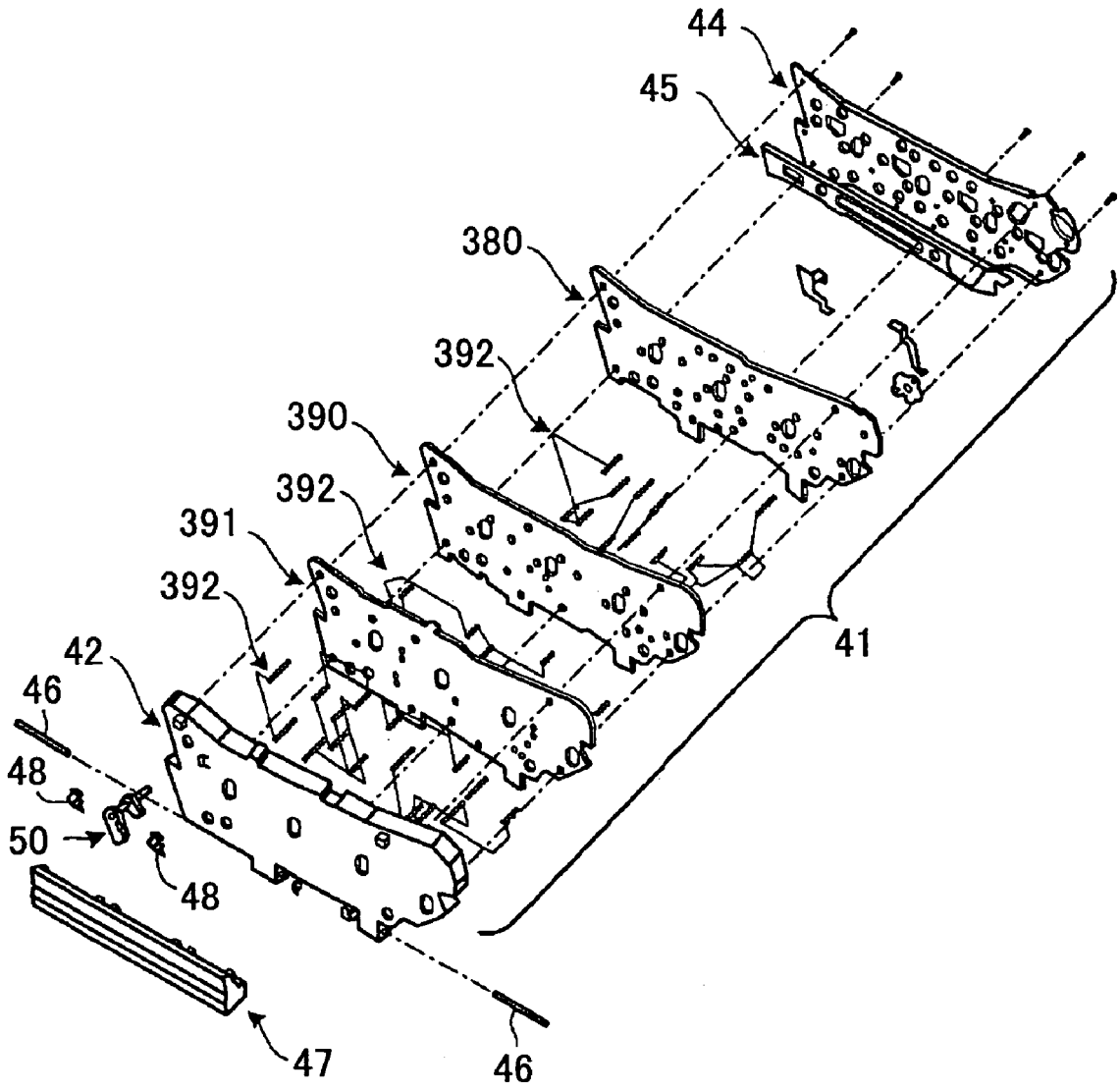
FIG. 65 is an exploded perspective view of the front panel 341.

FIG. 65 is an exploded perspective view of the front panel 341.

As illustrated in FIG. 65, the insulating member 380 (for example, an insulating plate), and the power feeding members 390, 391 (for example, they are also plates) are placed between the cover 42 and the positioning plate 44. In the present embodiment, the positioning plate 44, the insulating member 380, the power feeding members 390, 391, and the cover 42 are stacked in the above order. That is, when the front panel 341 is at the CLOSED position, the positioning plate 44 is closest to the main body 1, specifically, the opened portion 40A. By stacking the positioning plate 44, the insulating member 380, the power feeding members 390, 391, and the cover 42 in this way, it is possible to form the front panel 341 within limited space. Further, by stacking the insulating plate 380 on the positioning plate 44, it is possible to prevent electric current from being conducted in the positioning plate 44. As a result, when the front panel 341 is at the CLOSED position, it is possible to prevent unnecessary current conduction due to contact with metal portions of the main body 1, and when the front panel 341 is at the OPENED position, it is possible to prevent current conduction due to contact with the operator.

The positioning plate 44 may be formed from metals so as to obtain high strength. It may also be made from nonmetallic materials such as resins to reduce the weight of the front panel 341. In addition, it is also preferable to form the positioning plate 44 by insulating materials; in this case, safety in operating the front panel 341 is improved.

Power feeding terminals 392 are arranged on the power feeding members 390, 391 for connection with the terminals 3120, 3121, and 3122 and other not-illustrated terminals.

Figure 66:
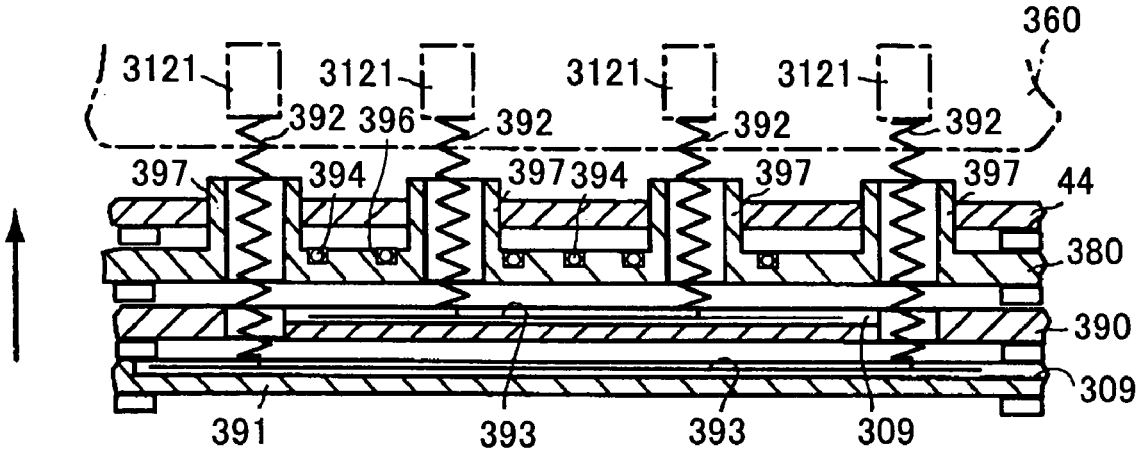
FIG. 66 is an enlarged partial cross-sectional view of the front panel 341, showing relation of the insulating plate 380, the power feeding members 390, 391, the positioning plate 44.

FIG. 66 is an enlarged partial cross-sectional view of the front panel 341, showing relations of the insulating plate 380, the power feeding members 390, 391, the positioning plate 44, and others.

As illustrated in FIG. 66, each power feeding terminal 392 is a coil spring. Therefore, when the front panel 341 is at the CLOSED position, power feeding terminals 392 elastically contact the terminals 3120, 3121, 3122 and others, respectively, and push the component units having those terminals toward the side panel 402, that is, to the inside of the main body 1, to reliably connect with the couplings 470 and 471.

Power feeding terminals 392 are connected with the contacting terminal 371, which can be connected with the high voltage terminals 361, through bare cords 393 and 394.

Guide tubes 397 are formed on the insulating member 380 to protect the power feeding terminals 392. Each guide tube 397 is sufficiently long so as to project toward the opened portion 40A out of the stacked structure of the positioning plate 44, the insulating member 380, the power feeding members 390, 391, and the cover 42. Each power feeding terminal 392 penetrates the corresponding guide tube 397, projecting more than the guide tube 397.

With the above front panel 341, which has power feeding functions, when the front panel 341 is turned to the CLOSED position, the component units detachably attached to the main body 1 are held by the positioning plate 44, and in the meantime, the terminals on these component units are held at positions corresponding to the power feeding terminals 392; thereby it is possible to supply electric power to the component units from the high voltage supply 3110.

The power feeding terminals 392 are placed in the guide tubes 397. Therefore, even if the power feeding terminals 392, which are long, are bent when contacting the terminals on the component units, the guide tubes 397 limit the power feeding terminals 392 from bending too much. As a result, it is possible to avoid contact by the power feeding terminals 392 with the positioning plate 44. Further, because the power feeding terminals 392 are contained in the guide tubes 397, position shifts of the power feeding terminals 392 relative to terminals on the component units are small, being limited to be less than the size of the guide tubes 397.

Figure 67:
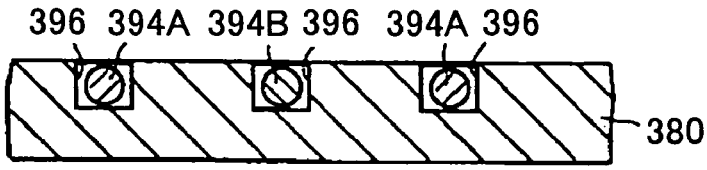
FIG. 67 is an enlarged partial cross-sectional view of the insulating member 380, showing arrangement of the bare cords 394 for high voltage and low voltage the power supplies.

FIG. 67 is an enlarged partial cross-sectional view of the insulating member 380, showing arrangement of the bare cords 394 for high voltage and low voltage the power supplies.

As illustrated in FIG. 67, there are two kinds of cords in the bare cords 394, one is bare cord 394A for use of high voltages, for example, 2 kV or higher, the other is bare cord 394B for use of voltages, less than 2 kV. The cord 394A and the cord 394B are alternately arranged. With such arrangement of the cords 394A and 394B, it is possible to prevent unexpected electric leakage when the power supply is turned on.

In addition, a surface distance between two adjacent cords, for example, the cord 394A and 394B, is set according to a ratio of the voltages applied on the two cords so as to maintain a sufficiently large surface distance between the two cords. By setting the surface distance in this way, it is possible to prevent unexpected electric leakage when the power supply is turned on.

Figure 68:
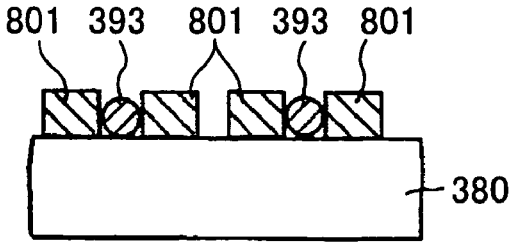
FIG. 68 is an enlarged partial cross-sectional view of the insulating member 380, showing another example of arrangement of the bare cords 394.

FIG. 68 is an enlarged partial cross-sectional view of the insulating member 380, showing another example of arrangement of the bare cords 394.

FIG. 68 illustrates a method of effectively setting the surface distance between two adjacent bare cords. As illustrated in FIG. 68, projections 801 are formed on the surface of the insulating member 380, and the projections 801 increase the surface distance between the bare cords 393 and 394.

It is described above that the positioning plate 44, the insulating member 380, the power feeding members 390, 391, and the cover 42 are stacked in order, with the positioning plate 44 being closest to the main body 1 when the front panel 341 is at the CLOSED position. However, the present embodiment is not limited to this arrangement. They may be arranged in order of the insulating member 380, the power feeding members 390, 391, the positioning plate 44, and the cover 42.

Figure 69:
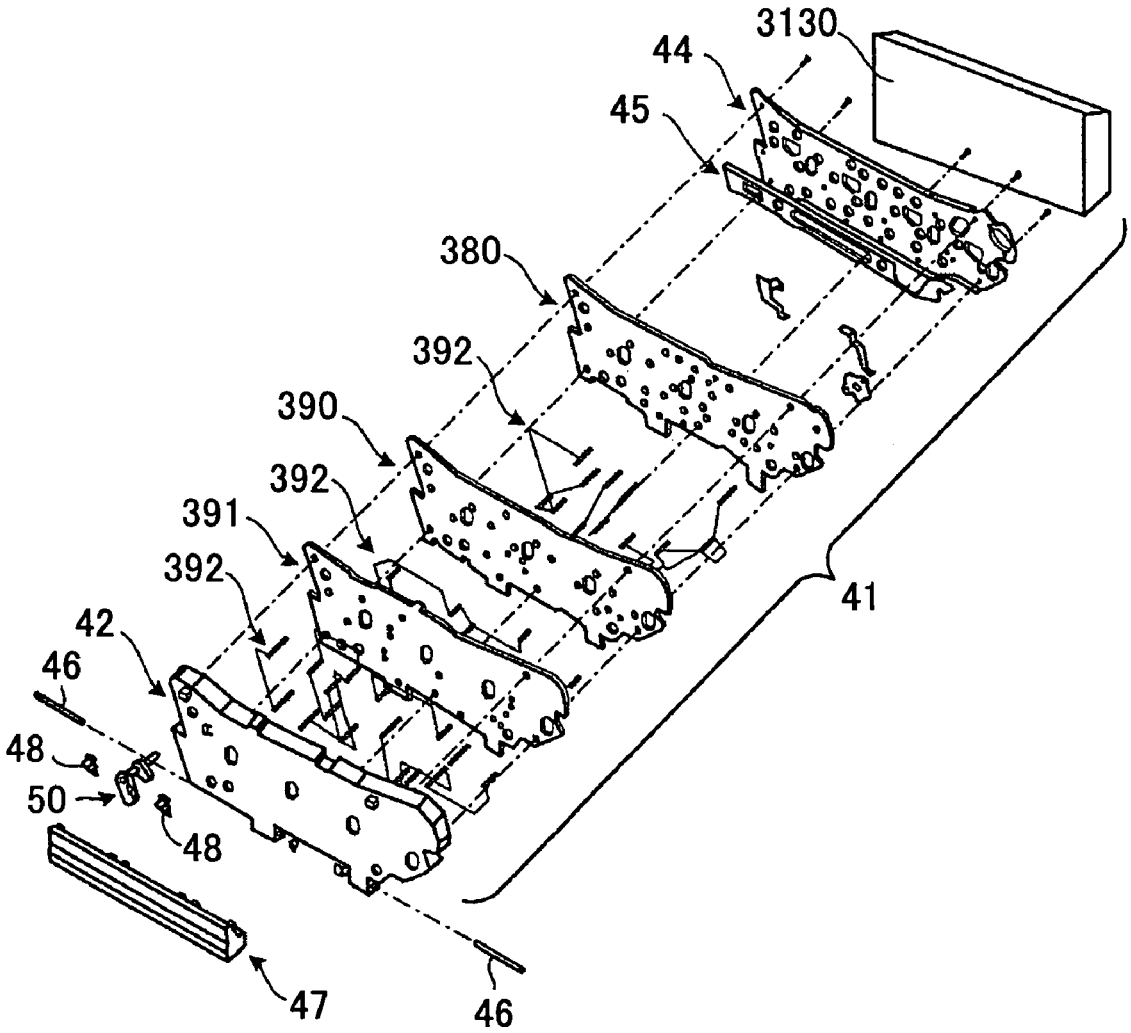
FIG. 69 is an exploded perspective view of the front panel 341, showing another example of arrangement of the insulating member 380, the power feeding members 390, 391.

FIG. 69 is an exploded perspective view of the front panel 341, showing another example of arrangement of the insulating member 380, the power feeding members 390, 391.

As illustrated in FIG. 69, the positioning plate 44, the insulating member 380, the power feeding members 390, 391, and the cover 42 are arranged in the same order as in FIG. 65, but an inner side cover 3130 is provided between the positioning plate 44 and the main body 1.

Preferably, the insulating member 380 may be made from a synthesized resin having a CTI (Comparative Tracking Index) equal to or greater than 175, whereby it is possible to suppress surface current flowing on the material. In addition, the insulating member 380 may also be made from a synthesized resin having a flame-retardancy equal to or higher than UL94V-1, whereby the insulating member 380 can hardly burn even it is heated by a current caused by the high voltage, hence being superior in safety of operation.

Figure 70:
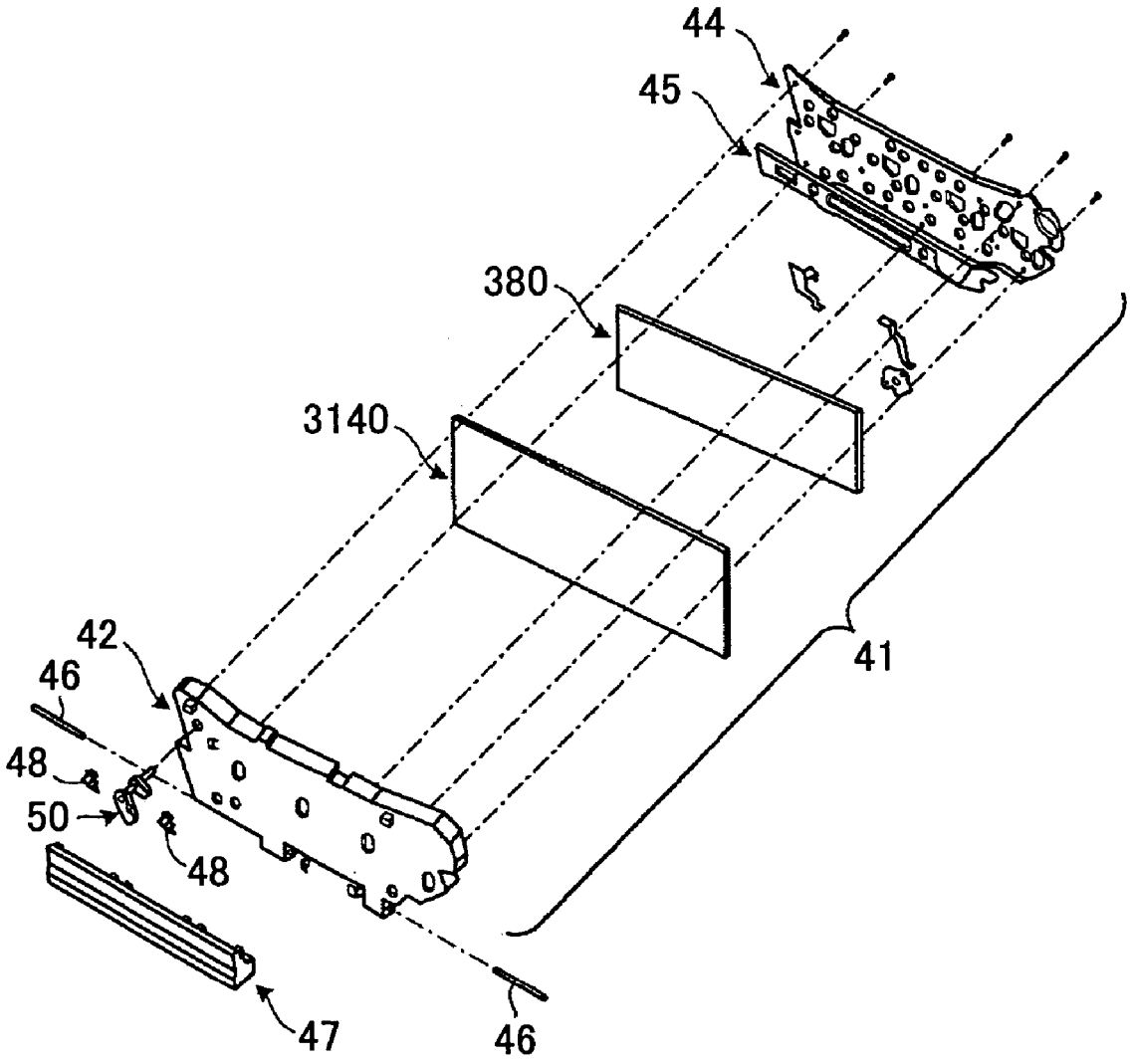
FIG. 70 is an exploded perspective view showing another example of the front panel 341 having a printed circuit board 3140 which combines the power feeding members 390, 391 and cords.

FIG. 70 is an exploded perspective view showing another example of the front panel 341 having a printed circuit board 3140 which combines the power feeding members 390, 391 and cords.

As illustrated in FIG. 70, the front panel 341 includes a stacked structure of the positioning plate 44, the insulating member 380, the printed circuit board 3140, and the cover 42. Contacting terminals 371 and the power feeding terminals 392 are formed on and projecting from the printed circuit board 3140. With such an arrangement, it is possible to reduce the number of parts in the front panel 341, simplify the structure and reduce the weight of the front panel 341.

It is described above that the contacting terminals 371 and the power feeding terminals 392 in the front panel 341 are connected with bare cords 393 and 394. However, the contacting terminals 371 and the power feeding terminals 392 may also connected with cords wrapped by some materials. With the wrapped cords used in the front panel 341, because the cords are not visible from outside, the appearance is good. In addition, even when the front panel 341 is opened frequently, the cords can hardly be caught anywhere, thereby improving durability of the apparatus. Further, compared with the bare cords, there are more degrees of freedom for arrangement of the cords.

Figure 71:
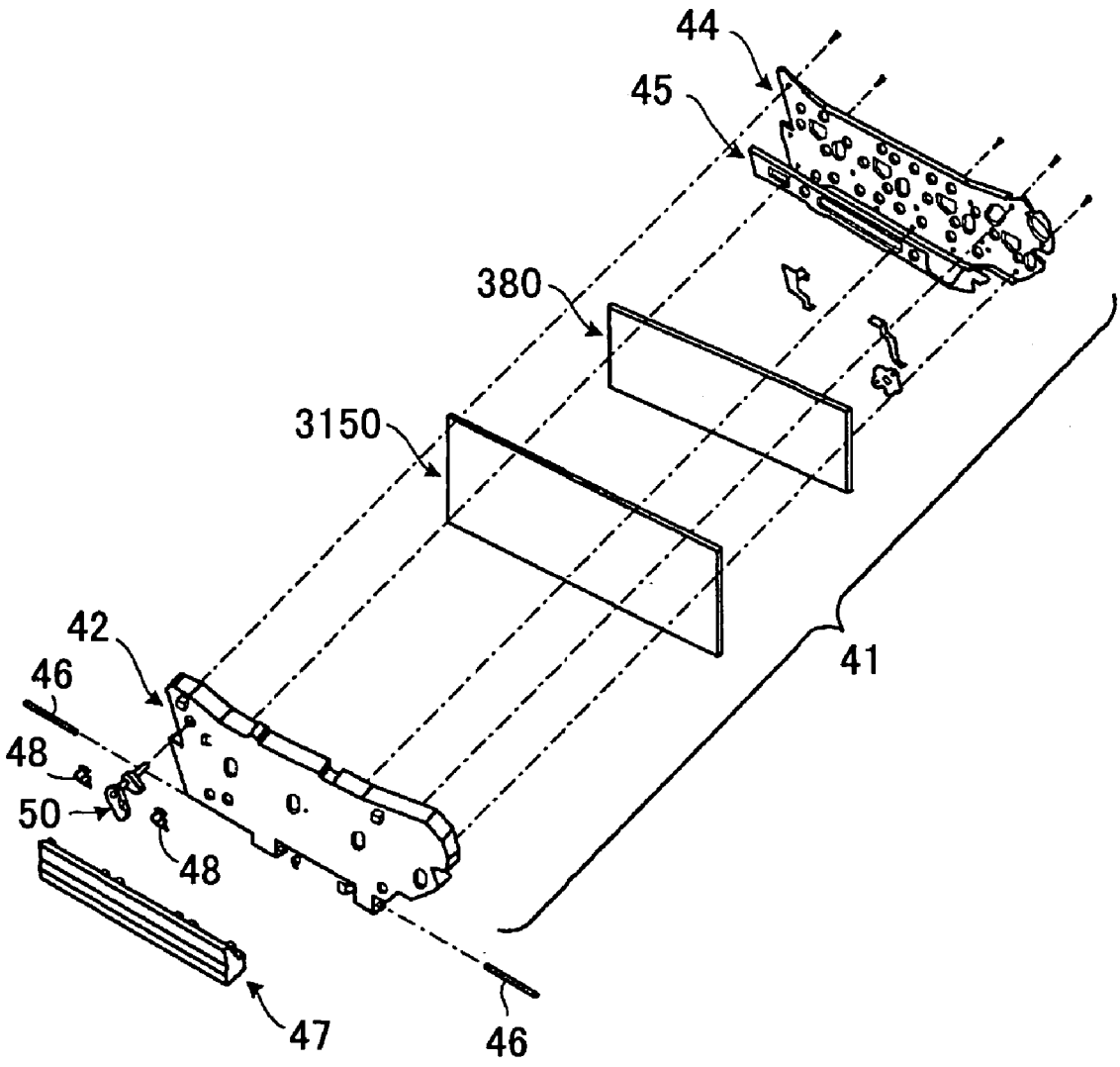
FIG. 71 is an exploded perspective view showing another example of the front panel 341.

FIG. 71 is an exploded perspective view showing another example of the front panel 341.

In the example shown in FIG. 71, a high voltage power supply 3150 is arranged in the front panel 341, but not in the main body 1. In this case, it is not necessary to provide the contacting terminals 371, thus simplifying the cord arrangement.

Figure 72:
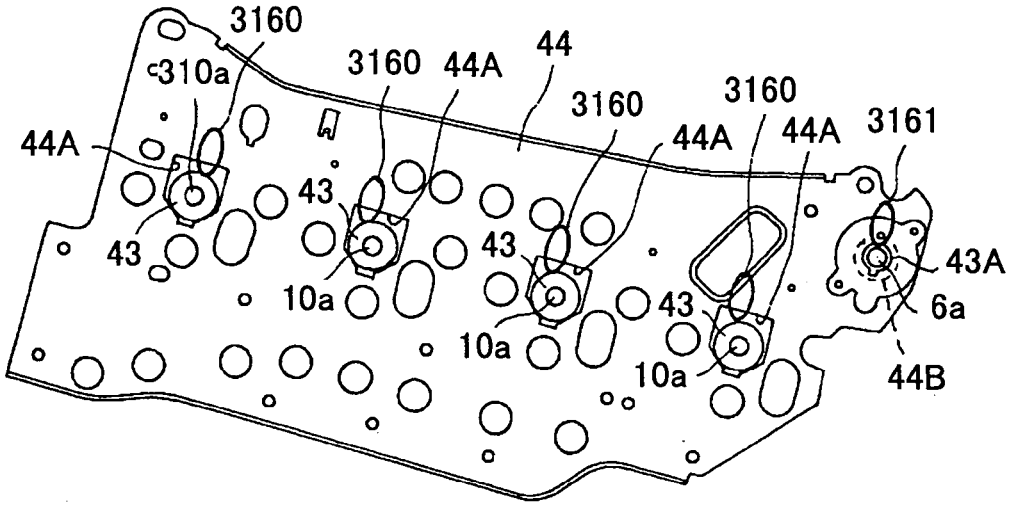
FIG. 72 is a plan view of the positioning plate 44, showing a position control mechanism of the present embodiment.

FIG. 72 is a plan view of the positioning plate 44, showing a position control mechanism of the present embodiment.

As illustrated in FIG. 72, the positioning member 44 has the recessed portions 44A and 44B for accommodating the bearings 43 attached to axles 10*a* of the photo conductors 10 and the bearing 43A attached to the axle of the driving roller 6 in the intermediate transfer unit 7.

In addition, cams 3160, 3161 are separably arranged for the bearings 43, 43A, respectively, acting as a position control mechanism to set the bearings 43, 43A to specified positions. The cams 3160, 3161 are attached while being separable from the bearings 43, 43A. For example, with the above axles being rotatably supported by the cover 42 and positioning plate 44, the cams 3160, 3161 are attached to the respective ends of the axles on the side of the positioning plate 44, and levers are attached to the ends of the axles on the side of the cover 42.

By installing the cams 160, 161, it is possible to accurately set positions of the front panel 341 and the positions of the image forming units in the main body 1, and maintain good contacting condition of terminals. In addition, by installing the cams 160, 161, it is not necessary to provide the eccentric member 50, or the bias setting member 45 described in the first embodiment with reference to in FIG. 4.

In FIG. 72, it is illustrated that the bearings 43, 43A are directly attached to axles 10*a*, 6*a*, and are held by the recessed portions 44A and 44B of the positioning member 44. However, the bearings 43, 43A may be directly attached into the recessed portions 44A and 44B of the positioning member 44 to rotatably support the axles 10*a*, 6*a*.

The bearings 43, 43A may be formed from metals or synthesized resins. When metals are used, the bearings 43, 43A can be used as the electric ground of the photo conductors 10 and the driving roller 6. When synthesized resins are used, weights of the bearings 43, 43A can be reduced.

Figure 73:
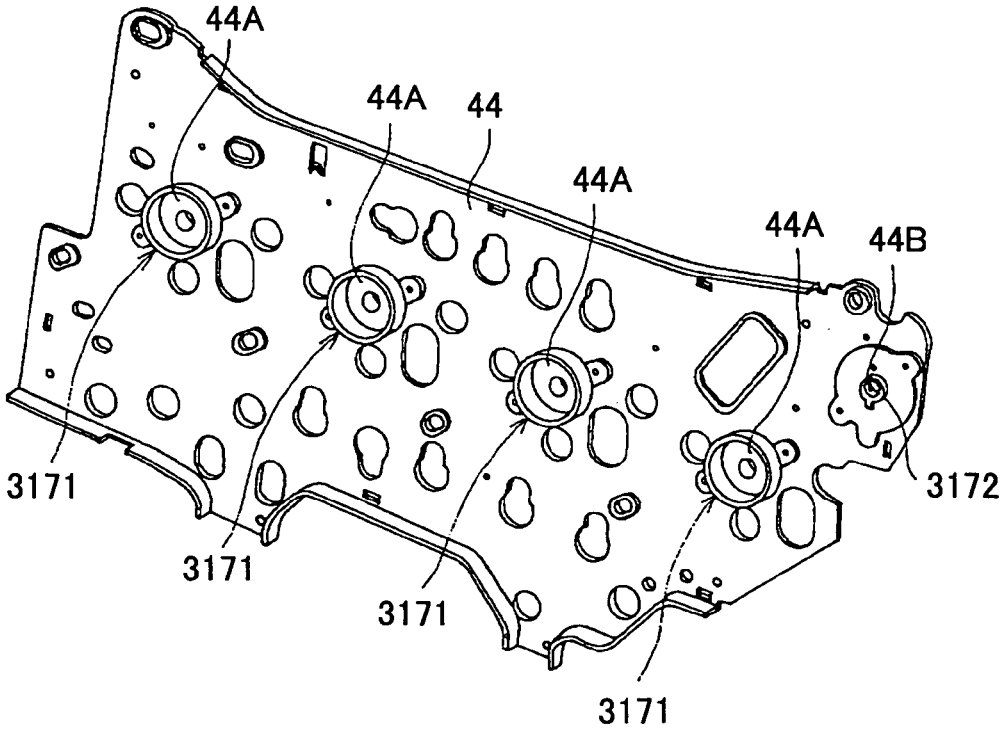
FIG. 73 is a plan view of the positioning plate 44, showing another example of the position control mechanism of the present embodiment.

FIG. 73 is a plan view of the positioning plate 44, showing another example of the urging mechanism of the present embodiment.

In FIG. 73, instead of holding the bearings 43, 43A, which are directly attached to the axles 10*a*, 6*a*, by the recessed portions 44A and 44B of the positioning member 44, holding portions 3171, 3172 are formed on the positioning member 44 to hold the bearings 43, 43A attached to the axles 10*a*, 6*a*.

The holding portions 3171, 3172 and the positioning member 44 are formed from synthesized resins, and the bearings 43, 43A are from metals. Each of the holding portions 3171, 3172 is shaped like a ring, and the inner diameter thereof is nearly the same as the outer diameter of the bearings 43, 43A.

For example, the holding portions 3171, 3172 are separate parts from the positioning member 44, and are attached to the positioning member 44 by screws.

When the front panel 341 is at the CLOSED position, the bearings 43, 43A are held by the holding portions 3171, 3172, and thereby, it is possible to maintain good corresponding positional relations between the front panel 341 and the component units in the main body 1, positions of the terminals used in feeding power are stable, and the terminals are good contacting condition.

The holding portions 3171, 3172 and the positioning member 44 may also be formed from metals, and the bearings 43, 43A from synthesized resins.

Figure 74:
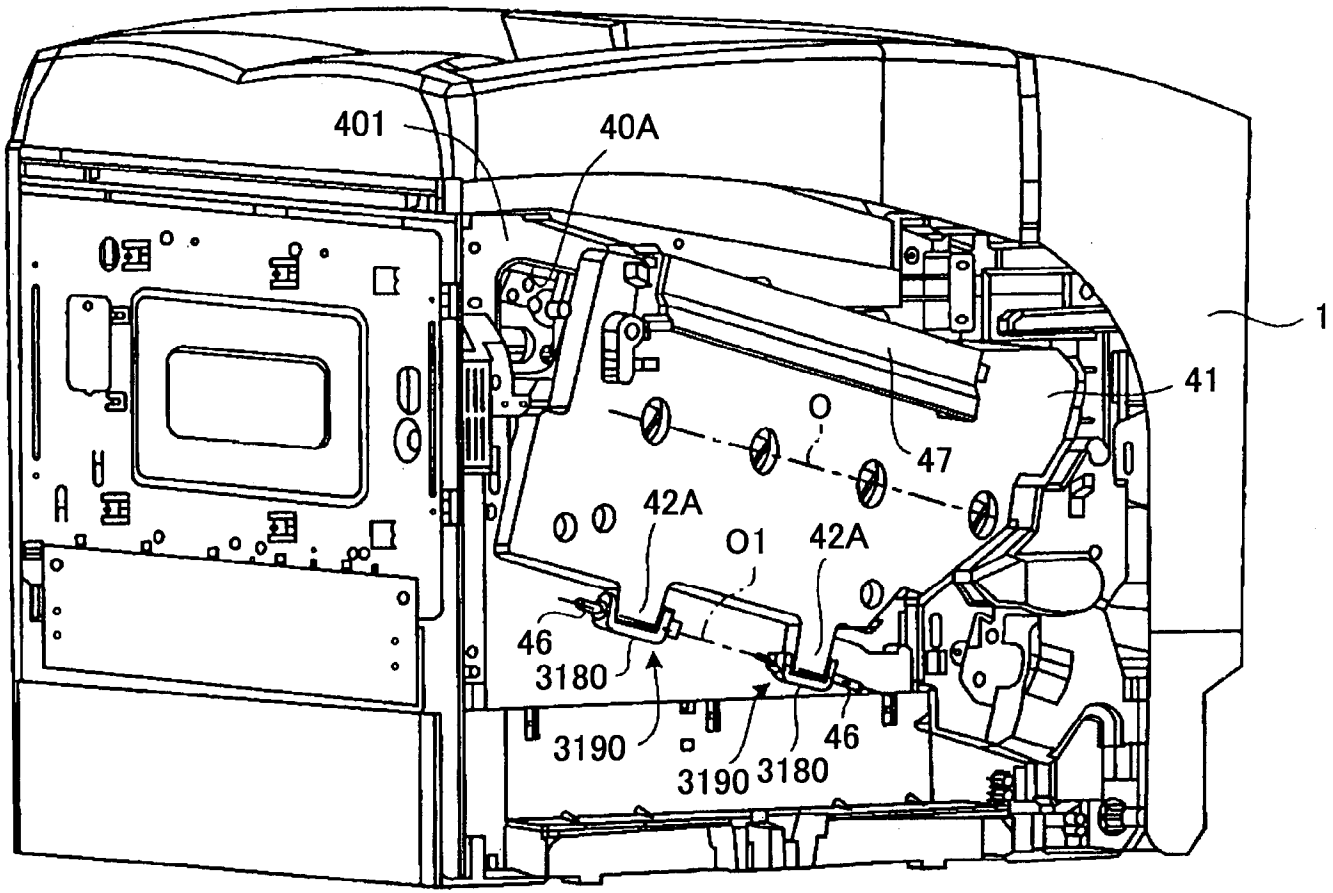
FIG. 74 is a perspective view of the main body 1 showing a structure for holding and positioning the front panel 341.

FIG. 74 is a perspective view of the main body 1 showing a structure for holding and positioning the front panel 341.

As illustrated in FIG. 74, the front panel 341 is connected to the main body 1 via a rotating portion 3190 including the hinges 46 and the bearing 3180, and the line along their rotational axis is indicated by "O1". An end of each of the photo conductors 10 is arranged on a line O, which is in the same plane with the opened portion 40A. The rotational axis O1 is below the line O and is substantially parallel to the line O. With such an arrangement, when the front panel 341 is rotated relative to the rotational axis O1, the corresponding position relation between the front panel 341 and the photo conductors 10 can be maintained.

In FIG. 74, the rotating portion 3190 is arranged below the opened portion 40A, and the rotational axis O1 is slanted at an angle. When the photo conductors 10 are horizontally arranged in the main body 1, the rotating portion 3190 may also be arranged below or above the opened portion 40A, and the rotational axis O1 be laid horizontally.

Figure 75:
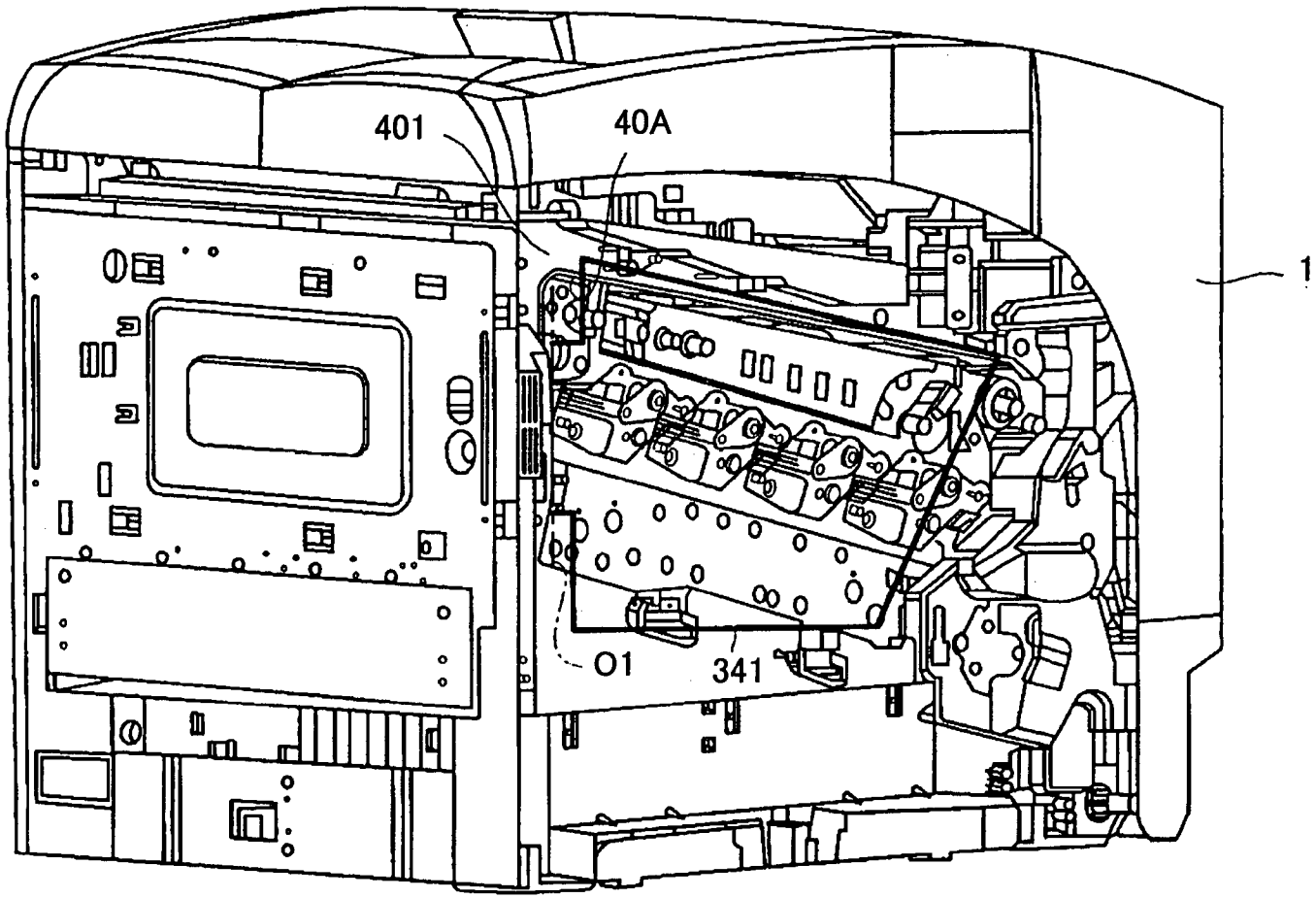
FIG. 75 is a perspective view of the main body 1 showing an example of the arrangement of the front panel 341.

FIG. 75 is a perspective view of the main body 1 showing an example of the arrangement of the front panel 341.

As illustrated in FIG. 75, the rotational axis O1 of the front panel 341 may be arranged vertically on the left side of the opened portion 40A, alternatively, be arranged vertically on the right side of the opened portion 40A.

Figure 76:
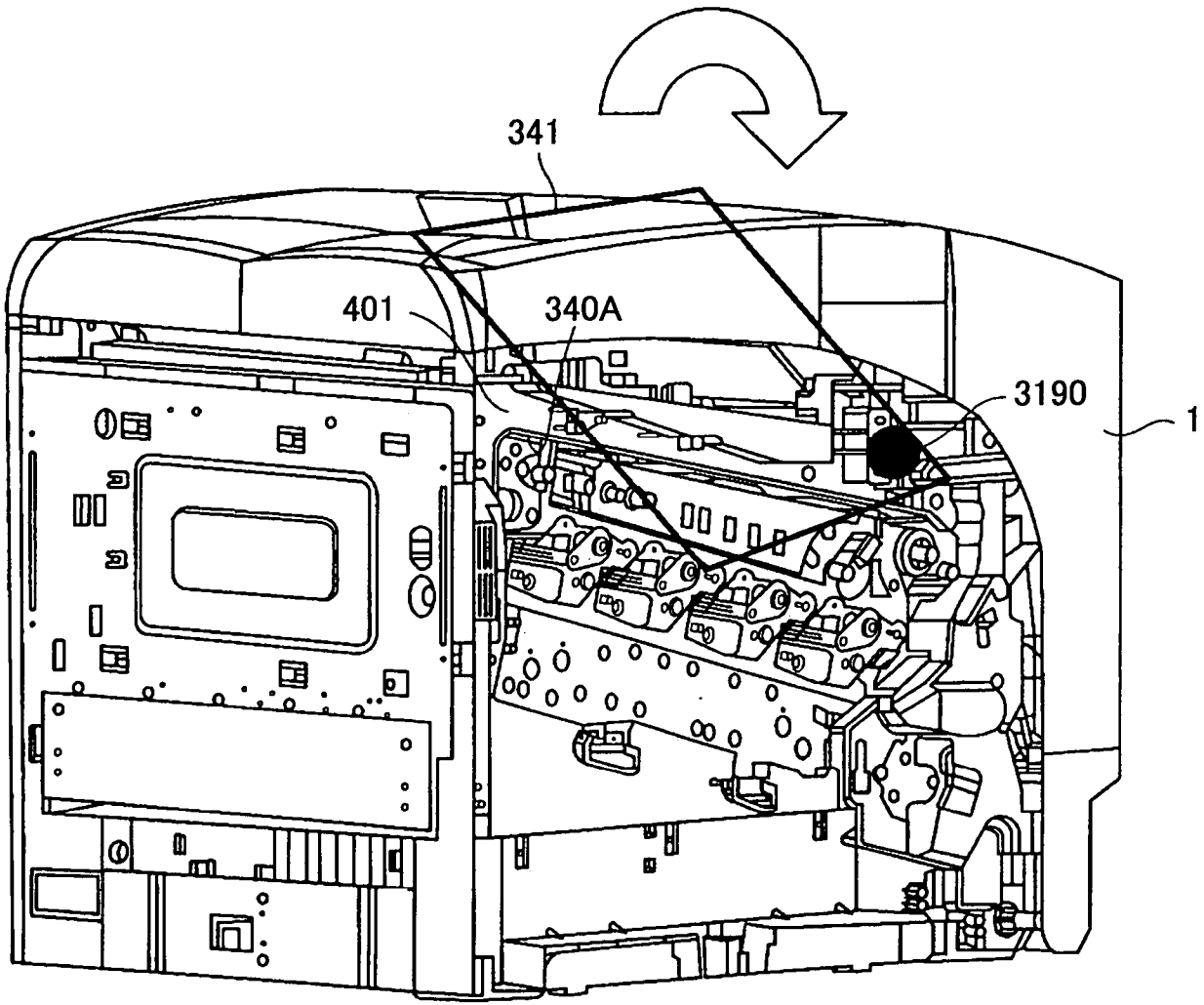
FIG. 76 is a perspective view of the main body 1 showing another example of the arrangement of the front panel 341.

FIG. 76 is a perspective view of the main body 1 showing another example of the arrangement of the front panel 341.

As illustrated in FIG. 76, the rotational axis O1 of the front panel 341 may slanted and placed at positions corresponding to the right-upper part of the opened portion 40A. Alternatively, the front panel 341 may also be arranged to be opened or closed along a direction pointing the right-upper part of the opened portion 40A.

Figure 77:
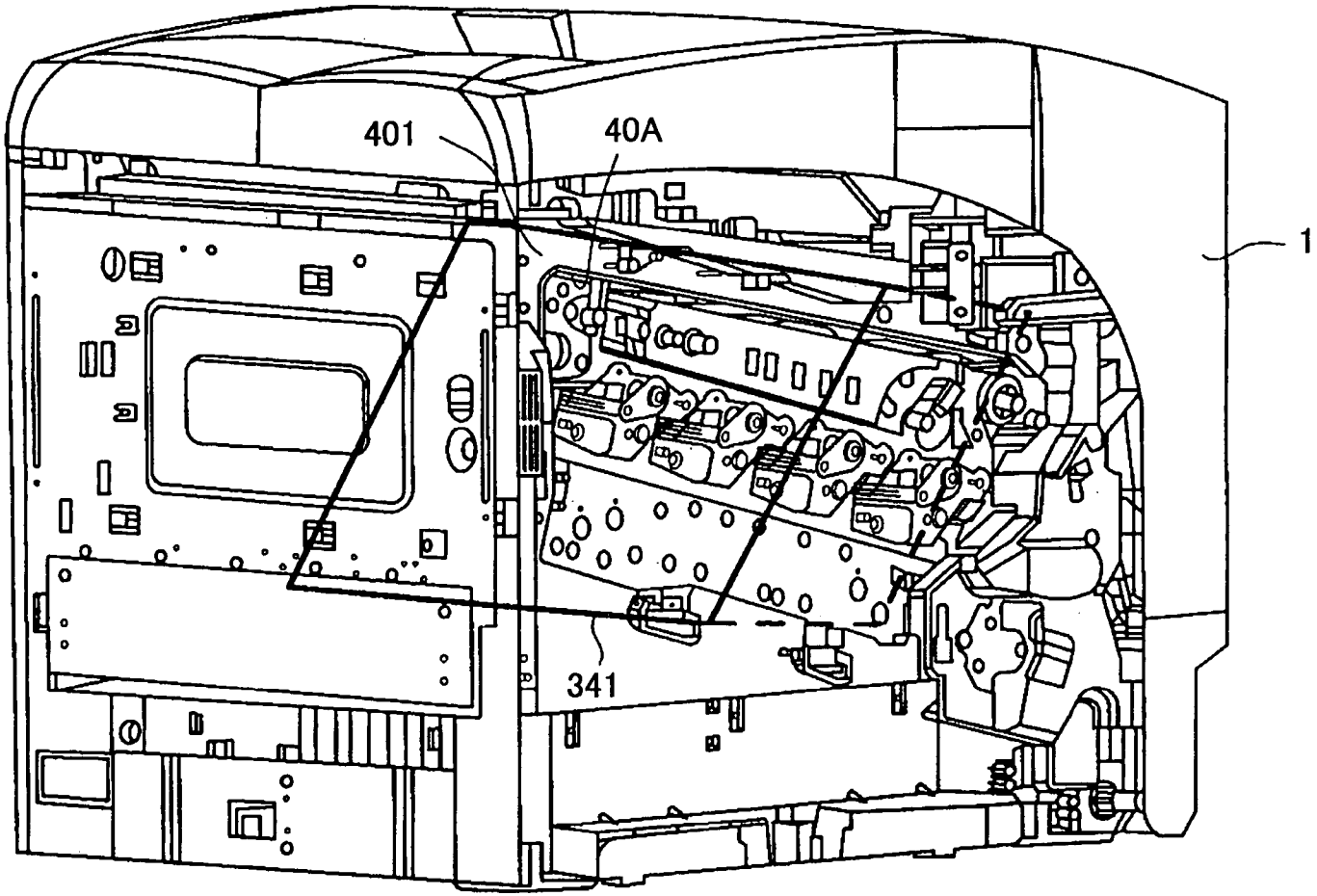
FIG. 77 is a perspective view of the main body 1 showing another example of the arrangement of the front panel 341.

FIG. 77 is a perspective view of the main body 1 showing another example of the arrangement of the front panel 341.

As illustrated in FIG. 77, the front panel 341 may also be attached to the main body 1 while being able to slide in the direction of closing or opening the front panel 341. In this case, for example, rails can be mounted on the front panel 341 and the main body 1. As shown in FIG. 77, preferably, the sliding direction is set toward the back side of the main body 1, because there are no parts there interfering with the sliding front panel 341. In addition, it is preferable to set the rotating range of the front panel 341 to be larger than 90 degrees so as to make operation on the apparatus easy.

Figure 78:
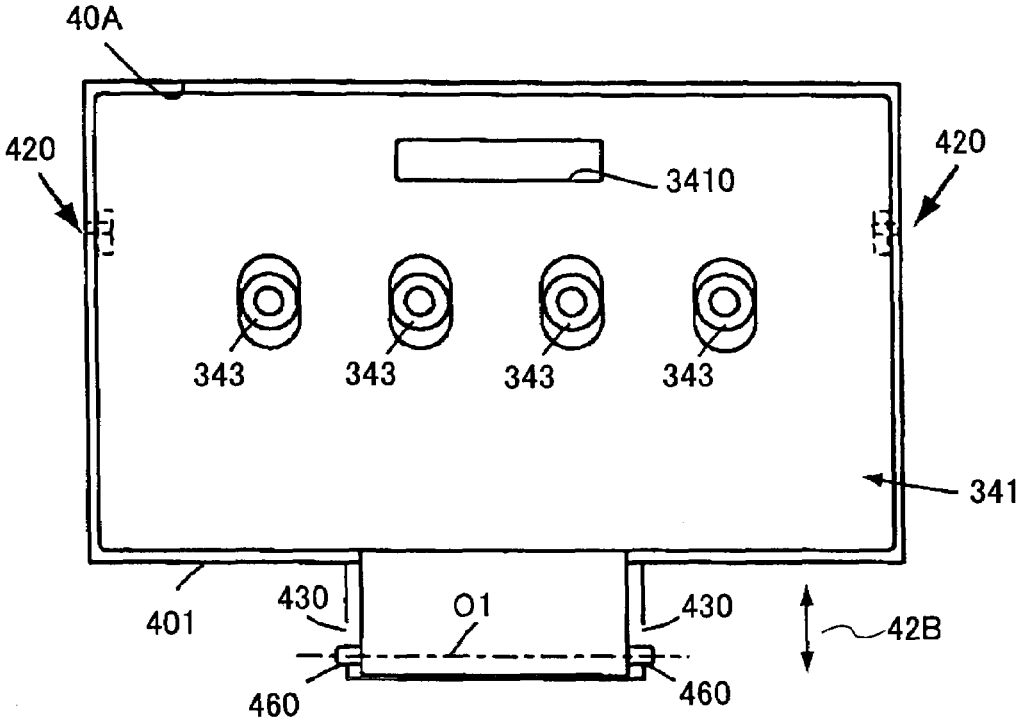
FIG. 78 is a plan view of the front panel 341, which is slidable and rotatable.

FIG. 78 is a plan view of the front panel 341, which is slidable and rotatable.

In FIG. 78, the front panel 341 is slidably and rotatably attached to the side panel 401. There is one hinge 42B at the lower edge of the front panel 341. At the two ends of the hinge 42B, an axle 460 of the hinge 42B is projecting toward guide holes 430 formed on the inner back side of the side panel 401.

Figure 79:
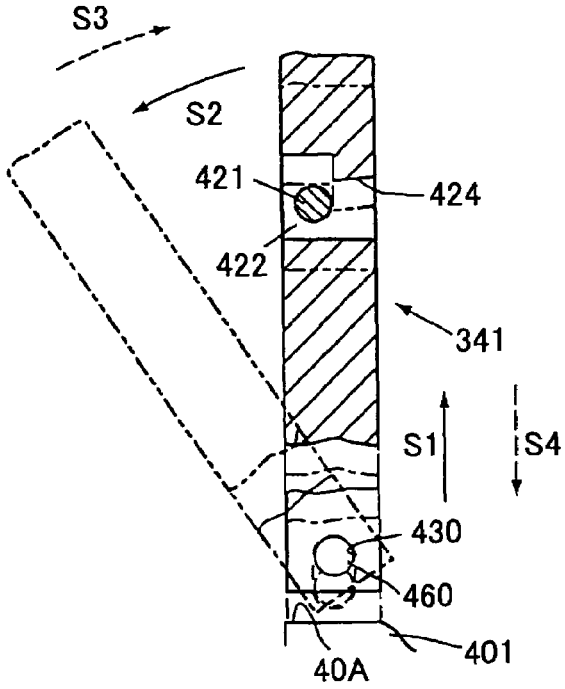
FIG. 79 is a cross-sectional view of the front panel 341, showing sliding and rotating operation of the front panel 341.

FIG. 79 is a cross-sectional view of the front panel 341, showing sliding and rotating operations of the front panel 341.

As illustrated in FIG. 79, the two ends of the axle 460 are inserted into the guide holes 430 and slidably and rotatably supported by the guide holes 430 with the front panel 341 being slidable in the vertical directions S1, S4, and rotatable in the opening and closing directions S2, S3.

A recess 410 is formed on the front panel 341 for opening or closing the front panel 341.

FIG. 79 is a cross-sectional view showing sliding and rotating operation of the front panel 341.

As illustrated in FIG. 79, the two ends of the axle 460 are inserted into the guide holes 430 and slidably and rotatably supported by the guide holes 430 with the front panel 341 being slidable in the vertical directions S1, S4, and rotatable in the opening and closing directions S2, S3.

Figure 80:
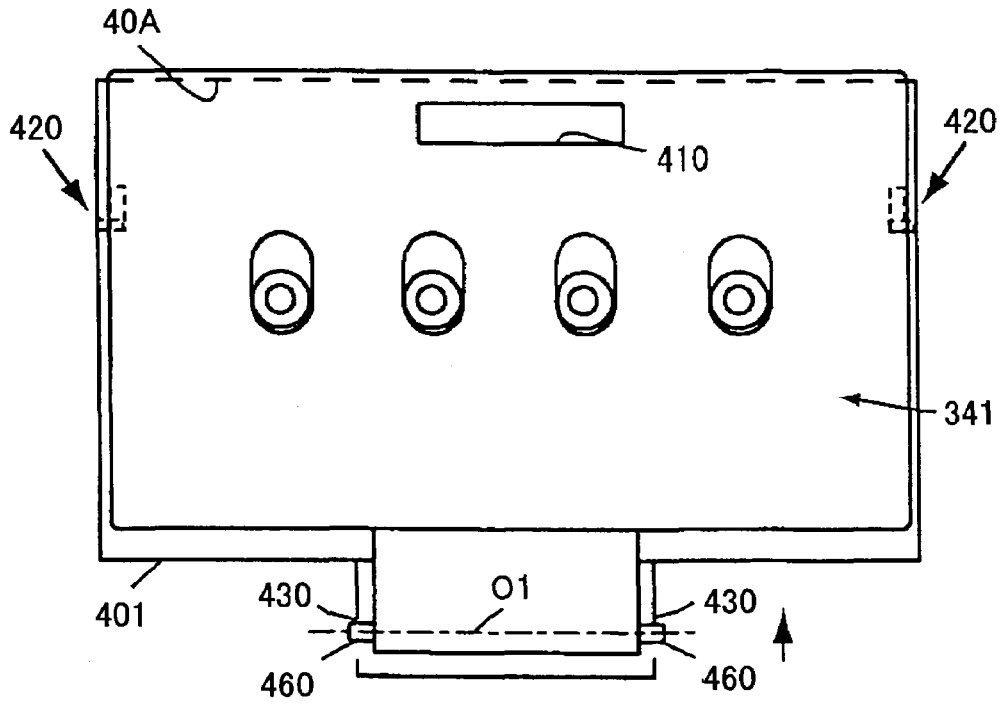
FIG. 80 is a plan view of the front panel 341.

FIG. 80 is a plan view of the front panel 341.

As illustrated in FIG. 80, and with reference to FIG. 78, a locking unit 420 is attached to the front panel 341 and the opened portion 40A to limit the closing and opening operations of the front panel 341.

Figure 81:
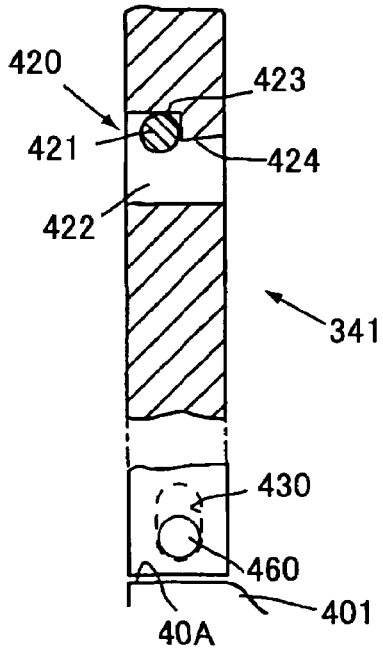
FIG. 81 is a cross-sectional view of the front panel 341, showing a mechanism for driving the front panel 341 to slide and rotate.

FIG. 81 is a cross-sectional view of the front panel 341, showing a mechanism for driving the front panel 341 to slide and rotate.

As illustrated in FIG. 81 and FIG. 79, the locking unit 420 includes a projection 421 on the opened portion 40A and a hole 422 formed on the front panel 341 for accommodating the projection 421. The hole 422 extends in the direction S1 and S4. A step portion 423 and an inclined portion 424 are formed on the inner surface of the hole 422. When the front panel 341 is at the locking position as shown in FIG. 81 by its own weight, the step portion 423 is engaged with the projection 421, and when the front panel 341 is moved upward in the S1 direction, the step portion 423 is disengaged from the projection 421.

With such a configuration, by moving the front panel 341, which is presently at the locking position, in the S1 direction, the step portion 423 is disengaged from the projection 421; therefore, the front panel 341 can be opened and closed. By further moving the front panel 341 in the direction S2, the opened portion 40A is exposed.

To cover the opened portion 40A, the front panel 341 is moved in the direction S3 and lifted up more or less, then the front panel 341 is further moved in the direction S4. Resultantly, the step portion 423 is engaged with the projection 421, and the front panel 341 is locked at the locking position.

By providing the locking unit 420, the front panel 341 can be reliably locked at the CLOSED position even without the handle 47 and the eccentric member 50 mentioned in the first embodiment, and this can reduce the weight of the front panel 341.

Effect of the present embodiment is summarized below.

With the front panel 341 of the present embodiment, which has power feeding functions, when the front panel 341 is turned to the CLOSED position, the component units in the main body 1 are held by the positioning plate 44, and in the meantime, the terminals on these component units are held at positions facing to the power feeding terminals 392; thereby it is possible to supply electric power to the component units from the high voltage supply 3110.

By stacking the positioning plate 44, the insulating member 380, the power feeding members 390, 391, and the cover 42 in specified order, it is possible to form the front panel 341 within limited space. Further, by stacking the insulating plate 380 on the positioning plate 44, it is possible to prevent electric current from being conducted in the positioning plate 44. As a result, when the front panel 341 is at the CLOSED position, it is possible to prevent unnecessary current conduction due to contact with metal portions of the main body 1, and when the front panel 341 is at the OPENED position, it is possible to prevent current conduction due to contact with the operator.

When the positioning plate 44 is formed from metals, high strength can be obtained. When using nonmetallic materials such as resins, it is possible to reduce the weight of the front panel 341. If the positioning plate 44 is formed from insulating materials, safety in operating the front panel 341 is improved.

Because the power feeding terminals 392 are placed in the guide tubes 397, even if the power feeding terminals 392 are bent when contacting the terminals on the component units, the guide tubes 397 limit the power feeding terminals 392 from bending too much. As a result, it is possible to avoid contact by the power feeding terminals 392 with the positioning plate 44. Further, because the power feeding terminals 392 are contained in the guide tubes 397, position shifts of the power feeding terminals 392 relative to terminals on the component units are small, being limited to be less than the size of the guide tubes 397.

By arranging bare cords for high voltages (2 kV or higher) and bare cords for voltages less than 2 kV alternately, it is possible to prevent unexpected electric leakage when the power supply is turned on. In addition, by maintaining a sufficiently large surface distance between adjacent cords, it is possible to prevent unexpected electric leakage when the power supply is turned on.

When the insulating member 380 is made from a synthesized resin having a CTI (Comparative Tracking Index) equal to or greater than 175, it is possible to suppress surface current flowing on the material. In addition, when the insulating member 380 is made from a synthesized resin having a flame-retardancy equal to or higher than UL94V-1, the insulating member 380 can hardly burn even it is heated by a current caused by the high voltage, hence being superior in safety of operation.

When the power feeding members 390, 391 and cord are combined into the printed circuit board 3140, it is possible to reduce the number of parts in the front panel 341, simplify the structure and reduce the weight of the front panel 341.

When wrapped cords are used in the front panel 341, because the cords are not visible from outside, the appearance is good. In addition, even when the front panel 341 is opened frequently, the cords can hardly be caught anywhere, thereby improving durability of the apparatus. Further, compared with the bare cords, there are more degrees of freedom for arrangement of the cords.

By installing the cams 160, 161, it is possible to accurately set positions of the front panel 341 and the positions of the image forming units in the main body 1, and maintain good contacting condition of terminals. In addition, by installing the cams 160, 161, it is not necessary to provide an eccentric member or a bias setting member.

When the bearings 43, 43A are formed from metals, the bearings 43, 43A can be used as the electric ground of the photo conductors 10 and the driving roller 6. When synthesized resins are used, weights of the bearings 43, 43A can be reduced.

Because when the front panel 341 is at the CLOSED position, the bearings 43, 43A are held by the holding portions 3171, 3172, it is possible to maintain good corresponding positional relations between the front panel 341 and the component units in the main body 1, positions of the terminals used in feeding power are stable, and the terminals are good contacting condition.

When the rotational axis O1 of the front panel 341 is below the opened portion 40A, and is substantially parallel to the line O, when the front panel 341 is rotated relative to the rotational axis 01, the corresponding position relation between the front panel 341 and the photo conductors 10 can be maintained.

When the rotating range of the front panel 341 is set larger than 90 degrees, it is possible to make operation on the apparatus easy.

By providing the locking unit 420, the front panel 341 can be reliably locked at the CLOSED position even without the handle 47 and the eccentric member 50 mentioned in the first embodiment, and this can reduce the weight of the front panel 341.

While the present invention has been described with reference to specific embodiments chosen for purpose of illustration, it should be apparent that the invention is not limited to these embodiments, but numerous modifications could be made thereto by those skilled in the art without departing from the basic concept and scope of the invention.

In addition to inventions claimed below, the present invention also includes following embodiments.

A1. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit including a claw member arranged on the holding unit, and a claw catching member that is arranged on the main body and is engaged with the claw member when the holding unit is closed relative to the opened portion, said claw member having an L shape.

A2. An image forming apparatus, comprising:

a main body having an opened portion on a side thereof;

one or more devices detachably attached to the main body through the opened portion;

a holding unit capable of being opened and closed relative to the opened-portion, said holding unit being engaged with the devices and holding the devices at predetermined positions when the holding unit is closed relative to the opened portion; and a fixing unit including a claw member arranged on the holding unit, and a claw catching member that is arranged on the main body and is engaged with the claw member when the holding unit is closed relative to the opened portion, said claw member having a size covering half or more of the claw catching member.

A3. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit including a claw member arranged on the holding unit, and a claw catching member that is arranged on the main body and is engaged w ith the claw member when the holding unit is closed relative to the opened portion, said claw member being formed from a synthesized resin.

A4. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit including a claw member arranged on the holding unit, and a claw catching member that is arranged on the main body and is engaged with the claw member when the holding unit is closed relative to the opened portion, said claw member being formed from a metal.

A5. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed-relative to the opened portion; and a fixing unit including a claw member arranged on the holding unit, and a claw catching member that is arranged on the main body and is engaged with the claw member when the holding unit is closed relative to the opened portion, said claw member being formed from a combination of a synthesized resin and a metal.

A6. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit including a claw member arranged on the holding-unit, and a claw catching member that is arranged on the main body and is engaged with the claw member when the holding unit is closed relative to the opened portion, said claw member being formed from a ceramic.

A7. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, the supporting portions being arranged to be symmetric to the locking positions.

A8. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, the supporting portions being arranged outside the locking positions.

A9. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, the supporting portions being arranged between the locking positions.

A10. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, wherein the devices include a plurality of image forming units arranged in a line in the main body; and the supporting portions are arranged substantially to be parallel to a direction in which the image forming units are arranged.

A11. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, said supporting portions being hitched to the main body.

A12. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, wherein each of the supporting portions includes an axle arranged on the holding unit and a bearing that is formed on the main body to support the axle.

A13. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, each of said supporting portions being formed from a synthesized resin.

A14. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, each of said supporting portions being formed from a metal.

A15. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, each of said supporting portions being formed from a combination of a synthesized resin and a metal.

A16. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, each of said supporting portions being formed from a ceramic.

A17. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit; and one or more supporting portions that support the holding unit when the holding unit is opened or closed, wherein each of the supporting portion includes an axle arranged on the holding unit and a bearing that is formed on the main body to support the axle; and a clearance equaling 2% of a radius of the axle is provided between the axle and the bearing.

A18. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit;

one or more supporting portions that support the holding unit when the holding unit is opened or closed; and an urging member that is arranged on the supporting portions to apply an elastic deforming force on the holding unit to urge the holding unit in a locking direction.

A19. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit;

one or more supporting portions that support the holding unit when the holding unit is opened or closed; and an urging member that is arranged on the supporting portions to apply a fluid viscosity force on the holding unit to urge the holding unit in a locking direction.

A20. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit that fixes the holding unit when the holding unit is closed relative to the opened portion, said fixing unit fixing the holding unit at one or more locking positions on the holding unit;

one or more supporting portions that support the holding unit when the holding unit is opened or closed; and an urging member that is arranged on the supporting portions to apply an elastic deforming force and a fluid viscosity force on the holding unit to urge the holding unit in a locking direction.

A21. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit including a claw member arranged on the holding unit, and a claw catching member that is arranged on the main body and is engaged with the claw member when the holding unit is closed relative to the opened portion; and an urging member that applies an elastic deforming force on the claw member to urge the claw member to engage with the claw catching member.

A22. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a fixing unit including a claw member arranged on the holding unit, and a claw catching member that is arranged on the main body and is engaged with the claw member when the holding unit is closed relative to the opened portion; and an urging member that applies an elastic deforming force and a fluid viscosity pressure on the claw member to urge the claw member to engage with the claw catching member.

A23. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member at one or more engagement positions when the locking member is slid when the holding unit is closed relative to the opened portion, wherein the engagement positions are arranged in a center portion of the holding unit.

A24. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member at one or more engagement positions when the locking member is slid when the holding unit is closed relative to the opened portion, wherein the engagement positions are arranged on a perpendicular through the gravity center of the holding unit.

A25. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member at one or more engagement positions when the locking member is'slid when the holding unit is closed relative to the opened portion, wherein the engagement positions are symmetrically arranged relative to a perpendicular through the gravity center of the holding unit.

A26. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member at one or more engagement positions when the locking member is slid when the holding unit is closed relative to the opened portion, wherein the devices include an intermediate transfer unit and an image forming unit; and the engagement positions are arranged in a center portion of the holding unit above the intermediate transfer unit and the image forming unit.

A27. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member at one or more engagement positions when the locking member is slid when the holding unit is closed relative to the opened portion, wherein the devices include an intermediate transfer unit and an image forming unit; and the engagement positions are symmetrically arranged relative to a center portion of an upper edge of the holding unit above the intermediate transfer unit and the image forming unit.

A28. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member at one or more engagement positions when the locking member is slid when the holding unit is closed relative to the opened portion, wherein the devices include an intermediate transfer unit having a plurality of rollers arranged at intervals and an intermediate transfer belt would on the roller; and the engagement positions are arranged in regions between axles of the rollers.

A29. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member at one or more engagement positions when the locking member is slid when the holding unit is closed relative to the opened portion, wherein the devices include an intermediate transfer unit having a plurality of rollers arranged at intervals, an intermediate transfer belt would on the roller, and a plurality of image forming units arranged along the intermediate transfer belt; and the engagement positions are arranged so that the holding unit is capable of covering axles of the rollers and the image forming units when the holding unit is closed relative to the opened portion.

A30. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member that is slidably arranged on the holding unit and includes a plurality of locking claws; and a plurality of locking bearing portions that are arranged on the main body, said locking bearing portions being engaged with the respective locking claws when the locking member is slid when the holding unit is closed relative to the opened portion, wherein the locking claws are symmetrically arranged.

A31. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member that is slidably arranged on the holding unit and includes a plurality of locking claws; and a plurality of locking bearing portions that are arranged on the main body, said locking bearing portions being engaged with the respective locking claws when the locking member is slid when the holding unit is closed relative to the opened portion, wherein the locking claws are asymmetrically arranged.

A32. An image forming-apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member that is slidably arranged on the holding unit and includes a plurality of locking claws; and a plurality of locking bearing portions that are arranged on the main body, said locking bearing portions being engaged with the respective locking claws when the locking member is slid when the holding unit is closed relative to the opened portion, wherein the locking claws are arranged in two planes perpendicular with each other.

A33. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member that is slidably arranged on the holding unit and includes a plurality of locking claws, each of said locking claws being formed from a synthesized resin; and a plurality of locking bearing portions that are arranged on the main body, said locking bearing portions being engaged with the respective locking claws when the locking member is slid when the holding unit is closed relative to the opened portion.

A34. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member that is slidably arranged on the holding unit and includes a plurality of locking claws, each of said locking claws being formed from a metal; and a plurality of locking bearing portions that are arranged on the main body, said locking bearing portions being engaged with the respective locking claws when the locking member is slid when the holding unit is closed relative to the opened portion.

A35. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member that is slidably arranged on the holding unit and includes a plurality of locking claws, each of said locking claws being formed from a combination of a synthesized resin and a metal; and a plurality of locking bearing portions that are arranged on the main body, said locking bearing portions being engaged with the respective locking claws when the locking member is slid when the holding unit is closed relative to the opened portion.

A36. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member that is slidably arranged on the holding unit and includes a plurality of locking claws, each of said locking claws being formed from a ceramic; and a plurality of locking bearing portions that are arranged on the main body, said locking bearing portions being engaged with the respective locking claws when the locking member is slid when the holding unit is closed relative to the opened portion.

A37. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member when the locking member is slid when the holding unit is closed relative to the opened portion, wherein a sliding direction of the locking member is the same as a direction of opening or closing the holding unit.

A38. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit; and a locking bearing portion that is arranged on the main body, said locking bearing portion being engaged with the locking member when the locking member is slid when the holding unit is closed relative to the opened portion, wherein the locking member is movable along an outer surface of the holding unit.

A39. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member rotatably arranged on the holding unit; and a locking bearing portion that is arranged on the main body, said locking bearing portion being engaged with the locking member when the locking member is rotated when the holding unit is closed relative to the opened portion.

A40. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member arranged on the holding unit capable of rotating along an outer surface of the holding unit; and a locking bearing portion that is arranged on the main body, said locking bearing portion being engaged with the locking member when the locking member is rotated when the holding unit is closed relative to the opened portion.

A41. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member rotatably arranged on the holding unit; and a locking bearing portion that is arranged on the main body, said locking bearing portion being engaged with the locking member when the locking member is rotated by a predetermined angle when the holding unit is closed relative to the opened portion.

A42. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member arranged on the holding unit capable of sliding in a horizontal direction passing through the opened portion when the holding unit is closed relative to the opened portion; and a locking bearing portion that is arranged on the main body, said locking bearing portion being engaged with the locking member when the locking member is slid when the holding unit is closed relative to the opened portion.

A43. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member arranged on the holding unit capable of sliding in a vertical direction passing through the opened portion when the holding unit is closed relative to the opened portion; and a locking bearing portion that is arranged on the main body, said locking bearing portion being engaged with the locking member when the locking member is slid when the holding unit is closed relative to the opened portion.

A44. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member arranged on the holding unit capable of sliding in an inclined direction passing through the opened portion when the holding unit is closed relative to the opened portion; and a locking bearing portion that is arranged on the main body, said locking bearing portion being engaged with the locking member when the locking member is slid when the holding unit is closed relative to the opened portion.

A45. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member at one or more engagement positions when the locking member is slid when the holding unit is closed relative to the opened portion; and one or more supporting portions that support the holding unit when the holding unit is opened or closed, the supporting portions being arranged to be symmetric to the engagement positions.

A46. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member at one or more engagement positions when the locking member is slid when the holding unit is closed relative to the opened portion; and one or more supporting portions that support the holding unit when the holding unit is opened or closed, the supporting portions being arranged outside the engagement positions.

A47. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member at one or more engagement positions when the locking member is slid when the holding unit is closed relative to the opened portion; and one or more supporting portions that support the holding unit when the holding unit is opened or closed, the supporting portions being arranged between the engagement positions.

A48. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion; and one or more supporting portions that support the holding unit when the holding unit is opened or closed, wherein the devices include a plurality of image forming units arranged in a line in the main body; and the supporting portions are arranged substantially to be parallel to a direction in which the image forming units are arranged.

A49. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion; and one or more supporting portions that support the holding unit when the holding unit is opened or closed, said supporting portions being hitched to the main body.

A50. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion; and one or more supporting portions that support the holding unit when the holding unit is opened or closed, said supporting portions being hitched to the main body, each of said supporting portions including an axle arranged on the holding unit and a bearing that is formed on the main body to support the axle.

A51. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion; and one or more supporting portions that support the holding unit when the holding unit is opened or closed, said supporting portions being hitched to the main body, each of said supporting portions being formed from a synthesized resin.

A52. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion; and one or more supporting portions that support the holding unit when the holding unit is opened or closed, said supporting portions being hitched to the main body, each of said supporting portions being formed from a metal.

A53. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the,locking member when the locking member is slid when the holding unit is closed relative to the opened portion; and one or more supporting portions that support the holding unit when the holding unit is opened or closed, said supporting portions being hitched to the main body, each of said supporting portions being formed from a combination of a synthesized resin and a metal.

A54. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion; and one or more supporting portions that support the holding unit when the holding unit is opened or closed, said supporting portions being hitched to the main body, each of said supporting portions being formed from a ceramic.

A55. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion; and one or more supporting portions that support the holding unit when the holding unit is opened or closed, said supporting portions being hitched to the main body, wherein each of the supporting portion includes an axle arranged on the holding unit and a bearing that is formed on the main body to support the axle; and a clearance equaling 2% of a radius of the axle is provided between the axle and the bearing.

A56. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion;

one or more supporting portions that support the holding unit when the holding unit is opened or closed, said supporting portions being hitched to the main body; and an urging member that is arranged on the supporting portions to apply an elastic deforming force on the holding unit to urge the holding unit in a direction leading engagement of the locking member and the locking bearing portion.

A57. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion;

one or more supporting portions that support the holding unit when the holding unit is opened or closed, said supporting portions being hitched to the main body; and an urging member that is arranged on the supporting portions to apply a fluid viscosity force on the holding unit to urge the holding unit in a direction leading engagement of the locking member and the locking bearing portion.

A58. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion;

one or more supporting portions that support the holding unit when the holding unit is opened or closed, said supporting portions being hitched to the main body; and an urging member that is arranged on the supporting portions to apply an elastic deforming force and a fluid viscosity pressure on the holding unit to urge the holding unit in a direction leading engagement of the locking member and the locking bearing portion.

A59. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion;

one or more supporting portions that support the holding unit when the holding unit is opened or closed, said supporting portions being hitched to the main body; and an urging member that applies an elastic deforming force on the holding unit to urge the locking member in a direction leading engagement of the locking member and the locking bearing portion.

A60. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion;

a locking member slidably arranged on the holding unit;

a locking bearing portion that is arranged on the main body, said locking bearing portion being engaged with the locking member when the locking member is slid when the holding unit is closed relative to the opened portion;

one or more supporting portions that support the holding unit when the holding unit is opened or closed, said supporting portions being hitched to the main body; and an urging member that applies an elastic deforming force and a fluid viscosity force on the holding unit to urge the locking member in a direction leading engagement of the locking member and the locking bearing portion.

A61. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a stopper member connected to the main body and the holding unit to restrict an opening angle of the holding unit.

A62. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a stopper member whose two ends are respectively connected to the main body and the holding unit to restrict an opening angle of the holding unit, said stopper member being connected to ends of the holding unit.

A63. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a stopper member whose two ends are respectively connected to the main body and the holding unit to restrict an opening angle of the holding unit, said stopper member being connected to a center portion of the holding unit.

A64. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a shock-absorbing member arranged between the main body and the holding unit to reduce a moving speed of the holding unit when the holding unit is opened.

A65. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a shock-absorbing member arranged between the main body and the holding unit to reduce a moving speed of the holding unit by fluid resistance when the holding unit is opened.

A66. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a shock-absorbing member arranged between the main body and the holding unit to reduce a moving speed of the holding unit by an elastic deforming force when the holding unit is opened.

B1. A power feeding panel as disclosed in claim 12, wherein the insulating plate includes two layers with the power feeding unit arranged therebetween.

B2. A power feeding panel as disclosed in claim 12, wherein the insulating plate includes three or more layers with the power feeding unit arranged therebetween.

B3. A power feeding panel as disclosed in claim 12, wherein the power feeding unit is arranged on both a front side and a back side of the insulating plate.

B4. The power feeding panel as disclosed in B1 or B2, wherein the insulating plates are connected by screws.

B5. The power feeding panel as disclosed in B1 or B2, wherein the insulating plates are connected by fitting a hook formed on one of the insulating plates into holes formed on other of the insulating plates.

B6. A power feeding panel as disclosed in claim 12, comprising:

a positioning plate arranged in the case for holding and positioning the component unit in the main body, said positioning plate being arranged at a position closer to the main body than the insulating plates when the case is at the second position.

B7. A power feeding panel as disclosed in claim 12, comprising:

a positioning plate arranged in the case for holding and positioning the component unit in the main body, said positioning plate being arranged at a position farther from the main body than the insulating plates when the case is at the second position.

B8. The power feeding panel as disclosed in B6 or B7, wherein the positioning plate and the insulating plates are connected by screws.

B9. The power feeding panel as disclosed in B6 or B7, wherein the positioning plate and the insulating plates are connected by fitting a hook formed on one of the insulating plates and the positioning plate into holes formed on the other of the insulating plates and the positioning plate.

B10. A power feeding panel as disclosed in claim 12, wherein pin guide tubes are formed on the insulating plate, into which the first conductive pin and the second conductive pin are inserted respectively, an inner diameter of each of the pin guide tubes being greater than an outer diameter of each of the first conductive pin and the second conductive pin by 0.01 mm to 0.5 mm.

B11. The power feeding panel as disclosed in B10, wherein an entrance of each of the pin guide tubes has a tapered surface.

B12. The power feeding panel as disclosed in B10, wherein an entrance of each of the pin guide tubes has a rounded surface.

B13. A power feeding panel as disclosed in claim 12, wherein spring guide tubes are formed on the insulating plate, into which the first conductive spring and the second conductive spring are inserted, an inner diameter of each of the spring guide tubes being greater than an outer diameter of each of the first conductive spring and the second conductive spring by 0.01 mm to 0.5 mm.

B14. A power feeding panel as disclosed in claim 12, wherein spring guide tubes are formed on the insulating plate, into which the first conductive spring and the second conductive spring are inserted, an inner diameter of each of the spring guide tubes being equal to an outer diameter of each of the first conductive spring and the second conductive spring.

B15. A power feeding panel as disclosed in claim 12, wherein spring guide tubes are formed on the insulating plate, into which the first conductive spring and the second conductive spring are inserted, an inner diameter of each of the spring guide tubes being less than an outer diameter of each of the first conductive spring and the second conductive spring by 0.01 mm to 0.5 mm.

B16. The power feeding panel as disclosed in B13, wherein an entrance of each of the spring guide tubes has a tapered surface.

B17. The power feeding panel as disclosed in B13, wherein an entrance of each of the spring guide tubes has a rounded surface.

B18. A power feeding panel as disclosed in claim 12, wherein projecting supporting portions are formed on the insulating plate, said projecting supporting portions being inserted into the first conductive spring and the second conductive spring, an outer size of each of the projecting supporting portions being less than an inner diameter of each of the first conductive spring and the second conductive spring.

B19. A power feeding panel as disclosed in claim 12, wherein projecting supporting portions are formed on the insulating plate, said projecting supporting portions being inserted into the first conductive spring and the second conductive spring, an outer size of each of the projecting supporting portions being equal to an inner diameter of each of the first conductive spring and the second conductive spring.

B20. A power feeding panel as disclosed in claim 12, wherein projecting supporting portions are formed on the insulating plate, said projecting supporting portions being inserted into the first conductive spring-and the second conductive spring, an outer size of each of the projecting supporting portions being greater than an inner diameter of each of the first conductive spring and the second conductive spring by 0.01 mm to 0.5 mm.

B21. The power feeding panel as disclosed in B18, wherein an end of each of the projecting supporting portions has a tapered surface.

B22. The power feeding panel as disclosed in B18, wherein an end of each of the projecting supporting portions has a rounded surface.

B23. A power feeding panel as disclosed in claim 12, wherein a guide rib having a shape matched with the conductive plate member is formed on the insulating plate with the conductive plate member being fitted therein.

B24. The power feeding panel as disclosed in B23, wherein a rib is formed on the insulating plate between two adjacent guide ribs.

B25. A power feeding panel as disclosed in claim 12, wherein a cross slit is formed in the conductive plate member, and a projection is formed on the insulating plate, said projection being inserted into the cross slit.

B26. A power feeding panel as disclosed in claim 12, wherein an I-shaped slit is formed in the conductive plate member, and a projection is formed on the insulating plate, said projection being inserted into the I-shaped slit.

B27. A power feeding panel as disclosed in claim 12, wherein two projections are formed on two sides of the conductive plate member in a width direction thereof so that the guide lib catches the conductive plate member at the two projections when the conductive plate member is fitted into the guide lib.

B28. A power feeding panel as disclosed in claim 12, wherein the conductive plate member and the insulating plate are connected by screws.

B29. The power feeding panel as disclosed in B25, wherein an end of the projection has a tapered surface.

B30. The power feeding panel as disclosed in B25, wherein an end of the projection has a rounded surface.

B31. A power feeding panel as disclosed in claim 12, wherein guide holes are formed on the insulating plate in which the first conductive pin and the second conductive pin are slidably inserted, respectively; and a stopping portion is formed on each of the first conductive pin and the second conductive pin, an outer diameter of said stopping portion being greater than an inner diameter of each of the first conductive pin and the second conductive pin.

B32. A power feeding panel as disclosed in claim 12, wherein guide holes are formed on the insulating plate in which the first conductive pin and the second conductive pin are slidably inserted, respectively;

conductive grease is applied between an outer surface of each of the first conductive pin and the second conductive pin and an inner surface of the corresponding guide hole.

B33. A power feeding panel as disclosed in claim 12, wherein a projecting supporting portion is formed on an end of each the first conductive pin and the second conductive pin respectively pushed by the first conductive spring and the second conductive spring, said projecting supporting portion being inserted into each of the first conductive spring and the second conductive spring, an outer size of the projecting supporting portion being less than an inner diameter of each of the first conductive spring and the second conductive spring.

B34. A power feeding panel as disclosed in claim 12, wherein a projecting supporting portion is formed on an end of each the first conductive pin and the second conductive pin respectively pushed by the first conductive spring and the second conductive spring, said projecting supporting portion being inserted into each of the first conductive spring and the second conductive spring, an outer size of the projecting supporting portion being equal to an inner diameter of each of the first conductive spring and the second conductive spring.

B35. A power feeding panel as disclosed in claim 12, wherein a projecting supporting portion is formed on an end of each the first conductive pin and the second conductive pin respectively pushed by the first conductive spring and the second conductive spring, said projecting supporting portion being inserted into each of the first conductive spring and the second conductive spring, an outer size of the projecting supporting portion being greater than an inner diameter of each of the first conductive spring and the second conductive spring by 0.01 mm to 0.5 mm.

B36. The power feeding panel as disclosed in B33, wherein an end of the projecting supporting portion has a tapered surface.

B37. The power feeding panel as disclosed in B33, wherein an end of the projecting supporting portion has a rounded surface.

B38. The power feeding panel as disclosed in B33, wherein conductive grease is applied between the projecting supporting portion and each of the first conductive spring and the second conductive spring.

B39. A power feeding panel as disclosed in claim 12, wherein each of the first conductive pin and the second conductive pin is formed from a steel rod; and each of the first conductive spring and the second conductive spring is formed from piano wires or steel wires.

B40. A power feeding panel as disclosed in claim 12, wherein each of the first conductive pin and the second conductive pin is formed from a copper rod; and each of the first conductive spring and the second conductive spring is formed from piano wires or steel wires.

B41. A power feeding panel as disclosed in claim 12, wherein nickel layers are formed on either the first conductive pin and the second conductive pin or the first conductive spring and the second conductive spring.

B42. A power feeding panel as disclosed in claim 12, wherein nickel layers are formed on both the first conductive pin and the second conductive pin and the first conductive spring and the second conductive spring, respectively.

B43. A power feeding panel as disclosed in claim 12, wherein copper layers are formed on either the first conductive pin and the second conductive pin or the first conductive spring and the second conductive spring, and nickel layers are formed on the respective copper layers.

B44. A power feeding panel as disclosed in claim 12, wherein copper layers are formed on both the first conductive pin and the second conductive pin and the first conductive spring and the second conductive spring, respectively, and nickel layers are formed on the respective copper layers.

B45. A power feeding panel as disclosed in claim 16, wherein the back end of each of the first conductive pin and the second conductive pin is flat; and a portion of the conductive urging plate in contact with the back end of each of the first conductive pin and the second conductive pin is flat.

B46. A power feeding panel as disclosed in claim 16, wherein the back end of each of the first conductive pin and the second conductive pin is flat; and a portion of the conductive urging plate in contact with the back end of each of the first conductive pin and the second conductive pin is a projecting arc.

B47. A power feeding panel as disclosed in claim 16, wherein the back end of each of the first conductive pin and the second conductive pin is flat; and a portion of the conductive urging plate in contact with the back end of each of the first conductive pin and the second conductive pin is a projecting semi-sphere.

B48. A power feeding panel as disclosed in claim 16, wherein the back end of each of the first conductive pin and the second conductive pin is a projecting semi-sphere; and a portion of the conductive urging plate in contact with the back end of each of the first conductive pin and the second conductive pin is a flat.

B49. A power feeding panel as disclosed in claim 16, wherein conductive grease is applied between the back end of each of the first conductive pin and the second conductive pin and the conductive urging plate.

B50. A power feeding panel as disclosed in claim 16, wherein the conductive pin is formed from a steel rod; and the conductive urging plate is formed from a steel plate.

B51. A power feeding panel as disclosed in claim 16, wherein each of the first conductive pin and the second conductive pin is formed from a steel rod; and the conductive urging plate is formed from a copper plate.

B52. A power feeding panel as disclosed in claim 16, wherein each of the first conductive pin and the second conductive pin is formed from a copper rod; and the conductive urging plate is formed from a steel plate.

B53. A power feeding panel as disclosed in claim 16, wherein each of the first conductive pin and the second conductive pin is formed from a copper rod; and the conductive urging plate is formed from a copper plate.

B54. A power feeding panel as disclosed in claim 16, wherein nickel layers are formed on either the first conductive pin and the second conductive pin or the conductive urging plate.

B55. A power feeding panel as disclosed in claim 16, wherein nickel layers are formed on both the first conductive pin and the second conductive pin and the conductive urging plate.

B56. A power feeding panel as disclosed in claim 16, wherein copper layers are formed on either the first conductive pin and the second conductive pin or the conductive urging plate, and nickel layers are formed on the respective copper layers.

B57. A power feeding panel as disclosed in claim 16, wherein copper layers are formed on both the first conductive pin and the second conductive pin and the conductive urging plate, respectively, and nickel layers are formed on the respective copper layers.

B58. A power feeding panel as disclosed in claim 12, wherein each of the first conductive pin and the second conductive pin is formed by cutting a cylindrical rod material.

B59. A power feeding panel as disclosed in claim 12, wherein each of the first conductive pin and the second conductive pin is formed by header operation.

B60. A power feeding panel as disclosed in claim 12, wherein each of the first conductive pin and the second conductive pin is formed by rolling.

B61. A power feeding panel as disclosed in claim 12, wherein bent plates are formed in the conductive plate member to catch a wire of each of the first conductive spring and the second conductive spring.

B62. A power feeding panel as disclosed in claim 12, wherein a bent plate is formed on the conductive plate member to be inserted into each of the first conductive spring and the second conductive spring.

B63. The power feeding panel as disclosed in B62, wherein an end of the bent plate has a tapered surface.

B64. The power feeding panel as disclosed in B62, wherein an end of the bent plate has a rounded surface.

B65. A power feeding panel as disclosed in claim 12, wherein conductive grease is applied between the conductive plate member and each of the first conductive spring and the second conductive spring.

B66. A power feeding panel as disclosed in claim 12, wherein the conductive plate member is formed from a steel plate; and each of the first conductive spring and the second conductive spring is formed from piano wires or steel wires.

B67. A power feeding panel as disclosed in claim 12, wherein the conductive plate member is formed from a copper plate; and each of the first conductive spring and the second conductive spring is formed from piano wires or steel wires.

B68. A power feeding panel as disclosed in claim 12, wherein nickel layers are formed on either the conductive plate member or the first conductive spring and the second conductive spring.

B69. A power feeding panel as disclosed in claim 12, wherein nickel layers are formed on both the conductive plate member and the first conductive spring and the second conductive spring.

B70. A power feeding panel as disclosed in claim 12, wherein copper layers are formed on either the conductive plate member or the first conductive spring and the second conductive spring, and nickel layers are formed on the respective copper layers.

B71. A power feeding panel as disclosed in claim 12, wherein copper layers are formed on both the conductive plate member and the first conductive spring and the second conductive spring, and nickel layers are formed on the respective copper layers.

B72. A power feeding panel as disclosed in claim 12, wherein pressures of the first conductive spring and the second conductive spring on the respective first conductive pin and the second conductive pin are set to be from 0.5 N to 1.5 N.

B73. A power feeding panel as disclosed in claim 16, wherein a pressure of the conductive urging plate on the first conductive pin and the second conductive pin are set to be from 0.5 N to 1.5 N.

B74. A power feeding panel as disclosed in claim 12, wherein pressures of the first conductive spring and the second conductive spring on the respective first conductive pin and the second conductive pin are set to be the same.

B75. A power feeding panel as disclosed in claim 16, wherein pressures of different conductive urging plates on the first conductive pin and the second conductive pin are set to be the same.

B76. A power feeding panel as disclosed in claim 12, wherein a pressure of at least one of a plurality of the first conductive springs and the second conductive springs is set to be greater than pressures of other of the first conductive springs and the second conductive springs; and a deformation-prevention member is provided to prevent deformation of the insulating plate near a position pushed by said conductive spring.

B77. A power feeding panel as disclosed in claim 16, wherein a pressure of at least one of a plurality of the conductive urging plates is set to be greater than pressures of other of the conductive urging plates; and a deformation-prevention member is provided to prevent deformation of the insulating plate near a position pushed by said conductive urging plate.

B78. An image forming apparatus as disclosed in claim 11, wherein an end of each of the first conductive pin and the second conductive pin is flat; and a portion of each of the connection terminal of the component unit and the connection terminal of the high voltage power supply in contact with the end of each of the first conductive pin and the second conductive pin is flat.

B79. An image forming apparatus as disclosed in claim 11, wherein an end of each of the first conductive pin and the second conductive pin is flat; and a portion of each of the connection terminal of the component unit and the connection terminal of the high voltage power supply in contact with the end of each of the first conductive pin and the second conductive pin is a projecting arc.

B80. An image forming apparatus as disclosed in claim 11, wherein an end of each of the first conductive pin and the second conductive pin is flat; and a portion of each of the connection terminal of the component unit and the connection terminal of the high voltage power supply in contact with the end of each of the first conductive pin and the second conductive pin is a projecting semi-sphere.

B81. An image forming apparatus as disclosed in claim 11, wherein an end of each of the first conductive pin and the second conductive pin is flat; and each of the connection terminal of the component unit and the connection terminal of the high voltage power supply includes a first flat plate and a second flat plate perpendicular to the first flat plate, said first flat plate being in contact with the end of each of the first conductive pin and the second conductive pin, said second flat plate being in contact with a side surface of each of the first conductive pin and the second conductive pin.

B82. An image forming apparatus as disclosed in claim 11, wherein an end of each of the first conductive pin and the second conductive pin is a projecting semi-sphere; and a portion of each of the connection terminal of the component unit and the connection terminal of the high voltage power supply in contact with the end of each of the first conductive pin and the second conductive pin is flat.

B83. An image forming apparatus as disclosed in claim 11, wherein an end of each of the first conductive pin and the second conductive pin is a projecting semi-sphere; and a portion of each of the connection terminal of the component unit and the connection terminal of the high voltage power supply in contact with the end of each of the first conductive pin and the second conductive pin is a conical recess.

B84. An image forming apparatus as disclosed in claim 11, wherein conductive grease is applied between the first conductive pin and the second conductive pin and the respective connection terminals of the component unit and the high voltage power supply.

B85. An image forming apparatus as disclosed in claim 11, wherein each of the first conductive pin and the second conductive pin is formed from a steel rod; and each of the connection terminals is formed from steel.

B86. An image forming apparatus as disclosed in claim 11, wherein each of the first conductive pin and the second conductive pin is formed from a steel rod; and each of the connection terminals is formed from copper.

B87. An image forming apparatus as disclosed in claim 11, wherein each of the first conductive pin and the second conductive pin is formed from a copper rod; and each of the connection terminals is formed from steel.

B88. An image forming apparatus as disclosed in claim 11, wherein each of the first conductive pin and the second conductive pin is formed from a copper rod; and each of the connection terminals is formed from copper.

B89. An image forming apparatus as disclosed in claim 11, wherein nickel layers are formed on either the first conductive pin and the second conductive pin or the connection terminals.

B90. An image forming apparatus as disclosed in claim 11, wherein nickel layers are formed on both the first conductive pin and the second conductive pin and the connection terminals.

B91. An image forming apparatus as disclosed in claim 11, wherein copper layers are formed on either the first conductive pin and the second conductive pin or the connection terminals, and nickel layers are formed on the respective copper layers.

B92. An image forming apparatus as disclosed in claim 11, wherein copper layers are formed on both the first conductive pin and the second conductive pin and the connection terminals, respectively, and nickel layers are formed on the respective copper layers.

Summarizing the effect of the present invention, according to the present invention, it is possible to provide an image forming apparatus that is able to reliable holding its constituent units and is superior in operability and is safe in operation of exchanging and inspecting the constituent units.

In addition, it is possible to provide an image forming apparatus that enables easy and visual confirmation of connection condition of high voltage connection terminals and connection terminals on the constituent units of the image forming apparatus, allows the connection terminals in a problem to be easily fixed, and able to obtain a stable connection condition at contact points for supplying high voltages to the components.

Furthermore, it is possible to provide an image forming apparatus that is able to reliably maintain position correspondence between connection terminals of a power supply and members of the constituent units, and is superior in operability when inspecting the image forming apparatus.

This patent application is based on Japanese Priority Patent Applications No. 2003-142623 filed on May 20, 2003, No. 2003-142637 filed on May 20, 2003, and No. 2003-205123 filed on Jul. 31, 2003, the entire contents of which are hereby incorporated by reference.

What is claimed is:

1. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion;

wherein the devices include an intermediate transfer unit and an image forming unit; and the fixing unit fixes the holding unit at one or more locking positions on the holding unit, said locking positions being arranged in a center portion of an upper edge of the holding unit above the intermediate transfer unit and the image forming unit.

2. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion;

wherein the devices include an intermediate transfer unit and an image forming unit; and the fixing unit fixes the holding unit at one or more locking positions on the holding unit, said locking positions being symmetrically arranged relative to a center portion of an upper edge of the holding unit above the intermediate transfer unit and the image forming unit.

3. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion;

wherein the devices include an intermediate transfer unit having a plurality of rollers arranged at intervals and an intermediate transfer belt wound on the rollers; and the fixing unit fixes the holding unit at one or more locking positions on the holding unit, said locking positions being arranged in regions between axles of the rollers.

4. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion;

wherein the devices include an intermediate transfer unit having a plurality of rollers arranged at intervals, an intermediate transfer belt wound on the rollers, and a plurality of image forming units arranged along the intermediate transfer belt; and the fixing unit fixes the holding unit at one or more locking positions on the holding unit, said locking positions being arranged so that the holding unit is capable of covering axles of the rollers and the image forming units when the holding unit is closed relative to the opened portion.

5. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion;

wherein the fixing unit fixes the holding unit at one or more locking positions on the holding unit, said locking positions being at two ends of the holding unit.

6. An image forming apparatus, comprising:

a main body having an opened portion on a side thereof;

one or more devices detachably attached to the main body through the opened portion;

a holding unit capable of being opened and closed relative to the opened portion, said holding unit being engaged with the devices and holding the devices at predetermined positions when the holding unit is closed relative to the opened portion; and a fixing unit arranged on the holding unit that fixes the holding unit when the holding unit is closed relative to the opened portion;

wherein the fixing unit fixes the holding unit at three or more positions on the holding unit.

7. A power feeding panel of an image forming apparatus, comprising:

a case rotatably attached to a main body of the image forming apparatus, said case being capable of being rotated to a first position to expose an opened portion on a side of the main body and to a second position to cover the opened portion;

a power feeding unit arranged in the case and capable of feeding electric power from a high voltage power supply in the main body to a component unit of the image forming apparatus when the case is at the second position; and an insulating plate arranged in the case with the power feeding unit arranged thereon;

wherein the power feeding unit includes a first conductive pin capable of sliding along a direction of an axial center thereof and capable of being brought into contact with a connection terminal of the component unit when the case is at the second position;

a first conductive spring connected to the first conductive pin to push the first conductive pin to contact the connection terminal of the component unit;

a second conductive pin capable of sliding along a direction of an axial center thereof and capable of being brought into contact with a connection terminal of the high voltage power supply when the case is at the second position;

a second conductive spring connected to the second conductive pin to push the second conductive pin to contact the connection terminal of the high voltage power supply; and a conductive plate member connected to an end of the first conductive spring and an end of the second conductive spring.

8. A power feeding panel of an image forming apparatus, comprising:

a case rotatably attached to a main body of the image forming apparatus, said case being capable of being rotated to a first position to expose an opened portion on a side of a main body of the image forming apparatus, and to a second position to cover the opened portion;

a power feeding unit arranged in the case and capable of feeding electric power from a high voltage power supply in the main body to a component unit of the image forming apparatus when the case is at the second position; and an insulating plate arranged in the case with the power feeding unit arranged thereon;

wherein the power feeding unit includes a conductive pin capable of sliding along a direction of an axial center thereof and capable of being brought into contact with a connection terminal of the component unit when the case is at the second position;

a conductive spring connected to the conductive pin to push the conductive pin to contact the connection terminal of the component unit; and a cord coated with an insulating layer, an end of said cord being connected to the conductive spring, and another end of said cord being connected to a connection terminal of the high voltage power supply.

9. A power feeding panel of an image forming apparatus, comprising:

a case rotatably attached to a main body of the image forming apparatus, said case being capable of being rotated to a first position to expose an opened portion on a side of a main body of the image forming apparatus, and to a second position to cover the opened portion;

a power feeding unit arranged in the case and capable of feeding electric power from a high voltage power supply in the main body to a component unit of the image forming apparatus when the case is at the second position; and an insulating plate arranged in the case with the power feeding unit arranged thereon;

wherein the power feeding unit includes a conductive pin capable of sliding along a direction of an axial center thereof and capable of being brought into contact with a connection terminal of the component unit when the case is at the second position;

a conductive spring connected to the conductive pin to push the conductive pin to contact the connection terminal of the component unit;

a conductive plate member connected to an end of the conductive spring; and a cord coated with an insulating layer, an end of said cord being connected to the conductive plate member, and another end of said cord being connected to a connection terminal of the high voltage power supply.

10. A power feeding panel of an image forming apparatus, comprising:

a case rotatably attached to a main body of the image forming apparatus, said case being capable of being rotated to a first position to expose an opened portion on a side of the main body and to a second position to cover the opened portion;

a power feeding unit arranged in the case and capable of feeding electric power from a high voltage power supply in the main body to a component unit of the image forming apparatus when the case is at the second position; and an insulating plate arranged in the case with the power feeding unit arranged thereon;

wherein the power feeding unit includes a first conductive pin capable of sliding along a direction of an axial center thereof and capable of being brought into contact with a connection terminal of the component unit when the case is at the second position;

a first conductive spring connected to the first conductive pin to push the first conductive pin to contact the connection terminal of the component unit;

a first conductive plate member connected to an end of the first conductive spring;

a second conductive pin capable of sliding along a direction of an axial center thereof and capable of being brought into contact with a connection terminal of the high voltage power supply when the case is at the second position;

a second conductive spring connected to the second conductive pin to push the second conductive pin to contact the connection terminal of the high voltage power supply;

a second conductive plate member connected to an end of the second conductive spring; and a cord coated with an insulating layer, an end of said cord being connected to the first conductive plate member, and another end of said cord being connected to the second conductive plate member.

11. A power feeding panel of an image forming apparatus, comprising:

a case rotatably attached to a main body of the image forming apparatus, said case being capable of being rotated to a first position to expose an opened portion on a side of the main body and to a second position to cover the opened portion;

a power feeding unit arranged in the case and capable of feeding electric power from a high voltage power supply in the main body to a component unit of the image forming apparatus when the case is at the second position; and an insulating plate arranged in the case with the power feeding unit arranged thereon;

wherein the power feeding unit includes a first conductive pin capable of sliding along a direction of an axial center thereof and capable of being brought into contact with a connection terminal of the component unit when the case is at the second position;

a second conductive pin capable of sliding along a direction of an axial center thereof and capable of being brought into contact with a connection terminal of the high voltage power supply when the case is at the second position; and a conductive urging plate connected to a back end of the first conductive pin and to a back end of the second conductive pin to push the first conductive pin to contact the connection terminal of the component unit and the second conductive pin to contact the connection terminal of the high voltage power supply.

12. A power feeding panel of an image forming apparatus, comprising:

a case rotatably attached to a main body of the image forming apparatus, said case being capable of being rotated to a first position to expose an opened portion on a side of the main body and to a second position to cover the opened portion;

a power feeding unit arranged in the case and capable of feeding electric power from a high voltage power supply in the main body to a component unit of the image forming apparatus when the case is at the second position; and an insulating plate arranged in the case with the power feeding unit arranged thereon;

wherein the power feeding unit includes a conductive pin capable of sliding along a direction of an axial center thereof and capable of being brought into contact with a connection terminal of the component unit when the case is at the second position;

a conductive urging plate connected to a back end of the conductive pin to push the conductive pin to contact the connection terminal of the component unit; and a cord coated with an insulating layer, an end of said cord being connected to the conductive plate member, and another end of said cord being connected to a connection terminal of the high voltage power supply.

13. A power feeding panel of an image forming apparatus, comprising:

a case rotatably attached to a main body of the image forming apparatus, said case being capable of being rotated to a first position to expose an opened portion on a side of the main body and to a second position to cover the opened portion;

a power feeding unit arranged in the case and capable of feeding electric power from a high voltage power supply in the main body to a component unit of the image forming apparatus when the case is at the second position; and an insulating plate arranged in the case with the power feeding unit arranged thereon;

wherein the power feeding unit includes a first conductive pin capable of sliding along a direction of an axial center thereof and capable of being brought into contact with a connection terminal of the component unit when the case is at the second position;

a first conductive urging plate connected to a back end of the first conductive pin to push the first conductive pin to contact the connection terminal of the component unit;

a second conductive pin capable of sliding along a direction of an axial center thereof and capable of being brought into contact with a connection terminal of the high voltage power supply when the case is at the second position;

a second conductive urging plate connected to a back end of the second conductive pin to push the second conductive pin to contact the connection terminal of the high voltage power supply; and a cord coated with an insulating layer, an end of said cord being connected to the first conductive urging plate, and another end of said cord being connected to the second conductive urging plate.

14. An image forming apparatus, comprising:

a main body having an opened portion on a side thereof;

a high voltage power supply arranged in the main body;

a component unit capable of being attached to and detached from the main body through the opened portion, said component unit including a component member with a connection terminal formed thereon, said component member receiving electric power from the high voltage power supply through a power feeding terminal in contact with the connection terminal; and a movable unit rotatably attached to the main body and capable of being rotated to a first position to expose the opened portion and to a second position to cover the opened portion, said movable unit holding the component unit when being set at the second position, said power feeding terminal facing said connection terminal when said movable unit is set at the second position, wherein the movable unit comprises:

a power feeding unit with the power feeding terminal formed thereon;

a positioning unit that engages the component member and holds the component member at a predetermined position;

an insulating member; and a cover plate; and wherein the power feeding unit, the positioning unit, the insulating member, and the cover plate are stacked together.

15. The image forming apparatus as claimed in claim 14, wherein the movable unit comprises:

a power feeding unit with the power feeding terminal formed thereon;

a positioning unit that engages the component member and holds the component member at a predetermined position;

an insulating member; and a cover plate; and wherein when the movable unit is set at the second position, the positioning unit is closest to the main body with the power feeding unit, the insulating member, and the cover plate following sequentially.

16. The image forming apparatus as claimed in claim 14, wherein the movable unit comprises:

a power feeding unit with the power feeding terminal formed thereon;

a positioning unit that engages the component member and holds the component member at a predetermined position;

an insulating member; and a cover plate; and wherein when the movable unit is set at the second position, the insulating member is closest to the main body with the power feeding unit, the positioning unit, and the cover plate following sequentially.

17. The image forming apparatus as claimed in claim 14, wherein the positioning unit is formed from a metal.

18. The image forming apparatus as claimed in claim 14, wherein the insulating member has a guide tube to protect the power feeding terminal.

19. The image forming apparatus as claimed in claim 14, wherein the insulating member is formed from a synthesized resin having a Comparative Tracking Index (CTI) equal to or greater than 175.

20. The image forming apparatus as claimed in claim 14, wherein the insulating member is formed from a synthesized resin having a flame-retardant rating equal to or higher than UL94V-1.

21. The image forming apparatus as claimed in claim 14, wherein bare cords for use with a voltage equal to or higher than 2 kV and bare cords for use with a voltage lower than 2 kV are alternately arranged on a surface of the insulating member, said bare cords being connected to the power feeding terminal.

22. The image forming apparatus as claimed in claim 14, wherein bare cords directly connected to a plurality of the power feeding terminals and bare cords connected to a plurality of the power feeding terminals through relay terminals are arranged on a surface of the insulating member; and the bare cords and the relay terminals are arranged so that a surface distance between adjacent ones of the bare cords or the relay terminals is greater than a predetermined value related to a ratio of voltages applied to the bare cords.

23. The image forming apparatus as claimed in claim 14, wherein the power feeding unit has electrical contacts and electrical wires formed on a printed circuit board.

24. The image forming apparatus as claimed 14, wherein the movable unit has a contacting terminal for trans mitting electric power from the high voltage power supply.

25. The image forming apparatus as claimed in claim 14, wherein the movable unit has a contacting terminal for transmitting electric power from the high voltage power supply; and the contacting terminal and the power feeding terminal are connected by a wrapped cord arranged in the movable unit.

26. The image forming apparatus as claimed in claim 14, wherein the component unit includes at least an image forming unit including an image carrier on which a latent image is formed, and an intermediate transfer unit for transferring the latent image as a toner image to an intermediate transfer belt;

the movable unit has a contacting terminal for transmitting electric power from the high voltage power supply; and the movable unit is sufficiently large to cover the image forming unit, the intermediate transfer unit, and the contacting terminal.

27. The image forming apparatus as claimed in claim 14, wherein the high voltage power supply is arranged in the movable unit.

28. The image forming apparatus as claimed in claim 14, wherein the movable unit includes a position control unit for setting the component member to a predetermined position.

29. The image forming apparatus as claimed in claim 14, wherein a bearing formed from a metal is arranged on the movable unit to hold an axle of the component member.

30. The image forming apparatus as claimed in claim 14, wherein a bearing formed from a synthesized resin is arranged on the movable unit to hold an axle of the component member.

31. The image forming apparatus as claimed in claim 14, wherein the component member includes at least a driving axle of a driving roller on which an intermediate transfer belt is wound, and a supporting axle for rotatably supporting an image carrier on which a latent image is formed;

bearings formed from a synthesized resin are arranged on the movable unit to hold the driving axle and the supporting axle; and protection portions formed from a metal are formed on the movable unit to protect the bearings.

32. The image forming apparatus as claimed in claim 14, wherein the component member includes at least a driving axle of a driving roller on which an intermediate transfer belt is wound, and a supporting axle for rotatably supporting an image carrier on which a latent image is formed;

bearings formed from a metal are arranged on the movable unit to hold the driving axle and the supporting axle; and protection portions formed from a synthesized resin are formed on the movable unit to protect the bearings.

33. The image forming apparatus as claimed in claim 14, wherein the movable unit is supported by a rotating mechanism while being able to be opened and closed freely, a rotational axis of said rotating mechanism being nearly horizontally arranged.

34. The image forming apparatus as claimed in claim 14, wherein the movable unit is supported by a rotating mechanism while being able to be opened and closed freely, a rotational axis of said rotating mechanism being nearly vertically arranged.

35. The image forming apparatus as claimed in claim 14, wherein the movable unit is supported by a rotating mechanism while being able to be opened and closed freely, said rotating mechanism being arranged on a right side of the opened portion.

36. The image forming apparatus as claimed in claim 14, wherein the movable unit is supported by a rotating mechanism while being able to be opened and closed freely, said rotating mechanism being arranged on a left side of the opened portion.

37. The image forming apparatus as claimed in claim 14, wherein the movable unit is supported by a rotating mechanism while being able to be opened and closed freely, said rotating mechanism being arranged near an upper side of the opened portion.

38. The image forming apparatus as claimed in claim 14, wherein the movable unit is supported by a rotating mechanism while being able to be opened and closed freely, said rotating mechanism being arranged near a lower side of the opened portion.

39. The image forming apparatus as claimed in claim 14, wherein the movable unit is capable of being rotated by an angle equal to or larger than 90 degrees relative to one or more rotating mechanisms.

40. The image forming apparatus as claimed in claim 14, wherein the movable unit is slidably attached to the main body.

41. The image forming apparatus as claimed in claim 14, wherein the movable unit is slidably and rotatably attached to the main body.

42. The image forming apparatus as claimed in claim 14, wherein the component unit includes an image forming unit including a plurality of image carriers on each of which a latent image is formed, ends of said image carriers being arranged along a first line in the plane of the opened portion; and the movable unit is supported by a rotating mechanism whose rotational axis is nearly parallel to the first line.

* * * * *